US006916601B2

(12) United States Patent
Yokozawa et al.

(10) Patent No.: US 6,916,601 B2
(45) Date of Patent: Jul. 12, 2005

(54) IMAGE-FORMING METHOD USING A SILVER HALIDE COLOR PHOTOGRAPHIC LIGHT-SENSITIVE MATERIAL, AND SILVER HALIDE COLOR PHOTOGRAPHIC LIGHT-SENSITIVE MATERIAL

(75) Inventors: Akito Yokozawa, Minami-ashigara (JP); Tatsuya Ishizaka, Minami-ashigara (JP); Katsuyuki Takada, Minami-ashigara (JP); Yoshiro Ochiai, Minami-ashigara (JP); Tetsuo Nakamura, Minami-ashigara (JP)

(73) Assignee: Fuji Photo Film Co., Ltd., Kanagawa-ken (JP)

( * ) Notice: Subject to any disclaimer, the term of this patent is extended or adjusted under 35 U.S.C. 154(b) by 0 days.

(21) Appl. No.: 10/330,013

(22) Filed: Dec. 27, 2002

(65) Prior Publication Data

US 2004/0115570 A1 Jun. 17, 2004

(30) Foreign Application Priority Data

| | | |
|---|---|---|
| Dec. 28, 2001 | (JP) | 2001-400606 |
| Dec. 28, 2001 | (JP) | 2001-400759 |
| Dec. 28, 2001 | (JP) | 2001-401863 |
| Mar. 29, 2002 | (JP) | 2002-094226 |

(51) Int. Cl.[7] ..... G03C 7/38
(52) U.S. Cl. ..... 430/573; 430/363
(58) Field of Search ..... 430/573, 363

(56) References Cited

U.S. PATENT DOCUMENTS 5,395,742 A 3/1995 Deguchi et al.
5,492,802 A 2/1996 Parton et al.
6,291,144 B1 * 9/2001 Aylward et al. ..... 430/359

FOREIGN PATENT DOCUMENTS

DE 199 39 541 A1 2/2001
EP 0 727 705 * 8/1996

OTHER PUBLICATIONS

Abstract of DE 10005769 C1, Jul. 26, 2001.*
English language translation of DE 100 05 769.*

* cited by examiner

*Primary Examiner*—Hoa Van Le
(74) *Attorney, Agent, or Firm*—Sughrue Mion, PLLC

(57) ABSTRACT

An image-forming method comprising:

employing a silver halide color photographic light-sensitive material, comprising, on a support, at least one silver halide emulsion layer containing a yellow dye-forming coupler, at least one silver halide emulsion layer containing a magenta dye-forming coupler, at least one silver halide emulsion layer containing a cyan dye-forming coupler, at least one color-mix preventing layer and at least one protective layer, wherein the said silver halide emulsion layer containing a yellow dye-forming coupler includes a blue-sensitive silver halide emulsion having a silver chloride content of 90 mole % or more and containing at least one specific blue-sensitive sensitizing dye; and exposing the said silver halide color photographic light-sensitive material to a blue semiconductor laser of a wavelength shorter by 30 nm to 60 nm than the wavelength at which the said blue-sensitive silver halide emulsion has the spectral sensitivity maximum.

8 Claims, No Drawings

IMAGE-FORMING METHOD USING A SILVER HALIDE COLOR PHOTOGRAPHIC LIGHT-SENSITIVE MATERIAL, AND SILVER HALIDE COLOR PHOTOGRAPHIC LIGHT-SENSITIVE MATERIAL

FIELD OF THE INVENTION

The present invention relates to an image-forming method using a silver halide color photographic light-sensitive material, and in particular to a method for obtaining a high-quality image at a low cost.

Further, the present invention relates to an image-forming method and a silver halide color photographic light-sensitive material, and in particular, to technologies for improving a residual color problem by providing a silver halide color photographic light-sensitive material that is suitable for rapid processing.

Further, the present invention relates to a color image forming process and, in particular, to a color image forming process which comprises exposing a silver halide light-sensitive material to light by using an inexpensive and compact laser exposing apparatus and provides a high-quality color print.

BACKGROUND OF THE INVENTION

In recent years, progresses for laser light sources are remarkable. Previously an expensive large-size apparatus was needed for a laser. Presently, in contrast, laser light sources can be obtained using an inexpensive small-size apparatus, and the thus-obtained laser light sources are stable. This has been brought about by active and steady development of the semiconductor laser for DVDs and so on in the electronics industry. A laser of shorter wavelength has been developed for recording a high density of information, resulting in laser light sources for a variety of wavelength ranging from short to long.

Description of blue semiconductor laser light sources was presented by NICHIA CORPORATION in the 48th Meeting of the Japan Society of Applied Physics and Related Societies in March in 2001.

On the other hand, digitalization has been remarkably widespread in the field of color prints using color photographic printing paper. For example, a digital exposure system that uses laser scanning exposure has spread rapidly, compared with an ordinary analog exposure system in which printing is directly conducted from a processed color negative film using a color printer.

Such a digital exposure system is characterized in that high image quality is obtained by image processing, and it greatly contributes to improving qualities of color prints using color photographic printing paper. Further, according to the rapid spread of digital cameras, it is also an important factor that a color print with high image quality is easily obtained from these electronic recording media. It is believed that they will rapidly spread further. A digital exposure system, and an image-forming method using the same are described in detail in JP-A-11-84284 ("JP-A" means unexamined published Japanese patent application) and JP-A-2001-75219.

From the above-described situation, there is a demand for actualization of a color print system that attains low cost and high quality though a combination of inexpensive laser light sources and a digital exposure system. However, inexpensive laser light sources and the color print system do not always accord with each other. In development of the semiconductor laser, the laser wavelength is made shorter moment by moment for recording a high density of information. Accordingly, it is believed that an inexpensive semiconductor laser will shift to a shorter wavelength direction from now on, from the point of productivity. If the wavelength of the spectral sensitivity maximum of a color photographic printing paper is changed in accordance with laser light sources, a problem arises that interchangeability of the digital exposure system and the analogue exposure system is deteriorated. Even if the wavelength of the spectral sensitivity maximum of a color photographic printing paper is arranged in accordance with a wavelength of the laser light sources that is available at the present time neglecting interchangeability, it is not actual policy to adapt to the situation in which the wavelength of the laser light sources always varies moment by moment. Therefore, such color photographic printing paper cannot be put into practical use. Like this, an image-forming method and a development of a light-sensitive material not being subjected to fluctuation in exposure wavelength are strongly desired.

Generally, there is also a best exposure wavelength suitable for a color photographic printing paper. Hitherto, generally a wavelength near the wavelength of spectral sensitivity maximum has been chosen. This is because a photographic sensitivity is reduced if a color photographic printing paper is exposed to light having a wavelength different from the wavelength of spectral sensitivity maximum.

Surprisingly, such exposure caused a further serious problem. Namely, it was found that sensitiveness to fluctuation in exposure environments (particularly temperature fluctuation) became more remarkable. In other words, if the color photographic printing paper is exposed to light having a wavelength different from the wavelength of spectral sensitivity maximum, photographic sensitivity is changed depending on the environmental temperature at the time of exposure, and an image of constant quality cannot be obtained. The reduction in sensitivity can be prevented by increasing both the exposure amount and exposure power. However, it was difficult to substantially reduce the sensitivity fluctuation owing to changes of exposure environments.

JP-A-2001-75219 discloses the relation of a wavelength of the spectral sensitivity maximum and a wavelength of the exposure light sources. However, the wavelength of the exposure light sources disclosed therein is in the wavelength of spectral sensitivity maximum. Therefore, the above-mentioned publication completely fails to disclose the present invention. The above-mentioned JP-A-2001-75219 proposes a means to enhance the maximum density that can be obtained by a light-sensitive material employing a high silver chloride emulsion. However, the publication provides no specific solution of the above-mentioned problem. In addition, the exposure wavelength is set in a wavelength range at which a light-sensitive layer of the light-sensitive material has the spectral sensitivity maximum. Therefore, the above-mentioned publication completely fails to disclose the present invention.

Meanwhile, as to the color print processes, such technologies as an ink jet method, a sublimation-type method, and a color xerography have each made a progress to an extent that these methods are reputed for their photographic qualities and these are being accepted as color print processes. Among these processes, the features of the digital exposure process using color print paper reside in high-quality images, high productivity, and excellent colorfastness of images. Based on these features, it is required to provide photographs having further higher qualities in a simpler and less expensive measures.

In the color print process comprising laser exposure of color print paper, a digital scanning exposure system, which uses a monochromatic high-density light such as a gas laser, a semiconductor laser, or a second harmonic generation (SHG) light source comprising a combination of a semiconductor laser as an exciting light source and a nonlinear optical crystal, is actually used. The exposing apparatus using a gas laser is of a large size and therefore a large space is necessary for the accommodation. Presently, examples of the exposing apparatus using a gas laser as the light source include Lambda (trade name) series manufactured by Durst Corporation. However, the apparatus is large in size and the use is limited to a special application such as large-enlargement prints and the apparatus is not used for so-called amateur prints.

On the other hand, since an exposing apparatus using a semiconductor laser is far smaller than an exposing apparatus using a gas laser, the exposing apparatus using a semiconductor laser is suitable for a mini-lab which produces color prints in the area around a shop counter. Actually, an example of the exposing apparatus for a mini-lab is developed as a Frontier (trade name) series manufactured by Fuji Photo Film Co., Ltd. and this apparatus uses a semiconductor laser. When a color print is produced by the printing on a color print paper by laser exposure, normally blue light, green light, and red light are used as laser lights. This is because the wavelengths of these laser lights are close to the exposure wavelengths for color print paper for conventional analog type exposure and therefore the merit is that the main color print paper production technique can be used commonly with that for analog exposure and digital exposure. Because of the absence of a semiconductor laser, which fulfills such requirements as life and exposure intensity in the blue and green wavelength regions, blue and green laser lights are obtained by use of a second harmonic generation (SHG) light source comprising a combination of a red or infrared semiconductor laser as an exciting light source and a nonlinear optical crystal. The use of a nonlinear optical crystal causes a limitation in making the apparatus compact and inexpensive. This presents a problem particularly in an amateur market where cost is important.

As presented by NICHIA CORPORATION in the 48th Meeting of the Japan Society of Applied Physics and Related Societies in March in 2001, in recent years a blue semiconductor laser having wavelengths of 430 to 450 nm has reached the level enabling its actual use. The use of this semiconductor laser makes it possible to obtain a blue laser without the use of a nonlinear optical crystal.

However, in the image obtained by using as a light source a blue semiconductor laser whose wavelength is shorter than 450 nm, problems that color purity of yellow decreased and tints changed in the peripheral region of prints occurred. The problem that color purity of yellow decreased was alleviated by the sensitivity adjustment of a blue-sensitive emulsion but the problem that tints changed in the peripheral region of prints was not alleviated. Although the problem of tint change in the peripheral region of prints was alleviated by the gradation adjustment of a blue-sensitive emulsion, the gradation adjustment of a blue-sensitive emulsion led to the problem that color purity of yellow further decreased.

In recent years, high quality photographic light-sensitive materials which make it possible to outstandingly shorten the time required for an image forming process from an exposure step to a drying step through some treating steps have been desired as a part of improvements in a service to customers and as a measures for improving productivity in the photograph treatment service industry. In order to cope with this desire, for example, an exposure treatment system are being put to the market from each company in which system, the process since the exposure step is started until the drying step is finished is rapidly carried out in a total time about 4 minutes by shortening the time required from the exposure to the treatment (called latent image time in the field concerned) to about 10 seconds and carrying out the subsequent color developing treatment for 45 seconds (for example, in Frontier 350 manufactured by Fuji Photo Film Co., Ltd.). As to an exposure treatment using these systems, continuous exposure treatment is carried out in each processing laboratory, and the developed products are conveyed to photo processing shops and delivered to customers. However, a simple exposure treating system is being installed inside of a photo processing shop and the shop offers its service to return a photographic image to customers in about one hour from reception in these days. These systems are superior in shortening the time required until a photographic image is returned to customers. If there is a system capable of completing a process from the exposure to the treatment in 1 to 2 minutes by further shortening the latent image time, the time required for reception to return of photograph is greatly shortened and it is therefore expected to contribute to a much improvement in service.

It has been found that in case of conducting such super-rapid processing under the conditions, if a silver halide particle is small-sized from the necessity of improving developing progress and the amount of a spectral sensitizing dye is increased to obtain high sensitivity, the problem of residual color caused by a sensitizing dye remaining in a dried film is enhanced after treatment. Particularly residual color in a blue-sensitive layer to be formed by application as the lowermost layer of an image forming coating film is increased. As a measures used to solve this problem, technologies concerning a silver halide photographic light-sensitive material using a sensitizing dye that has as a substituent, an aromatic group having a specific structure differing from a phenyl group are disclosed in JP-A-6-230501. These technologies are however found to be quite unsatisfactory to achieve super-rapid processing in which the time from start of developing step to finish of drying step is a little more than one minute. Moreover, residual color improving technologies using a water-soluble diaminostilbene type fluorescent whiting agent or a highly hydrophilic sensitizing dye as described in JP-A-6-329936 and a method for promoting the washing of a sensitizing dye by decreasing not only the thickness of a swelled film but also the thickness of a dry film are keenly studied. However, these technologies are not satisfactory yet and it is therefore desired to develop technologies for improving problem of residual color.

Also, a system performing exposure using laser light is introduced to the market to make it possible to return a high quality print to customers by taking in information from a negative image obtained by taking a photograph and performing image treatment. This system is outstandingly spread at a high rate because of the important feature that high image quality is obtained and a color print having high image quality is obtained easily from an image recording medium of a digital camera or the like according to this system. In such a system, exposure is carried out using a laser and therefore exposure illuminance is made high, so that it is required for a silver halide light-sensitive material to have very superb characteristics coping with high illuminance. A method in which a silver halide is doped with a metal complex to thereby improve the reciprocity characteristics at a high illuminance, thereby making exposure illuminance conversion to coordinate a gradation at a middle to low illuminance and a gradation at high illuminance has been used from of old. However, this method has the drawback that the latent image time becomes long and it is therefore desired to develop technologies for more shortening the latent image time for laser exposure.

SUMMARY OF THE INVENTION

The present invention is an image-forming method comprising:

employing a silver halide color photographic light-sensitive material, comprising, on a support, at least one silver halide emulsion layer containing a yellow dye-forming coupler, at least one silver halide emulsion layer containing a magenta dye-forming coupler, at least one silver halide emulsion layer containing a cyan dye-forming coupler, at least one color-mix preventing layer, and at least one protective layer, wherein the said silver halide emulsion layer containing a yellow dye-forming coupler includes a blue-sensitive silver halide emulsion having a silver chloride content of 90 mole % or more, and containing at least one blue-sensitive sensitizing dye represented by formula (B-I); and exposing the said silver halide color photographic light-sensitive material to a blue semiconductor laser of a wavelength shorter by 30 nm to 60 nm than the wavelength at which the said blue-sensitive silver halide emulsion has the spectral sensitivity maximum:

Formula (B-I)

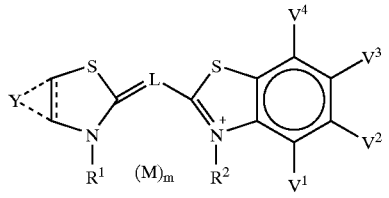

in formula (B-I), Y represents atoms necessary to form a benzene ring or a heterocyclic ring, each of which may be condensed with another carbon ring or heterocyclic ring and may have a substituent; $R^1$ and $R^2$ each represent an alkyl group, an aryl group, or a heterocyclic group; $V^1$, $V^2$, $V_3$, and $V^4$ each represent a hydrogen atom or a substituent, with the proviso that two adjacent substituents do not bond with each other to form a saturated or unsaturated condensed ring; L represents a methine group; M represents a counter ion; and m represents a number of 0 or greater necessary to neutralize a charge of the molecule.

Further, the present invention is an image-forming method comprising:

employing a silver halide color photographic light-sensitive material, comprising, on a support, at least one silver halide emulsion layer containing a yellow dye-forming coupler, at least one silver halide emulsion layer containing a magenta dye-forming coupler, at least one silver halide emulsion layer containing a cyan dye-forming coupler, at least one color-mix preventing layer, and at least one protective layer, wherein the said silver halide emulsion layer containing a cyan dye-forming coupler includes a red-sensitive silver halide emulsion having a silver chloride content of 90 mole % or more, and containing at least one red-sensitive sensitizing dye represented by formula (R-I); and exposing the said silver halide color photographic light-sensitive material to a red semiconductor laser of a wavelength shorter by 40 nm to 80 nm than the wavelength at which the said red-sensitive silver halide emulsion has the spectral sensitivity maximum:

Formula (R-I)

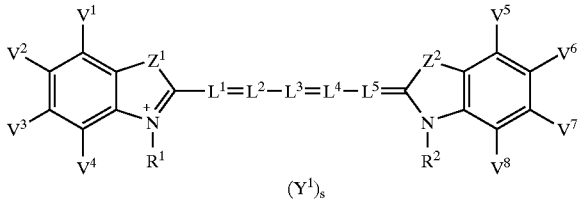

in formula (R-I), $Z^1$ represents a nitrogen atom, an oxygen atom, a sulfur atom, or a selenium atom; $L^1$, $L^2$, $L^3$, $L^4$, and $L^5$ each represent a methine group which may be substituted, or may be combined together with other methine group to form a 5- or 6-membered ring; $R^1$ and $R^2$ which may be the same or different, each represent an alkyl group and may have a substituent; further, $R^1$ and $L^1$, and/or $R^2$ and $L^5$, may bond with other to form a 5- or 6-membered ring; $V^1$, $V^2$, $V^3$, $V^4$, $V^5$, $V^6$, $V^7$, and $V^8$ each represent a hydrogen atom, a halogen atom, an alkyl group, an acyl group, an acyloxy group, an alkoxycarbonyl group, a carbamoyl group, a sulfamoyl group, a carboxyl group, a cyano group, a hydroxyl group, an amino group, an acylamino group, an alkoxy group, an alkylthio group, an alkylsulfonyl group, a sulfo group, an aryloxy group, or an aryl group; two of $V^1$ to $V^8$, bonding to carbon atoms adjacent to each other, may be combined together to form a condensed ring; $Y^1$ represents a counter ion for balancing a charge; and s represents a number of 0 or greater necessary to neutralize a charge.

Further, the present invention is an image-forming method comprising:

employing a silver halide color photographic light-sensitive material, comprising, on a support, at least one silver halide emulsion layer containing a yellow dye-forming coupler, at least one silver halide emulsion layer containing a magenta dye-forming coupler, at least one silver halide emulsion layer containing a cyan dye-forming coupler, at least one color-mix preventing layer, and at least one protective layer, wherein the said silver halide emulsion layer containing a yellow dye-forming coupler includes a blue-sensitive silver halide emulsion having a silver chloride content of 90 mole % or more, and containing at least one blue-sensitive sensitizing dye represented by the above-described formula (B-I), and wherein the said silver halide emulsion layer containing a cyan dye-forming coupler that includes a red-sensitive silver halide emulsion having a silver chloride content of 90 mole % or more, and containing at least one red-sensitive sensitizing dye represented by the above-described formula (R-I); and exposing the said blue-sensitive silver halide emulsion at a wavelength shorter by 30 nm to 60 nm than the spectral sensitivity maximum of the blue-sensitive silver halide emulsion by using a blue semiconductor laser, and exposing the said red-sensitive silver halide emulsion at a wavelength shorter by 40 nm to 80 nm than the spectral sensitivity maximum of the red-sensitive silver halide emulsion by using a red semiconductor laser.

Further, the present invention is a silver halide color photographic light-sensitive material for use in a laser exposure, which comprises, on a support:

at least one silver halide emulsion layer containing a yellow dye-forming coupler, at least one silver halide emulsion layer containing a magenta dye-forming coupler, at least one silver halide emulsion layer containing a cyan dye-forming coupler, at least one color-mix preventing layer, and at least one protective layer; wherein the said silver halide emulsion layer containing a yellow dye-forming coupler includes a blue-sensitive silver halide emulsion having a silver chloride content of 90 mole % or more and containing at least one blue-sensitive sensitizing dye represented by the above-described formula (B-I), and the wavelength of the spectral sensitivity maximum of the said blue-sensitive silver halide emulsion is longer, by 30 nm to 60 nm, than the exposure wavelength of a blue exposure light source to be used.

Further, the present invention is a silver halide color photographic light-sensitive material for use in a laser exposure, which comprises, on a support:

at least one silver halide emulsion layer containing a yellow dye-forming coupler, at least one silver halide emulsion layer containing a magenta dye-forming coupler, at least one silver halide emulsion layer containing a cyan dye-forming coupler, at least one color-mix preventing layer, and at least one protective layer; wherein the said silver halide emulsion layer containing a cyan dye-forming coupler includes a red-sensitive silver halide emulsion having a silver chloride content of 90 mole % or more and containing at least one red-sensitive sensitizing dye represented by the above-described formula (R-I), and the wavelength of the spectral sensitivity maximum of the said red-sensitive silver halide emulsion is longer by 40 nm to 80 nm than the exposure wavelength of a red exposure light source to be used.

Further, the present invention is a silver halide color photographic light-sensitive material for use in a laser exposure, which comprises, on a support, at least one silver halide emulsion layer containing a yellow dye-forming coupler, at least one silver halide emulsion layer containing a magenta dye-forming coupler, and at least one silver halide emulsion layer containing a cyan dye-forming coupler, at least one color-mix preventing layer, and at least one protective layer; wherein the said silver halide emulsion layer containing a yellow dye-forming coupler includes a blue-sensitive silver halide emulsion having a silver chloride content of 90 mole % or more and containing at least one blue-sensitive sensitizing dye represented by the above-described formula (B-I), and the wavelength of the spectral sensitivity maximum of the said blue-sensitive silver halide emulsion is longer by 30 nm to 60 nm than the exposure wavelength of a blue exposure light source to be used; and wherein the said silver halide emulsion layer containing a cyan dye-forming coupler includes a red-sensitive silver halide emulsion having a silver chloride content of 90 mole % or more and containing at least one red-sensitive sensitizing dye represented by the above-described formula (R-I), and the wavelength of the spectral sensitivity maximum of the said red-sensitive silver halide emulsion is longer by 40 nm to 80 nm than the exposure wavelength of a red exposure light source to be used.

Further, the present invention is an image-forming method comprising employing a silver halide color light-sensitive material containing at least one yellow color developing light-sensitive silver halide emulsion layer, at least one magenta color developing light-sensitive silver halide emulsion layer and at least one cyan color developing light-sensitive emulsion layer and at least one non light-sensitive and non color-developing hydrophilic colloidal layer on a reflective support, wherein the water-swelled film thickness of a photographic structural layer on the side of the emulsion layers of the support is 8 μm or-more and 19 μm or less and the film thickness at the side to which the emulsion layers are applied on the support is 3 μm or more and 7.5 μm or less, and imagewise exposing the yellow color developing light-sensitive silver halide emulsion layer of the silver halide color light-sensitive material to coherent light from a blue color-emitting semiconductor laser at an emission wavelength of 420 nm to 450 nm.

Further, the present invention is a silver halide color photographic light-sensitive material comprising, on a reflective support, at least one yellow color developing light-sensitive silver halide emulsion layer, at least one magenta color developing light-sensitive silver halide emulsion layer and at least one cyan color developing light-sensitive emulsion layer and at least one non light-sensitive and non color-developing hydrophilic colloidal layer, wherein;

(a) the water-swelled film thickness of the photographic structural layer on the side of the emulsion layers coated on the support is 8 μm or more and 19 μm or less and the film thickness of the side to which the emulsion layers are applied on the support is 3 μm or more and 7.5 μm or less;

(b) the amount of silver coated on the side to which the emulsion layers are applied on the support is 0.2 $g/m^2$ or more and 0.5 $g/m^2$ or less;

(c) the silver halide color photographic light-sensitive material contains at least one light-sensitive silver halide doped with a six-coordination complex having, as a center metal, Ir having at least one $H_2O$ molecule as a ligand; and (d) the yellow color developing light-sensitive silver halide emulsion layer contains a compound represented by the following formula (I):

Formula (I)

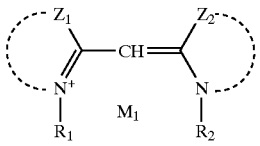

in formula (I), $Z_1$ and $Z_2$ respectively represent a non-metal atomic group necessary to form a benzothiazole ring, provided that the benzothiazole ring formed by $Z_1$ and $Z_2$ may have a substituent excluding an aromatic group and a hetero aromatic group as a substituent or may have a —O—$CH_2$—O— group condensed thereto; $R_1$ and $R_2$ respectively represent an alkyl group; and $M_1$ represents a counter ion necessary to neutralize the charge in the molecule and is unessential in the case of forming an intermolecular salt.

Further, the present invention is an image-forming method comprising:

exposing a silver halide color photographic light-sensitive material to at least 3 kinds of visible laser lights of different wavelengths as the exposure wavelengths in 420 to 450 nm, 500 to 560 nm, and 620 to 710 nm, respectively; and subjecting the material to color development processing, wherein at least 2 kinds of laser lights are obtained from semiconductor laser light sources not through nonlinear optical crystals, γc, γm, and γy are each 1.0 to 1.6, the difference of any two of γc, γm, and γy is −0.2 to 0.2, and ΔS is 1.0 to 1.8:

γc: gradation of cyan-color image obtained by color development processing after exposure to a laser light source having the longest wavelength;

γm: gradation of magenta-color image obtained by color development processing after exposure to a laser light source having the exposure wavelength in 520 to 560 nm;

γy: gradation of yellow-color image obtained by color development processing after exposure to a laser light source having the shortest wavelength; and ΔS:the difference between yellow sensitivity and magenta sensitivity (Sy−Sm)

(The gradation means the value γ=Log(E2/E1) obtained from an exposure amount (E1) which gives a developed color density equivalent to unexposed portion density +0.02 and an exposure amount (E2) which gives a developed color density equivalent to 90% of the maximum developed color density in the characteristic curve of each of the images. Further, yellow sensitivity Sy means the value Log(1/Ey) obtained from an exposure amount (Ey) which gives a yellow density of 1.8 and magenta sensitivity Sm means the value Log(1/Em) obtained from an exposure amount (Em) which gives a magenta density of 0.6, on the characteristic curves of yellow and magenta images obtained by color development processing after exposure to a laser light source having the shortest wavelength).

Further, the present invention is a silver halide color photographic light-sensitive material for laser exposure in an image-forming process that is to be exposed to at least 3 kinds of visible laser lights having different wavelengths as the exposure wavelengths in 420 to 450 nm, 500 to 560 nm, and 620 to 710 nm, respectively, and to be subjected to color development processing, wherein at least 2 kinds of laser lights are those obtained from semiconductor laser light sources not through nonlinear optical crystals, the above-described γc, γm, and γy are each 1.0 to 1.6, the difference of any two of γc, γm, and γy is −0.2 to 0.2, and the above-described ΔS is 1.0 to 1.8.

Further, the present invention is an image-forming method that comprises:

exposing a silver halide color photographic light-sensitive material, comprising, on a support, at least one blue-sensitive silver halide emulsion layer, at least one green-sensitive silver halide emulsion layer, and at least one red-sensitive silver halide emulsion layer; and then subjecting the exposed light-sensitive material to color development processing, wherein the said blue-sensitive silver halide emulsion layer includes silver halide grains having a silver chloride content of 90 mole % or more, and a silver iodide content of 0.02 to 1 mole %, and wherein the said silver halide color photographic light-sensitive material is exposed to at least blue semiconductor laser having a wavelength of 430 to 450 nm.

Further, the present invention is an image-forming method that comprises:

exposing a silver halide color photographic light-sensitive material, comprising, on a support, at least one blue-sensitive silver halide emulsion layer, at least one green-sensitive silver halide emulsion layer, and at least one red-sensitive silver halide emulsion layer, and then subjecting the exposed light-sensitive material to color development processing, wherein the said blue-sensitive silver halide emulsion layer includes silver halide grains having a silver chloride content of 90 mole % or more, and a silver bromide content of 0.1 to 7 mole %, and wherein the said silver halide color photographic light-sensitive material is exposed to at least blue semiconductor laser having a wavelength of 430 to 450 nm.

Further, the present invention is an image-forming method that comprises:

exposing a silver halide color photographic light-sensitive material, comprising, on a support, at least one blue-sensitive silver halide emulsion layer, at least one green-sensitive silver halide emulsion layer, and at least one red-sensitive silver halide emulsion layer, and then subjecting the exposed light-sensitive material to color development processing, wherein the said blue-sensitive silver halide emulsion layer includes silver halide grains having a silver chloride content of 90 mole % or more, a silver iodide content of 0.02 to 1 mole %, and a silver bromide content of 0.1 to 7 mole %, wherein the said silver halide grains further have a silver iodide-containing phase with a profile in which the iodide ion concentration decreases in the direction from the grain surface to inner portion and a silver bromide-containing phase providing a maximum of the bromide concentration in the inner portion of the grain, and wherein the said silver halide color photographic light-sensitive material is exposed to at least blue semiconductor laser having a wavelength of 430 to 450 nm.

Further, the present invention is an image-forming method that comprises:

exposing a silver halide color photographic light-sensitive material, comprising, on a support, at least one blue-sensitive silver halide emulsion layer, at least one green-sensitive silver halide emulsion layer, and at least one red-sensitive silver halide emulsion layer, and then subjecting the exposed light-sensitive material to a color development processing, wherein the said blue-sensitive silver halide emulsion layer includes a silver halide emulsion in which silver halide grains have a silver chloride content of 90 mole % or more, and a six-coordinate complex having Ir as a central metal, and having Cl, Br or I as a ligand, and wherein the said silver halide color photographic light-sensitive material is exposed to at least blue semiconductor laser having a wavelength of 430 to 450 nm.

Further, the present invention is an image-forming method that comprises:

exposing a silver halide color photographic light-sensitive material, comprising, on a support, at least one blue-sensitive silver halide emulsion layer, at least one green-sensitive silver halide emulsion layer, and at least one red-sensitive silver halide emulsion layer, and then subjecting the exposed light-sensitive material to color development processing, wherein the said red-sensitive silver halide emulsion layer includes silver halide grains having a silver chloride content of 90 mole % or more, a silver iodide content of 0.02 to 1 mole %, and a silver bromide content of 0.1 to 7 mole %, wherein the said silver halide grains further have a silver iodide-containing phase with a profile in which the iodide concentration decreases in the direction from the grain surface to inner portion and a silver bromide-containing phase providing a maximum of the bromide concentration in the inner portion of the grain, and wherein the said silver halide color photographic light-sensitive material is exposed to at least red semiconductor laser having a wavelength of 620 to 670 nm.

Other and further features and advantages of the invention will appear more fully from the following description.

DETAILED DESCRIPTION OF THE INVENTION

According to the present invention, there is provided the following means:

(1) An image-forming method comprising:

employing a silver halide color photographic light-sensitive material, comprising, on a support, at least one silver halide emulsion layer containing a yellow dye-forming coupler, at least one silver halide emulsion layer containing a magenta dye-forming coupler, at least one silver halide emulsion layer containing a cyan dye-forming coupler, at least one color-mix preventing layer, and at least one protective layer, wherein the said silver halide emulsion layer containing a yellow dye-forming coupler includes a blue-sensitive silver halide emulsion having a silver chloride content of 90 mole % or more, and containing at least one blue-sensitive sensitizing dye represented by formula (B-I); and exposing the said silver halide color photographic light-sensitive material to a blue semiconductor laser of a wavelength shorter by 30 nm to 60 nm than the wavelength at which the said blue-sensitive silver halide emulsion has the spectral sensitivity maximum:

Formula (B-I)

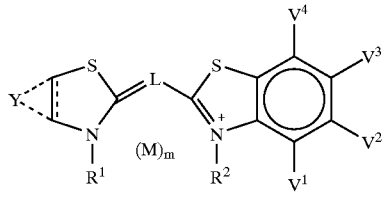

in formula (B-I), Y represents atoms necessary to form a benzene ring or a heterocyclic ring, each of which may be condensed with another carbon ring or heterocyclic ring and may have a substituent; $R^1$ and $R^2$ each represent an alkyl group, an aryl group, or a heterocyclic group; $V^1$, $V^2$, $V^3$, and $V^4$ each represent a hydrogen atom or a substituent, with the proviso that two adjacent substituents do not bond with each other to form a saturated or unsaturated condensed ring; L represents a methine group; M represents a counter ion; and m represents a number of 0 or greater necessary to neutralize a charge of the molecule.

(2) An image-forming method comprising:

employing a silver halide color photographic light-sensitive material, comprising, on a support, at least one silver halide emulsion layer containing a yellow dye-forming coupler, at least one silver halide emulsion layer containing a magenta dye-forming coupler, at least one silver halide emulsion layer containing a cyan dye-forming coupler, at least one color-mix preventing layer, and at least one protective layer, wherein the said silver halide emulsion layer containing a cyan dye-forming coupler includes a red-sensitive silver halide emulsion having a silver chloride content of 90 mole % or more, and containing at least one red-sensitive sensitizing dye represented by formula (R-I); and exposing the said silver halide color photographic light-sensitive material to a red semiconductor laser of a wavelength shorter by 40 nm to 80 nm than the wavelength at which the said red-sensitive silver halide emulsion has the spectral sensitivity maximum:

Formula (R-I)

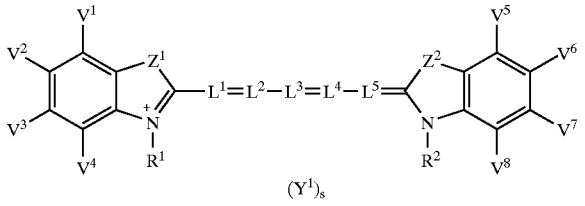

in formula (R-I), $Z^1$ represents a nitrogen atom, an oxygen atom, a sulfur atom, or a selenium atom; $L^1$, $L^2$, $L^3$, $L^4$, and $L^5$ each represent a methine group which may be substituted, or may be combined together with other methine group to form a 5- or 6-membered ring; $R^1$ and $R^2$, which may be the same or different, each represent an alkyl group and may have a substituent; further, $R^1$ and $L^1$, and/or $R^2$ and $L^5$, may bond with another to form a 5- or 6-membered ring; $V^1$, $V^2$, $V^3$, $V^4$, $V^5$, $V^6$, $V^7$, and $V^8$ each represent a hydrogen atom, a halogen atom, an alkyl group, an acyl group, an acyloxy group, an alkoxycarbonyl group, a carbamoyl group, a sulfamoyl group, a carboxyl group, a cyano group, a hydroxyl group, an amino group, an acylamino group, an alkoxy group, an alkylthio group, an alkylsulfonyl group, a sulfo group, an aryloxy group, or an aryl group; two of $V^1$ to $V^8$, bonding to carbon atoms adjacent to each other, may be combined together to form a condensed ring; $Y^1$ represents a counter ion for balancing a charge; and s represents a number of 0 or greater necessary to neutralize a charge.

(3) An image-forming method comprising:

employing a silver halide color photographic light-sensitive material, comprising, on a support, at least one silver halide emulsion layer containing a yellow dye-forming coupler, at least one silver halide emulsion layer containing a magenta dye-forming coupler, at least one silver halide emulsion layer containing a cyan dye-forming coupler, at least one color-mix preventing layer, and at least one protective layer, wherein the said silver halide emulsion layer containing a yellow dye-forming includes a blue-sensitive silver halide emulsion having a silver chloride content of 90 mole % or more, and containing at least one blue-sensitive sensitizing dye represented by formula (B-I), and wherein the said silver halide emulsion layer containing a cyan dye-forming coupler that includes a red-sensitive silver halide emulsion having a silver chloride content of 90 mole % or more, and containing at least one red-sensitive sensitizing dye represented by formula (R-I); and exposing the said blue-sensitive silver halide emulsion at a wavelength shorter by 30 nm to 60 nm than the spectral sensitivity maximum of the blue-sensitive silver halide emulsion by using a blue semiconductor laser, and exposing the said red-sensitive silver halide emulsion at a wavelength shorter by 40 nm to 80 nm than the spectral sensitivity maximum of the red-sensitive silver halide emulsion by using a red semiconductor laser:

Formula (B-I)

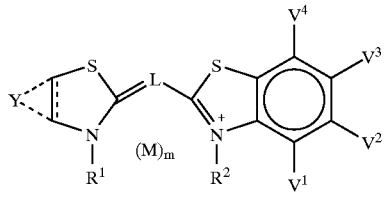

in formula (B-I), Y represents atoms necessary to form a benzene ring or a heterocyclic ring, each of which may be condensed with another carbon ring or heterocyclic ring and may have a substituent; $R^1$ and $R^2$ each represent an alkyl group, an aryl group, or a heterocyclic group; $V^1$, $V^2$, $V^3$, and $V^4$ each represent a hydrogen atom or a substituent, with the proviso that two adjacent substituents do not bond with each other to form a saturated or unsaturated condensed ring; L represents a methine group; M represents a counter ion; and m represents a number of 0 or greater necessary to neutralize a charge of the molecule;

Formula (R-I)

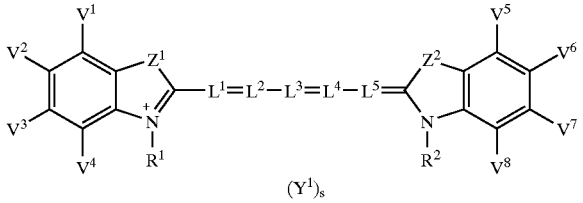

in formula (R-I), $Z^1$ represents a nitrogen atom, an oxygen atom, a sulfur atom or a selenium atom; $L^1$, $L^2$, $L^3$, $L^4$, and $L^5$ each represent a methine group which may be substituted, or may be combined together with other methine group to form a 5- or 6-membered ring; $R^1$ and $R^2$, which may be the same or different, each represent an alkyl group and may have a substituent; further, $R^1$ and $L^1$, and/or $R^2$ and $L^5$, may bond with another to form a 5- or 6-membered ring; $V^1$, $V^2$, $V^3$, $V^4$, $V^5$, $V^6$, $V^7$, and $V^8$ each represent a hydrogen atom, a halogen atom, an alkyl group, an acyl group, an acyloxy group, an alkoxycarbonyl group, a carbamoyl group, a sulfamoyl group, a carboxyl group, a cyano group, a hydroxyl group, an amino group, an acylamino group, an alkoxy group, an alkylthio group, an alkylsulfonyl group, a sulfo group, an aryloxy group, or an aryl group; two of $V^1$ to $V^8$, bonding to carbon atoms adjacent to each other, may be combined together to form a condensed ring; $Y^1$ represents a counter ion for balancing a charge; and s represents a number of 0 or greater necessary to neutralize a charge.

(4) The image-forming method according to any one of the above items (1) to (3), wherein the light-sensitive material is exposed to blue, green, and red light for 5 microseconds or less per pixel, with resolution of 200 dpi or more, and it is developed with a 40° C. or more developer solution, for a total wetting time of 100 seconds or less.

(5) The image-forming method according to any one of the above items (1) to (4), wherein development processing is started within 10 seconds after exposure.

(6) The image-forming method according to any one of the above items (1) to (5), wherein 50% or more in the projected area of silver halide grains, that are contained in the above-said blue-sensitive silver halide emulsion, is occupied by tabular grains having an aspect ratio of 2 or more.

(7) A silver halide color photographic light-sensitive material for use in a laser exposure, which comprises, on a support:

at least one silver halide emulsion layer containing a yellow dye-forming coupler, at least one silver halide emulsion layer containing a magenta dye-forming coupler, at least one silver halide emulsion layer containing a cyan dye-forming coupler, at least one color-mix preventing layer, and at least one protective layer; wherein the said silver halide emulsion layer containing a yellow dye-forming coupler includes a blue-sensitive silver halide emulsion having a silver chloride content of 90 mole % or more and containing at least one blue-sensitive sensitizing dye represented by formula (B-I), and the wavelength of the spectral sensitivity maximum of the said blue-sensitive silver halide emulsion is longer by 30 nm to 60 nm than the exposure wavelength of a blue exposure light source to be used:

Formula (B-I)

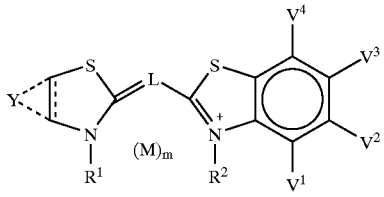

in formula (B-I), Y represents atoms necessary to form a benzene ring or a heterocyclic ring, each of which may be condensed with another carbon ring or heterocyclic ring and may have a substituent; $R^1$ and $R^2$ each represent an alkyl group, an aryl group, or a heterocyclic group;. $V^1$, $V^2$, $V^3$, and $V^4$ each represent a hydrogen atom or a substituent, with the proviso that two adjacent substituents do not bond with each other to form a saturated or unsaturated condensed ring; L represents a methine group; M represents a counter ion; and m represents a number of 0 or greater necessary to neutralize a charge of the molecule.

(8) A silver halide color photographic light-sensitive material for use in a laser exposure, which comprises, on a support:

at least one silver halide emulsion layer containing a yellow dye-forming coupler, at least one silver halide emulsion layer containing a magenta dye-forming coupler, at least one silver halide emulsion layer containing a cyan dye-forming coupler, at least one color-mix preventing layer, and at least one protective layer; wherein the said silver halide emulsion layer containing a cyan dye-forming coupler includes a red-sensitive silver halide emulsion having a silver chloride content of 90 mole % or more and containing at least one red-sensitive sensitizing dye represented by formula (R-I), and wherein the wavelength of the spectral sensitivity maximum of the said red-sensitive silver halide emulsion is longer by 40 nm to 80 nm than the exposure wavelength of a red exposure light source to be used: Formula (R-I)

Formula (R-I)

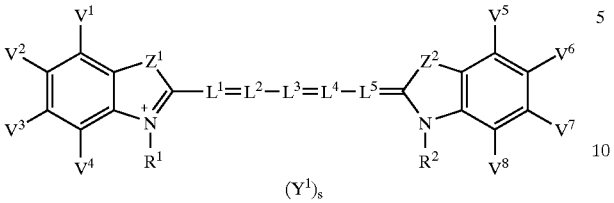

in formula (R-I), $Z^1$ represents a nitrogen atom, an oxygen atom, a sulfur atom, or a selenium atom; $L^1$, $L^2$, $L^3$, $L^4$, and $L^5$ each represent a methine group which may be substituted, or may be combined together with other methine group to form a 5- or 6-membered ring; $R^1$ and $R^2$, which may be the same or different, each represent an alkyl group and may have a substituent; further, $R^1$ and $L^1$, and/or $R^2$ and $L^5$, may bond with another to form a 5- or 6-membered ring; $V^1$, $V^2$, $V^3$, $V^4$, $V^5$, $V^6$, $V^7$, and $V^8$ each represent a hydrogen atom, a halogen atom, an alkyl group, an acyl group, an acyloxy group, an alkoxycarbonyl group, a carbamoyl group, a sulfamoyl group, a carboxyl group, a cyano group, a hydroxyl group, an amino group, an acylamino group, an alkoxy group, an alkylthio group, an alkylsulfonyl group, a sulfo group, an aryloxy group, or an aryl group; two of $V^1$ to $V^8$, bonding to carbon atoms adjacent to each other, may be combined together to form a condensed ring; $Y^1$ represents a counter ion for balancing a charge; and s represents a number of 0 or greater necessary to neutralize a charge.

(9) A silver halide color photographic light-sensitive material for use in a laser exposure, which comprises, on a support, at least one silver halide emulsion layer containing a yellow dye-forming coupler, at least one silver halide emulsion layer containing a magenta dye-forming coupler, at least one silver halide emulsion layer containing a cyan dye-forming coupler, at least one color-mix preventing layer, and at least one protective layer; wherein the said silver halide emulsion layer containing a yellow dye-forming coupler includes a blue-sensitive silver halide emulsion having a silver chloride content of 90 mole % or more and containing at least one blue-sensitive sensitizing dye represented by formula (B-I), and the wavelength of the spectral sensitivity maximum of the said blue-sensitive silver halide emulsion is longer by 30 nm to 60 nm than the exposure wavelength of a blue exposure light source to be used; and wherein the said silver halide emulsion layer containing a cyan dye-forming coupler includes a red-sensitive silver halide emulsion having a silver chloride content of 90 mole % or more and containing at least one red-sensitive sensitizing dye represented by formula (R-I), and the wavelength of the spectral sensitivity maximum of the said red-sensitive silver halide emulsion is longer by 40 nm to 80 nm than the exposure wavelength of a red exposure light source to be used:

Formula (B-I)

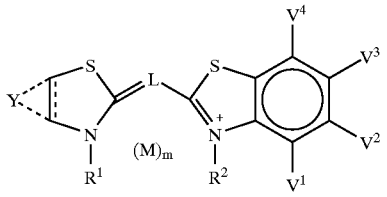

in formula (B-I), Y represents atoms necessary to form a benzene ring or a heterocyclic ring, each of which may be condensed with another carbon ring or heterocyclic ring and may have a substituent; $R^1$ and $R^2$ each represent an alkyl group, an aryl group, or a heterocyclic group; $V^1$, $V^2$, $V^3$, and $V^4$ each represent a hydrogen atom or a substituent, with the proviso that two adjacent substituents do not bond with each other to form a saturated or unsaturated condensed ring; L represents a methine group; M represents a counter ion; and m represents a number of 0 or greater necessary to neutralize a charge of the molecule;

Formula (R-I)

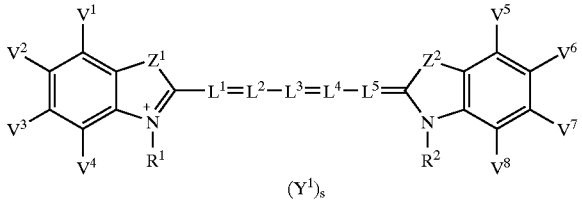

in formula (R-I), $Z^1$ represents a nitrogen atom, an oxygen atom, a sulfur atom, or a selenium atom; $L^1$, $L^2$, $L^3$, $L^4$, and $L^5$ each represent a methine group which may be substituted, or may be combined together with other methine group to form a 5- or 6-membered ring; $R^1$ and $R^2$, which may be the same or different, each represent an alkyl group and may have a substituent; further, $R^1$ and $L^1$, and/or $R^2$ and $L^5$, may bond with another to form a 5- or 6-membered ring; $V^1$, $V^2$, $V^3$, $V^4$, $V^5$, $V^6$, $V^7$, and $V^8$ each represent a hydrogen atom, a halogen atom, an alkyl group, an acyl group, an acyloxy group, an alkoxycarbonyl group, a carbamoyl group, a sulfamoyl group, a carboxyl group, a cyano group, a hydroxyl group, an amino group, an acylamino group, an alkoxy group, an alkylthio group, an alkylsulfonyl group, a sulfo group, an aryloxy group, or an aryl group; two of $V^1$ to $V^8$, bonding to carbon atoms adjacent to each other, may be combined together to form a condensed ring; $Y^1$ represents a counter ion for balancing a charge; and s represents a number of 0 or greater necessary to neutralize a charge.

(Hereinafter, a first embodiment of the present invention means to include the image-forming method or the silver halide color photographic light-sensitive material described in the items (1), to (9) above.)

(10) An image forming method comprising:

employing a silver halide color light-sensitive material containing at least one yellow color developing light-sensitive silver halide emulsion layer, at least one magenta color developing light-sensitive silver halide emulsion layer and at least one cyan color developing light-sensitive emulsion layer and at least one non light-sensitive and non color-developing hydrophilic colloidal layer on a reflective support, wherein the water-swelled film thickness of a photographic structural layer on the side of the emulsion layers of the support is 8 μm or more and 19 μm or less and the film thickness at the side to which the emulsion layers are applied on the support is 3 μm or more and 7.5 μm or less; and imagewise exposing the yellow color developing light-sensitive silver halide emulsion layer of the silver halide color light-sensitive material to coherent light from a blue color-emitting semiconductor laser at an emission wavelength of 420 nm to 450 nm.

(11) The image-forming method according to the above item (10), wherein the amount of silver to be applied to the side to which the emulsion layers are applied on the support is 0.2 $g/m^2$ or more and 0.5 $g/m^2$ or less.

(12) The image-forming method according to the above item (10) or (11), wherein the silver halide color photographic light-sensitive material contains at least one light-sensitive silver halide doped with a six-coordination complex having, as a center metal, Ir having at least one $H_2O$ molecule as a ligand.

(13) The image-forming method according to the above item (10), (11) or (12), wherein the yellow color developing light-sensitive silver halide emulsion layer contains a compound represented by formula (I):

Formula (I)

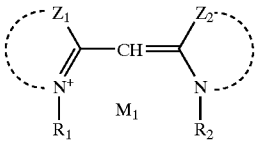

in formula (I), $Z_1$ and $Z_2$ respectively represent a non-metal atomic group necessary to form a benzothiazole ring, provided that the benzothiazole ring formed by $Z_1$ and $Z_2$ may have a substituent excluding an aromatic group and a hetero aromatic group as a substituent or may have a —O—$CH_2$—O— group condensed thereto; $R_1$ and $R_2$ respectively represent an alkyl group; and $M_1$ represents a counter ion necessary to neutralize the charge in the molecule and is unessential in the case of forming an intermolecular salt.

(14) The image-forming method according to the above item (10), (11), (12) or (13), wherein the reflective support contains a white pigment and a fluorescent whitening agent.

(15) The image-forming method according to any one of the above items (10) to (14), comprising exposing imagewise the cyan color developing light-sensitive silver halide emulsion layer of the silver halide color light-sensitive material to light having a wavelength of 620 nm to 650 nm.

(16) A silver halide color photographic light-sensitive material comprising, on a reflective support, at least one yellow color developing light-sensitive silver halide emulsion layer, at least one magenta color developing light-sensitive silver halide emulsion layer and at least one cyan color developing light-sensitive emulsion layer and at least one non light-sensitive and non color-developing hydrophilic colloidal layer, wherein;

(a) the water-swelled film thickness of the photographic structural layer on the side of the emulsion layers coated on the support is 8 μm or more and 19 μm or less and the film thickness of the side to which the emulsion layers are applied on the support is 3 μm or more and 7.5 μm or less;

(b) the amount of silver coated on the side to which the emulsion layers are applied on the support is 0.2 $g/m^2$ or more and 0.5 $g/m^2$ or less;

(c) the silver halide color photographic light-sensitive material contains at least one light-sensitive silver halide doped with a six-coordination complex having, as a center metal, Ir having at least one $H_2O$ molecule as a ligand; and (d) the yellow color developing light-sensitive silver halide emulsion layer contains a compound represented by the following formula (I):

Formula (I)

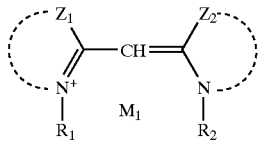

in formula (I), $Z_1$ and $Z_2$ respectively represent a non-metal atomic group necessary to form a benzothiazole ring, provided that the benzothiazole ring formed by $Z_1$ and $Z_2$ may have a substituent excluding an aromatic group and a hetero aromatic group as a substituent or may have a —O—$CH_2$—O— group condensed thereto; $R_1$ and $R_2$ respectively represent an alkyl group; and $M_1$ represents a counter ion necessary to neutralize the charge in the molecule and is unessential in the case of forming an intermolecular salt.

(17) The silver halide color photographic light-sensitive material, wherein the yellow color developing light-sensitive silver halide emulsion layer of the silver halide color light-sensitive material is exposed imagewise to coherent light from a blue color-emitting semiconductor laser at an emission wavelength of 420 nm to 450 nm.

(Hereinafter, a second embodiment of the present invention means to include the image-forming method or the silver halide color photographic light-sensitive material described in the items (10) to (17) above.

In the present invention, the photographic structural layer means all of the hydrophilic colloidal layers formed by application on the side of emulsion layers on the support. Examples of the hydrophilic colloidal layer include a silver halide emulsion layer, an antihalation layer, a color layer, an intermediate layer and a ultraviolet absorbing layer.)

(18) An image-forming method comprising:

exposing a silver halide color photographic light-sensitive material to at least 3 kinds of visible laser lights of different wavelengths as the exposure wavelengths in 420 to 450 nm, 500 to 560 nm, and 620 to 710 nm, respectively; and subjecting the material to color development processing, wherein at least 2 kinds of laser lights are obtained from semiconductor laser light sources not through nonlinear optical crystals, γc, γm, and γy are each 1.0 to 1.6, the difference of any two of γc, γm, and γy is −0.2 to 0.2, and ΔS is 1.0 to 1.8:

γc: gradation of cyan-color image obtained by color development processing after exposure to a laser light source having the longest wavelength;

γm: gradation of magenta-color image obtained by color development processing after exposure to a laser light source having the exposure wavelength in 520 to 560 nm;

γy: gradation of yellow-color image obtained by color development processing after exposure to a laser light source having the shortest wavelength; and ΔS:the difference between yellow sensitivity and magenta sensitivity (Sy−Sm)

(The gradation means the value γ=Log(E2/E1) obtained from an exposure amount (E1) which gives a developed color density equivalent to unexposed portion density +0.02 and an exposure amount (E2) which gives a developed color density equivalent to 90% of the maximum developed color density in the characteristic curve of each of the images. Further, yellow sensitivity Sy means the value Log(1/Ey) obtained from an exposure amount (Ey) which gives a yellow density of 1.8 and magenta sensitivity Sm means the value Log(1/Em) obtained from an exposure amount (Em) which gives a magenta density of 0.6, on the characteristic curves of yellow and magenta images obtained by color development processing after exposure to a laser light source having the shortest wavelength).

(19) The image-forming method according to the above item (18) wherein the wavelength difference between the longest wavelength and the shortest wavelength of the laser light is 180 to 210 nm.

(20) The image-forming method according to the above item (18) or (19), using a silver halide color photographic light-sensitive material having a yellow image-forming layer which contains a silver halide emulsion composed of silver halide grains having on the surface thereof a phase containing silver iodide at a maximum concentration.

(21) A silver halide color photographic light-sensitive material for laser exposure in an image-forming process that is to be exposed to at least 3 kinds of visible laser lights having different wavelengths as the exposure wavelengths in 420 to 450 nm, 500 to 560 nm, and 620 to 710 nm, respectively, and to be subjected to color development processing, wherein at least 2 kinds of laser lights are those obtained from semiconductor laser light sources not through nonlinear optical crystals, γc, γm, and γy are each 1.0 to 1.6, the difference of any two of γc, γm, and γy is −0.2 to 0.2, and Δs is 1.0 to 1.8.

γc: gradation of cyan-color image obtained by color development processing after exposure to a laser light source having the longest wavelength;

γm: gradation of magenta-color image obtained by color development processing after exposure to a laser light source having the exposure wavelength in 520 to 560 nm;

γy: gradation of yellow-color image obtained by color development processing after exposure to a laser light source having the shortest wavelength; and ΔS: the difference between yellow sensitivity and magenta sensitivity (Sy−Sm)

(The gradation means the value γ=Log(E2/E1) obtained from an exposure amount (E1) which gives a developed color density equivalent to unexposed density +0.02 and an exposure amount (E2) which gives a developed color density equivalent to 90% of the maximum developed color density in the characteristic curve of each of the images. Further, yellow sensitivity Sy means the value Log(1/Ey) obtained from an exposure amount (Ey) which gives a yellow density of 1.8 and magenta sensitivity Sm means the value Log(1/Em) obtained from an exposure amount (Em) which gives a magenta density of 0.6, on the characteristic curves of yellow and magenta images obtained by color development processing after exposure to a laser light source having the shortest wavelength).

(22) The silver halide color photographic light-sensitive material for laser exposure according to the above item (21), having a yellow image-forming layer which contains a silver halide emulsion composed of silver halide grains having on the surface thereof a phase containing silver iodide at a maximum concentration.

(Hereinafter, a third embodiment of the present invention means to include the image-forming method or the silver halide color photographic light-sensitive material described in the items (18) to (22) above.)

(23) An image-forming method that comprises:

exposing a silver halide color photographic light-sensitive material, comprising, on a support, at least one blue-sensitive silver halide emulsion layer, at least one green-sensitive silver halide emulsion layer, and at least one red-sensitive silver halide emulsion layer; and then subjecting the exposed light-sensitive material to color development processing, wherein the said blue-sensitive silver halide emulsion layer includes silver halide grains having a silver chloride content of 90 mole % or more and a silver iodide content of 0.02 to 1 mole %, and wherein the said silver halide color photographic light-sensitive material is exposed to at least blue semiconductor laser having a wavelength of 430 to 450 nm.

(24) The image-forming method according to the above item (23), wherein the said blue-sensitive silver halide emulsion layer includes silver halide grains having a silver iodide-containing phase with a profile in which the iodide concentration decreases in the direction from the grain surface to inner portion.

(25) The image-forming method according to the above item (23) or (24), wherein the said one blue-sensitive silver halide emulsion layer includes silver halide grains in which the iodide concentration on the silver halide grain surface is 0.7 mole % or more of the silver concentration on the grain surface.

(26) An image-forming method that comprises:

exposing a silver halide color photographic light-sensitive material, comprising, on a support, at least one blue-sensitive silver halide emulsion layer, at least one green-sensitive silver halide emulsion layer, and at least one red-sensitive silver halide emulsion layer; and then subjecting the exposed light-sensitive material to color development processing, wherein the said blue-sensitive silver halide emulsion layer includes silver halide grains having a silver chloride content of 90 mole % or more and a silver bromide content of 0.1 to 7 mole %, and wherein the said silver halide color photographic light-sensitive material is exposed to at least blue semiconductor laser having a wavelength of 430 to 450 nm.

(27) The image-forming method according to the above item (26), wherein the said blue-sensitive silver halide emulsion layer contains silver halide grains having a silver bromide-containing phase providing a maximum of the bromide concentration in the inside of the grain.

(28) An image-forming method that comprises:

exposing a silver halide color photographic light-sensitive material, comprising, on a support, at least one blue-sensitive silver halide emulsion layer, at least one green-sensitive silver halide emulsion layer, and at least one red-sensitive silver halide emulsion layer; and then subjecting the exposed light-sensitive material to color development processing, wherein the said blue-sensitive silver halide emulsion layer includes silver halide grains having a silver chloride content of 90 mole % or more, a silver iodide content of 0.02 to 1 mole %, and a silver bromide content of 0.1 to 7 mole %, wherein the said silver halide grains further have a silver iodide-containing phase with a profile in which the iodide ion concentration decreases in the direction from the grain surface to inner portion and a silver bromide-containing phase providing a maximum of the bromide concentration in the inner portion of the grain, and wherein the said silver halide color photographic light-sensitive material is exposed to at least blue semiconductor laser having a wavelength of 430 to 450 nm.

(29) The image-forming method according to the above item (28), wherein the said blue-sensitive silver halide emulsion layer includes silver halide grains in which the silver bromide-containing phase is formed more internally in the grain than the silver iodide-containing phase.

(30) The image-forming method according to any one of the above items (23) to (25), (28) and (29), wherein the said blue-sensitive silver halide emulsion layer includes silver halide grains in which the silver iodide-containing phase is formed by addition of silver iodide fine grains. (31) The image-forming method according to any one of the above items (26) to (29), wherein the silver bromide-containing phase in the said silver halide grains is formed by addition of silver bromide fine grains.

(32) An image-forming method that comprises:

exposing a silver halide color photographic light-sensitive material, comprising, on a support, at least one blue-sensitive silver halide emulsion layer, at least one green-sensitive silver halide emulsion layer, and at least one red-sensitive silver halide emulsion layer; and then subjecting the exposed light-sensitive material to a color development processing, wherein the said blue-sensitive silver halide emulsion layer includes a silver halide emulsion in which silver halide grains have a silver chloride content of 90 mole % or more, and a six-coordinate complex having Ir as a central metal, and having Cl, Br or I as a ligand, and wherein the said silver halide color photographic light-sensitive material is exposed to at least blue semiconductor laser having a wavelength of 430 to 450 nm.

(33) The image-forming method according to the above item (32), wherein the said blue-sensitive silver halide emulsion layer includes silver halide grains having a silver chloride content of 90 mole % or more, a silver iodide content of 0.02 to 1 mole %, and a silver bromide content of 0.1 to 7 mole %; wherein the said silver halide grains further have a silver iodide-containing phase with a profile in which the iodide concentration decreases in the direction from the grain surface to inner portion, and a silver bromide-containing phase providing a maximum of the bromide concentration in the inner portion of the grain.

(34) The image-forming method according to any one of the above items (23) to (33), wherein 50% or more in the projected area of all silver halide grains in the said blue-sensitive silver halide emulsion layer is occupied by tabular grains having an aspect ratio of 2 or more, an average thickness of less than 0.3 $\mu$m, and {111} plane as the major face.

(35) The image-forming method according to any one of the above items (23) to (33), wherein 50% or more in the projected area of all silver halide grains in the said blue-sensitive silver halide emulsion layer is occupied by tabular grains having an aspect ratio of 2 or more, an average thickness of less than 0.3 $\mu$m, and {100} plane as the major face.

(36) An image-forming method that comprises:

exposing a silver halide color photographic light-sensitive material, comprising, on a support, at least one blue-sensitive silver halide emulsion layer, at least one green-sensitive silver halide emulsion layer, and at least one red-sensitive silver halide emulsion layer; and then subjecting the exposed light-sensitive material to color development processing, wherein the said red-sensitive silver halide emulsion layer includes silver halide grains having a silver chloride content of 90 mole % or more, a silver iodide content of 0.02 to 1 mole %, and a silver bromide content of 0.1 to 7 mole %, wherein the said silver halide grains further have a silver iodide-containing phase with a profile in which the iodide concentration decreases in the direction from the grain surface to inner portion and a silver bromide-containing phase providing a maximum of the bromide concentration in the inner portion of the grain, and wherein the said silver halide color photographic light-sensitive material is exposed to at least red semiconductor laser having a wavelength of 620 to 670 nm.

(37) The image-forming method according to any one of the preceding items (23) to (36), wherein the said red-sensitive silver halide emulsion layer includes silver halide grains having a silver chloride content of 90 mole % or more, a silver iodide content of 0.02 to 1 mole %, and a silver bromide content of 0.1 to 7 mole %; wherein the said silver halide grains further have a silver iodide-containing phase with a profile in which the iodide concentration decreases in the direction from the grain surface to inner portion, and a silver bromide-containing phase providing a maximum of the bromide concentration in the inner portion of the grain, and wherein the said silver halide color photographic light-sensitive material is exposed to at least red semiconductor laser having a wavelength of 620 to 670 nm.

(38) The image-forming method according to the above items (36) or (37), wherein the said red-sensitive silver halide emulsion layer includes silver halide grains in which the silver bromide-containing phase is formed more internally in the grain than the silver iodide-containing phase.

(39) The image-forming method according to any one of the preceding items (36) to (38), wherein the said red-sensitive silver halide emulsion layer contains a six-coordinate complex having Ir as a central metal, and having Cl, Br or I as a ligand.

(40) The image-forming method according to any one of the preceding items (23) to (39), wherein the light-sensitive material is exposed to blue, green, and red light, for 5 microseconds or less per pixel, with resolution of 200 dpi or more, and then it is developed with a 40° C. or more developer solution, for a total wetting time of 100 seconds or less.

(41) The image-forming method according to any one of the preceding items (23) to (40), wherein development processing is started within 10 seconds after exposure.

(Hereinafter, a fourth embodiment of the present invention means to include the image-forming method described in the items (23) to (41) above.)

Herein, the present invention means to include all of the above first, second, third and fourth embodiments, unless otherwise specified.

The present invention is explained in detail below.

The blue exposure light source for use in the present invention, preferably in the first embodiment, is a semiconductor laser of a wavelength shorter by 30 nm to 60 nm, preferably 35 nm to 55 nm, and more preferably 40 nm to 50 nm, than the wavelength of the blue sensitivity maximum. For example, if a wavelength of the maximum blue sensitivity is 480 nm, exposure is conducted using a semiconductor laser with a wavelength of 420 nm to 450 nm. The blue semiconductor laser is described in detail in a report presented by NICHIA CORPORATION in the 48th Meeting of the Japan Society of Applied Physics and Related Societies in March in 2001.

As the red and green light sources for exposure for use in the present invention, preferably in the first embodiment, preferred are monochromatic high density light sources such as a gas laser, a light-emitting diode, a semiconductor laser and a second harmonic generation light source (SHG) comprising a combination of nonlinear optical crystal with a solid state laser using a semiconductor laser as an excitation light source. A semiconductor laser or SHG light source is more preferable to make a system more compact and inexpensive. Particularly a semiconductor laser is preferable for designing a considerably compact and inexpensive apparatus having a longer duration of life and high stability.

The red exposure light source for use in the present invention, preferably in the first embodiment, is preferably a red semiconductor laser of a wavelength shorter by 40 nm to 80 nm than the maximum red sensitivity wavelength. These light sources are already available on the market. Specifically, it is preferred to use semiconductor lasers such as AlGaInP (the oscillation wavelength: about 680 nm; Type No. LN9R20 (trade name), manufactured by Matsushita Electric Industrial Co., Ltd.), (the oscillation wavelength: about 650 nm; Type No. HL6501MG (trade name), manufactured by Hitachi, Ltd.), or (the oscillation wavelength: about 685 nm; ML101J10 (trade name), manufactured by Mitsubishi Electric Corporation), and GaAlAs (the oscillation wavelength: 780 nm; HL7859MG (trade name), manufactured by Hitachi, Ltd.).

As the green exposure light source for use in the present invention, preferably in the first embodiment, it is preferable to use laser light sources such as a green laser at 532 nm obtained by wavelength modulation of $YVO_4$ solid state laser (the oscillation wavelength: 1064 nm) using as an excitation light source a semiconductor laser GaAlAs (the oscillation wavelength: 808.7 nm) with an SHG crystal of $LiNbO_3$ having an inverting domain structure.

In present invention, it is preferable for sharp image to conduct exposure with resolution of 200 dpi or more, more preferably 400 dpi or more, and especially preferably 600 dpi or more. The term "dpi" means the number of pixels per inch.

The exposure time in such a scanning exposure is defined as the time necessary to expose the size of pixel with the density of the picture element being 400 dpi, and preferred exposure time is $10^{-4}$ sec or less, and more preferably $10^{-6}$ sec or less.

In the present invention, the term "total wetting time" means a period of time required from the beginning of dipping of the exposed light-sensitive material into a developing solution until completion of a washing step through a bleach-fixing solution (i.e., a period of time just until the light-sensitive material begins to be conveyed toward a drying step).

The total wetting time is 180 seconds at the highest (preferably 180 to 10 seconds), preferably 100 seconds or less (preferably 100 to 10 seconds), and more preferably 70 seconds or less (preferably 70 to 15 seconds). The developing time in the total wetting time is 45 seconds at the highest (preferably 45 to 3 seconds), preferably 30 seconds or less (preferably 30 to 3 seconds), more preferably 20 seconds or less (preferably 20 to 3 seconds), and especially preferably 5 seconds or more but 15 seconds or less.

The temperature of the developing solution is in the range of 30° C. to 60° C., especially preferably 40° C. to 50° C.

From the viewpoint of productivity, a period of time required from "just after exposure" to until dipping into a developing solution" is preferably within 10 seconds (preferably 10 to 1 seconds), more preferably 2 seconds or more but 8 seconds or less.

In the present invention, preferably in the first embodiment, the a blue-sensitive silver halide emulsion of the light-sensitive material comprises at least one blue-sensitive sensitizing dye represented by formula (B-I). Most preferably, all blue-sensitive sensitizing dyes in the blue-sensitive silver halide emulsion are ones represented by formula (B-I). Compounds represented by formula (B-I) according to the present invention are explained in detail below.

In the present invention, when a specified moiety is referred to as "group", the moiety embraces ones that are not substituted or substituted with one or more (up to possible maximum numbers of) substituents. For example, the term "alkyl group" means a substituted or unsubstituted alkyl group. Further, the substituent that can be used for the compound according to the present invention, embraces any kinds of substituents regardless of presence or absence of additional substituents.

Here, the substituent is designated as v. Examples of the substituent represented by V include a halogen atom, an alkyl group [including an alkyl group (including a cycloalkyl group and a bicycloalkyl group), an alkenyl group (including a cycloalkenyl group and a bicycloalkenyl group), and an alkynyl group], an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an ammonio group, an acylamino group, an aminocarbonylamino group, an alkoxycarbonylamino group, an aryloxycarbonylamino group, a sulfamoylamino group, an alkyl- or aryl-sulfonylamino group, a mercapto group, an alkylthio group, an arylthio group, a heterocyclic thio group, a sulfamoyl group, a sulfo group, an alkyl- or aryl-sulfinyl group, an alkyl- or aryl-sulfonyl group, an acyl group, an alkoxycarbonyl group, an aryloxycarbonyl group, a carbamoyl group, an aryl azo group and a heterocyclic azo group, an imido group, a phosphino group, a phosphinyl group, a phosphinyloxy group, a phosphinylamino group, a phospho group, a silyl group, a hydrazino group, an ureido group, and other conventionally known substituents.

More specifically, V represents a halogen atom (e.g., fluorine, chlorine, bromine, iodine); an alkyl group {represents a straight- or branched-chain or cyclic, substituted or unsubstituted alkyl group; examples include an alkyl group (preferably an alkyl group having 1 to 30 carbon atoms, e.g., methyl, ethyl, n-propyl, isopropyl, t-butyl, n-octyl, eicosyl, 2-chloroethyl, 2-cyanoethyl, and 2-ethylhexyl), a cycloalkyl group (preferably a substituted or unsubstituted cycloalkyl group having 3 to 30 carbon atoms, e.g., cyclohexyl, cyclopentyl, and 4-n-dodecyl cyclohexyl), a bicycloalkyl group (preferably a substituted or unsubstituted bicycloalkyl group having 5 to 30 carbon atoms, e.g. bicyclo[1,2,2]heptane-2-yl and bicyclo[2,2,2]octane-3-yl), and those having polycyclic structures -such as a tricyclo structure; in the present specification, the alkyl groups constituting the below mentioned substituents (e.g., the alkyl group of an alkylthio group) includes the below-explained alkenyl, cycloalkenyl, bicycloalkenyl, alkynyl groups and the like, in addition to the alkyl groups based on the above-described concept}; an alkenyl group {(represents a straight- or branched-chain or cyclic, substituted or unsubstituted alkenyl group; examples include an alkenyl group (an alkenyl group having 2 to 30 carbon atoms, e.g., vinyl, allyl, prenyl, geranyl, oleyl), a cycloalkenyl group (preferably a substituted or unsubstituted monocyclic cycloalkenyl group having 3 to 30 carbon atoms, e.g., 2-cyclopentene-1-yl, 2-cyclohexene-1-yl), a bicycloalkenyl group (a substituted or unsubstituted bicycloalkenyl group, preferably those having 5 to 30 carbon atoms, e.g., bicyclo[2,2,1]hepto-2-ene-1-yl and bicyclo[2,2,2]octo-2-ene-4-yl)}; an alkynyl group (preferably a substituted or unsubstituted alkynyl group having 2 to 30 carbon atoms, e.g., ethynyl, propargyl, trimethylsilylethynyl); an aryl group (preferably a substituted or unsubstituted aryl group having 6 to 30 carbon atoms, e.g., phenyl, p-tolyl, naphthyl, m-chlorophenyl, o-hexadecanoylaminophenyl); a heterocyclic group (preferably a monovalent group formed by eliminating a hydrogen atom from a 5- or 6-membered, substituted or unsubstituted, aromatic or nonaromatic heterocyclic compound; more preferably a 5- or 6-membered, aromatic heterocyclic group having 3 to 30 carbon atoms, for example, 2-furyl, 2-thienyl, 2-pyrimidinyl, and 2-benzothiazolyl; further 1-methyl-2-pyridinio and 1-methyl-2-quinolinio can be used); a cyano group; a hydroxyl group; a nitro group; a carboxyl group; an alkoxy group (preferably a substituted or unsubstituted alkoxyl group having 1 to 30 carbon atoms, e.g., methoxy, ethoxy, isopropoxy, t-butoxy, n-octyloxy, 2-methoxyethoxy); an aryloxy group (preferably a substituted or unsubstituted aryloxy group having 6 to 30 carbon atoms, e.g., phenoxy, 2-methylphenoxy, 4-t-buthylphenoxy, 3-nitrophenoxy, 2-tetradecanoylaminophenoxy); a silyloxy group (preferably a silyloxy group having 3 to 20 carbon atoms, e.g., trimethylsilyloxy, t-butyldimethylsilyloxy); a heterocyclic oxy group (preferably a substituted or unsubstituted heterocyclic oxy group having 2 to 30 carbon atoms, e.g., 1-phenyltetrazole-5-oxy, 2-tetrahydropyranyloxy); an acyloxy group (preferably formyloxy, a substituted or unsubstituted alkylcarbonyloxy group having 2 to 30 carbon atoms, a substituted or unsubstituted arylcarbonyloxy group having 6 to 30 carbon atoms, e.g., formyloxy, acetyloxy, pivaloyloxy, stearoyloxy, benzoyloxy, p-methoxyphenylcarbonyloxy); a carbamoyloxy group (preferably a substituted or unsubstituted carbamoyloxy group having 1 to 30 carbon atoms, e.g., N,N-dimethylcarbamoyloxy, N,N-diethylcarbamoyloxy, morpholino carbonyloxy, N,N-di-n-octylaminocarbonyloxy, N-n-octylcarbamoyloxy); an alkoxycarbonyloxy group (preferably a substituted or unsubstituted alkoxycarbonyloxy group having 2 to 30 carbon atoms, e.g., methoxycarbonyloxy, ethoxycarbonyloxy, t-butoxy carbonyloxy, n-octylcarbonyloxy); an aryloxycarbonyloxy group (preferably a substituted or unsubstituted aryloxycarbonyloxy group having 7 to 30 carbon atoms, e.g., phenoxycarbonyloxy, p-methoxy phenoxycarbonyloxy, p-n-hexadecyloxyphenoxy carbonyloxy); an amino group (preferably an amino group, a substituted or unsubstituted alkylamino group having 1 to 30 carbon atoms, a substituted or unsubstituted anilino group having 6 to 30 carbon atoms, e.g., amino, methylamino, dimethylamino, anilino, N-methylanilino, diphenylamino), an ammonio group (preferably a substituted or unsubstituted ammonio group having 1 to 30 carbon atoms, to which an alkyl, aryl, or heterocyclic group is substituted, e.g., trimethylammonio, triethylammonio, diphenylmethylammonio), an acylamino group (preferably formylamino group, a substituted or unsubstituted alkylcarbonylamino group having 1 to 30 carbon atoms, a substituted or unsubstituted arylcarbonylamino group having 6 to 30 carbon atoms, e.g., formylamino, acetylamino, pivaloylamino, lauroylamino, benzoylamino and 3,4,5-tri-n-octyloxyphenylcarbonylamino); an aminocarbonylamino group (preferably a substituted or unsubstituted aminocarbonylamino group having 1 to 30 carbon atoms, e.g., carbamoylamino, N,N-dimethylaminocarbonylamino, N,N-diethylamino carbonylamino, morpholinocarbonylamino), an alkoxycarbonylamino group (preferably a substituted or unsubstituted alkoxycarbonylamino group having 2 to 30 carbon atoms, e.g., methoxycarbonylamino, ethoxycarbonylamino, t-butoxycarbonylamino, n-octadecyloxycarbonylamino, N-methylmethoxycarbonylamino); an aryloxycarbonylamino group (preferably a substituted or unsubstituted aryloxycarbonylamino group having 7 to 30 carbon atoms, e.g., phenoxycarbonylamino, p-chlorophenoxycarbonylamino, m-(n-octyloxy)phenoxycarbonyl amino); a sulfamoyl amino group (preferably a substituted or unsubstituted sulfamoylamino group having 0 to 30 carbon atoms, e.g., sulfamoylamino, N,N-dimethylaminosulfonylamino, N-n-octyl aminosulfonylamino); an alkyl- or aryl-sulfonylamino group (preferably a substituted or unsubstituted alkylsulfonylamino group having 1 to 30 carbon atoms, and a substituted or unsubstituted aryl-sulfonylamino group having 6 to 30 carbon atoms, e.g., methylsulfonylamino, butylsulfonylamino, phenylsulfonylamino, 2,3,5-trichlorophenylsulfonylamino, p-methylphenylsulfonylamino); a mercapto group; an alkylthio group (preferably a substituted or unsubstituted alkylthio group having 1 to 30 carbon atoms, e.g., methylthio, ethylthio, n-hexadecylthio), an arylthio group (preferably a substituted or unsubstituted arylthio group having 6 to 30 carbon atoms, e.g., phenylthio, p-chlorophenylthio, m-methoxyphenylthio); a heterocyclic thio group (preferably a substituted or unsubstituted heterocyclic thio group having 2 to 30 carbon atoms, e.g., 2-benzothiazolylthio, 1-phenyltetrazol-5-ylthio); a sulfamoyl group (preferably a substituted or unsubstituted sulfamoyl group having 0 to 30 carbon atoms, e.g., N-ethylsulfamoyl, N-(3-dodecyloxypropyl)sulfamoyl, N,N-dimethyl sulfamoyl, N-acetylsulfamoyl, N-benzoylsulfamoyl, N-(N'-phenylcarbamoyl)sulfamoyl); a sulfo group; an alkyl- or aryl-sulfinyl group (preferably a substituted or unsubstituted alkylsulfinyl group having 1 to 30 carbon atoms, and a substituted or unsubstituted arylsulfinyl group having 6 to 30 carbon atoms, e.g., methylsulfinyl, ethylsulfinyl, phenylsulfinyl, p-methylphenylsulfinyl); an alkyl- or aryl-sulfonyl group (preferably a substituted or unsubstituted alkyl sulfonyl group having 1 to 30 carbon atoms, and a substituted or unsubstituted arylsulfonyl group having 6 to 30 carbon atoms, e.g., methylsulfonyl, ethylsulfonyl, phenylsulfonyl, p-methylphenylsulfonyl); an acyl group (preferably a formyl group, a substituted or unsubstituted alkylcarbonyl group having 2 to 30 carbon atoms, a substituted or unsubstituted arylcarbonyl group having 7 to 30 carbon atoms, and a substituted or unsubstituted heterocyclic carbonyl group having 4 to 30 carbon atoms, which bonds to the carbonyl group via its carbon atom, e.g., acetyl, pivaloyl, 2-chloroacetyl, stearoyl, benzoyl, p-n-octyloxyphenylcarbonyl, 2-pyridylcarbonyl, 2-furylcarbonyl); an aryloxycarbonyl group (preferably a substituted or unsubstituted aryloxycarbonyl group having 7 to 30 carbon atoms, e.g., phenoxycarbonyl, o-chlorophenoxycarbonyl, m-nitrophenoxycarbonyl, p-t-butylphenoxycarbonyl); an alkoxycarbonyl group (preferably a substituted or unsubstituted alkoxycarbonyl group having 2 to 30 carbon atoms, e.g., methoxycarbonyl, ethoxycarbonyl, t-butoxycarbonyl, n-octadecyloxycarbonyl); a carbamoyl group (preferably a substituted or unsubstituted carbamoyl group having 1 to 30 carbon atoms, e.g., carbamoyl, N-methylcarbamoyl, N,N-dimethylcarbamoyl, N,N-di-n-octylcarbamoyl, N-(methylsulfonyl)carbamoyl); an aryl azo group or heterocyclic azo group (preferably a substituted or unsubstituted aryl azo group having 6 to 30 carbon atoms, and a substituted or unsubstituted heterocyclic azo group having 3 to 30 carbon atoms, e.g., phenylazo, p-chlorophenylazo, 5-ethylthio-1,3,4-thiadiazole-2-yl azo); an imido group (preferably N-succinimido, N-phthalimido); a phosphino group (preferably a substituted or unsubstituted phosphino group having 2 to 30 carbon atoms, e.g., dimethylphosphino, diphenylphosphino, methylphenoxyphosphino); a phosphinyl group (preferably a substituted or unsubstituted phosphinyl group having 2 to 30 carbon atoms, e.g., phosphinyl, dioctyloxyphosphinyl, diethoxyphosphinyl); a phosphinyloxy group (preferably a substituted or unsubstituted phosphinyloxy group having 2 to 30 carbon atoms, e.g., diphenoxyphosphinyloxy, dioctyloxyphosphinyloxy); a phosphinylamino group (preferably a substituted or unsubstituted phosphinylamino group having 2 to 30 carbon atoms, e.g., dimethoxyphosphinylamino, dimethylamino phosphinylamino); a phospho group; a silyl group (preferably a substituted or unsubstituted silyl group having 3 to 30 carbon atoms, e.g., trimethylsilyl, t-butyldimethylsilyl, phenyldimethylsilyl); a hydrazino group (preferably a substituted or unsubstituted hydrazino group having 0 to 30 carbon atoms, e.g., trimethylhydrazino), or an ureido group (preferably a substituted or unsubstituted ureido group having 0 to 30 carbon atoms, e.g., N,N-dimethylureido).

Further, two V's may combine together to form a condensed ring structure. The ring is an aromatic or non-aromatic hydrocarbon ring or heterocyclic ring. These rings may be further combined together to form a poly cyclic condensed ring. Examples of these rings include rings of benzene, naphthalene, anthracene, quinoline, phenanthrene, fluorene, triphenylene, naphthacene, biphenyl, pyrrole, furan, thiophene, imidazole, oxazole, thiazole, pyridine, pyrazine, pyrimidine, pyridazine, indolizine, indole, benzofuran, benzothiophene, isobenzofuran, quinolizine, isoquinoline, phthalazine, naphthyridine, quinoxaline, quinoxazoline, carbazole, phenanthridine, acridine, phenanthoroline, thianthrene, chromene, xanthene, phinoxthine, phenothiazine and phenazine.

Among the above-mentioned substituents V, ones having one or more hydrogen atoms may be removed the hydrogen atom(s) and may be further substituted with the above-mentioned group(s). Examples of these complex substituents include an acylsulfamoyl group and an alkyl and aryl sulfonylcarbamoyl group. Specific examples of these groups include a methylsulfonylcarbamoyl group, a p-methylphenylsulfonylcarbamoyl group, an acetylsulfamoyl group and a benzoylsulfamoyl group.

The methine dyes represented by formula (B-I) for use in the present invention are explained below in detail.

In the case where Y is a group of atoms necessary to form a benzene ring, the benzene ring may condense with another 5- or 6-membered hydrocarbon ring or heterocyclic ring to form a condensed ring such as rings of naphthalene, anthracene, phenanthrene, indole, benzofuran and benzothiophene.

In the case where Y is a group of atoms necessary to form a heterocyclic ring, Y means a 3- to 8-membered, preferably 5- or 6-membered heterocyclic ring, which contains therein at least one hetero atom such as atoms of nitrogen, oxygen, sulfur, phosphorus, selenium and tellurium. Examples of the 5-membered unsaturated heterocyclic ring that is formed by Y include rings of pyrrole, pyrazole, imidazole, triazole, furan, oxazole, isooxazole, thiophene, thiazole, isothiazole, thiadiazole, selenophene, selenazole, isoselenazole, tellurophene, tellurazole and isotellurazole. Examples of the 6-membered unsaturated heterocyclic ring that is formed by Y include rings of pyridine, pyridazine, pyrimidine, pyrazine, pyran and thiopyran. These unsaturated heterocyclic rings may condense with another 5- or 6-membered hydrocarbon ring or heterocyclic ring to form a condensed ring such as rings of indole, benzofuran, benzothiophene and thienothiophene. The heterocyclic ring that is formed by Y may be unsaturated heterocyclic rings in which a part of double bonds is subjected to hydrogenation, such as rings of pyrroline, pyrazoline, imidazololine, dihydrofuran, oxazoline, dihydrothiophene and thiazoline. Further, the heterocyclic ring that is formed by Y may be saturated heterocyclic rings in which all double bonds are subjected to hydrogenation, such as rings of pyrrolidine, pyrazolidine, imidazolidine, tetrahydrofuran, oxazolidine, tetrahydrothiophene and thiazolidine.

Among these rings formed by Y, preferred are benzene, naphthalene, pyrrole, furan, thiophene, indole, benzofuran and benzothiophene, more preferably benzene, pyrrole, thiophene and furan, and further more preferably benzene and thiophene.

In formula (B-I), when the rings formed by Y are selected from pyrrole, furan and thiophene, a configuration of condensation of the ring (Y) is not particularly limited. Taking the thiophene ring as an example, there are a thieno[3,2-d]thiazole type condensation in which a sulfur atom of the thiophene ring is on the same side as a sulfur atom of the thiazole ring to the condensation carbon-carbon bond, a thieno[2,3-d]thiazole type condensation in which a sulfur atom of the thiophene ring is on the opposite side to a sulfur atom of the thiazole ring, and a thieno[3,4-d]thiazole type condensation in which a thiophene ring is condensed with the thiazole ring at the 3- or 4-position of the thiophene ring. Among the above-mentioned three-type condensation, the former two are preferable. In the case where a spectral absorption with a long wavelength is needed to a sensitizing dye, the thieno[2,3-d]thiazole type condensation is particularly preferable.

The rings formed by Y may have a substituent. Examples of the substituent are the same as the above-listed examples of the substituent represented by V. As the substituent V, preferred are the above-mentioned alkyl group, aryl group, aromatic heterocyclic group, alkylthio group, cyano group and halogen atom.

It is particularly preferable that a substituent is present on the ring formed by Y. The substituent is preferably an alkyl group (such as methyl), an aryl group (such as phenyl), an aromatic heterocyclic group (such as 1-pyrrolyl), an alkoxy group (such as methoxy), an alkylthio group (such as methylthio), a cyano group and a halogen atom (such as fluorine, chlorine, bromine, iodine), more preferably a halogen atom and especially preferably a chlorine atom and a bromine atom.

Examples of the substituent each represented by $V^1$, $V^2$, $V^3$ and $V^4$ are the same as the above-listed examples of the substituent represented by V. $V^1$ and $V^4$ are preferably a hydrogen atom. $V^2$ and $V^4$ are preferably a hydrogen atom an alkyl group (such as methyl), an aryl group (such as phenyl), an aromatic heterocyclic group (such as 1-pyrrolyl), an alkoxy group (such as methoxy), an alkylthio group (such as methylthio), a cyano group and a halogen atom (such as fluorine, chlorine, bromine, iodine). $V^3$ is more preferably a halogen atom. $V^2$ is more preferably a halogen atom, especially preferably a chlorine atom and a bromine atom.

The alkyl group represented by $R^1$ and $R^2$ may be an unsubstituted or substituted alkyl group. Examples of the alkyl group include unsubstituted alkyl groups having 1 to 18 carbon atoms, preferably 1 to 7 carbon atoms, especially preferably 1 to 4 carbon atoms (such as methyl, ethyl, propyl, isopropyl, butyl, isobutyl, hexyl, octyl, dodecyl, octadecyl) and substituted alkyl groups having 1 to 18 carbon atoms, preferably 1 to 7 carbon atoms, especially preferably 1 to 4 carbon atoms. Examples of the substituent of the substituted alkyl groups are the same as the above-listed examples of the substituent represented by V (such as aryl groups, unsaturated hydrocarbon groups, a carboxyl group, a sulfo group, a sulfato group, a cyano group, halogen atoms (e.g., fluorine, chlorine, bromine, iodine), a hydroxyl group, a mercapto group, alkoxy groups, aryloxy groups, alkylthio groups, arylthio groups, acyl groups, alkoxycarbonyl groups, aryloxycarbonyl groups, acyloxy groups, carbamoyl groups, sulfamoyl groups, heterocyclic groups, alkylsulfonylcarbamoyl groups, acylcarbamoyl groups, acylsulfamoyl groups and alkylsulfonylsulfamoyl groups. Further, these groups may be substituted.).

The aryl group represented by $R^1$ and $R^2$ may be an unsubstituted or substituted aryl group. Examples of the aryl group include unsubstituted aryl groups having 6 to 20 carbon atoms, preferably 6 to 15 carbon atoms, and further preferably 6 to 10 carbon atoms (such as phenyl, 1-naphthyl) and substituted aryl groups having 6 to 26 carbon atoms, preferably 6 to 21 carbon atoms, and further preferably 6 to 16 carbon atoms. Examples of the substituent of the substituted aryl groups are the same as the above-listed examples of the substituent represented by V (such as alkyl groups, aryl groups, unsaturated hydrocarbon groups, a carboxyl group, a sulfo group, a sulfato group, a cyano group, halogen atoms (e.g., fluorine, chlorine, bromine, iodine), a hydroxyl group, a mercapto group, alkoxy groups, aryloxy groups, alkylthio groups, arylthio groups, acyl groups, alkoxycarbonyl groups, aryloxycarbonyl groups, acyloxy groups, carbamoyl groups, sulfamoyl groups, heterocyclic groups, alkylsulfonylcarbamoyl groups, acylcarbamoyl groups, acylsulfamoyl groups and alkylsulfonylsulfamoyl groups. Further, these groups may be substituted.). Among these groups, a phenyl group is preferable.

The heterocyclic group represented by $R^1$ and $R^2$ may be an unsubstituted or substituted heterocyclic group. Examples of the heterocyclic group include unsubstituted heterocyclic groups having 1 to 20 carbon atoms, preferably 1 to 15 carbon atoms, and further preferably 1 to 10 carbon atoms (such as pyrrole, furan, thiophene) and substituted heterocyclic groups having 1 to 26 carbon atoms, preferably 1 to 21 carbon atoms, and further preferably 1 to 16 carbon atoms. Examples of the substituent of the substituted heterocyclic groups are the same as the above-listed examples of the substituent represented by V.

$R^1$ and $R^2$ are preferably a group substituted with an acid group or with a group having a dissociative proton (specifically a carboxyl group, a sulfo group, a phosphonic acid group, a bronic acid group, or —$CONHSO_2$—, —$SO_2NHSO_2$—, —CONHCO—, —$SO_2NHCO$—, or the like). More preferred are alkyl groups substituted with an acid group or with a group having a dissociative proton as mentioned above. Further more preferred are substituted alkyl groups containing any one of a carboxyl group, a sulfo group, an alkylsulfonylcarbamoyl group (such as methanesulfonylcarbamoyl group), an acylcarbamoyl group (such as acetylcarbamoyl group), an acylsulfamoyl group (such as acetylsulfamoyl group) and an alkylsulfonylsulfamoyl group (such as methanesulfonylsulfamoyl group). Particularly a carboxymethyl group, a 2-sulfoethyl group, a 3-sulfopropyl group, a 3-sulfobutyl group, a 4-sulfobutyl group and a methanesulfonylcarbamoylmethyl group are preferable.

It is most preferable that one of $R^1$ and $R^2$ is a 2-sulfoethyl group, a 3-sulfopropyl group, a 3-sulfobutyl group or a 4-sulfobutyl group, and another is a carboxymethyl group or a methanesulfonylcarbamoylmethyl group.

The methine group represented by L may have a substituent. Examples of the substituent are the same as the above-listed examples of the substituent represented by V. The methine group is preferably an unsubstituted one.

M in formula (B-I) is incorporated therein in order to show the presence of a cation or anion, when they are needed to neutralize an ionic charge of a dye. It depends on a substituent of a dye, or an environment (such as pH) in a dye solution, whether the dye becomes cationic or anionic, or the dye carries a net ionic charge. Typical examples of the cation include inorganic cations such as a hydrogen ion (H+), alkali metal ions (such as sodium, potassium, lithium ions), alkaline earth metal ions (such as calcium ion) and organic cations such as ammonium ions (such as ammonium, tetraalkyl ammonium, triethyl ammonium, pyridinium, ethyl pyridinium, 1,8-diazobicyclo [5,4,0]-7-undecenium ions). The anion may be inorganic or organic anions. Examples of the anion include halide anions (such as fluoride, chloride, bromide, iodide ions), substituted aryl sulfonic acid ions (such as p-toluene sulfonic acid, p-chlorobenzene sulfonic acid ions), aryldisulfonic acid ions (such as 1,3-benzenedisulfonic acid, 1,5-naphthalenedisulfonic acid, 2,6-naphthalenedisulfonic acid ions), alkylsulfuric acid ions (such as methyl sulfuric acid ion), a sulfuric acid ion, a thiocyanic ion, a perchloric acid ion, a tetrafluoroboric acid ion, a picric acid ion, an acetic acid ion and a trifluoromethane sulfonic acid ion. Further, ionic polymers or other dyes having a charge opposite to the primary dye may be used.

Preferable cations are sodium, potassium, triethyl ammonium, tetraethyl ammonium, pyridinium, ethyl pyridinium and methyl pyridinium ions. Preferable anions are a perchloric acid ion, an iodide ion, a bromide ion and substituted arylsulfonic acid ions (such as p-toluene sulfonic acid ion).

Further, m represents a number of 0 or more that is needed to balance a charge. When a dye forms an intramolecular salt, m is 0. m is preferably a number of 0 or more but 4 or less.

Specific examples of the compound represented by formula (B-I) for use in the present invention are shown below. However, the present invention is not construed as being limited to these compounds. In addition to the following compounds, the compounds represented by formula (B-I) may be chosen from the methine dyes S-1 to S-158 described in the specification of JP-A-2001-118281.

I-1

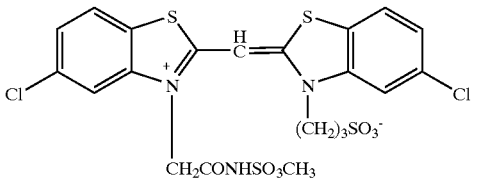

I-2

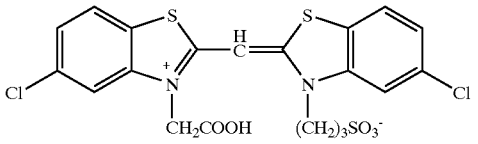

-continued
I-3
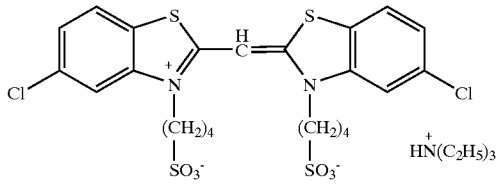
I-4
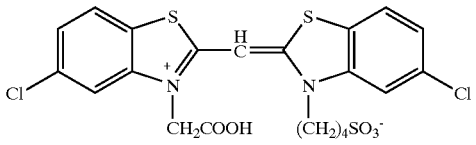
I-5
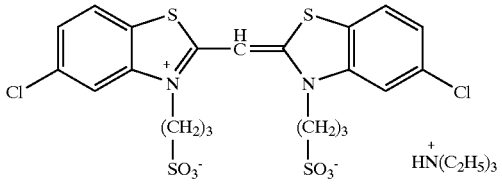
I-6
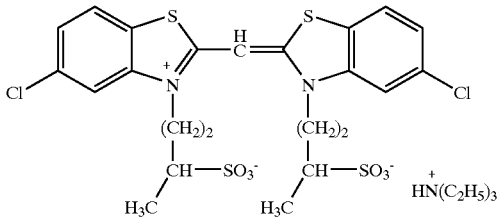
I-7
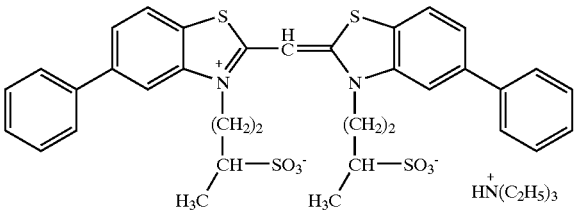
I-8
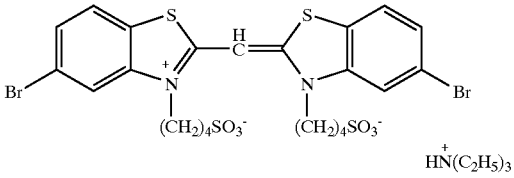
I-9
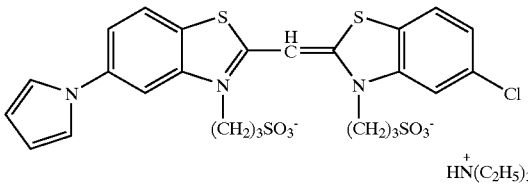
I-10
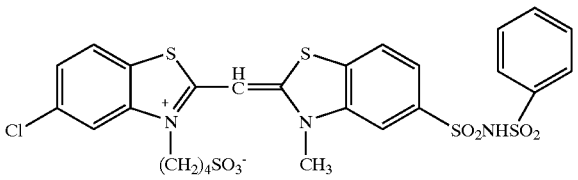
-continued
I-11
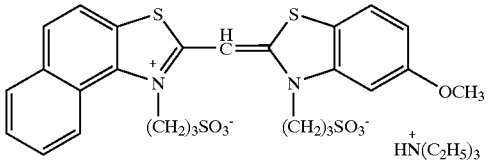
I-12
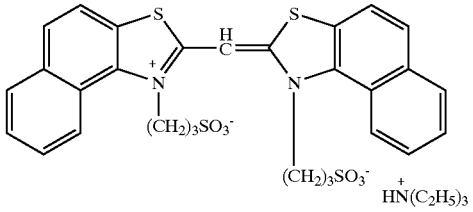
I-13
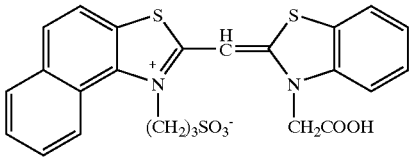
I-14
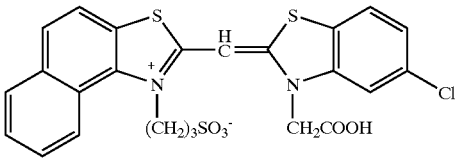
I-15
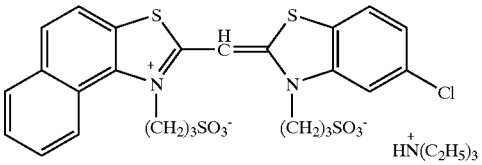
I-16
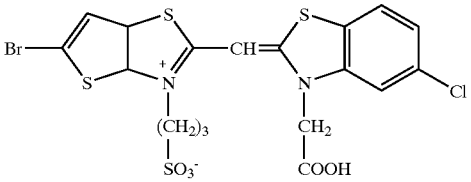
I-17
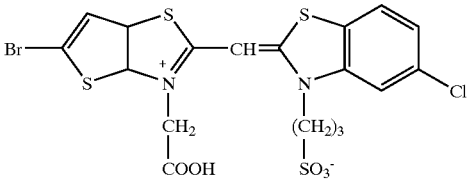
I-18
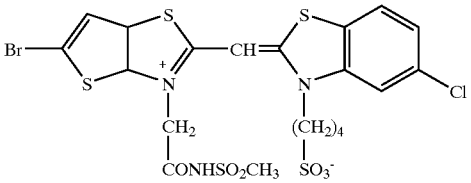

-continued
I-19
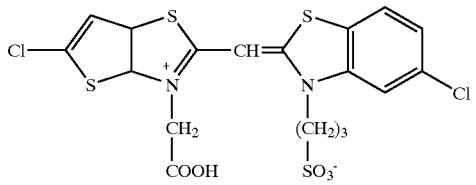
I-20
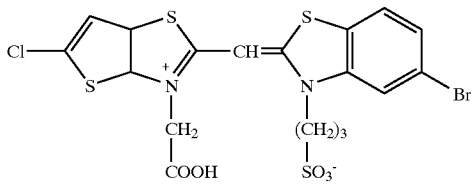
I-21
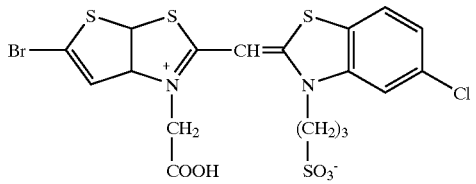
I-22
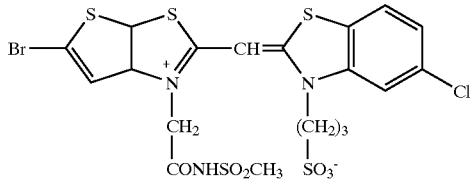
I-23
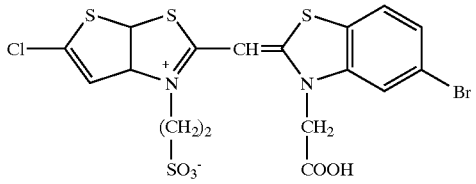
I-24
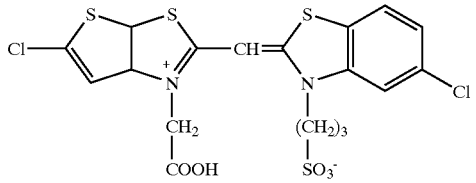
I-25
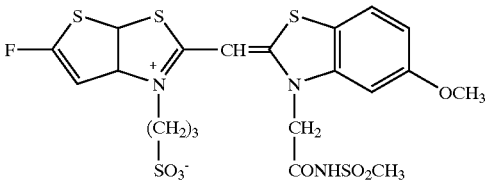
I-26
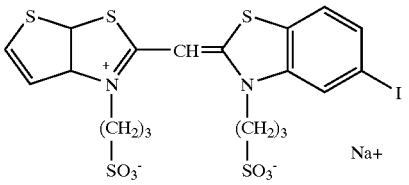
-continued
I-27
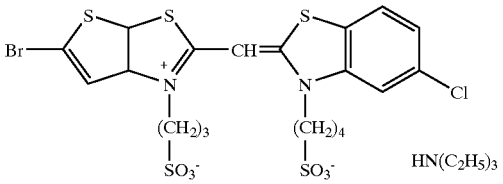
I-28
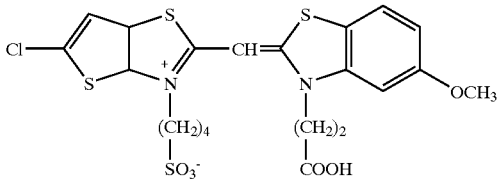
I-29
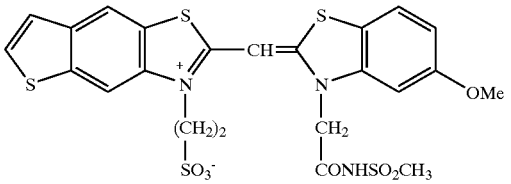
I-30
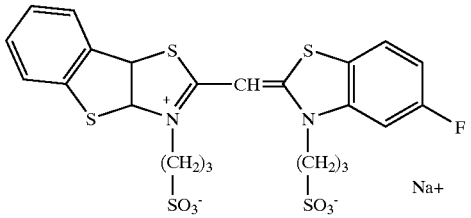
I-31
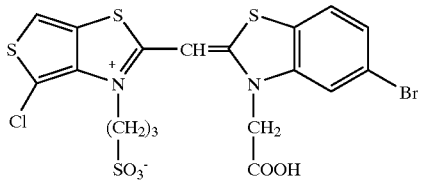
I-32
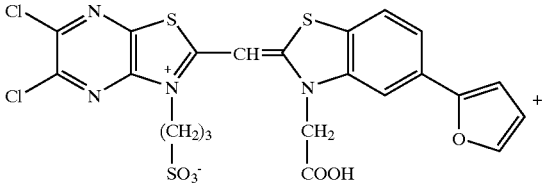
I-33
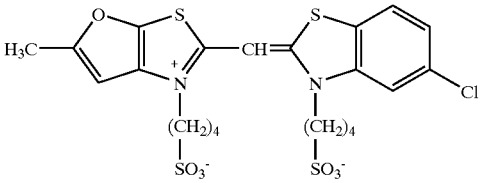
I-34
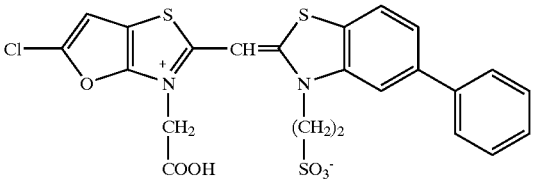

-continued

I-35

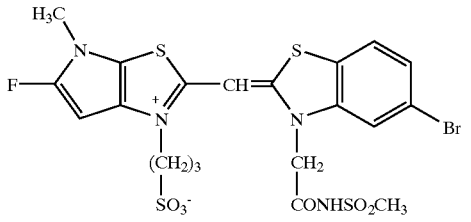

I-36

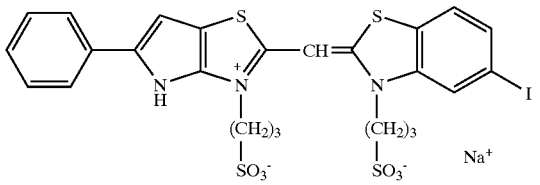

In the present invention, preferably in the first embodiment, a red-sensitive silver halide emulsion of the light-sensitive material preferably contains at least one red-sensitive sensitizing dye represented by formula (R-I). It is most preferable that each of the red-sensitive sensitizing dye in the red-sensitive silver halide emulsion is the red-sensitive sensitizing dye represented by formula (R-I).

The sensitizing dyes represented by formula (R-I) are explained in detail below.

$Z_1$ is preferably a sulfur atom. $Z_2$ is preferably an oxygen atom or a sulfur atom. $L_1$, $L_2$, $L_3$, $L_4$ and $L_5$ each independently represent a methine group that may be substituted with a substituent such as a substituted or unsubstituted alkyl group (such as methyl, ethyl), a substituted or unsubstituted aryl group (such as phenyl) and a halogen atom (such as chlorine, bromine). Further, two methine groups may combine together to form a 5- or 6-membered ring. It is particularly preferable that $L_2$ and $L_4$ combine together to form a 6-membered ring.

$R_1$ and $R_2$ each represent an alkyl group, and they may be same or different. Preferable examples of $R_1$ or $R_2$ include an unsubstituted alkyl group having 1 to 18 carbon atoms (e.g., methyl, ethyl, propyl, butyl, pentyl, octyl, decyl, dodecyl and octadecyl) and a substituted alkyl group {examples include an alkyl group having 1 to 18 carbons substituted by the following: carboxy group, sulfo group, cyano group, halogen atom (e.g., fluorine, chlorine or bromine atom), hydroxy group, alkoxycarbonyl group having 2 to 8 carbon atoms (e.g., methoxycarbonyl, ethoxycarbonyl, phenoxycarbonyl and benzyloxycarbonyl), alkoxy group having 1 to 8 carbon atoms (e.g., methoxy, ethoxy, benzyloxy and phenethyloxy), monocyclic aryloxy group having 6 to 10 carbon atoms (e.g., phenoxy and p-tolyloxy), acyloxy group having 2 to 8 carbon atoms (e.g., acetyloxy and propionyloxy), acyl group having 2 to 8 carbon atoms (e.g., acetyl, propionyl, benzoyl and mesyl), carbamoyl group having 1 to 8 carbon atoms (e.g., carbamoyl, N,N-dimethylcarbamoyl, morpholinocarbonyl and piperidinocarbonyl), sulfamoyl group having 0 to 8 carbon atoms (e.g., sulfamoyl, N,N-dimethylsulfamoyl, morpholinosulfonyl and piperidinosulfonyl) or aryl group having 6 to 10 carbon atoms (e.g., phenyl, 4-chlorophenyl, 4-methylphenyl and α-naphthyl)}. Particularly preferably, $R_1$ or $R_2$ represents an unsubstituted alkyl group (e.g., methyl, ethyl), sulfoalkyl group (e.g., a 2-sulfoethyl, 3-sulfopropyl, 4-sulfobutyl). Further, $R_1$ and $L_1$, and/or $R_2$ and $L_5$ may bond together to form a 5-membered or 6-membered carbocycle.

$V_1$, $V_2$, $V_3$, $V_4$, $V_5$, $V_6$, $V_7$ and $V_8$ each represent a hydrogen atom, a halogen atom (such as fluorine, chlorine, bromine), an unsubstituted alkyl group {more preferably an unsubstituted alkyl group having 1 to 10 carbon atoms (such as methyl, ethyl)}, a substituted alkyl group {more preferably a substituted alkyl group having 1 to 18 carbon atoms (such as benzoyl, α-naphthylmethyl, 2-phenylethyl, trifluoromethyl)}, an acyl group {more preferably an acyl group having 2 to 10 carbon atoms (such as acetyl, benzoyl, mesyl)}, an acyloxy group {(more preferably an acyloxy group having 2 to 10 carbon atoms (such as acetyloxy)}, an alkoxycarbonyl group {more preferably an alkoxycarbonyl group having 2 to 10 carbon atoms (such as methoxycarbonyl, ethoxycarbonyl, benzyloxycarbonyl)}, a substituted or unsubstituted carbamoyl group having 1 to 10 carbon atoms (such as carbamoyl, N,N-dimethylcarbamoyl, morpholinocarbonyl, piperidinocarbonyl), a substituted or unsubstituted sulfamoyl group having 0 to 10 carbon atoms (such as sulfamoyl, N,N-dimethylsulfamoyl, morpholinosulfonyl, piperidinocarbonyl), a carboxyl group, a cyano group, a hydroxyl group, an amino group, an acylamino group {more preferably, an acylamino group having 2 to 8 carbon atoms (such as acethylamino)}, an alkoxy group {more preferably, an alkoxy group having 1 to 10 carbon atoms (such as methoxy, ethoxy, benzyloxy)}, an alkylthio group {more preferably, an alkylthio group having 1 to 10 carbon atoms (such as ethylthio)}, an alkylsulfonyl group {more preferably, an alkylsulfonyl group having 1 to 10 carbon atoms (such as methylsulfonyl)}, a sulfonic acid group, an aryloxy group {more preferably, an aryloxy group having 6 to 10 carbon atoms (such as phenoxy)}, or an aryl group {more preferably, an aryl group having 6 to 10 carbon atoms (such as phenyl, tolyl)}. Further, two of $V_1$ to $V_8$, each of which binds to a carbon atom adjacent to each other, may combine together to form a condensed ring. Examples of the condensed ring include a benzene ring and a heterocyclic ring (such as pyrrole, thiophene, furan, pyridine, imidazole, triazole, thiazole).

$(Y^1)_s$ is incorporated in the formula in order to show the presence or absence of a cation or an anion, when they are needed to neutralize an ionic charge of the dye. Accordingly, s may be a value of 0 or more to be properly taken, if necessary. It depends on the auxochrome and the substituent of a dye, whether the dye becomes cationic or anionic, or otherwise the dye carries no net ionic charge. The counter ion $(Y^1)_s$ may be easily exchanged after production of the dye. Typical examples of the cation are inorganic or organic ammonium or alkali metal ions. However, the anion may be specifically inorganic or organic anion. Examples of the anion include halogen anions (such as fluorine ion, chlorine ion, bromine ion, iodine ion), substituted arylsulfonic acid ions (such as p-toluene sulfonic acid, p-chlorobenzene sulfonic acid ions), aryldisulfonic acid ions (such as 1,3-benzenedisulfonic acid, 1,5-naphthalenedisulfonic acid, 2,6-naphthalene disulfonic acid ions), alkylsulfuric acid ions (such as methylsulfuric acid ion), a sulfuric acid ion, a thiocyanic acid ion, a perchloric acid ion, a tetrafluoroboric acid ion, a picric acid ion, an acetic acid ion and a trifluoromethanesulfonic acid ion. Preferable acid ions are a p-toluene sulfonic acid ion and an iodide ion.

Specific examples of the compound represented by formula (R-I) are shown below. The present invention is not construed as being limited to these compounds.

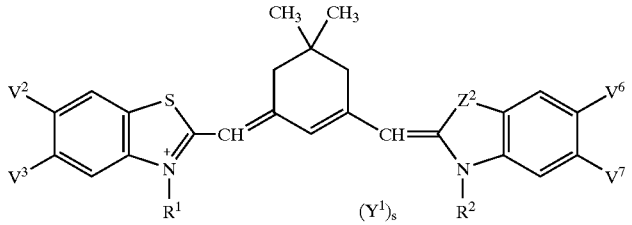

| Dye | $Z^2$ | $R^1$ | $R^2$ | $V^2$ | $V^3$ | $V^6$ | $V^7$ | $Y^1$ | s |
|---|---|---|---|---|---|---|---|---|---|
| S-1 | S | $CH_3CH_2$ | $CH_3CH_3$ | $CH_3$ | H | H | H | $I^-$ | 1 |
| S-2 | S | $CH_3CH_2$ | $CH_3CH_2$ | $CH_3$ | $CH_3$ | H | H | $I^-$ | 1 |
| S-3 | S | $CH_3CH_2$ | $CH_3CH_2$ | $CH_3$ | H | $CH_3$ | H | $I^-$ | 1 |
| S-4 | S | $CH_3CH_2$ | $CH_3CH_2$ | $CH_3$ | H | H | $CH_3$ | $I^-$ | 1 |
| S-5 | S | $CH_3CH_2$ | $CH_3CH_2$ | H | $CH_3$ | H | $CH_3$ | $I^-$ | 1 |
| S-6 | S | $CH_3CH_2$ | $CH_3CH_2$ | $CH_3O$ | H | H | H | $I^-$ | 1 |
| S-7 | S | $CH_3CH_2$ | $CH_3CH_2$ | H | H | H | H | $I^-$ | 1 |
| S-8 | S | $CH_3CH_2$ | $CH_3CH_2$ | $CH_3O$ | $CH_3O$ | H | H | $I^-$ | 1 |
| S-9 | S | $CH_3CH_2$ | $CH_3CH_2$ | $CH_3O$ | H | $CH_3O$ | H | $I^-$ | 1 |
| S-10 | S | $CH_3CH_2$ | $CH_3CH_2$ | $CH_3O$ | H | H | $CH_3O$ | $I^-$ | 1 |
| S-11 | S | $CH_3CH_2$ | $CH_3CH_2$ | H | $CH_3O$ | H | $CH_3O$ | $I^-$ | 1 |
| S-12 | S | $CH_3CH_2$ | $CH_3CH_2$ | $CH_3$ | $CH_3$ | $CH_3$ | $CH_3$ | $I^-$ | 1 |
| S-13 | S | $CH_3CH_2$ | $CH_3CH_2$ | $CH_3O$ | $CH_3O$ | $CH_3O$ | $CH_3O$ | $I^-$ | 1 |
| S-14 | S | $CH_3CH_2$ | $CH_3CH_2$ | $CH_3O$ | $CH_3$ | H | H | $I^-$ | 1 |
| S-15 | S | $CH_3CH_2$ | $CH_3CH_2$ | $C_2H_5O$ | H | $C_2H_5O$ | H | $I^-$ | 1 |
| S-16 | S | $CH_3CH_2$ | $CH_3CH_2$ | $C_2H_5$ | H | $C_2H_5$ | H | $I^-$ | 1 |
| S-17 | S | $CH_3CH_2$ | $CH_3CH_2$ | n-$C_8H_7$ | H | n-$C_5H_7$ | H | $I^-$ | 1 |
| S-18 | S | $CH_3CH_2$ | $CH_3CH_2$ | $N(CH_3)_2$ | H | H | H | $I^-$ | 1 |
| S-19 | S | $(CH_2)_3SO_3-$ | $CH_3CH_2$ | $CH_3$ | H | $CH_3$ | H | — | — |
| S-20 | S | $(CH_2)_4SO_3-$ | $CH_3CH_2$ | $CH_3$ | H | $CH_3$ | H | — | — |
| S-21 | S | $(CH_2)_3SO_3-$ | $(CH_2)_3SO_3-$ | $CH_3$ | H | $CH_3$ | H | $HN^+ Et_2$ | 1 |
| S-22 | S | $(CH_2)_4SO_3^-$ | $(CH_2)_4SO_3-$ | $CH_3$ | H | $CH_3$ | H | 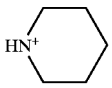 | 1 |
| S-23 | S | $CH_3(CH_2)_4$ | $CH_3CH_2$ | $CH_3$ | H | $CH_3$ | H | $I^-$ | 1 |
| S-24 | S | $CH_3(CH_3)_4$ | $(CH_2)_3SO_4-$ | $CH_3$ | H | $CH_3$ | H | — | — |
| S-25 | S | $CH_3$ | $CH_3$ | $CH_3$ | H | $CH_3$ | H | $I^-$ | 1 |
| S-26 | S | $(CH_2)_3SO_4-$ | $(CH_2)_4SO_4-$ | $CH_3$ | H | $CH_3$ | H | $HN^+ Et_2$ | 1 |
| S-27 | S | $CH_3$ | $CH_3(CH_2)_2$ | $CH_3$ | H | $CH_3$ | H | $I^-$ | 1 |
| S-28 | S | $(CH_2)_3SO_3-$ | $CH_3CH_2$ | $CH_3O$ | $CH_3O$ | H | H | — | — |
| S-29 | S | $CH_3CH_2$ | $(CH_2)_3SO_3-$ | $CH_3O$ | $CH_3O$ | H | H | — | — |
| S-30 | O | $CH_3CH_2$ | $CH_3CH_2$ | $CH_3$ | H | H | H | $I^-$ | 1 |
| S-31 | O | $CH_3CH_2$ | $CH_3CH_2$ | H | $CH_3$ | H | H | $I^-$ | 1 |
| S-32 | O | $CH_3CH_2$ | $CH_3CH_2$ | $CH_3$ | $CH_3$ | H | H | $I^-$ | 1 |
| S-33 | O | $CH_3CH_2$ | $CH_3CH_2$ | $CH_3$ | H | $CH_3$ | H | $I^-$ | 1 |
| S-34 | O | $CH_3CH_2$ | $CH_3CH_2$ | $CH_3$ | H | H | $CH_3$ | $I^-$ | 1 |
| S-35 | O | $CH_3CH_2$ | $CH_3CH_2$ | H | $CH_3$ | H | $CH_3$ | $I^-$ | 1 |

R-1

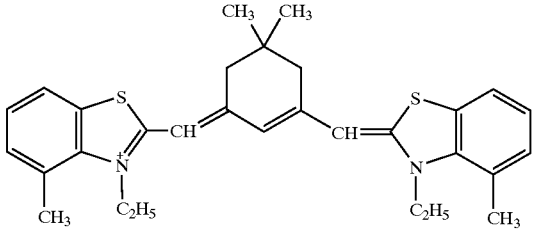

$I^-$

R-2

-continued
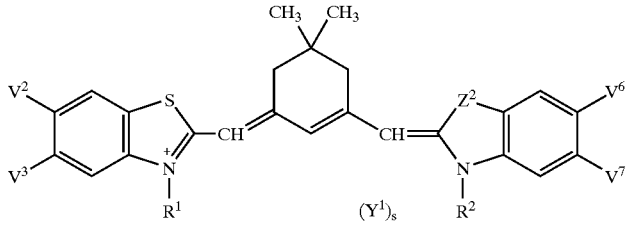
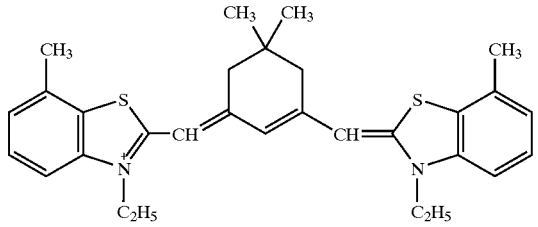
I-
R-3
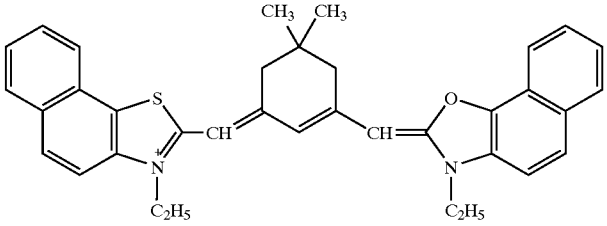
I-
R-4
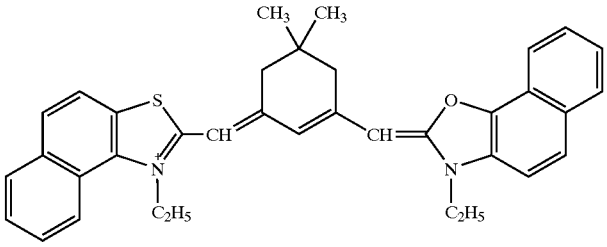
I-
R-5
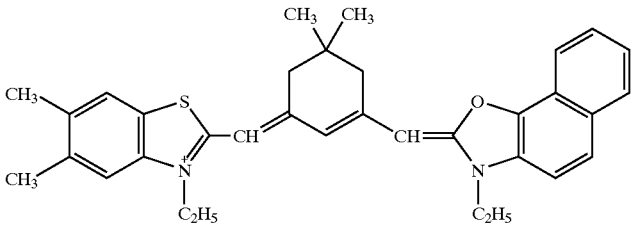
I-
R-6

-continued

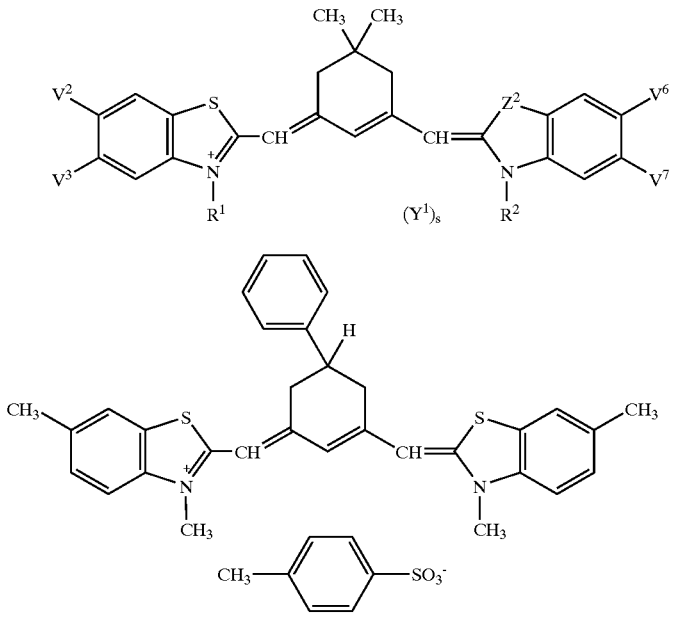

The amount of each of the sensitizing dyes represented by formula (B-I) and formula (R-I) to be added respectively varies depending on a shape and a size of the silver halide grains to be used. But, the amount to be added is preferably in the range of $1.0\times10^{-7}$ mole to $1.0\times10^{-2}$ mole, more preferably in the range of $5.0\times10^{-7}$ mole to $1.0\times10^{-2}$ mole, and further preferably in the range of $1.0\times10^{-6}$ mole to $5.0\times10^{-3}$mole, per mole of silver halide respectively.

The compounds represented by the above-described formulae (B-I) and (R-I) can be synthesized based on the methods as described in, for example, F. M. Hamer, *Heterocyclic Compounds—Cyanine Dyes and Related Compounds,* John Wiley & Sons, New York, London, 1964; D. M. Sturmer, *Heterocyclic Compounds—Special topics in heterocyclic chemistry,* The Chapter 18, Section 14, pp. 482 to 515, John Wiley & Sons, New York, London (1977); and *Rodd's Chemistry of Carbon Compounds,* 2nd Ed. vol. IV, part B (1977), The Chapter 15, pp. 369 to 422, Elsevier Science Publishing Company Inc., New York.

The compounds represented by formula (B-I) and formula (R-I) for use in the present invention respectively may be used in combination with other sensitizing dyes out of the present invention in the emulsion in which each of the above-mentioned compounds is incorporated. As examples of these other sensitizing dyes, preferred are cyanine dyes, merocyanine dyes, rhodacyanine dyes, trinuclear merocyanine dyes, quadri-nuclear merocyanine dyes, allopolar dyes, hemicyanine dyes and styryl dyes. More preferred are cyanine dyes, merocyanine dyes and rhodacyanine dyes. Cyanine dyes are most preferable. Details of these dyes are described in F. M. Hamer, *Heterocyclic Compounds—Cyanine Dyes and Related Compounds* John Wiley & Sons, New York, London (1964); and D. M. Sturmer, *Heterocyclic Compounds—Special topics in heterocyclic chemistry,* The Chapter 18, Section 14, pp. 482 to 515.

As these dyes, preferred are other sensitizing dyes represented by formulae described in, for example, U.S. Pat. No. 5,994,051, pages 32 to 44, U.S. Pat. No. 5,747,236, pages 30 to 39 and specific compounds exemplified therein.

In addition, examples of cyanine dyes, merocyanine dyes and rhodacyanine dyes are compounds represented by formula (XI), (XII) or (XIII) described in U.S. Pat. No. 5,340,694, columns 21 to 22, with the proviso that the number of each of $n_{12}$, $n_{15}$, $n_{17}$ and $n_{18}$ is not limited, but an integer of 0 or more (preferably 4 or less).

These sensitizing dyes can be used singly or in combination, and a combination of these sensitizing dyes is often used, particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,303,377, 3,769,301, 3,814,609, 3,837,862, and 4,026,707, British Patent Nos. 1,344,281 and 1,507,803, JP-B-43-49336 ("JP-B" means examined Japanese patent publication) and JP-B-53-12375, and JP-A-52-110618 and JP-A-52-109925.

Together with the sensitizing dye, a dye having no spectral sensitizing action itself, or a substance that does not substantially absorb visible light and that exhibits supersensitization, may be included in the emulsion.

Examples of a supersensitizing agent useful for spectral sensitization according to the present invention include pyrimidylamino compounds, triazynylamino compounds, azolium compounds, aminostyryl compounds, aromatic organic acid-formaldehyde condensates, azaindene compounds and cadmium salts. These supersensitizing agents and a combination of said supersensitizing agent and a sensitizing dye are described, for example, in U.S. Pat. Nos. 3,511,664, 3,615,613, 3,615,632, 3,615,641, 4,596,767, 4,945,038, 4,965,182, 4,965,182, 2,933,390, 3,635,721, 3,743,510, 3,617,295 and 3,635,721. As to usage thereof, methods described in the above-mentioned patents are also preferable.

The sensitizing dyes according to the present invention (and also other sensitizing dyes and supersensitizing agents) may be directly dispersed into an emulsion. Alternatively, after they are dissolved in an arbitrary solvent such as methyl alcohol, ethyl alcohol, methyl cellosolve, acetone, water and pyridine, or a mixed solvent thereof the solution may be added to an emulsion. At this time, bases and acids, or additives such as surfactants may be incorporated in the solution. Ultrasonic wave may be used for the dissolution. To add a sensitizing dye to an emulsion, for example, after the compound is dissolved in a volatile organic solvent, the resulting solution is dispersed into a hydrophilic colloid to form a dispersion, and then the dispersion is added to the emulsion, as described, for example, in U.S. Pat. No. 3,469,987; after the compound is dispersed into an aqueous solvent and the dispersion is added to the emulsion, as described, for example, in JP-B-46-24185; after the compound is dissolved into a surfactant, the resulting solution is added to the emulsion, as described, for example, in U.S. Pat. No. 3,822,135; after the compound is dissolved using a red-shift inducing compound, the solution is added to the emulsion, as described, for example, in JP-A-51-74624; or after the compound is dissolved into an acid substantially free of water, the solution is added to the emulsion, as described, for example, in JP-A-50-80826. As other methods of adding the compound to an emulsion, those methods as described, for example, in U.S. Pat. Nos. 2,912,343, 3,342,605, 2,996,287 and 3,429,835 also may be used.

Examples of the organic solvent for dissolving the sensitizing dyes for use in the present invention include methyl alcohol, ethyl alcohol, n-propanol, isopropanol, n-butanol, isobutanol, t-butanol, benzyl alcohol, fluorine alcohol, methyl cellosolve, acetone, pyridine and a mixed solvent thereof.

When the sensitizing dyes for use in the present invention is dissolved in water, the above-mentioned organic solvent, or a mixed solvent thereof, a base is also preferably added. The base may be organic or inorganic. Examples of the base include amine derivatives (such as triethylamine, triethanolamine) pyridine derivatives, sodium hydroxide, potassium hydroxide, sodium acetate and potassium acetate. One of preferable dissolution methods is a method in which a dye is added to a mixed solvent of water and methanol, followed by addition of triethylamine with an amount equimolar to the dye.

The silver halide grains in the silver halide emulsion for use in the present invention are not particularly limited in their grain shape, but preferably composed of cubic or tetradecahedral crystal grains (apexes of these grains may be round and those grains may have a higher level face) having substantially {100} planes or an octahedral crystal grains, or a tabular grains having {100} planes or {111} planes as major faces and having an aspect ratio of 2 or more. The aspect ratio is defined as the value obtained by dividing the diameter of a circle corresponding to the circle having the same area as projected area by the thickness of the grains. In the present invention, more preferably, the blue-sensitive silver halide emulsion is a tabular grains having an aspect ratio of 2 or more.

The silver halide grains for use in the present invention, preferably in the first embodiment, have the silver chloride content of 90 mole % or more. From the point of rapid processing suitability, the silver chloride content is preferably 93 mole % or more, and further preferably 95 mole % or more. The silver bromide content is preferably from 0.1 to 7 mole %, and more preferably from 0.5 to 5 mole %, in view of high contrast and excellent latent image stability. The silver iodide content is preferably from 0.02 to 1 mole %, more preferably from 0.05 to 0.50 mole %, and most preferably from 0.07 to 0.40 mole %, in view of high sensitivity and high contrast under high illumination intensity exposure.

The silver halide grains for use in the present invention, preferably in the first embodiment, are preferably silver chloroiodobromide grains, and more preferably silver chloroiodobromide grains having the above-described halogen composition.

The silver halide grains for use in the present invention may have a silver bromide-containing phase and/or a silver iodide-containing phase. Herein, a region where the content of silver bromide is higher than that in other (surrounding) regions will be referred to as a silver bromide-containing phase, and likewise, a region where the content of silver iodide is higher than that in other regions will be referred to as a silver iodide-containing phase. The halogen compositions of the silver bromide-containing phase or the silver iodide-containing phase and of its periphery may vary either continuously or drastically. Such a silver bromide-containing phase or a silver iodide-containing phase may form a layer which has an approximately constant concentration and has a certain width at a certain portion in the grain, or it may form a maximum point having no spread. The localized silver bromide content in the silver bromide-containing phase is preferably 5 mole % or more, more preferably from 10 to 80 mole %, and most preferably from 15 to 50 mole %. The localized silver iodide content in the silver iodide-containing phase is preferably 0.3 mole % or more, more preferably from 0.5 to 8 mole %, and most preferably from 1 to 5 mole %. Such silver bromide- or silver iodide-containing phase may be present in plural numbers in layer form, within the grain. In this case, the phases may have different silver bromide or silver iodide contents from each other. The silver halide grain for use in the invention contain both of at least one the silver bromide-containing phase and at least one silver iodide-containing phase.

The silver bromide-containing phase or silver iodide-containing phase in the silver halide grain used in the present invention is preferably present in a layer form surrounding the grain center. One preferred embodiment is that the silver bromide-containing phase or the silver iodide-containing phase formed in the layer form so as to surround the grain center has a uniform concentration distribution in the circumferential direction of the grain, in each phase. However, in the silver bromide-containing phase or silver iodide-containing phase formed in the layer form so as to surround the grain center, there may be the maximum point or the minimum point of the silver bromide or silver iodide concentration, in the circumferential direction of the grain to have a concentration distribution. For example, when a grain has a silver bromide-containing phase or silver iodide-containing phase formed in the layer form so as to surround the grain center in the vicinity of a surface of the grain, the silver bromide or silver iodide concentration of a corner portion or an edge of the grain can be different from that of a main surface of the grain. Further, aside from a silver bromide-containing phase or a silver iodide-containing phase formed in a layer form so as to surround the grain center, another silver bromide-containing phase or silver iodide-containing phase that exists in complete isolation at a specific portion of the surface of the grain, and does not surround the grain center, may exist.

When a silver halide grain for use in the present invention has a silver bromide-containing phase, the silver bromide-containing phase is preferably formed in a layer form so as to have a maximum silver bromide concentration inside the grain. Likewise, when the silver halide grain for use in the present invention has a silver iodide-containing phase, the silver iodide-containing phase is formed in a layer form so as to form a maximum concentration at the surface of the grain. Such silver bromide-containing phase or silver iodide-containing phase is constituted preferably with a silver amount of 3% to 30% of the grain volume, and more preferably with a silver amount of 3% to 15%, in the meaning to increase the local concentration with a less silver bromide or silver iodide content.

The silver halide grain for use in the present invention preferably contains both a silver bromide-containing phase and a silver iodide-containing phase. In this mode, the silver bromide-containing phase and the silver iodide-containing phase may exist either at the same place in the grain or at different places thereof. However, it is preferred that they exist at different places, in a point that the control of grain formation may become easy. Further, a silver bromide-containing phase may contain silver iodide. Alternatively, a silver iodide-containing phase may contain silver bromide. In general, an iodide added during formation of high silver chloride grains is liable to ooze to the surface of the grain more than a bromide, so that the silver iodide-containing phase is liable to be formed at the vicinity of the surface of the grain. Accordingly, when a silver bromide-containing phase and a silver iodide-containing phase exist at different places in a grain, it is preferred that the silver bromide-containing phase is formed more internally than the silver iodide-containing phase. In such a case, another silver bromide-containing phase may be provided further outside the silver iodide-containing phase in the vicinity of the surface of the grain.

A silver bromide or silver iodide content necessary for exhibiting the effects of the present invention such as achievement of high sensitivity and realization of high contrast, increases with the silver bromide-containing phase or silver iodide-containing phase is being formed inside a grain. This causes the silver chloride content to decrease to more than necessary, resulting in the possibility of impairing rapid processing suitability. Accordingly, for putting together these functions for controlling photographic actions, in the vicinity of the surface of the grain, it is preferred that the silver bromide-containing phase and the silver iodide-containing phase are placed adjacent to each other. From these points, it is preferred that the silver bromide-containing phase is formed at any of the position ranging from 50% to 100% of the grain volume measured from the inside, and that the silver iodide-containing phase is formed at any of the position ranging from 85% to 100% of the grain volume measured from the inside. Further, it is more preferred that the silver bromide-containing phase is formed at any of the position ranging from 70% to 95% of the grain volume measured from the inside, and that the silver iodide-containing phase is formed at any of the position ranging from 90% to 100% of the grain volume measured from the inside.

To a silver halide grain for use in the present invention, bromide ions or iodide ions are introduced to make the grain include silver bromide or silver iodide. In order to introduce bromide ions or iodide ions, a bromide or iodide salt solution may be added alone, or it may be added in combination with both a silver salt solution and a high chloride salt solution. In the latter case, the bromide or iodide salt solution and the high chloride salt solution may be added separately or as a mixture solution of these salts of bromide or iodide and high chloride. The bromide or iodide salt is generally added in the form of a soluble salt, such as an alkali or alkali earth bromide or iodide salt. Alternatively, bromide or iodide ions may be introduced by cleaving the bromide or iodide ions from an organic molecule, as described in U.S. Pat. No. 5,389,508. Further, from viewpoint of uniformity of concentration of bromide or iodide ion between grains, as a source of bromide or iodide ion, fine silver bromide grains or fine silver iodide grains are especially preferably used in the present invention, preferably in the fourth embodiment. Herein, the grain size of the fine silver bromide grains is preferably from 0.3 to 0.005 $\mu$m, more preferably from 0.1 to 0.01 $\mu$m. The grain size of the fine silver iodide grains is preferably from 0.2 to 0.001 $\mu$m, more preferably from 0.1 to 0.002 $\mu$m, and most preferably from 0.05 to 0.004 $\mu$m.

The addition of a bromide salt or iodide salt solution may be concentrated at one time of grain formation process or may be performed over a certain period of time. For obtaining an emulsion with high sensitivity and low fog, the position of the introduction of an iodide ion to a high silver chloride emulsion is restricted. The deeper in the emulsion grain the iodide ion is introduced, the smaller is the increment of sensitivity. Accordingly, the addition of an iodide salt solution is preferably started at 50% or outer side of the volume of a grain, more preferably 70% or outer side, and most preferably 85% or outer side. Moreover, the addition of an iodide salt solution is preferably finished at 98% or inner side of the volume of a grain, more preferably 96% or inner side. When the addition of an iodide salt solution is finished at a little inner side of the grain surface, thereby an emulsion having higher sensitivity and lower fog can be obtained.

On the other hand, the addition of a bromide salt solution is preferably started at 50% or outer side of the volume of a grain, more preferably 70% or outer side of the volume of an emulsion grain.

The distribution of a bromide ion concentration and iodide ion concentration in the depth direction of a grain can be measured according to an etching/TOF-SIMS (Time of Flight-Secondary Ion Mass Spectrometry) method by means of, for example, a TRIFT II Model TOF-SIMS apparatus (trade name, manufactured by Phi Evans Co.). A TOF-SIMS method is specifically described in Nippon Hyomen Kagakukai edited, *Hyomen Bunseki Gijutsu Sensho Niji Ton Shitsuryo Bunsekiho* (*Surface Analysis Technique Selection-Secondary Ion Mass Analytical Method*), Maruzen Co., Ltd. (1999). When an emulsion grain is analyzed by the etching/TOF-SIMS method, it can be analyzed that iodide ions ooze toward the surface of the grain, even though the addition of an iodide salt solution is finished at an inner side of the grain. It is preferred that the emulsion for use in the present invention has the maximum concentration of iodide ions at the surface of the grain, and the iodide ion concentration decreases inwardly in the grain for the analysis with etching/TOF-SIMS. The bromide ions preferably have the maximum concentration in the inside of a grain. The local concentration of silver bromide can also be measured with X-ray diffractometry, as long as the silver bromide content is high to some extent.

The iodide ion concentration on the grain surface can be also measured by the ESCA (Electron Spectroscopy for Chemical Analysis) method. In present invention, the iodide ion concentration on the grain surface was expressed as an integrated value measured by the following method. Photoelectrons released from a sample by irradiation of X ray using the ESCA5300 (trade name) manufactured by Ulvac Phi Co. with X ray-applied voltage of 15 kV and X ray-pass energy of 71.5 eV were detected from the output angle of 90° to the surface of the sample. The measurement was performed 30 times while cooling a sample using liquid nitrogen (−120° C.) in order to prevent the sample from damage caused by X ray irradiated or thermal radiation from X ray sources. The iodide ion concentration on the grain surface is preferably 0.7 mole or more, further more preferably 1.0 mole or more, and especially preferably 1.5 mole or more.

It is preferable that the electron release delay time of the silver halide emulsion used in the present invention, preferably in the third embodiment, is between $10^{-5}$ second and 10 seconds. The term "electron release retardation time" as used herein means the time taken for photoelectrons to be generated in silver halide crystals and thereafter captured in the electron traps in the crystals until released again out of the crystals when a silver halide emulsion is exposed to light. If the electron release retardation time is shorter than $10^{-5}$ second, it is difficult to achieve high sensitivity and high contrast under high illumination intensity exposure. On the other hand, if the electron release retardation time is longer than 10 seconds, the problem of latent image sensitization occurs soon after exposure before processing. The electron release retardation time is more preferably between $10^{-4}$ second and 10 seconds and most preferably between $10^{-3}$ second and 1 second.

The electron release retardation time of electrons can be measured by a double-pulse photoconductivity method. That is, using a microwave photoconductivity method or a radio wave photoconductivity method, a first short-time exposure to light is carried out and a second short-time exposure to light is carried out at a certain interval after the first exposure. The first exposure causes the electrons to be captured in the electron traps in the silver halide crystal. If the second exposure is carried out immediately after the first exposure, the intensity of photoconductivity signals by the second exposure becomes larger because the electron traps are filled with electrons. If the second exposure is carried out after a sufficient interval such that the electrons captured in the electron traps by the first exposure are already released, the photoconductivity signals based on the second exposure are already reduced to original intensity. If the dependence of the intensities of the photoconductivity signals by the second exposure on the intervals between exposures is measured by varying the interval between the first and second exposures, the attenuation of the intensities of the photoconductivity signals by the second exposure can be observed with the lapse of the interval between exposures. This represents the retardation time taken to release photoelectrons from electron traps. Although in some cases the delayed release of electrons continues for a certain time after exposure, it is preferable that the retarded release is observed between $10^{-5}$ second and 10 seconds. It is more preferable that the retarded release is observed between $10^{-4}$ second and 10 seconds, and it is most preferable that the retarded release is observed between $10^{-3}$ second and 1 second.

The equivalent spherical diameter of the silver halide grains contained in the silver halide emulsion for use in the present invention is not particularly limited, but preferably 0.4 $\mu$m or less, and more preferably 0.3 $\mu$m or less, for rapid processing. The grain having an equivalent spherical diameter of 0.4 $\mu$m corresponds to a cubic grain having a side length of approximately 0.32 $\mu$m, and the grain having an equivalent spherical diameter of 0.3 $\mu$m corresponds to a cubic grain having a side length of approximately 0.24 $\mu$m, respectively. The silver halide emulsion for use in the present invention may contain silver halide grains other than the silver halide grains according to the present invention (i.e., the specific silver halide grains). In the present invention, preferably in the forth embodiment, for obtaining a broad latitude, it is also preferred to blend the above-described monodisperse emulsions in the same layer or to form a multilayer structure by multilayer-coating of the monodisperse emulsions. In the silver halide emulsion for use in the present invention, however, a ratio of the specific silver halide grains in the total projected area of the all silver halide grains is preferably 50% or more, and it is more preferably 80% or more, still more preferably 90% or more.

The silver halide grains for use in the present invention (for example, specific silver halide grains in the emulsion) are preferably doped with an iridium compound. As the iridium compound, a six-coordination complex having 6 ligands and containing iridium as a central metal is preferable, for uniformly incorporating iridium in a silver halide crystal. As one preferable embodiment of iridium compound for use in the present invention, a six-coordination complex having Cl, Br or I as a ligand and containing iridium as a central metal is preferable. A more preferable example is a six-coordination complex in which all six ligands are Cl, Br, or r and which has iridium as a central metal. In this case, Cl, Br and I may coexist in the six-coordination complex. It is especially preferable that a six-coordination complex having Cl, Br or I as a ligand and containing iridium as a central metal is contained in a silver bromide-containing phase, in order to obtain a hard gradation in a high illumination intensity exposure.

Specific examples of the six-coordination complex in which all of 6 ligands are Cl, Br or I and iridium is a central metal are shown below. However, the iridium compound for use in the present invention is not limited thereto.

$[IrCl_6]^{2-}$
$[IrCl_6]^{3-}$
$[IrBr_6]^{2-}$
$[IrBr_6]^{3-}$
$[IrI_6]^{3-}$

As another embodiment of the iridium compound that can be used in the present invention, a six-coordination complex having at least one ligand other than a halogen (nonhalogen ligand) or ligand other than a cyan and containing iridium as a central metal, is preferable. A six-coordination complex having $H_2O$, OH, O, OCN, thiazole or a substituted thiazole as a ligand and containing iridium as a central metal is preferable. A six-coordination complex in which at least one ligand is $H_2O$, OH, O, OCN, thiazole or substituted thiazoles and the remaining ligands are Cl, Br or I, and iridium is a central metal, is more preferable. A six-coordination complex in which one or two ligands are 5-methylthiazole and the remaining ligands are Cl, Br or I, and iridium is a central metal, is most preferable.

Specific examples of the six-coordination complex in which at least one ligand is $H_2O$, OH, O, OCN, thiazole or a substituted thiazole and the remaining ligands are Cl, Br or I, and iridium is a central metal, are listed below. However, the iridium compound for use in the present invention is not limited thereto.

$[Ir(H_2O)Cl_5]^{2-}$
$[Ir(H_2O)_2Cl_4]^{-}$
$[Ir(H_2O)Br_5]^{2-}$
$[Ir(H_2O)_2Br_4]^{-}$
$[Ir(OH)Cl_5]^{3-}$
$[Ir(OH)_2Cl_4]^{3-}$
$[Ir(OH)Br_5]^{3-}$
$[Ir(OH)_2Br_4]^{3-}$
$[Ir(O)Cl_5]^{4-}$
$[Ir(O)_2Cl_4]^{5-}$
$[Ir(O)Br_5]^{4-}$
$[Ir(O)_2Br_4]^{5-}$ $[Ir(OCN)Cl_5]^{3-}$
$[Ir(OCN)Br_5]^{3-}$
$[Ir(thiazole)Cl_5]^{2-}$
$[Ir(thiazole)_2Cl_4]^{-}$
$[Ir(thiazole)Br_5]^{2-}$
$[Ir(thiazole)_2Br_4]^{-}$
$[Ir(5\text{-methylthiazole})Cl_5]^{2-}$
$[Ir(5\text{-methylthiazole})_2Cl_4]^{-}$
$[Ir(5\text{-mthylthiazole})Br_5]^{2-}$
$[Ir(5\text{-methylthiazole})_2Br_4]^{-}$ The foregoing metal complexes are anionic ions. When these are formed into salts with cationic ions, counter cationic ions are preferably those easily soluble in water. Preferable examples thereof include an alkali metal ion such as a sodium ion, a potassium ion, a rubidium ion, a cesium ion and a lithium ion, an ammonium ion and an alkylammonium ion. These metal complexes can be used by dissolving them in water or in a mixed solvent composed of water and an arbitrary organic solvent miscible with water (such as alcohols, ethers, glycols, ketones, esters and amides). These iridium complexes are added in amounts of, preferably $1\times10^{-10}$ mole to $1\times10^{-3}$ mole, most preferably $1\times10^{-8}$ mole to $1\times10^{-5}$ mole, per mole of silver, during grain formation.

In the present invention, the above-mentioned iridium complexes are preferably added directly to the reaction solution at the time of silver halide grain formation, or indirectly to the grain-forming reaction solution via addition to an aqueous halide solution for forming silver halide grains or other solutions, so that they are doped to the inside of the silver halide grains. Furthermore, it is also preferable to employ a method in which the iridium complex is doped into a silver halide grain by preparing fine grains doped with the complex in advance and adding the grains for carrying out physical ripening. Further, these methods may be combined, to incorporate the complex into the inside of the silver halide grains.

In case where these complexes are doped to the inside of the silver halide grains, they are preferably uniformly distributed in the inside of the grains. On the other hand, as disclosed in JP-A-4-208936, JP-A-2-125245 and JP-A-3-188437, they are also preferably distributed only in the grain surface layer. Alternatively they are also preferably distributed only in the inside of the grain while the grain surface is covered with a layer free from the complex. Further, as disclosed in U.S. Pat. Nos. 5,252,451 and 5,256,530, it is also preferred that the silver halide grains are subjected to physical ripening in the presence of fine grains having complexes incorporated therein to modify the grain surface phase. Further, these methods may be used in combination. Two or more kinds of complexes may be incorporated in the inside of an individual silver halide grain. The halogen composition at the position (portion) where the complexes are incorporated, is not particularly limited, but the six-cordination complex whose central metal is Ir and whose all six-ligands are Cl, Br, or I is preferably incorporated in a silver bromide concentration maximum portion.

In the present invention, a metal ion other than iridium can be doped in the inside and/or on the surface of the silver halide grains. As the metal ion to be used, a transition metal is preferable, and iron, ruthenium, osmium, lead, cadmium or zinc is especially preferable. It is more preferable that these metal ions are used in the form of a six-coordination complex of octahedron-type having ligands. When employing an inorganic compound as a ligand, cyanide ion, halide ion, thiocyanato, hydroxide ion, peroxide ion, azide ion, nitrite ion, water, ammonia, nitrosyl ion, or thionitrosyl ion is preferably used. Such a ligand is preferably coordinated to any metal ion selected from the group consisting of the above-mentioned iron, ruthenium, osmium, lead, cadmium and zinc. Two or more kinds of these ligands are also preferably used in one complex molecule. Further, an organic compound can also be preferably used as a ligand. Preferable examples of the organic compound include chain compounds having a main chain of 5 or less carbon atoms and/or heterocyclic compounds of 5- or 6-membered ring. More preferable examples of the organic compound are those having at least a nitrogen, phosphorus, oxygen, or sulfur atom in a molecule as an atom which is capable of coordinating to a metal. Most preferred organic compounds are furan, thiophene, oxazole, isooxazole, thiazole, isothiazole, imidazole, pyrazole, triazole, furazane, pyran, pyridine, pyridazine, pyrimidine and pyrazine. Further, organic compounds which have a substituent introduced into a basic skeleton of the above-mentioned compounds are also preferred.

Preferable combinations of a metal ion and a ligand are those of iron and/or ruthenium ion and cyanide ion. In the present invention, one of these compounds is preferably used in combination with the iridium compound. Preferred of these compounds are those in which the number of cyanide ions accounts for the majority of the coordination sites intrinsic to the iron or ruthenium that is the central metal. The remaining coordination sites are preferably occupied by thiocyan, ammonia, water, nitrosyl ion, dimethylsulfoxide, pyridine, pyrazine, or 4,4'-bipyridine. Most preferably each of 6 coordination sites of the central metal is occupied by a cyanide ion, to form a hexacyano iron complex or a hexacyano ruthenium complex. These metal complexes having cyanide ion ligands are preferably added, during grain formation, in an amount of $1\times10^{-8}$ mol to $1\times10^{-2}$ mol, most preferably $1\times10^{-6}$ mol to $5\times10^{-4}$ mol, per mol of silver. In case where ruthenium or osmium is used as the central metal, a nitrosyl ion, a thionitrosyl ion, or water molecule is preferably used as a ligand, together with a chloride ion. More preferably these ligands form a pentachloronitrosyl complex, a pentachlorothionitrosyl complex, or a pentachloroaquo complex. The formation of a hexachloro complex is also preferred. These complexes are preferably added, during grain formation, in an amount of $1\times10^{-10}$ mol to $1\times10^{-6}$ mol, more preferably $1\times10^{-9}$ mol to $1\times10^{-6}$ mol, per mol of silver.

The oxidation potential of the latent image of the silver halide emulsion for use in the present invention is preferably more noble than 70 mV, more preferably more noble than 100 mV. That the oxidation potential of the latent image is more noble than 70 mV means that the oxidation resistance of the latent image is relatively high. The oxidation potential of the latent image can be measured by the method described in a known data, for example, *Photographic Sensitivity,* Oxford University Press, Tadaaki Tani, 1995, p.103. Specifically, gradation exposure for 0.1 second is applied to a coating of a silver halide emulsion, and it is dipped in a redox bath having various potentials before development to measure a potential in which a latent image is bleached.

The silver halide emulsion for use in the present invention is generally subjected to chemical sensitization. As to the chemical sensitization method, sulfur sensitization typified by the addition of an unstable sulfur compound, noble metal sensitization typified by gold sensitization, and reduction sensitization may be used independently or in combination. As compounds used for the chemical sensitization, those described in JP-A-62-215272, page 18, right lower column to page 22, right upper column are preferably used. Of these chemical sensitization, gold-sensitized silver halide emulsion is particularly preferred, since a fluctuation in photographic properties which occurs when scanning exposure with laser beams or the like is conducted, can be further reduced by gold sensitization.

In order to conduct gold sensitization to the silver halide emulsion to be used in the present invention, various inorganic gold compounds, gold (I) complexes having an inorganic ligand, and gold (I) compounds having an organic ligand may be used. Inorganic gold compounds, such as chloroauric acid or salts thereof; and gold (I) complexes having an inorganic ligand, such as dithiocyanato gold compounds (e.g., potassium dithiocyanatoaurate (I)), and dithiosulfato gold compounds (e.g., trisodium dithiosulfatoaurate (I)), can be used.

As the gold (I) compounds having an organic ligand, the bis gold (I) mesoionic heterocycles described in JP-A-4-267249, for example, gold (I) tetrafluoroborate bis(1,4,5-trimethyl-1,2,4-triazolium-3-thiolate), the organic mercapto gold (I) complexes described in JP-A-11-218870, for example, potassium bis(1-[3-(2-sulfonatobenzamido) phenyl]-5-mercaptotetrazole potassium salt) aurate (I) pentahydrate, and the gold (I) compound with a nitrogen compound anion coordinated therewith, as described in JP-A-4-268550, for example, gold (I) bis (1-methylhydantoinate) sodium salt tetrahydrate may be used. Also, the gold (I) thiolate compound described in U.S. Pat. No. 3,503,749, the gold compounds described in JP-A-8-69074, JP-A-8-69075 and JP-A-9-269554, and the compounds described in U.S. Pat. Nos. 5,620,841, 5,912,112, 5,620,841, 5,939,245, and 5,912,111 may be used.

The amount of these compounds to be added can be varied in a wide range depending on the occasion, and it is generally in the range of $5\times10^{-7}$ mole to $5\times10^{-3}$ mole, preferably in the range of $5\times10^{-6}$ mole to $5\times10^{-4}$ mole, per mole of silver halide.

The silver halide emulsion for use in the present invention can be subjected to gold sensitization using a colloidal gold sulfide. The silver halide emulsion for use in the present invention is preferably subjected to gold sensitization using a colloidal gold sulfide or a gold sensitizer having log $\beta_2$ (stability constant of gold complex) of 21 or more but 35 or less. A method of producing the colloidal gold sulfide is described in, for example, *Research Disclosure,* No. 37154; *Solid State Tonics,* Vol. 79, pp. 60 to 66 (1995); and *Compt. Rend. Hebt. Seances Acad. Sci. Sect. B,* Vol. 263, p. 1328 (1996). Colloidal gold sulfide having various grain sizes are applicable, and even those having a grain diameter of 50 nm or less are also usable. The amount of these compounds to be added can be varied in a wide range depending on the occasion, and it is generally in the range of $5\times10^{-7}$ mol to $5\times10^{-3}$ mol, preferably in the range of $5\times10^{-6}$ mol to $5\times10^{-4}$ mol, in terms of gold atom, per mol of silver halide. In the present invention, gold sensitization may be used in combination with other sensitizing methods, for example, sulfur sensitization, selenium sensitization, tellurium sensitization, reduction sensitization, or noble metal sensitization using a noble metal compound other than gold compounds.

The gold sensitizer having a complex stability constant log $\beta_2$ of gold within a range of from 21 to 35 is explained below.

The measurement of the complex stability constant log $\beta_2$ of gold is described in *Comprehensive Coordination Chemistry,* chap. 55, p. 864, 1987; *Encyclopedia of Electrochemistry of the Elements,* chap. IV-3, 1975; and *Journal of the Royal Netherlands Chemical Society,* Vol. 101, p. 164, 1982; and other references. According to the measuring method described in these documents, the complex stability constant log $\beta_2$ of gold is obtained from a gold potential which is measured at a measurement temperature of 25° C. with an ionic strength of 0.1 M (KBr) by adjusting pH to 6.0 with a potassium dihydrogenphosphate/disodium hydrogenphosphate buffer. In this measurement, log $\beta_2$ of a thiocyanate ion is 20.5 which is close to 20, a value described in a literature (*Comprehensive Coordination Chemistry,* chap. 55, p. 864, 1987, Table 2).

The gold sensitizer having the complex stability constant log $\beta_2$ of gold within a range of from 21 to 35 is preferably represented by formula (S).

$$\{(L^1)_x(Au)_y(L^2)_z.Q_q\}_p \qquad \text{Formula (S)}$$

In formula (S), $L^1$ and $L^2$, independently from each other, represent a compound having log $\beta_2$ of 21 to 35, preferably a compound having log $\beta_2$ of 22 to 31, and more preferably a compound having log $\beta_2$ of 24 to 28.

Examples of $L^1$ and $L^2$ include a compound containing at least one unstable sulfur group capable of forming silver sulfide by reaction with a silver halide, a hydantoin compound, a thioether compound, a mesoionic compound, —SR', a heterocyclic compound, a phosphine compound, amino acid derivatives, sugar derivatives or a thiocyanato group. These may be the same or different. R' represents an aliphatic hydrocarbon group, an aryl group, a heterocyclic group, an acyl group, a carbamoyl group, a thiocarbamoyl group or a sulfonyl group.

Q represents a counter anion or a counter cation required for neutralizing a charge of a compound, x and z each independently represent an integer of 0 to 4, y and p each independently represent 1 or 2, and q represents a value of 0 to 1 including a decimal, wherein x and z are not 0 at the same.

With respect to preferable compounds represented by formula (S), $L^1$ and $L^2$ each represent a compound containing at least one unstable sulfur group capable of forming silver sulfide by reaction with a silver halide, a hydantoin compound, a thioether compound, a mesoionic compound, —SR', a heterocyclic compound or a phosphine compound, and x, y and z each represent 1.

With respect to more preferable compounds represented by formula (S), $L^1$ and $L^2$ each represent a compound containing at least one unstable sulfur group capable of forming silver sulfide by reaction with a silver halide, a mesoionic compound or —SR', and x, y, z and p each represent 1.

The gold compounds represented by formula (S) are described in more detail below.

In formula (S), examples of a compound containing at least one unstable sulfur group capable of forming silver sulfide by reaction with a silver halide as represented by $L^1$ and $L^2$ include thioketones (such as thioureas, thioamides and rhodanines), thiophosphates and thiosulfates.

Preferable examples of a compound containing at least one unstable sulfur group capable of forming silver sulfide by reaction with a silver halide include thioketones (preferably, thioureas and thioamides) and thiosulfates.

Next, in formula (S), examples of a hydantoin compound represented by $L^1$ and $L^2$ include unsubstituted hydantoin and N-methylhydantoin. Examples of a thioether compound include linear or cyclic thioethers having 1 to 8 thio groups that are bond with a substituted or unsubstituted linear or branched alkylene group (such as ethylene, or triethylene) or a phenylene group. Specific examples thereof include bishydroxyethylthio ether, 3,6-dithia-1,8-octanediol and 1,4,8,11-tetrathiacyclotetradecane. Examples of a mesoionic compound include mesoionic-3-mercapto-1,2,4-triazole (such as mesoionic-1,4,5-trimethyl-3-mercapto-1,2,4-triazole).

When $L^1$ and $L^2$ in formula (S) represent —SR', examples of an aliphatic hydrocarbon group represented by R' include a substituted or unsubstituted linear or branched alkyl group having 1 to 30 carbon atoms (such as methyl, ethyl, isopropyl, n-propyl, n-butyl, t-butyl, 2-pentyl, n-hexyl, n-octyl, t-octyl, 2-ethyhexyl, 1,5-dimethylhexyl, n-decyl, n-dodecyl, n-tetradecyl, n-hexadecyl, hydroxylethyl, hydroxypropyl, 2,3-dihydroxypropyl, carboxymethyl, carboxyethyl, sodiumsulfoethyl, diethylaminoethyl, diethylaminopropyl, butoxypropyl, ethoxyethoxyethyl or n-hexyloxypropyl), a substituted or unsubstituted cyclic alkyl group having 3 to 18 carbon atoms (such as cyclopropyl, cyclopentyl, cyclohexyl, cyclooctyl, adamantyl or cyclododecyl), an alkenyl group having 2 to 16 carbon atoms (such as allyl, 2-butenyl or 3-pentenyl), an alkinyl group having 2 to 10 carbon atoms (such as propargyl or 3-pentinyl) and an aralkyl group having 6 to 16 carbon atoms (such as benzyl). Examples of an aryl group include a substituted or unsubstituted phenyl and naphthyl groups having 6 to 20 carbon atoms (such as unsubstituted phenyl, unsubstituted naphthyl, 3,5-dimethylphenyl, 4-butoxyphenyl, 4-dimethylaminophenyl and 2-carboxypheny). Examples of a heterocyclic group include a substituted or unsubstituted 5-membered nitrogen-containing heterocyclic ring (such as imidazolyl, 1,2,4-triazolyl, tetrazolyl, oxadiazolyl, thiadiazolyl, benzoimidazolyl or purinyl), a substituted or unsubstituted 6-membered nitrogen-containing heterocyclic ring (such as pyridyl, piperidyl, 1,3,5-triazino or 4,6-dimercapto-1,3,5-triazino), a furyl group and a thienyl group. Examples of an acyl group include acetyl and benzoyl. Examples of a carbamoyl group include dimethyl carbamoyl. Examples of a thiocarbamoyl group include diethylthio carbamoyl. Examples of a sulfonyl group include a substituted or unsubstituted alkylsulfonyl group having 1 to 10 carbon atoms (such as methanesulfonyl and ethanesulfonyl), and a substituted or unsubstituted phenylsulfonyl group having 6 to 16 carbon atoms (such as phenylsulfonyl).

With respect to —SR' represented by $L^1$ and $L^2$, R' is preferably an aryl group or a heterocyclic group, more preferably a heterocyclic group, further more preferably a 5- or 6-membered nitrogen-containing heterocyclic group, most preferably a nitrogen-containing heterocyclic group substituted with a water-soluble group (such as sulfo, carboxy, hydroxy or amino).

Examples of the heterocyclic compound represented by $L^1$ and $L^2$ in formula (S) include substituted or. unsubstituted 5-membered nitrogen-containing heterocyclic compounds (such as pyrroles, imidazoles, pyrazoles, 1,2,3-triazoles, 1,2,4-triazoles, tetrazoles, oxazoles, iso-oxazoles, isothiazoles, oxadiazoles, thiadiazoles, pyrrolidines, pyrrolines, imidazolidines, imidazolines, pyrazolidines, pyrazolines and hydantoins), heterocyclic compounds containing a 5-membered ring (such as indoles, isoindoles, indolidines, indazoles, benzoimidazoles, purines, benzotriazoles, carbazoles, tetrazaindenes, benzotriazoles and indolines), substituted or unsubstituted 6-membered nitrogen-containing heterocyclic compounds (such as pyridines, pyrazines, pyrimidines, pyridazines, triazines, thiadiazines, piperidines, piperazines and morpholines), heterocyclic compounds containing a 6-membered ring (such as quinolines, isoquinolines, phthaladines, naphthyridines, quinoxalines, quinazolines, pteridines, phenathridines, acridines, phenanthrolines and phenazines), substituted or unsubstituted furans, substituted or unsubstituted thiophenes and benzothiazoliums.

Preferable examples of the heterocyclic compound represented by $L^1$ and $L^2$ include 5-or 6-membered nitrogen-containing unsubstituted heterocyclic compounds and heterocyclic compounds containing the same. Specific examples thereof include pyrroles, imidazoles, pirazoles, 1,2,4-triazoles, oxadiazoles, thiadiazoles, imidazolines, indoles, indolidines, indazoles, benzoimidazoles, purines, benzotriazoles, carbazoles, tetrazaindenes, benzothiazoles, pyridines, pyrazines, pyrimidines, pyridazines, triazines, quinolines, isoquinolines and phthaladines. Further, heterocyclic compounds known to those skilled in the art as an anti-fogging agent (such as imidazoles, benzoimidazoles, benzotriazoles and tetrazaindenes) are preferable.

Examples of a phosphine compound represented by $L^1$ and $L^2$ in formula (S) include phosphines substituted with an aliphatic hydrocarbon group having 1 to 30 carbon atoms, an aryl group having 6 to 20 carbon atoms, a heterocyclic group (such as pyridyl), a substituted or unsubstituted amino group (such as dimethylamino), and/or an alkoxy group (such as methoxy, ethoxy). Preferable are phosphines substituted with an alkyl group having 1 to 10 carbon atoms, an aryl group having 6 to 12 carbon atoms (such as triphenylphosphine and triethylphosphine).

Further, it is preferable that the mesoionic compound, —SR' and the heterocyclic compound represented by $L^1$ and $L^2$ are substituted with an unstable sulfur group capable of forming silver sulfide by a reaction with a silver halide (for example, a thioureido group).

Moreover, the compound represented by $L^1$ and $L^2$ in formula (S) may have as many substituents as possible. Examples of the substituent include a halogen atom (such as fluorine, chlorine, bromine), an aliphatic hydrocarbon group (such as methyl, ethyl, isopropyl, n-propyl, t-butyl, n-octyl, cyclopentyl or cyclohexyl), an alkenyl group (such as allyl, 2-butenyl or 3-pentenyl), an alkynyl group (such as propargyl or 3-pentinyl), an aralkyl group (such as benzyl, phenethyl), an aryl group (such as phenyl,. naphthyl or 4-methylphenyl), a heterocyclic group (such as pyridyl, furyl, imidazolyl, pyperidinyl or morphoryl), an alkoxy group (such as methoxy, ethoxy, butoxy, 2-ethylhexyloxy, ethoxyethoxy, or methoxyethoxy), an aryloxy group (such as phenoxy, or 2-naphthyloxy), an amino group (such as an unsubstituted amino, dimethylamino, diethylamino, dipropylamino, dibutylamino, ethylamino, dibenzylamino or anilino), an acylamino group (such as acethylamino or benzoylamino), a ureido group (such as unsubstituted ureido, N-methylureido or N-phenylthioureido), a thioureido group (such as unsubstituted thioureido, N-methylthioureido or N-phenylthioureido), a selenoureido group (such as unsubstituted selenoureido), a phosphineselenido group (such as diphenylphosphine selenido), a tellurureido group (such as unsubstituted tellurureido), a urethane group (such as methoxycarbonylamino or phenoxycarbonylamino), a sulfonamido group (such as methylsulfonamido or phenylsulfonamido), a sulfamoyl group (such as unsubstituted sulfamoyl, N,N-dimethylsulfamoyl or N-phenylsulfonyl), a carbamoyl group (such as unsubstituted carbamoyl, N,N-diethylcarbamoyl or N-phenylcarbamoyl), a sulfonyl group (such as methanesulfonyl or p-toluenesulfonyl), a sulfinyl group (such as methyl sulfinyl or phenylsulfinyl), an alkoxycarbonyl group (such as methoxycarbonyl, ethoxycarbonyl), an aryloxycarbonyl group (such as phenoxycarbonyl), an acyl group (such as acetyl, benzoyl, formyl or pivaloyl), an acyloxy group (such as acetyloxy or benzoyloxy), a phosphoric acid amide group (such as N,N-diethylphosphoric acid amide), an alkylthio group (such as methylthio or ethylthio), an arylthio group (such as phenylthio), a cyano group, a sulfo group, a thiosulfonic acid group, a sulfinic group, a carboxyl group, a hydroxyl group, a mercapto group, a phosphono group, a nitro group, a sulfino group, an ammonio group (such as trimethyammonio), a phosphonio group, a hydrazino group, a thiazolino group, and a silyloxy group (such as t-butyldimethylsilyloxy or t-butyldiphenylsilyloxy). When there are two or more substitutes, they are the same or different.

Q and q in formula (S) are described below.

Examples of a counter anion represented by Q in formula (S) include a halogenium ion (such as $F^-$, $Cl^-$, $Br^-$, or $I^-$), a tetrafluoroborate ion ($BF_4^-$), hexafluorophosphate ion ($PF_6^-$), a sulfate ion ($SO_4^{2-}$), an arylsulfonate ion (such as p-toluenesulfonate ion or a naphthalene-2,5-disulphonate ion), and a carboxyl ion (such as acetate ion, a trifluoroacetate ion, an oxalate ion or a benzoate ion). Examples of a counter cation represented by Q include an alkali metal ion (such as a lithium ion, a sodium ion, a potassium ion, a rubidium ion or a cesium ion), an alkaline earth metal ion (such as a magnesium ion or calcium ion), a substituted or unsubstituted ammonium ion (such as an unsubstituted ammonium ion, a triethylammonium ion or tetramethylammonium ion), a substituted or unsubstituted pyridinium ion (such as an unsubstituted pyridinium ion or a 4-phenyl pyridinium ion), and a proton. Further, q is the number of Q for neutralizing a charge of a compound, and represents a value of 0 to 1, and its value may be a decimal.

Preferable examples of counter anion represented by Q include a halogenium ion (such as $Cl^-$ or $B^-$), a tetrafluoroborate ion, hexafluorophosphate ion and a sulfate ion. Preferable examples of counter cation represented by Q include an alkali metal ion (such as a sodium ion, a potassium ion, a rubidium ion or a cesium ion), a substituted or unsubstituted ammonium ion (such as an unsubstituted ammonium ion, a triethylammonium ion or tetramethylammonium ion), or a proton.

Specific examples of the compound represented by $L^1$ or $L^2$ are listed below. However, the compound for use in the present invention is not limited thereto. The number in a parenthesis indicates a log $\beta_2$ value.

(L-1)

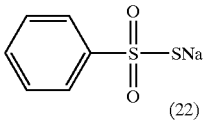

(22)

(L-2)

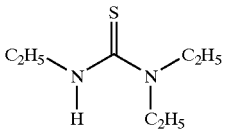

(24)

(L-3)

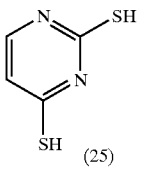

(25)

-continued (L-4)

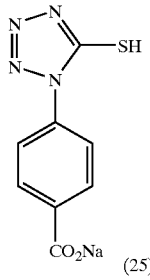

(25)

(L-5)

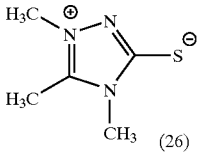

(26)

(L-6)

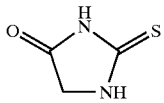

(27)

(L-7)

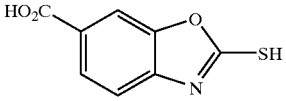

(27)

(L-8)

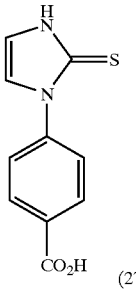

(27)

(L-9)

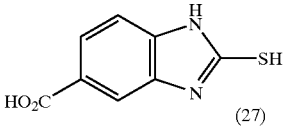

(27)

(L-10)

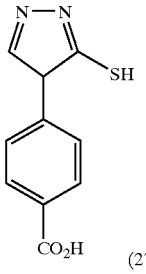

(27)

(L-11)

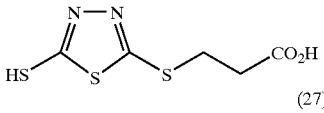

(27)

-continued (L-12)

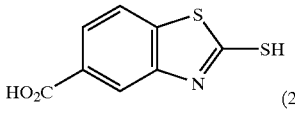

(27)

(L-13)

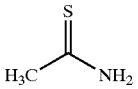

(28)

(L-14)

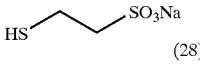

(28)

(L-15)

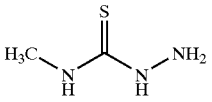

(29)

(L-16)

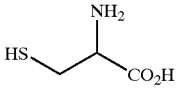

(29)

(L-17)

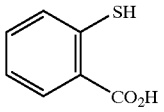

(30)

The compound represented by formula (S) can be synthesized with reference to a known method such as *Inorg. Nucl. Chem. Letters,* Vol. 10, p. 641(1974), *Transition Met. Chem.,* Vol. 1, p. 248 (1976), *Acta. Cryst.* B32, p.3321 (1976), JP-A-8-69075, JP-B-45-8831, European Patent No. 915371A1, JP-A-6-11788, JP-A-6-501789, JP-A-4-267249 and JP-A-9-118685.

Specific examples of the compound represented by formula (S) are listed below. However, the compound for use in the present invention is not limited thereto.

(S-1)

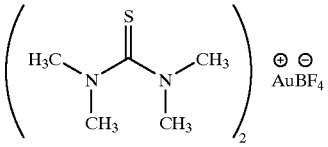

-continued (S-2)

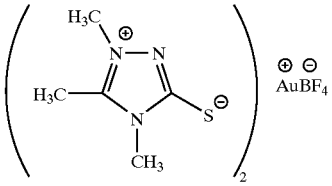

(S-3)

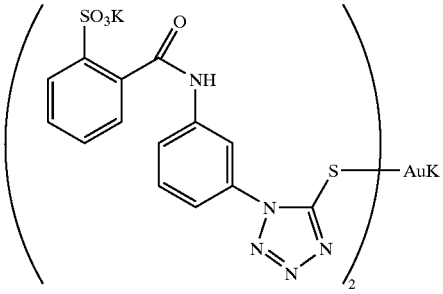

(S-4)

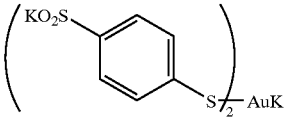

(S-5)

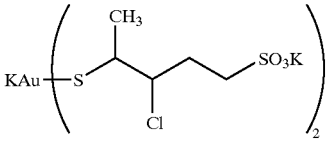

(S-6)

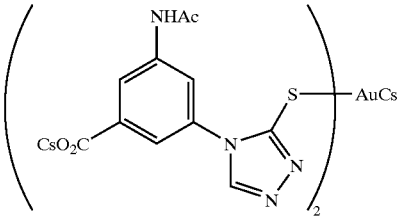

(S-7)

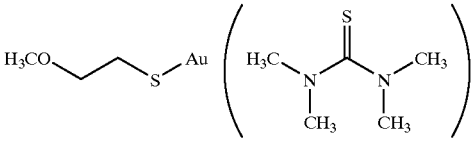

(S-8)

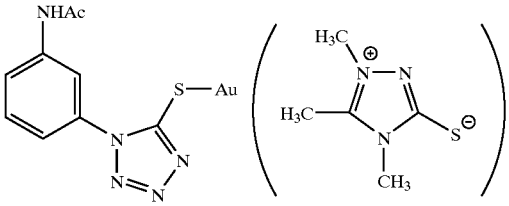

(S-9)

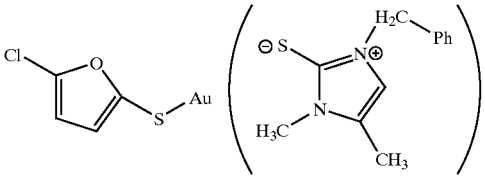

-continued (S-10)

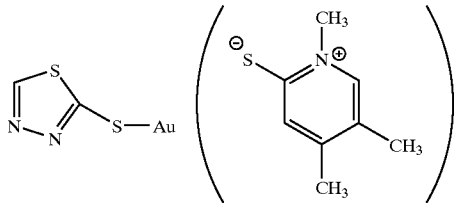

(S-11)

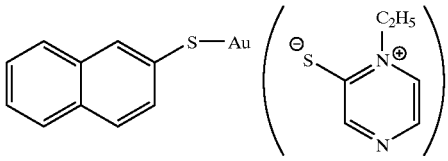

(S-12)

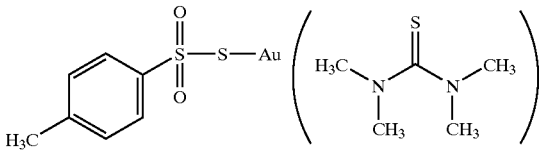

(S-13)

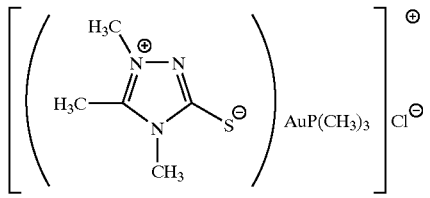

(S-14)

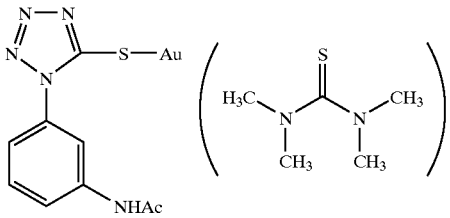

(S-15)

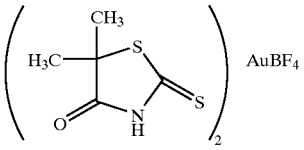

(S-16)

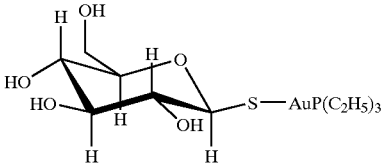

(S-17)

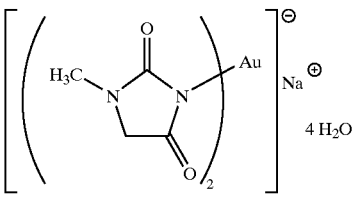

-continued (S-18)

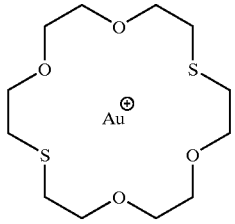

(S-19)

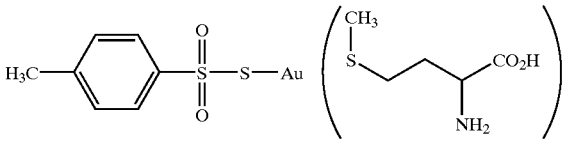

In the present invention, gold sensitization is carried out, generally, by adding a gold sensitizer to an emulsion and then stirring the emulsion at high temperature (preferably 40° C. or more) for a prescribed amount of period. The amount of the gold sensitizer to be added varies depending on various conditions, and preferably the amount is roughly $1\times10^{-7}$ mol or more but $1\times10^{-4}$ mol or less, per mol of silver halide.

As a gold sensitizer in the present invention, in addition to the above-mentioned compounds, a generally used gold compound can also be used in combination with the compound. Typical examples include chloroaurates, potassium chloroaurate, auric trichloride, potassium auric thiocyanate, potassium iodoaurate, tetracyanoauric acid, ammonium aurothiocyanate, and pyridyltrichlorogold.

The silver halide emulsion for use in the present invention can be subjected to, in addition to gold sensitization, other chemical sensitization. As to the chemical sensitization method that can be used in combination with gold sensitization, sulfur sensitization, selenium sensitization, tellurium sensitization, sensitization using a noble metal other than gold, reduction sensitization, and the like can be mentioned. As compounds used for the chemical sensitization, those described in JP-A-62-215272, page 18, right lower column to page 22, right upper column are preferably used.

Various compounds or precursors thereof can be included in the silver halide emulsion for use in the present invention to prevent fogging from occurring or to stabilize photographic performance during manufacture, storage or photographic processing of the photographic material. That is, as a compound which can be added to the silver halide emulsion, there are many compounds known as an antifogging agent or stabilizer, such as azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole and the like); mercaptopyrimidines, mercaptotriazines; thioketo compounds such as oxazolinethione; azaindenes, for example, triazaindenes, tetrazaindenes (particularly 4-hydroxy-substituted (1,3,3a,7)tetrazaindene), and pentazaindenes; benzenethiosulfonic acid, benzenesulfinic acid, and benzenesulfonamide. Specific examples of compounds useful for the above purposes are disclosed in JP-A-62-215272, pages 39 to 72, and they can be preferably used. In addition, 5-arylamino-1,2,3,4-thiatriazole compounds (the aryl residual group has at least one electron-attractive group) disclosed in European Patent No. 0447647 are also preferably used. These compounds preferably act so that a high illumination intensity speed can be further enhanced, in addition to antifogging and stabilization.

Further, in the present invention, it is preferable for enhancing storage stability of the silver halide emulsion to use hydroxamic acid derivatives described in JP-A-11-109576, cyclic ketones having a double bond both ends of which are substituted with an amino group or a hydroxyl group, in adjacent to a carbonyl group, described in JP-A-11-327094 (particularly those represented by formula (S1) and the descriptions of paragraph numbers 0036 to 0071 of JP-A-11-327094 can be incorporated in the specification of this application by reference), catechols and hydroquinones each substituted with a sulfo group, described in JP-A-11-143011 (e.g., 4,5-dihydroxy-1,3-benzenedisulfonic acid, 2,5-dihydroxy-1,4-benzenedisulfonic acid, 3,4-dihydroxybenzenesulfonic acid, 2,3-dihydroxybenzenesulfonic acid, 2,5-dihydroxybenzenesulfonic acid, 3,4,5-trihydroxybenzenesulfonic acid and salts thereof), hydroxylamines represented by the formula (A) in U.S. Pat. No. 5,556,741 (the descriptions of column 4, line 56 to column 11, line 22 in the U.S. Pat. No. 5,556,741 can be preferably used in the present invention and is incorporated in the specification of this application by reference), and water-soluble reducing agents represented by formula (I) to (III) of JP-A-11-102045.

Further, for the purpose of giving sensitivity in a desired light wavelength range (so-called spectral sensitivity) to the silver halide emulsion for use in the present invention, the compound represented by formula (B-I) or (R-I) may be used in combination with other spectral sensitizing dyes in the same emulsion layer or in a different layer.

Examples of the spectral sensitizing dye which can be used in the photographic material of the present invention for spectral sensitization of blue, green and red light regions, include those disclosed in F. M. Harmer, *Heterocyclic Compounds—Cyanine nyes and Related Compound,* John Wiley & Sons, New York, London (1964). Specific examples of compounds and spectral sensitization processes that are preferably used in the present invention include those described in JP-A-62-215272, from page 22, right upper column to page 38. In addition, the spectral sensitizing dyes described in JP-A-3-123340 are very preferred as red-sensitive spectral sensitizing dyes for silver halide emulsion grains having a high silver chloride content, from the viewpoint of stability, adsorption strength and the temperature dependency of exposure, and the like.

The amount of these spectral sensitizing dyes to be added can be varied in a wide range depending on the occasion, and it is preferably in the range of $0.5\times10^{-6}$ mol to $1.0\times10^{-2}$ mol, more preferably in the range of $1.0\times10^{-6}$ mol to $5.0\times10^{-3}$ mol, per mol of silver halide.

The blue-sensitive silver halide emulsion for use in the present invention, preferably in the first embodiment, preferably comprises tabular grains composed of {100} or {111} planes as major faces accounting for 50% to 100% in terms of the total projected area and having a thickness of 0.01 to 0.30 $\mu$m, an aspect ratio of 2 or more, and a projected diameter of 0.1 to 10. A coefficient of variation of the projected diameter and the thickness (standard deviation of the distribution/average projected diameter or average thickness) is preferably in the range of 0 to 0.4 respectively. The aspect ratio is defined as a value obtained by dividing the diameter of a circle equivalent to a projected area of an individual grain by the thickness of the grain. The greater the aspect ratio is, the thinner thickness and the more flat shape of the grains are obtained. In the present invention, preferably in the first embodiment, the term "tabular grain" means the grains having an the aspect ratio of 1.2 or more. The term "average aspect ratio" means the average value of the aspect ratio of each of entire tabular grains in an emulsion. Moreover, the term "projected diameter" means the diameter of a circle corresponding to the circle having the same area as a projected area of the grain. The term "thickness" refers to the distance between two major faces of the tabular grain. The term "projected diameter" refers to the diameter of a circle having the same area as a projected area measured in such a manner that major faces are placed in parallel with the surface of a substrate and observed from the perpendicular direction thereto.

Tabular silver halide emulsion grains having {100} planes as major faces are generally prepared adding and mixing with stirring a silver salt solution and a halide salt solution in a dispersion medium such as an aqueous gelatin solution. JP-A-6-301129 and JP-A-6-347929, for example, disclose a method of introducing screw dislocation in which the foregoing grain formation is performed in the presence of silver iodide, so that deformation in a grain nucleus is caused by a difference in size of the crystal lattice between silver iodide and silver chloride. JP-A-9-34045, for example, also discloses a method of introducing screw dislocation in which silver bromide is used in place of silver iodide during grain formation. If the screw dislocation is introduced, a two-dimensional nucleation at the dislocation area does not become a rate-limiting factor any more, resulting in acceleration of crystallization at that area. Accordingly, tabular grains are formed by introduction of screw dislocation into two {100} planes crossing each other. Further, {100} tabular grains are formed by addition of an accelerator for forming {100} planes. As the accelerator, for example, imidazoles and 3,5-diaminotriazoles are disclosed in JP-A-6-347928. Further, polyvinyl alcohols are disclosed in JP-A-8-339044.

As a method for forming tabular silver halide emulsion grains having {111} major planes, for example, U.S. Pat. Nos. 4,400,463, 5,185,239, and 5,176,991, JP-A-63-213836, and U.S. Pat. No. 5,176,992 and JP-A-2000-29156, disclose a method of forming grains in the presence of crystal habit-controlling agents, i.e. amino azaindenes, triaminopyrimidines, hydroxyaminoazines, thioureas, xanthonoides, and pyridinium salts, respectively.

The silver halide emulsion for use in the present invention is prepared by generally known three steps composed of a grain formation step in which a water-soluble silver salt and a water-soluble halide salt are reacted, a desalting step and a chemical ripening step.

At least one silver halide emulsion layer of the color photographic light-sensitive material of the present invention contains a silver halide emulsion prepared by a producing method according to the present invention. Examples of other silver halide used in the color photographic light-sensitive material of the present invention include silver chloride, silver bromide, silver (iodo)chlorobromide and silver iodobromide. Particularly, for the rapid processing, it is preferable to use a high silver chloride emulsion having a silver chloride content of 90 mole % or more, more preferably 95 mole % or more, and especially preferably 98 mole % or more. Silver halide grains having a silver bromide-localized phase are more preferable. Further, a ratio [hydrophilic binder amount/silver halide thickness] can be increased by the use of tabular grains having {100} or {111} planes as major faces. Therefore, such tabular grains are preferably used from two points of advances in color development and reduction in processing-induced color mixing.

The term "hydrophilic binder amount" used herein refers to the amount ($g/m^2$) of a hydrophilic binder per $m^2$ of said silver halide emulsion layer. The term "silver halide thickness" used herein refers to the thickness ($\mu$m) occupied, in the direction perpendicular to a substrate, by the silver halide emulsion grains in the silver halide emulsion layer.

The silver halide photographic light-sensitive material of the present invention is explained below.

The silver halide photographic light-sensitive material of the present invention can be used for a black-and-white photography or a color photography. However, the silver halide emulsion defined in the present invention is preferably used in a silver halide photographic light-sensitive material.

The silver halide color photographic light-sensitive material (hereinafter sometimes referred to simply as "light-sensitive material") in which the silver halide emulsion defined in the present invention is preferably used, is a silver halide color photographic light-sensitive material which has, on a support, at least one silver halide emulsion layer containing a yellow dye-forming coupler, at least one silver halide emulsion layer containing a magenta dye-forming coupler and at least one silver halide emulsion layer containing a cyan dye-forming coupler, wherein at least one of said silver halide emulsion layers comprises a silver halide emulsion defined in the present invention.

In the present invention, the above-said silver halide emulsion layer containing a yellow dye-forming coupler functions as a yellow coloring layer, the above-said silver halide emulsion layer containing a magenta dye-forming coupler functions as a magenta coloring layer, and the above-said silver halide emulsion layer containing a cyan dye-forming coupler functions as a cyan coloring layer. The silver halide emulsions contained in the yellow coloring layer, the magenta coloring layer, and the cyan coloring layer may preferably have photosensitivities to mutually different wavelength regions (such as light in a blue region, light in a green region and light in a red region).

The light-sensitive material of the present invention may, if necessary, have a hydrophilic colloid layer, an antihalation layer, an intermediate layer, and a coloring layer as described below, in addition to the above-said yellow coloring layer, magenta coloring layer, and cyan coloring layer.

Other conventionally known photographic materials and additives may be used in the silver halide photographic light-sensitive material of the present invention.

For example, as a photographic support (base), a transmissive type support and a reflective type support may be used. As the transmissive type support, it is preferred to use transparent supports, such as a cellulose nitrate film, and a transparent film of polyethyleneterephthalate, or a polyester of 2,6-naphthalenedicarboxylic acid (NDCA) and ethylene glycol (EG), or a polyester of NDCA, terephthalic acid and EG, provided thereon with an information-recording layer such as a magnetic layer. As the reflective type support, it is especially preferable to use a reflective support having a substrate laminated thereon with a plurality of polyethylene layers or polyester layers (water-proof resin layers or laminate layers), at least one of which contains a white pigment such as titanium oxide.

A more preferable reflective support for use in the present invention is a support having a paper substrate provided with a polyolefin layer having fine holes, on the same side as silver halide emulsion layers. The polyolefin layer may be composed of multi-layers. In this case, it is more preferable for the support to be composed of a fine hole-free polyolefin (e.g., polypropylene, polyethylene) layer adjacent to a gelatin layer on the same side as the silver halide emulsion layers, and a fine hole-containing polyolefin (e.g., polypropylene, polyethylene) layer closer to the paper substrate. The density of the multi-layer or single-layer of polyolefin layer(s) existing between the paper substrate and photographic constituting layers is preferably in the range of 0.40 to 1.0 g/ml, more preferably in the range of 0.50 to 0.70 g/ml. Further, the thickness of the multi-layer or single-layer of polyolefin layer(s) existing between the paper substrate and photographic constituting layers is preferably in the range of 10 to 100 $\mu$m, more preferably in the range of 15 to 70 $\mu$m. Further, the ratio of thickness of the polyolefin layer(s) to the paper substrate is preferably in the range of 0.05 to 0.2, more preferably in the range 0.1 to 0.15.

Further, it is also preferable for enhancing rigidity (mechanical strength) of the reflective support, by providing a polyolefin layer on the surface of the foregoing paper substrate opposite to the side of the photographic constituting layers, i.e., on the back surface of the paper substrate. In this case, it is preferable that the polyolefin layer on the back surface be polyethylene or polypropylene, the surface of which is matted, with the polypropylene being more preferable. The thickness of the polyolefin layer on the back surface is preferably in the range of 5 to 50 $\mu$m, more preferably in the range of 10 to 30 $\mu$m, and further the density thereof is preferably in the range of 0.7 to 1.1 g/ml. As to the reflective support for use in the present invention, preferable embodiments of the polyolefin layer provide on the paper substrate include those described in JP-A-10-333277, JP-A-10-333278, JP-A-11-52513, JP-A-11-65024, European Patent Nos. 0880065 and 0880066.

Further, it is preferred that the above-described water-proof resin layer contains a fluorescent whitening agent. Further, the fluorescent whitening agent also may be dispersed in a hydrophilic colloid layer of the light-sensitive material. Preferred fluorescent whitening agents which can be used, include benzoxazole series, coumarin series, and pyrazoline series compounds. Further, fluorescent whitening agents of benzoxazolylnaphthalene series and benzoxazolylstilbene series are more preferably used. The amount of the fluorescent whitening agent to be used is not particularly limited, and preferably in the range of 1 to 100 $mg/m^2$. When a fluorescent whitening agent is mixed with a water-proof resin, a mixing ratio of the fluorescent whitening agent to be used in the water-proof resin is preferably in the range of 0.0005 to 3% by mass, and more preferably in the range of 0.001 to 0.5% by mass of the resin.

Further, a transmissive type support or the foregoing reflective type support each having coated thereon a hydrophilic colloid layer containing a white pigment may be used as the reflective type support. Furthermore, a reflective type support having a mirror plate reflective metal surface or a secondary diffusion reflective metal surface may be employed as the reflective type support.

As the support for use in the light-sensitive material of the present invention, a support of the white polyester type, or a support provided with a white pigment-containing layer on the same side as the silver halide emulsion layer, may be adopted for display use. Further, it is preferable for improving sharpness that an antihalation layer be provided on the silver halide emulsion layer side or the reverse side of the support. In particular, it is preferable that the transmission density of support be adjusted to the range of 0.35 to 0.8 so that a display may be enjoyed by means of both transmitted and reflected rays of light.

In the light-sensitive material of the present invention, in order to improve the sharpness of an image, and the like, a dye (particularly an oxonole-series dye) that can be discolored by processing, as described in European Patent No. 0,337,490 A2, pages 27 to 76, is preferably added to the hydrophilic colloid layer such that an optical reflection density at 680 nm in the light-sensitive material is 0.70 or more. It is also preferable to add 12% by mass or more (more preferably 14% by mass or more) of titanium oxide that is surface-treated with, for example, dihydric to tetrahydric alcoholes (e.g., trimethylolethane), to a water-proof resin layer of the support.

The light-sensitive material of the present invention preferably contains, in their hydrophilic colloid layers, dyes (particularly oxonole dyes and cyanine dyes) that can be discolored by processing, as described in European Patent No. 0337490 A2, pages 27 to 76, in order to prevent irradiation or halation or enhance safelight safety (immunity). Further, dyes described in European Patent No. 0819977 are also preferably used in the present invention. Among these water-soluble dyes, some deteriorate color separation or safelight safety when used in an increased amount. Preferable examples of the dye which can be used and which does not deteriorate color separation include water-soluble dyes described in JP-A-5-127324, JP-A-5-127325 and JP-A-5-216185.

In the present invention, it is possible to use a colored layer that can be discolored during processing, in place of the water-soluble dye, or in combination with the water-soluble dye. The colored layer capable of being discolored with a processing to be used may contact with a light-sensitive emulsion layer directly, or indirectly through an interlayer containing an agent for preventing color-mixing during processing, such as hydroquinone and gelatin. The colored layer is preferably provided as a lower layer (closer to a support) with respect to the light-sensitive emulsion layer that develops the same primary color as the color of the colored layer. It is possible to provide colored layers independently, each corresponding to respective primary colors. Alternatively, only one layer selected from the above colored layers may be provided. In addition, it is possible to provide a colored layer subjected to coloring so as to match a plurality of primary-color regions. With respect to the optical reflection density of the colored layer, at the wavelength which provides the highest optical density in a range of wavelengths used for exposure (a visible light region from 400 nm to 700 nm for an ordinary printer exposure, and the wavelength of the light generated from the light source in the case of scanning exposure), the optical density is preferably within the range of 0.2 to 3.0, more preferably 0.5 to 2.5, and particularly preferably 0.8 to 2.0.

The colored layer described above may be formed by a known method. For example, there are a method in which a dye in a state of a dispersion of solid fine particles is incorporated in a hydrophilic colloid layer, as described in JP-A-2-282244, from page 3, upper right column to page 8, and JP-A-3-7931, from page 3, upper right column to page 11, left under column; a method in which an anionic dye is mordanted in a cationic polymer, a method in which a dye is adsorbed onto fine grains of silver halide or the like and fixed in the layer, and a method in which a colloidal silver is used, as described in JP-A-1-239544. As to a method of dispersing fine-powder of a dye in solid state, for example, JP-A-2-308244, pages 4 to 13 describes a method in which solid fine particles of dye which is at least substantially water-insoluble at the pH of 6 or less, but at least substantially water-soluble at the pH of 8 or more, are incorporated. The method of mordanting an anionic dye in a cationic polymer is described, for example, in JP-A-2-84637, pages 18 to 26. U.S. Pat. Nos. 2,688,601 and 3,459,563 disclose a method of preparing colloidal silver for use as a light absorber. Among these methods, preferred are the methods of incorporating fine particles of dye and of using colloidal silver.

The silver halide photographic light-sensitive material for use in the present invention, preferably in the first and fourth embodiments, can be used for a color negative film, a color positive film, a color reversal film, a color reversal photographic printing paper, a color photographic printing paper and the like. Among these materials, the light-sensitive material of the present invention is preferably used for a color photographic printing paper. The color photographic printing paper preferably has at least one yellow color-forming silver halide emulsion layer, at least one magenta color-forming silver halide emulsion layer, and at least one cyan color-forming silver halide emulsion layer, on a support. Generally, these silver halide emulsion layers are in the order, from the support, of the yellow color-forming silver halide emulsion layer, the magenta color-forming silver halide emulsion layer and the cyan color-forming silver halide emulsion layer.

However, another layer arrangement which is different from the above, may be adopted.

In the present invention, a yellow coupler-containing silver halide emulsion layer may be disposed at any position on a support. However, in the case where silver halide tabular grains are contained in the yellow coupler-containing layer, it is preferable that the yellow coupler-containing layer is positioned more apart from a support than at least one of a magenta coupler-containing silver halide emulsion layer and a cyan coupler-containing silver halide emulsion layer. Further, it is preferable that the yellow coupler-containing silver halide emulsion layer is positioned most apart from a support of other silver halide emulsion layers, from the viewpoint of color-development acceleration, desilvering acceleration, and reduction in a residual color due to a sensitizing dye. Further, it is preferable that the cyan coupler-containing silver halide emulsion layer is disposed in the middle of other silver halide emulsion layers, from the viewpoint of reduction in a blix fading. On the other hand, it is preferable that the cyan coupler-containing silver halide emulsion layer is the lowest layer, from the viewpoint of reduction in a light fading. Further, each of a yellow-color-forming layer, a magenta-color-forming layer and a cyan-color-forming layer may be composed of two or three layers. It is also preferable that a color-forming layer is formed by disposing a silver halide emulsion-free layer containing a coupler in adjacent to a silver halide emulsion layer, as described in, for example, JP-A-4-75055, JP-A-9-114035, JP-A-10-246940, and U.S. Pat. No. 5,576,159.

Preferred examples of silver halide emulsions and other materials (additives or the like) for use in the present invention, photographic constitutional layers (arrangement of the layers or the like), and processing methods for processing the photographic materials and additives for processing are disclosed in JP-A-62-215272, JP-A-2-33144 and European Patent No. 0355660 A2. Particularly, those disclosed in European Patent No. 0355660 A2 are preferably used. Further, it is also preferred to use silver halide color photographic light-sensitive materials and processing methods therefor disclosed in, for example, JP-A-5-34889, JP-A-4-359249, JP-A-4-313753, JP-A-4-270344, JP-A-5-66527, JP-A-4-34548, JP-A-4-145433, JP-A-2-854, JP-A-1-158431, JP-A-2-90145, JP-A-3-194539, JP-A-2-93641 and European Patent Publication No. 0520457 A2.

In particular, as the above-described reflective support and silver halide emulsion, as well as the different kinds of metal ions to be doped in the silver halide grains, the storage stabilizers or antifogging agents of the silver halide emulsion, the methods of chemical sensitization (sensitizers), the methods of spectral sensitization (spectral sensitizing dyes), the cyan, magenta, and yellow couplers and the emulsifying and dispersing methods thereof, the dye stability-improving agents (stain inhibitors and discoloration inhibitors), the dyes. (colored layers), the kinds of gelatin, the layer structure of the light-sensitive material, and the film pH of the light-sensitive material, those described in the patent publications as shown in the following Table 1 are preferably used in the present invention.

TABLE 1

| Element | JP-A-7-104448 | JP-A-7-77775 | JP-A-7-301895 |
|---|---|---|---|
| Reflective-type bases | Column 7, line 12 to Column 12, line 19 | Column 35, line 43 to Column 44, line 1 | Column 5, line 40 to Column 9, line 26 |
| Silver halide emulsions | Column 72, line 29 to Column 74, line 18 | Column 44, line 36 to Column 46, line 29 | Column 77, line 48 to Column 80, line 28 |
| Different metal ion species | Column 74, lines 19 to 44 | Column 46, line 30 to Column 47, line 5 | Column 80, line 29 to Column 81, line 6 |
| Storage stabilizers or antifoggants | Column 75, lines 9 to 18 | Column 47, lines 20 to 29 | Column 18, line 11 to Column 31, line 37 (Especially, mercaptohetero-cyclic compounds) |
| Chemical sensitizing methods (Chemical sensitizers) | Column 74, line 45 to Column 75, line 6 | Column 47, lines 7 to 17 | Column 81, lines 9 to 17 |
| Sensitizing methods (Spectral sensitizers) | Column 75, line 19 to Column 76, line 45 | Column 47, line 30 to Column 49, line 6 | Column 81, line 21 to Column 82, line 48 |
| Cyan Couplers | Column 12, line 20 to Column 39, line 49 | Column 62, line 50 to Column 63, line 16 | Column 88, line 49 to Column 89, line 16 |
| Yellow couplers | Column 87, line 40 to Column 88, line 3 | Column 63, lines 17 to 30 | Column 89, lines 17 to 30 |
| Magenta couplers | Column 88, lines 4 to 18 | Column 63, line 3 to Column 64, line 11 | Column 31, line 34 to Column 77, line 44 and column 88; lines 32 to 46 |
| Emulsifying and dispersing methods of couplers | Column 71, line 3 to Column 72, line 11 | Column 61, lines 36 to 49 | Column 87, lines 35 to 48 |
| Dye-image-preservability improving agents (antistaining agents) | Column 39, line 50 to Column 70, line 9 | Column 61, line 50 to Column 62, line 49 | Column 87, line 49 to Column 88, line 48 |
| Anti-fading agents | Column 70, line 10 to Column 71, line 2 | | |
| Dyes (coloring layers) | Column 77, line 42 to Column 78, line 41 | Column 7, line 14 to Column 19, line 42, and Column 50, line 3 to Column 51, line 14 | Column 9, line 27 to Column 18, line 10 |
| Gelatins | Column 78, lines 42 to 48 | Column 51, lines 15 to 20 | Column 83, lines 13 to 19 |
| Layer construction of light-sensitive | Column 39, lines 11 to 26 | Column 44, lines 2 to 35 | Column 31, line 38 to Column 32, line 33 |
| Film pH of light-sensitive materials | Column 72, lines 12 to 28 | | |
| Scanning exposure | Column 76, line 6 to Column 77, line 41 | Column 49, line 7 to Column 50, line 2 | Column 82, line 49 to Column 83, line 12 |
| Preservatives in developing | Column 88, line 19 to Column 89, line 22 | | |

As cyan, magenta and yellow couplers which can be used in the present invention, those disclosed in JP-A-62-215272, page 91, right upper column line 4 to page 121, left upper column line 6, JP-A-2-33144, page 3, right upper column line 14 to page 18, left upper column bottom line, and page 30, right upper column line 6 to page 35, right under column, line 11, European Patent No. 0355,660 (A2), page 4 lines 15 to 27, page 5 line 30 to page 28 bottom line, page 45 lines 29 to 31, page 47 line 23 to page 63 line 50, are also advantageously used.

Further, it is preferred for the present invention to add compounds represented by formula (II) or (III) in WO 98/33760 or compounds represented by formula (D) described in JP-A-10-221825.

As the cyan dye-forming coupler (hereinafter also referred to as "cyan coupler") which can be used in the present invention, pyrrolotriazole-series couplers are preferably used, and more specifically, couplers represented by any of. formulae (I) and (II) in JP-A-5-313324 and couplers represented by formula (I) in JP-A-6-347960 are preferred. Exemplified couplers described in these publications are particularly preferred. Further, phenol-series or naphthol-series cyan couplers are also preferred. For example, cyan couplers represented by formula (ADF) described in JP-A-

10-333297 are preferred. As cyan couplers other than the foregoing cyan couplers, there are pyrroloazole-type cyan couplers described in European Patent Nos. 0 488 248 and 0 491 197 (Al)., 2,5-diacylamino phenol couplers described in U.S. Pat. No. 5,888,716, pyrazoloazole-type cyan couplers having an electron-withdrowing group or a hydrogen bond at the 6-position, as described in U.S. Pat. Nos. 4,873,183 and 4,916,051, and particularly pyrazoloazole-type cyan couplers having a carbamoyl group at the 6-position, as described in JP-A-8-171185, JP-A-8-311360 and JP-A-8-339060.

In addition, diphenylimidazole-series cyan couplers described in JP-A-2-33144, 3-hydroxypyridine-series cyan couplers (particularly a coupler, which is a 2-equivalent coupler formed by allowing a 4-equivalent coupler of Coupler (42) to have a chlorine coupling split-off group, and Couplers (6) and (9) enumerated as specific examples are particularly preferable) described in EP 0333185 A2 or cyclic active methylene-series cyan couplers (particularly Couplers 3, 8, and 34 enumerated as specific examples are particularly preferable) described in JP-A-64-32260; pyrrolopyrazole-type cyan couplers described in European Patent No. 0 456 226 A1; or pyrroloimidazole-type cyan coupler described in European Patent No. 0 484 909 can also be used.

Among these cyan couplers, pyrroloazole-series cyan couplers represented by formula (I) described in JP-A-11-282138 are particularly preferred. The descriptions of the paragraph Nos. 0012 to 0059 including exemplified cyan couplers (1) to (47) of the above JP-A-11-282138 can be entirely applied to the present invention, and therefore they are preferably incorporated herein by reference.

As the magenta dye-forming coupler (hereinafter also referred to as "magenta coupler") usable in the present invention, use can be made of 5-pyrazolone-series magenta couplers and pyrazoloazole-series magenta couplers, such as those described in the above-mentioned patent publications in the above table. Among these, preferred are pyrazolotriazole couplers in which a secondary or tertiary alkyl group is directly bonded to the 2-, 3- or 6-position of the pyrazolotriazole ring, as described in JP-A-61-65245; pyrazoloazole couplers having a sulfonamido group in its molecule, as described in JP-A-61-65246; pyrazoloazole couplers having an alkoxyphenylsulfonamido ballasting group, as described in JP-A-61-147254; and pyrazoloazole couplers having a 6-positioned alkoxy or aryloxy group, as described in European Patent No. 0 226 849 A2 and 0 294 785 A, in view of the hue and stability of an image to be formed therefrom and color-forming property of the couplers. Particularly as the magenta coupler, pyrazoloazole couplers represented by formula (M-I) described in JP-A-8-122984 are preferred. The descriptions of paragraph Nos. 0009 to 0026 of the publication JP-A-8-122984 can be entirely and preferably applied to the present invention, and therefore they are incorporated herein by reference. In addition, pyrazoloazole couplers having a steric hindrance group at both the 3- and 6-positions, as described in European Patent Nos. 845 384 and 884 640, are also preferably used.

As the yellow dye-forming coupler (hereinafter also referred to as "yellow coupler"), preferably used in the present invention are acylacetamide-type yellow couplers in which the acyl group has a 3-membered to 5-membered cyclic structure, as described in European Patent No. 0 447 969 A1; malondianilide-type yellow couplers having a cyclic structure, as described in European Patent No. 0482552 A1; pyrrole-2 or 3-yl or indole-2 or 3-ylcarbonylacetic anilide-series couplers, as described in European Patent Nos. 953 870 A, 953 871 A1, 953 872 A1, 953 873 A1, 953 874 A1 and 953 875 A1; acylacetamide-type yellow couplers having a dioxane structure, as described in U.S. Pat. No. 5,118,599, in addition to the compounds described in the above-mentioned table. Above all, acylacetamide-type yellow couplers in which the acyl group is a 1-alkylcyclopropane-1-carbonyl group, and malondianilide-type yellow couplers in which one of the anilido groups constitutes an indoline ring are especially preferably used. These couplers may be used singly or as combined.

It is preferred that the coupler for use in the present invention is also pregnated into a loadable latex polymer (described, for example, in U.S. Pat. No. 4,203,716) in the presence (or absence) of the above high boiling point organic solvent described in the foregoing table, or the coupler is dissolved in the presence (or absence) of the foregoing high boiling point organic solvent with a polymer insoluble in water but soluble in an organic solvent, and then the resultant coupler is emulsified and dispersed into an aqueous hydrophilic colloid solution. The water-insoluble but organic solvent-soluble polymers which can be preferably used, include the homo-polymers and co-polymers disclosed in U.S. Pat. No. 4,857,449, from column 7 to column 15, and WO 88/00723, from page 12 to page 30. The use of methacrylate-series or acrylamide-series polymers is more preferable, and especially the use of acrylamide-series polymers is further preferable, in view of color image stabilization and the like.

In the present invention, known color mixing-inhibitors may be used. Among these compounds, those described in the following publications are preferred.

For example, high molecular weight redox compounds described in JP-A-5-333501; phenidone- or hydrazine-series compounds as described in, for example, WO 98/33760 and U.S. Pat. No. 4,923,787; and white couplers as described in, for example, JP-A-5-249637, JP-A-10-282615 and German Patent No. 19 629 142 A1, may be used. Further, in order to accelerate a developing speed by increasing the pH of a developing solution, redox compounds described in, for example, German Patent Nos. 19 618 786 A1 and 19 806 846 A1, European Patent Nos. 0 839 623 A1 and 0 842 975 A1, and French Patent No. 2 760 460 A1, are also preferably used.

In the present invention, as an ultraviolet ray absorber, it is preferred to use compounds having a high molar extinction coefficient. Examples of these compounds include those having a triazine skeleton. Among these compounds, use can be made of those described, for example, in JP-A-46-3335, JP-A-55-152776, JP-A-5-197074, JP-A-5-232630, JP-A-5-307232, JP-A-6-211813, JP-A-8-53427, JP-A-8-234364, JP-A-8-239368, JP-A-9-31067, JP-A-10-115898, JP-A-10-147577, JP-A-10-182621, German Patent No. 19 739 797 A, European Patent No. 0 711 804 A1, and JP-T-8-501291 ("JP-T" means searched and published International patent application). The ultraviolet ray absorber is preferably added to the light-sensitive layer or/and the light-nonsensitive layer.

As the binder or protecitive colloid which can be used in the light-sensitive material of the present invention, gelatin is preferred advantageously, but another hydrophilic colloid can be used singly or in combination with gelatin. In particular, it is preferable for the gelatin for use in the present invention that the content of heavy metals, such as Fe, Cu, Zn and Mn, as impurities therein be reduced to 5 ppm or below, more preferably 3 ppm or below. Further, the amount of calcium contained in the light-sensitive material of the present invention is preferably 20 mg/m$^2$ or less, more preferably 10 mg/m$^2$ or less, and most preferably 5 mg/m$^2$ or less.

In the present invention, it is preferred to add an antibacterial (fungi-preventing) agent and anti-mold agent as described in JP-A-63-271247, in order to destroy various kinds of molds and bacteria which propagate themselves in a hydrophilic colloid layer and deteriorate the image. Further, the pH of the film of the light-sensitive material of the present invention is preferably in the range of 4.0 to 7.0, more preferably in the range of 4.0 to 6.5.

In the present invention, a surface-active agent may be added to the light-sensitive material, in view of improvement in coating-stability, prevention of static electricity from being occurred, and adjustment of the charge amount. As the surface-active agent, there are anionic, cationic, betaine and nonionic surfactants. Examples thereof include those described in JP-A-5-333492. As the surface-active agent for use in the present invention, a fluorine-containing surface-active agent is preferred. The fluorine-containing surface-active agent may be used singly or in combination with known another surface-active agent. The fluorine-containing surfactant is preferably used in combination with known another surface-active agent. The amount of the surface-active agent to be added to the light-sensitive material is not particularly limited, but generally in the range of $1\times10^{-5}$ to 1 g/m$^2$, preferably in the range of $1\times10^{-4}$ to $1\times10^{-1}$ g/m$^2$, more preferably in the range of $1\times10^{-3}$ to $1\times10^{-2}$ g/m$^2$.

The photosensitive material of the present invention, preferably of the second embodiment, can form an image, via an exposure step in which the photosensitive material is irradiated with light according to image information, and a development step in which the photosensitive material irradiated with light is developed.

The light-sensitive material of the present invention can preferably be used, in addition to the printing system using a general negative printer, in a scanning exposure system using the cathode rays (CRT). The cathode ray tube exposure apparatus is simpler and more compact, and therefore less expensive than a laser-emitting apparatus. Further, optical axis and color (hue) can easily be adjusted. In a cathode ray tube which is used for image-wise exposure, various light-emitting materials which emit a light in the spectral region, are used as occasion demands. For example, any one of red light-emitting materials, green light-emitting materials, blue light-emitting materials, or a mixture of two or more of these light-emitting materials may be used. The spectral region are not limited to the above red, green and blue, and fluorophores which can emit a light in a region of yellow, orange, purple or infrared can be used. Particularly, a cathode ray tube which emits a white light by means of a mixture of these light-emitting materials, is often used.

In the case where the light-sensitive material has a plurality of light-sensitive layers each having different spectral sensitivity distribution from each other and also the cathode ray tube has a fluorescent substance which emits light in a plurality of spectral regions, exposure to a plurality of colors may be carried out at the same time. Namely, color image signals may be input into a cathode ray tube to allow light to be emitted from the surface of the tube. Alternatively, a method in which an image signal of each of colors is successively input and light of each of colors is emitted in order, and then exposure is carried out through a film capable of cutting a color other than the emitted color, i.e., a surface (area) successive exposure, may be used. Generally, among these methods the surface (area) successive exposure is preferred, from the viewpoint of high image quality enhancement, because a cathode ray tube of high resolution can be used.

The light-sensitive material of the present invention can be preferably used in combination with the exposure and development system described in the following publications:

Automatic printing and development system described in JP-A-10-333253;

Conveyor of light-sensitive materials, as described in JP-A-2000-10206;

Recording system including an image-reading apparatus, as described in JP-A-11-215312;

Exposure system including color image-recording system, as described in JP-A-11-B8619 and JP-A-10-202950;

Digital photo-printing system including remote diagnostic system, as described in JP-A-10-210206; and Photo-printing system including an image-recording apparatus, as described in Japanese Patent Application No. 10-159187.

Preferable scanning exposure systems that can be applied to the present invention are described in detail in the patent publications listed in the above Table.

It is preferred to use a band stop filter, as described in U.S. Pat. No. 4,880,726, when the photographic material of the present invention is subjected to exposure with a printer. Color mixing of light can be excluded and color reproducibility is remarkably improved by the above means.

In the present invention, a yellow microdot pattern may be previously formed by pre-exposure before giving an image information, to thereby perform copy restraint, as described in European Patent Nos. 0789270 A1 and 0789480 A1.

Further, in order to process the light-sensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, can be preferably applied. Further, as the preservative used for this developing solution, compounds described in the patent publications listed in the above Table are preferably used.

The present invention is preferably applied to a light-sensitive material having rapid processing suitability. In a rapid processing, the color-development time is 45 sec at the most (preferably 45 to 3 sec), preferably 30 sec or less (preferably 30 to 3 sec), more preferably 20 sec or less (preferably 20 to 3 sec), and most preferably 15 sec or less and 5 sec or more.

Likely the bleach-fixing time is 45 sec at the most (preferably 45 to 3 sec), preferably 30 sec or less (preferably 30 to 3 sec), more preferably 20 sec or less (preferably 20 to 3 sec), and most preferably 15 sec or less and 5 sec or more. Also, the washing or stabilizing time is preferably 40 sec or less (preferably 40 to 3 sec), more preferably 30 sec or less (preferably 30 to 3 sec), and most preferably 20 sec or less and 5 sec or more.

In the present invention, the term "color-developing time" means a period of time required from the beginning of dipping of a light-sensitive material into a color developing solution until the light-sensitive material is dipped into a blix solution in the subsequent processing step. In the case where a processing is carried out using, for example, an autoprocessor, the color developing time is the sum total of a time in which a light-sensitive material has been dipped in a color developing solution (so-called "time in the solution") and a time in which the light-sensitive material after departure from the color developing solution has been conveyed in the air toward a bleach-fixing bath in the step subsequent to color development (so-called "time in the air"). Similarly the term "bleach-fixing time" means a period of time required from the beginning of dipping of a light-sensitive material into a bleach-fixing solution until the light-sensitive material is dipped into a washing or stabilizing bath in the subsequent processing step. Further, the term "washing or stabilizing time" means a period of time in which a light-sensitive material is staying in the washing or stabilizing solution until it begins to be conveyed toward a drying step (so-called "time in the solution").

A drying in the present invention is effected by any one of previously known methods of rapidly drying a color photographic light-sensitive material. It is preferable, from the object of the present invention, to dry a color photographic light-sensitive material within 20 sec, more preferably within 15 minutes, most preferably in the range of 5 sec to 10 sec.

The drying system may be a contact heating system or a warm air spray system, but a combination of these systems is preferred because higher speed drying can be performed by such combined system, in comparison with any one of these systems. More preferable embodiment of the present invention with respective to a drying method is a system of heating a light-sensitive material by contact on a heat roller, and thereafter drying the light-sensitive material by blast of a warm air blown out thereto from a perforated plate or nozzles. At the air blast drying portion, the mass velocity of a warm air sprayed per unit area of the heating surface of the light-sensitive material is preferably 1000 $kg/m^2 \cdot hr$ or more. Further, it is preferable that the shape of an air blast opening be a shape which minimizes pressure loss, and as specific examples of the shape of an air blast opening, those shown in, for example, JP-A-9-33998, FIG. 7 to FIG. 15 can be mentioned. The light-sensitive material of the present invention exerts both rapid processing characteristics and a high sensitivity, and produces a low level of a pressure-induced fog, and further has a suitability for not only a face exposure but also a scanning exposure to high illumination intensity light in particular, and therefore an excellent image can be obtained in the above-described developing time.

Examples of a development method applicable to the photographic material of the present invention after exposure, include a conventional wet system, such as a development method using a developing solution containing an alkali agent and a developing agent, a development method wherein a developing agent is incorporated in the photographic material and an activator solution, e.g., a developing agent-free alkaline solution is employed for the development, as well as a heat development system using no processing solution. In particular, the activator method using a developing agent-free alkaline solution is preferred over the other methods, because the processing solution contains no developing agent, thereby it enables easy management and handling of the processing solution and reduction in loading by waste solution processing to make for environmental preservation.

Examples of the preferable developing agents or their precursors incorporated in the photographic materials in the case of adopting the activator method, include the hydrazine-type compounds described in, for example, JP-A-8-234388, JP-A-9-152686, JP-A-9-152693, JP-A-9-211814 and JP-A-9-160193.

Further, the development processing method in which the photographic material reduced in the amount of silver to be coated undergoes the image amplification processing using hydrogen peroxide (intensification processing) can be employed preferably. In particular, it is preferable to apply this processing method to the activator method. Specifically, the image-forming methods utilizing an activator solution containing hydrogen peroxide, as disclosed in JP-A-8-297354 and JP-A-9-152695, can be preferably used. Although the processing with an activator solution is generally followed by a desilvering step in the activator method, the desilvering step can be omitted in the case of applying the image amplification processing method to photographic materials having a reduced silver amount. In such a case, washing or stabilization processing can follow the processing with an activator solution to result in simplification of the processing process. On the other hand, when the system of reading the image information from photographic materials by means of a scanner or the like is employed, the processing form requiring no desilvering step can be applied, even if the photographic materials are those having a high silver amount, such as photographic materials for shooting.

As the processing materials and processing methods of the activator solution, desilvering solution (bleach/fixing solution), washing solution and stabilizing solution, which can be used in the present invention, known ones can be used. Preferably, those described in *Research Disclosure,* Item 36544, pp. 536–541 (September 1994), and JP-A-8-234388 can be used in the present invention.

The present invention, preferably the second embodiment, relates to a method which can reproduce a sufficient photographic performance and further provides an image decreased in residual color by a sensitizing dye when performing super-rapid processing taking only a little more than one minute from an exposure step to a drying step.

The present invention, preferably the second embodiment, is characterized by a process in which a blue light-sensitive silver halide emulsion in a light-sensitive material of which the thickness of the film swelled in water is 8 $\mu$m or more and 19 $\mu$m or less and the dry film thickness is 3 $\mu$m or more and 7 $\mu$m or less is exposed to light with a wavelength of 420 nm to 450 nm. The present invention relates to technologies for decreasing residual color caused by a sensitizing dye without any deterioration in photographic characteristics by forming an image using a sensitizing dye forming a zone absorbing a short wave by means of exposure using a blue semiconductor laser with a wavelength 420 nm to 450 nm.

As an apparatus of exposing the yellow light-sensitive silver halide emulsion in the present invention, preferably the second embodiment, for example, exposure apparatuses using a cathode ray tube and apparatuses mounted with a gas laser, a light-emitting diode, a semiconductor laser or a second harmonic generation light source (SHG) obtained combining a semiconductor laser or a solid laser using a semiconductor laser as an exciting light source with a non-linear optical crystal may be used without any particular limitation. However, apparatuses which can expose using coherent light are preferred. Although there are various lasers as the devices enabling exposure using coherent light, a semiconductor laser is preferable in view of cost. As a blue laser among these semiconductor lasers, specifically a blue laser with a wavelength of about 470 nm taken out from a semiconductor laser (oscillation wavelength: about 940 nm) by wavelength modulation using an SHG crystal of $LiNbO_3$ having a reversed domain structure in the form of a wave guide, is currently used. In the present invention, preferably in the second embodiment, a blue semiconductor laser (presented by NICHIA CORPORATION in the 48th Meeting of the Japan Society of Applied Physics and Related Societies in March in 2001) with an oscillation wavelengths of 430 to 450 nm is preferably used as the laser with the exposure wavelength.

With regard to exposure systems applied to form a green light-sensitive emulsion layer and a red light-sensitive emulsion layer, a digital scan exposure system using a monochrome high-density light such as a gas laser, a light-emitting diode, a semiconductor laser or a second harmonic generation light source (SHG) obtained combining a semiconductor laser or a solid state laser using a semiconductor laser as an exciting light source with a non-linear optical crystal is preferably used. It is preferable to use a semiconductor laser or a second harmonic generation light source (SHG) obtained combining a semiconductor laser or a solid state laser using a semiconductor laser as an exciting light source with a non-linear optical crystal to make the system more compact and inexpensive. Particularly, it is preferable to use a semiconductor laser to design a device which is compact and inexpensive and has a longer duration of life and high stability and it is desirable to use a semiconductor laser as at least one of the exposure light source. To state in more detail, a green laser with a wavelength of about 530 nm taken out from a semiconductor laser (oscillation wavelength: about 1060 nm) by wavelength modulation using an SHG crystal of $LiNbO_3$ having a reversed domain structure in the form of a wave guide, a red semiconductor laser having a wavelength of about 685 nm (Hitachi Type No. HL6738MG) and a red semiconductor laser having a wavelength of about 650 nm (Hitachi Type No. HL6501MG) are preferably used.

When such a scanning exposure light source is used, the maximum spectral sensitivity wavelength of the light-sensitive material of the present invention, preferably of the second embodiment, can be arbitrarily set up in accordance with the wavelength of a scanning exposure light source to be used. Since oscillation wavelength of a laser can be made half using a SHG light source obtainable by a combination of a nonlinear optical crystal with a semiconductor laser or a solid state laser using a semiconductor as an excitation light source, blue light and green light can be obtained. Accordingly, it is possible to have the spectral sensitivity maximum of a photographic material in normal three wavelength regions of blue, green and red.

The exposure time in such scanning exposure is preferably $10^{-4}$ second or less, more preferably $10^{-6}$ second or less, assuming that the pixel density is 400 dpi.

The light-sensitive material of the present invention, preferably of the second embodiment, is preferably exposed to coherent light. The coherent light means light of which the phase has a fixed nature and which has very high coherency. Typically, it is known that the laser light emitted from a laser has a coherent nature.

As a sensitizing dye of the blue light-sensitive silver halide emulsion to be preferably used in the present invention, preferably in the second embodiment, compounds represented by the formula (I) can be preferably used.

In the formula, $Z_1$ and $Z_2$ respectively represent a non-metal atomic group necessary to complete a benzothiazole ring, provided that $Z_1$ and $Z_2$ have, as a substituent, neither an unsubstituted or substituted aromatic group nor an unsubstituted or substituted hetero aromatic group. Preferable examples of $Z_1$ and $Z_2$ may include benzothiazole, 5-cyanobenzothiazole, 4-chlorobenzothiazole, 5-chlorobenzothiazole, 6-chlorobenzothiazole, 5-nitrobenzothiazole, 4-methylbenzothiazole, 5-methylthiobenzothiazole, 5-methylbenzothiazole, 6-methylbenzothiazole, 5-bromobenzothiazole, 6-bromobenzothiazole, 5-iodobenzothiazole, 5-methoxybenzothiazole, 6-methoxybenzothiazole, 6-methylthiobenzothiazole, 5-ethoxybenzothiazole, 5-ethoxycarbonylbenzothiazole, 5-carboxybenzothiazole, 5-fluorobenzothiazole, 5-chloro-6-methylbenzothiazole, 5,6-dimethylbenzothiazole, 5,6-dimethylthiobenzothiazole, 5,6-dimethoxybenzothiazole, 5-hydroxy-6-methylbenzothiazole, tetrahydrobenzothiazole, 4-phenylbenzothiazole and 5,6-methylenedioxybenzothiazole. Among these compounds, benzothiazole, 5-cyanobenzothiazole, 4-chlorobenzothiazole, 5-chlorobenzothiazole, 5-bromobenzothiazole, 6-bromobenzothiazole, 5-iodobenzothiazole, 5-methoxybenzothiazole, 5-ethoxycarbonylbenzothiazole, 5-carboxybenzothiazole, 5-fluorobenzothiazole, 5-chloro-6-methylbenzothiazole, 5,6-dimethylthiobenzothiazole, 5,6-dimethoxybenzothiazole and 5-hydroxy-6-methylbenzothiazole are more preferable.

Examples of the alkyl groups represented by $R_1$ and $R_2$ include methyl, ethyl, propyl, butyl, pentyl and octyl. Further, examples of the substituent of the alkyl group include carboxy, sulfo, cyano, fluorine, chlorine, bromine, hydroxy, methoxycarbonyl, ethoxycarbonyl, phenoxycarbonyl, benzyloxycarbonyl, methoxy, ethoxy, benzyloxy, phenethyloxy, phenoxy, p-tolyloxy, acetyloxy, propionyloxy, acetyl, propionyl, benzoyl, mesyl, carbamoyl, N,N-dimethylcarbamoyl, morpholinocarbonyl, piperidinocarbonyl, sulfamoyl, N,N-dimethylsulfamoyl, morpholinosulfonyl, piperidinosulfonyl, phenyl, 4-chlorophenyl, 4-methylphenyl and α-naphthyl. $R_1$ and $R_2$ are respectively preferably methyl, ethyl, n-propyl, n-butyl, n-pentyl, n-hexyl, 2-carboxyethyl, carboxymethyl, 2-sulfoethyl, 3-sulfopropyl, 4-sulfobutyl and 3-sulfobutyl.

$M_1$ is contained in the formula to show the presence or absence of a cation or an anion when it is necessary to neutralize the ion charge of the dye represented by the formula (I). Typical cations are an inorganic or organic ammonium ion and an alkali metal ion. on the other hand, the anion may be specifically either an inorganic anion or an organic anion. Examples of the anion include halogen anions (e.g., a fluoride ion, chloride ion, bromide ion and iodine ion), substituted arylsulfonic acid ions (e.g., a p-toluenesulfonic acid ion and p-chlorobenzenesulfonic acid ion), aryldisulfonic acid ions (e.g., a 1,3-benzenedisulfonic acid ion, 1,5-naphthalenedisulfonic acid ion and 2,6-naphthalenedisulfonic acid ion), alkylsulfuric acid ions (e.g., a methylsulfuric acid ion), sulfuric acid ions, thiocyanic acid ions, perchloric acid ions, tetrafluoroboric acid ions, picric acid ions, acetic acid ions and trifluoromethanesulfonic acid ions. Among these ions, a triethylammonium ion, pyridinium ion, sodium ion, iodine ion and p-toluenesulfonic acid ion are preferable.

The spectral sensitizing dye represented by the formula (I) may be synthesized based on the methods described in F. M. Hamer "Heterocyclic Compounds—Cyanine dyes and related Compounds" (John Wiley & Sons, New York, London, published in 1964), U.S. Pat. Nos. 3,582,344 and 2,734,900, A. I. Tolmachev etc., Dokl. Akad. Nauk SSSR, No. 177, pp. 869–872 (1967), Ukr. Khim. Zh., Vol 40, No. 6 pp. 625–629 (1974) and Zh. Org. Khim., Vol 15, No. 2, pp. 400–407 (1979). Specific examples of the compound represented by the formula (I) used in the present invention will be shown hereinbelow; however, these examples are not intended to be limiting of the present invention.

I-(1)
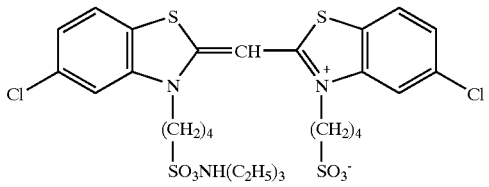
I-(2)
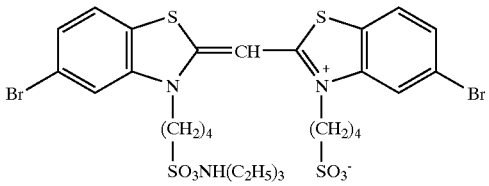
I-(3)
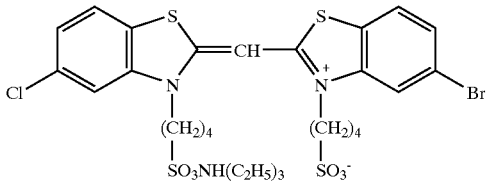
I-(4)
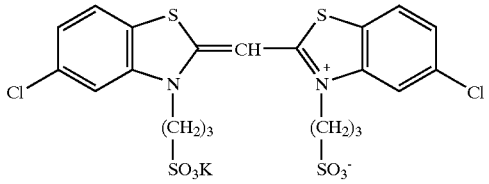
I-(5)
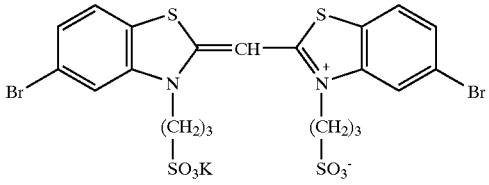
I-(6)
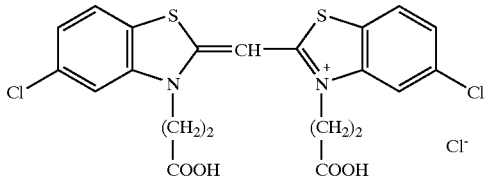
I-(7)
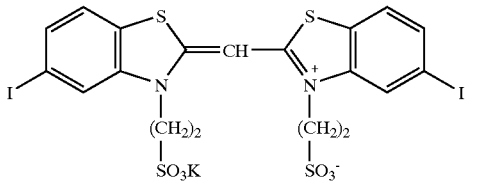
I-(8)
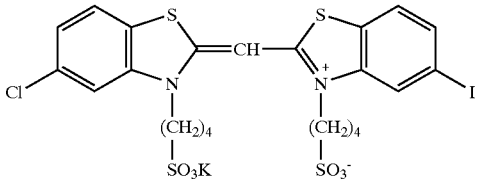
-continued
I-(9)
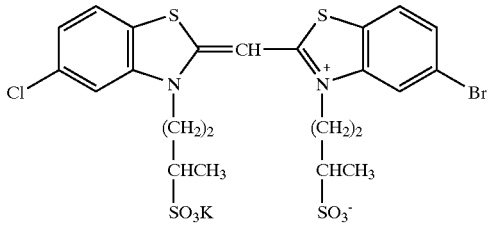
I-(10)
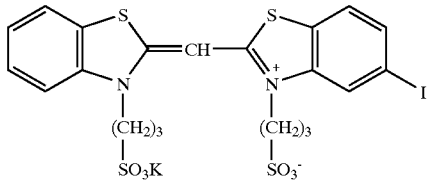
I-(11)
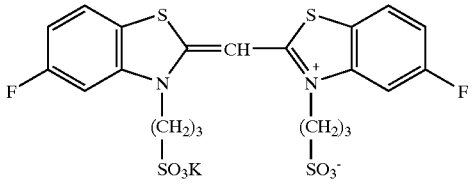
I-(12)
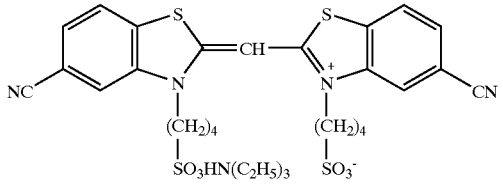
I-(13)
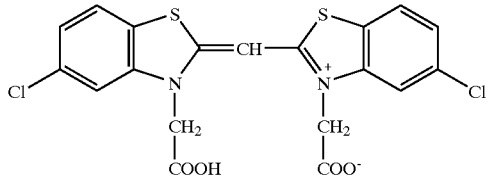
I-(14)
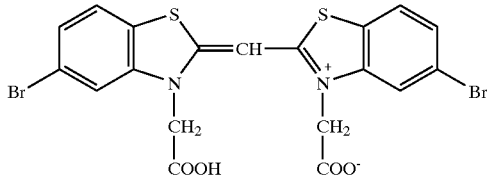
I-(15)
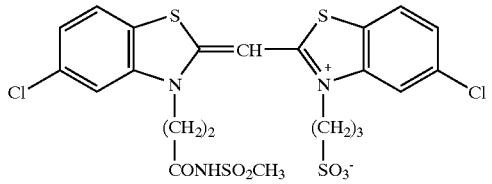
I-(16)
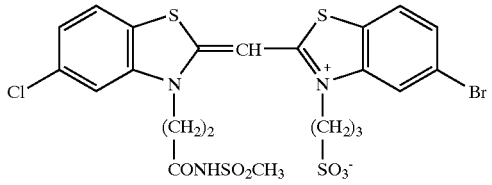

-continued
I-(17)
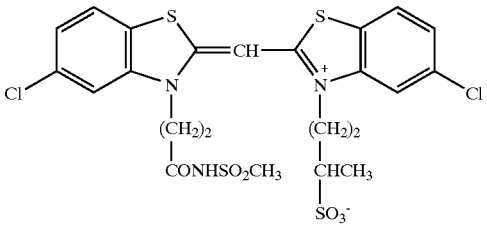
I-(18)
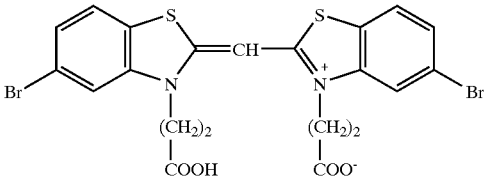
I-(19)
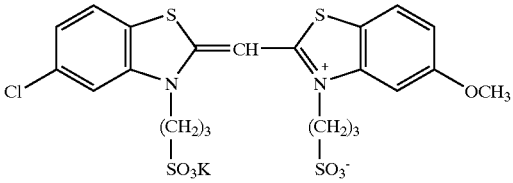
I-(20)
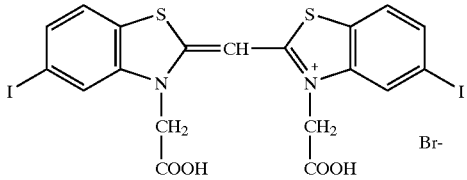
I-(21)
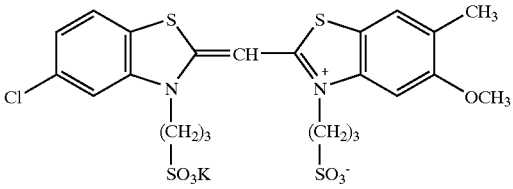
I-(22)
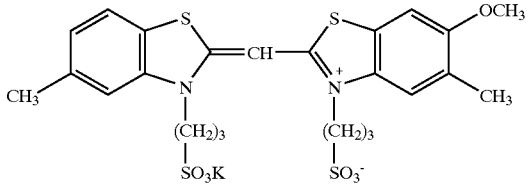
I-(23)
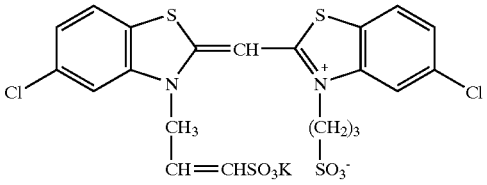
-continued
I-(24)
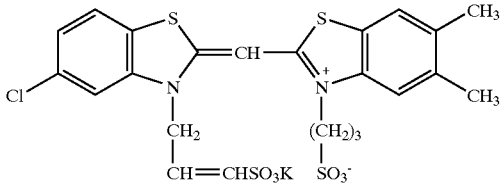
I-(25)
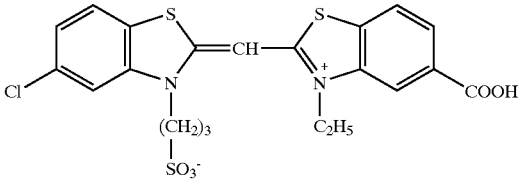
I-(26)
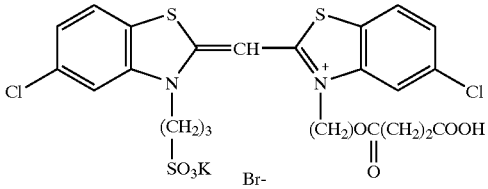
I-(27)
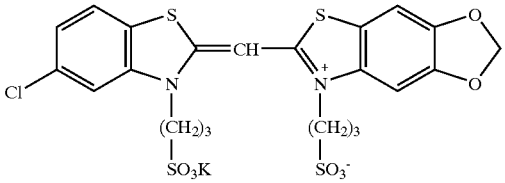
I-(28)
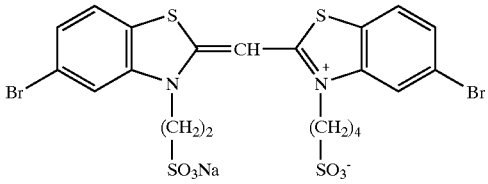
I-(29)
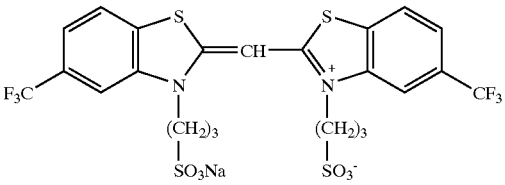
I-(30)
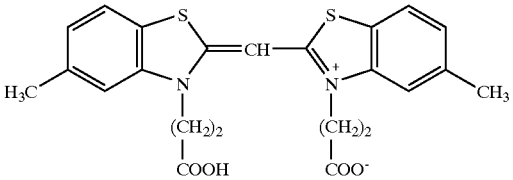

-continued

I-(31)

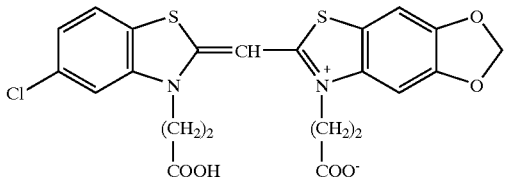

I-(32)

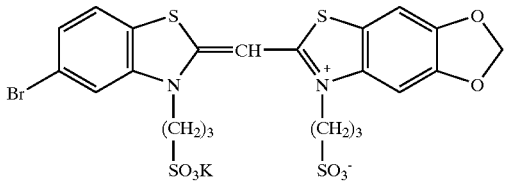

I-(33)

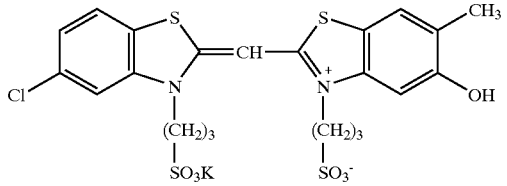

I-(34)

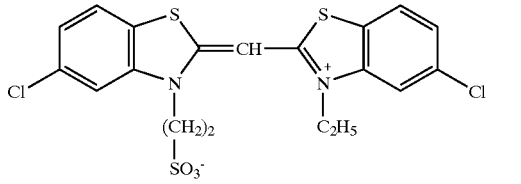

I-(35)

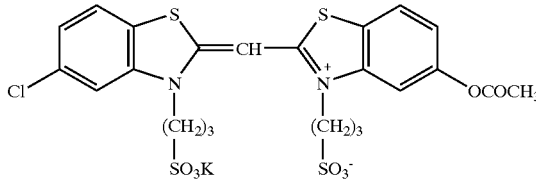

I-(36)

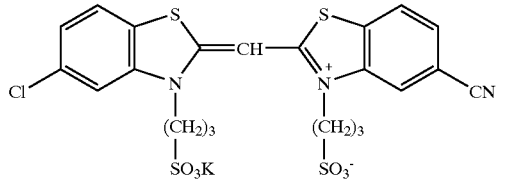

An amount of these sensitizing dyes to be added respectively varies depending on the occasion. But, the amount to be added is preferably in the range of $0.5\times10^{-6}$ mole to $1.0\times10^{-2}$ mole, more preferably in the range of $1.0\times10^{-6}$ mole to $5.0\times10^{-3}$ mole, per mole of silver halide respectively.

Examples of the spectral sensitizing dye which can be used in the photographic material of the present invention, preferably of the second embodiment, for spectral sensitization of blue, green and red light regions, include those disclosed in F. M. Harmer, *Heterocyclic Compounds—cyanine Dyes and Related Compounds,* John Wiley & Sons, New York, London (1964). Specific examples of compounds and spectral sensitization processes that are preferably used in the present invention include those described in JP-A-62-215272, from page 22, right upper column to page 38. In addition, the spectral sensitizing dyes described in JP-A-3-123340 are very preferred as red-sensitive spectral sensitizing dyes for silver halide emulsion grains having a high silver chloride content, from the viewpoint of stability, adsorption strength and the temperature dependency of exposure, and the like.

As to a method of evaluation for the residual color, principally the absorption spectrum of an unexposed portion after treated is measured and the obtained data is digitized, whereby the evaluation.for the residual color can be made. For example, using a U-3410-model spectrophotometer manufactured by Hitachi, Ltd., the evaluation for the residual color may be made by finding reflection absorbance in the condition of an integrating sphere numerical aperture of 2% and a slit width of 5 nm where specular light is excluded. Also, when the absorption of the residual color is different, it is possible to make functional evaluation with the eye.

In the present invention, preferably in the second embodiment, the swelled film thickness is preferably 8 μm to 19 μm and more preferably 9 μm to 18 μm to raise drying rate. The swelled film thickness may be measured using a chopper bar system in the condition that a dried light-sensitive material is dipped in a 35° C. aqueous solution to allow it to be swelled and to reach complete equilibrium.

The film thickness in the present invention, preferably in the second embodiment, is preferably 3 μm to 7.5 μm and more preferably 3 μm to 6.5 μm to satisfy developing progressiveness, fixing and bleaching ability and the ability to eliminate residual color also in the case of carrying out super-rapid processing. As to a method of evaluating the dry film thickness, a change in film thickness between the films before and after the dry film is peeled off or the section of the film may be observed using an optical microscope or an electron microscope to make measurement.

The amount of silver to be applied in the present invention, preferably in the second embodiment, is preferably 0.2 g/m$^2$ to 0.5 g/m$^2$ and more preferably 0.2 g/m$^2$ to 0.47 g/m$^2$ to raise the rate of fixing/bleaching.

In order to prevent a variation in photographic characteristics during latent image time since exposure until developing and to achieve satisfactory photographic characteristics in being exposed by a semiconductor laser in the present invention, preferably in the second embodiment, a six-coordination complex having, as a center metal, Ir having at least one $H_2O$ as a ligand is preferably used, a six-coordination complex having, as a center metal, Ir having at least one $H_2O$ as a ligand and Cl, Br or I as the remaining ligands is more preferably used and a six-coordination complex having, as a center metal, Ir having at least one $H_2O$ as a ligand and Cl as the remaining ligands is most preferably used in the silver halide emulsion according to the present invention.

Specific examples of the six-coordination complex in which at least one ligand is $H_2O$ and the remaining ligands are Cl, Br or I, and iridium is a central metal, are listed below. However, the iridium compound for use in the present invention, preferably in the second embodiment, is not limited thereto.

$[Ir(H_2O)Cl_5]^{2-}$
$[Ir(H_2O)_2Cl_4]^{-}$
$[Ir(H_2O)Br_5]^{2-}$
$[Ir(H_2O)_2Br_4]^{-}$

The foregoing metal complexes are anionic ions. When these are formed into salts with cationic ions, counter cationic ions are preferably soluble in water. Preferable examples thereof include alkali metal ions such as a sodium ion, a potassium ion, a rubidium ion, a cesium ion and a lithium ion, an ammonium ion and an alkyl ammonium ion. These metal complexes can be used being dissolved in water or mixed solvents of water and appropriate water-miscible organic solvents (such as alcohols, ethers, glycols, ketones, esters and amines). These iridium complexes are added in amounts of, preferably $1\times10^{-10}$ mole to $1\times10^{-3}$ mole, most preferably $1\times10^{-8}$ mole to $1\times10^{-5}$ mole, per mole of silver during grain formation.

The six-coordination complex having, as a center metal, Ir having at least one $H_2O$ as a ligand and preferably used in the present invention, preferably in the second embodiment, is preferably contained by doping in the silver halide grain at a position where the content of silver chloride is 90 mol % or more. If the content of silver chloride in the silver halide grain doped with the above six-coordination complex is less than 90%, the gradation tends to be softened and such a content is therefore undesirable.

Moreover, in the present invention, preferably in the second embodiment, a six-coordination complex having, as a center metal, Ir having Cl, Br or I as a ligand is preferably used in combination with the above six-coordination complex having at least one $H_2O$ as a ligand. A six-coordination complex having, as a center metal, Ir having Cl, Br or I as all of the six remaining ligands is more preferable and a six-coordination complex having, as a center metal, Ir having Cl as all of the six remaining ligands is particularly preferable. Specific examples of the six-coordination complex in which all of 6 ligands are made of Cl, Br or I and iridium is a central metal are listed below. However, the iridium complex in the present invention is not limited thereto.

$[IrCl_6]^{2-}$
$[IrCl_6]^{3-}$
$[IrBr_6]^{2-}$
$[IrBr_6]^{3-}$
$[IrI_6]^{3-}$

The six-coordination iridium complex having, as a center metal, Ir having Cl, Br or I as ligands is contained in the silver halide at a position where the content of silver bromide is preferably 20 mol % or more, more preferably 30 mol % or more and still more preferably 50 mol % or more to prevent a variation in photographic characteristics during latent image time since an exposure step until a developing step. The position of silver halide where the content of silver bromide is 20 mol % or more may be formed by addition of a Ag solution and counter addition of a halogen solution or by adding Ag and a halogen in the form of a silver halide fine grain. In this case, although the foregoing Ir complex may be added separately from the fine grain, it is more preferably contained in the fine grain in advance. This Ir complex is contained in an amount of preferably $1\times10^{-10}$ mol to $1\times10^{-4}$ mol and most preferably $1\times10^{-8}$ mol to $1\times10^{-5}$ mol, per mol of silver. As to a measures for analyzing Ir, it may be analyzed by detecting a halogen and Ir by ICP-mass-spectroscopy with dissolving the silver halide.

With regard to the time required for treating the light-sensitive material having an suitability for super-rapid processing in the present invention, preferably in the second embodiment, color developing time is preferably 30 seconds or less, more preferably 25 seconds or less and 6 seconds or more and still more preferably 20 seconds or less and 6 seconds or more. Similarly, bleaching/fixing time is preferably 40 seconds or less, more preferably 30 seconds or less and 6 seconds or more and still more preferably 20 seconds or less and 6 seconds or more. Also, water-washing or stabilizing time is preferably 40 seconds or less and more preferably 30 seconds or less and 6 seconds or more.

The reflective support used for use in the present invention, preferably in the second embodiment, will be explained in detail.

The reflective support for use in the present invention, preferably in the second embodiment, preferably has a structure in which a white pigment is contained in the water-resistant resin coating layer thereof on the side where the light-sensitive layer is formed by application. Examples of the white pigment to be mixed with and dispersed in the water-resistant resin may include inorganic pigments such as titanium dioxide, barium sulfate, lithopone, aluminum oxide, calcium carbonate, silicon oxide, antimony trioxide, titanium phosphate, zinc oxide, lead white and zirconium oxide and organic fine powders such as polystyrene and styrene-divinylbenzene copolymers. Among these pigments, the use of titanium dioxide is particularly effective. Although titanium dioxide may be either a rutile type or an anatase type, an anatase type is preferable when whiteness is given priority and a rutile type is preferable when sharpness is given priority. An anatase type and a rutile type may be blended with each other taking whiteness and sharpness into account. Moreover, in the case where the water-resistant resin layer is made of a multilayer, it is preferable to use a method in which an anatase type is used in one layer and a rutile type is used in another layer. The titanium dioxide may be those produced by either a sulfate method or a chloride method.

The water-resistant resin of the reflective support for use in the present invention, preferably in the second embodiment, is resins having a water absorbance (mass %) of 0.5 or less and preferably 0.1 or less. Examples of these resins include polyethylene, polypropylene, polyolefins such as polyethylene type polymers, vinyl polymers and their copolymers (e.g., polystyrene, polyacrylate and its copolymer) and polyesters (e.g., polyethylene terephthalate and polyethylene isophthalate) or their copolymers.

Polyethylenes and polyesters are particularly preferable. As the polyethylene, high density polyethylene, low density polyethylene and linear low-density polyethylene and blends of these polyethylenes may be used.

As the polyester, a polyester synthesized by condensation polymerization of a dicarboxylic acid with a diol is preferred. As a preferable dicarboxylic acid, for example, terephthalic acid, isophthalic acid, and naphthalenedicarboxylic acid can be mentioned. As a preferable diol, for example, ethylene glycol, butylene glycol, neopentyl glycol, triethylene glycol, butanediol, hexylene glycol, bisphenol A/ethylene oxide adduct (2,2-bis(4-(2-hydroxyethyloxy) phenyl)propane), and 1,4-dihydroxymethylcyclohexane can be mentioned. Various polyesters obtained by condensation polymerization of one of, or a mixture of, these dicarboxylic acids with one of, or a mixture of, these diols can be used. In particular, at least one of dicarboxylic acids is preferably terephthalic acid.

The mixing ratio of the above water-resistant resin to a white pigment is from 98/2 to 30/70, preferably from 95/5 to 50/50, and particularly preferably from 90/10 to 60/40, in terms of weight ratio (water-resistant resin/white pigment). Preferably these water-resistant resin layers are coated on a base to have a thickness of 2 to 200 $\mu$m, and more preferably 5 to 80 $\mu$m. The thickness of the resin or resin composition that will be applied to the surface of the base where the light-sensitive layers are not applied is preferably 5 to 100 μm, and more preferably 10 to 50 μm.

In the reflective base used in the present invention, preferably in the second embodiment, preferably in some cases the reflective base is a reflective base in which a water-proof resin coat layer on the side where the light-sensitive layer is applied comprises two or more water-proof resin coat layers different in content of a white pigment, in view, for example, of the cost and the suitability for production of the base. In that case, out of the water-proof resin coat layers different in white pigment content, the water-proof resin coat layer situated nearest to the base has preferably a white pigment content lower than that of at least one water-proof resin coat layer located above the former water-proof resin coat layer.

The white pigment content of each layer of the multilayer water-proof resin layer is generally 0 to 70%. by mass, preferably 0 to 50% by mass, and more preferably 0 to 40% by mass. The white pigment content of the layer having the highest white pigment content in the multilayer water-proof resin layers is generally 9 to 70% by mass, preferably 15 to 50% by mass, and more preferably 20 to 40% by mass.

Also, a bluing agent may be contained in the water-resistant resin layer to control the resin layer within the range of a white base according to the present invention. As the bluing agent, ultramarine, cobalt blue, oxidized cobalt phosphate, quinacridone type pigments and the like and mixtures of these pigments known generally are used. Although no particular limitation is imposed on the particle diameter, the particle diameter of a commercially available bluing agent is generally about 0.3 μm to 10 μm. A particle diameter falling in this range gives no hindrance to use. In the case where the water-proof resin layer of the reflective support to be used in the present invention, preferably in the second embodiment, has a multilayer structure, the content of the bluing agent in the water-proof layer is preferably as follows: the content of the bluing agent in the outermost water-proof resin layer is made to be that in lower layers or more. A preferable content of the bluing agent is 0.2 mass % to 0.5 mass % in the outermost layer and 0 to 0.45 mass % in layers under the outermost layer.

A base to be used for the reflective support in the present invention, preferably in the second embodiment, may be any of natural pulp paper using natural pulp as its major raw material, mixed paper made of natural pulp and synthetic fiber, synthetic fiber paper containing synthetic fiber as its major component, so-called synthetic paper obtained by forming a synthetic resin film such as a polystyrene film and polypropylene film as imitation paper and plastic films such as polyester films, e.g., polyethylene terephthalate films and polybutylene terephthalate films, triacetic acid cellulose films, polystyrene films and polyolefin films, e.g., polypropylene films. However, natural pulp paper (hereinafter referred to simply as raw paper) is particularly preferably and advantageously used as the base of the photographic water-resistant resin coating. According to the need, the white base may be controlled within the range defined in the present invention by adding a dye and a fluorescent dye.

Although no particular limitation is imposed on the thickness of the raw paper used for the support used in the present invention, preferably in the second embodiment, the basic weight is preferably 50 g/m$^2$ to 250 g/m$^2$ and the thickness is preferably 50 μm to 250 μm.

A more preferable reflective support for use in the present invention, preferably in the second embodiment, is a support having a paper substrate provided with a polyolefin layer having fine holes, on the same side as silver halide emulsion layers. The polyolefin layer may be composed of multi-layers. In this case, it is more preferable for the support to be composed of a fine hole-free polyolefin (e.g., polypropylene, polyethylene) layer adjacent to a gelatin layer on the same side as the silver halide emulsion layers, and a fine hole-containing polyolefin (e.g., polypropylene, polyethylene) layer closer to the paper substrate. The density of the multi-layer or single-layer of polyolefin layer(s) existing between the paper substrate and photographic constituting layers is preferably in the range of 0.40 to 1.0 g/ml, more preferably in the range of 0.50 to 0.70 g/ml. Further, the thickness of the multi-layer or single-layer of polyolefin layer(s) existing between the paper substrate and photographic constituting layers is preferably in the range of 10 to 100 μm, more preferably in the range of 15 to 70 μm. Further, the ratio of thickness of the polyolefin layer(s) to the paper substrate is preferably in the range of 0.05 to 0.2, more preferably in the range 0.1 to 0.15.

Further, it is also preferable for enhancing rigidity (mechanical strength) of the reflective support, by providing a polyolefin layer on the surface of the foregoing paper substrate opposite to the side of the photographic constituting layers, i.e., on the back surface of the paper substrate. In this case, it is preferable that the polyolefin layer on the back surface be polyethylene or polypropylene, the surface of which is matted, with the polypropylene being more preferable. The thickness of the polyolefin layer on the back surface is preferably in the range of 5 to 50 μm, more preferably in the range of 10 to 30 μm, and further the density thereof is preferably in the range of 0.7 to 1.1 g/ml. As to the reflective support for use in the present invention, preferably in the second embodiment, preferable embodiments of the polyolefin layer provide on the paper substrate include those described in JP-A-10-333277, JP-A-10-333278, JP-A-11-52513, JP-A-11-65024, European Patent Nos. 0880065 and 0880066.

Further, it is preferred that the above-described water-proof resin layer contains a fluorescent whitening agent. Further, the fluorescent whitening agent also may be dispersed in a hydrophilic colloid layer of the light-sensitive material. Preferred fluorescent whitening agents which can be used, include benzoxazole series, coumarin series, and pyrazoline series compounds. Further, fluorescent whitening agents of benzoxazolylnaphthalene series and benzoxazolylstilbene series are more preferably used. The amount of the fluorescent whitening agent to be used is not particularly limited, and preferably in the range of 1 to 100 mg/m$^2$. When a fluorescent whitening agent is mixed with a water-proof resin, a mixing ratio of the fluorescent whitening agent to be used in the water-proof resin is preferably in the range of 0.0005 to 3% by mass, and more preferably in the range of 0.001 to 0.5% by mass of the resin.

Further, a transmissive type support or the foregoing reflective type support each having coated thereon a hydrophilic colloid layer containing a white pigment may be used as the reflective type support. Furthermore, a reflective type support having a mirror plate reflective metal surface or a secondary diffusion reflective metal surface may be employed as the reflective type support.

Also, in the present invention, preferably in the second embodiment, a dye or a pigment which is not decolorized by processing is added to colorize and the light-sensitive material after processed is made to contain a fluorescent whitening agent, whereby the white background can be controlled within the preferable range defined in the present invention.

Typically, as color-development processing when defining hue and the white background in the present invention, preferably in the second embodiment, there is a method in which a process is carried out using a processing solution obtained after a sample of the light-sensitive material is imagewisely exposed from a negative film having an average density by using a mini-lab "PP350" (trade name) manufactured by Fuji Photo Film Co., Ltd. and a CP48S Chemical (trade name) as a processing agent and continuous processing is carried out until the volume of a color-developer replenisher becomes twice the volume of a tank of a color developing solution.

The chemical as the processing agent may be CP45X, or CP47L, manufactured by Fuji Photo Film Co., Ltd., or RA-100, RA-4, manufactured by Eastman Kodak Co. (each trade name), or the like without any problem.

As the color developing solution, a known or commercially available diaminostilbene type fluorescent whitening agent may be used. As known bistriazinyldiaminostilbene-disulfonic acid compound, the compounds described in JP-A-6-329936, JP-A-7-140625 or JP-A-10-104809 are preferable. The commercially available compounds are described in, for example, "Senshoku Note (Notebook on Dyeing)", 19th edition (Shikisensha Co., Ltd.), pp. 165 to 168. Among the products described in this publication, Blankophor UWliq, Blankophor REU, or Hakkol BRK (each trade names) are preferred.

The pigment that is used to color a hydrophilic colloidal layer among the photographic constitutional layers in the present invention, preferably in the second embodiment, is explained in detail below. In the silver halide photographic light-sensitive material of the present invention, preferably of the second embodiment, at least one pigment is preferably dispersed in at least one layer of light-sensitive silver halide emulsion layers and non light-sensitive layers, each of which are coated on a reflective support. In other words, at least one hydrophilic colloid layer coated on a reflective support is a layer containing an insoluble pigment. In the present invention, preferably in the second embodiment, the pigment-containing layer may be a light-sensitive layer containing a silver halide emulsion, or it may be any of light-insensitive layers, such as interlayers positioned between silver halide emulsion layers, and ultraviolet-absorbing layers positioned above (as overlayers of) the silver halide emulsion layers. In order to regulate the characteristic curve, a coating flow rate of the silver halide emulsion layer is generally changed. Therefore, it is often preferred to incorporate a pigment in a light-insensitive layer so that tinting is kept constant.

Usually yellow stain is conquered by blue-tinting. Such tinting is generally performed by adding a pigment in an amount sufficient to compete with yellow stain so as to form a neutral color which looks like white by a human eye. Further, it is possible to correct the yellow stain over the wide range, by using two or more kinds of pigment with different amounts to be used from each other. Generally a blue pigment which changes a resulting hue to the cyan side, and a red or violet pigment which changes a resulting hue to the magenta side, are used in combination. Such combination use enables to control the tint over the wide range.

The pigment for use in the present invention, preferably in the second embodiment, is not particularly limited, so long as it is water-insoluble. Particularly preferably, the pigment has a strong affinity to an organic solvent and moreover it is easily dispersed in the organic solvent.

Generally, in order to effectively tint, the particle size of the pigment is preferably 0.01 $\mu$m to 5 $\mu$m, more preferably 0.01 $\mu$m to 3 $\mu$m.

In the present invention, preferably in the second embodiment, the pigment is most preferably introduced as follows:

Similarly to the method in which a photographically useful substance such as an ordinary dye-forming coupler (also referred to as a coupler herein) is emulsified and dispersed, and the resulting dispersion is included in a light-sensitive material, the pigment for use in the present invention, preferably in the second embodiment, is added to a high boiling point organic solvent to form an uniform spontaneous dispersion liquid composed of fine-particles of the pigment. The resulting liquid is emulsified and dispersed together with a dispersing agent of a surface active agent, in a hydrophilic colloid (preferably an aqueous gelatin solution), by means of a known device such as ultrasonic, colloid mill, homogenizer, Manton-Gaulin, or high speed DISOLVER, so that a dispersion of the pigment can be obtained in the form of fine particles of the pigment.

The high boiling point organic solvent that can be used in the present invention preferably in the second embodiment, is not particularly limited, and ordinary ones can be used. Examples of the solvent include those described in U.S. Pat. No. 2,322,027 and JP-A-7-152129.

An auxiliary solvent may be used together with the high boiling point organic solvent. Examples of the auxiliary solvent include acetates of a lower alcohol, such as ethyl acetate and butyl acetate; ethyl propionate, secondary butyl acetate, methyl ethyl ketone, methyl isobutyl ketone, β-ethoxyethyl acetate, methyl cellosolve acetate, methyl carbitol acetate and cyclohexanone.

The pigment for use in the present invention, preferably in the second embodiment, is most preferably used as an emulsion which is prepared by including the pigment in an organic solvent having dissolved therein a photographically useful compound such as a coupler for use in the light-sensitive material of the present invention, and then subjecting the resulting mixture to co-emulsification.

The present invention is explained in more detail with reference to the following some examples. However, the present invention is not limited to those examples, unless otherwise specified.

In the present invention, preferably in the second embodiment, any kind of pigment can be used without limitation, so long as the pigment enables to control the color tone as required and also can remain in a light-sensitive material without changing itself at the time of processing. Preferable pigments are explained with reference to specific examples below. The term "blue pigment" for use in the present invention, preferably in the second embodiment, refers to a pigment classified as the C.I. Pigment Blue in "Color Index" (The Society of Dyers and Colourists). Similarly, the term "red pigment" and the term "violet pigment" for use in the present invention, preferably in the second embodiment, refer to a pigment classified as the C.I. Pigment Red and a pigment classified as the C.I. Pigment Violet, in "Color Index", respectively.

Examples of the blue pigment for use in the present invention, preferably in the second embodiment, include organic pigments, such as azo pigments (e.g., C.I. Pigment Blue 25), phthalocyanine pigments (e.g., C.I. Pigment Blues 15:1, 15:3, 15:6, 16, 75), indanthrone pigments (e.g., C.I. Pigment Blues 60, 64, 21), basic dye lake pigments of triarylcarbonium series (e.g., C.I. Pigment Blues 1, 2, 9, 10, 14, 62), acidic dye lake pigments of triarylcarbonium series (e.g., C.I. Pigment Blues 18, 19, 24:1, 24:x, 56, 61), and indigo pigments (e.g., C.I. Pigment Blues 63, 66). Among these pigments, indanthrone pigments, basic dye lake pigments and acidic dye lake pigments of triarylcarbonium series, and indigo pigments are preferred in view of the resultant hue. Further, indanthrone pigments are most preferred from the viewpoint of fastness.

As the blue pigment, ultramarine and cobalt blue each of which is an inorganic pigment, can also be preferably used in the present invention, preferably in the second embodiment.

Among indanthrone pigments for use in the present invention preferably in the second embodiment, those having high affinity to an organic solvent are particularly preferred. Such pigments can be selected from commercially available products. For example, Blue A3R-KP (trade name) and Blue A3R-K (trade name), each of which are manufactured by Ciba Specialty Chemicals, can be used.

In order to control the hue in the present invention, preferably in the second embodiment, red and/or violet pigments are preferably used in combination with the blue pigment. Preferable examples of the red pigment include azo pigments (e.g., C.I. Pigment Reds 2, 3, 5, 12, 23, 48:2, 48:3, 52:1, 53:1, 57:1, 63:2, 112, 144, 146, 150, 151, 166, 175, 176, 184, 187, 220, 221, 245), quinacridone pigments (e.g., C.I. Pigment Reds 122, 192, 202, 206, 207, 209), diketopyrrolopyrrol pigments (e.g., C.I. Pigment Reds 254, 255, 264, 272), perylene pigments (e.g., C.I. Pigment Reds 123, 149, 178, 179, 190, 224), perynone pigments (e.g., C.I. Pigment Red 194), anthraquinone pigments (e.g., C.I. Pigment Reds 83:1, 89, 168, 177), benzimidazolone pigments (e.g., C.I. Pigment Reds 171, 175, 176, 185, 208), basic dye lake pigments of triarylcarbonium series (e.g., C.I. Pigment Reds 81:1, 169), thioindigo pigments (e.g., C.I. Pigment Reds 88, 181), pyranthrone pigments (e.g., C.I. Pigment Reds 216, 226), pyrazoloquinazolone pigments (e.g., C.I. Pigment Reds 251, 252), and isoindoline pigments (e.g., C.I. Pigment Red 260). Among these pigments, azo pigments, quinacridone pigments, diketopyrrolopyrrol pigments and perylene pigments are more preferred. Azo pigments and diketopyrrolopyrrol pigments are particularly preferred.

Preferable examples of the violet pigment include azo pigments (e.g., C.I. Pigment Violets 13, 25, 44, 50), dioxazine pigments (e.g., C.I. Pigment Violets 23, 37), quinacridone pigments (e.g., C.I. Pigment Violets 19, 42), basic dye lake pigments of triarylcarbonium series (e.g., C.I. Pigment Violets 1, 2, 3, 27, 39), anthraquinone pigments (e.g., C.I. Pigment Violets 5:1, 33), perylene pigments (e.g., C.I. Pigment Violet 29), isoviolanthrone pigments (e.g., C.I. Pigment Violet 31), and benzimidazolone pigments (e.g., C.I. Pigment Violet 32). Among these pigments, azo pigments, dioxazine pigments and quinacridone pigments are more preferred. Dioxazine pigments are particularly preferred.

Among dioxazine pigments for use in the present invention, preferably in the second embodiment, those having high affinity to an organic solvent are particularly preferred. Such pigments can be selected from commercially available products. For example, Violet B-K (trade name) and Violet B-KP (trade name), each of which are manufactured by Ciba Specialty chemicals, can be used.

In order to control the hue in the present invention, preferably in the second embodiment, other pigments (those classified into C.I. Pigment Yellow, C.I. Pigment Orange, C.I. Pigment Brown, C.I. Pigment Green, respectively) may be used in addition to the above-mentioned pigments.

Specific compounds are described in "Color Index" (The Society of Dyers and Colourists), and W. Herbst and K. Hunger, *Indstrial Organic Pigments* (VCH verlagsgesellschaft mbH (1993)).

As the pigment recited above, one which has not been treated or one which has been surface-treated may be used in the present invention, preferably in the second embodiment. As the surface treatment, for example, a method of surface-coating with a resin or wax, a method of adhering a surface active agent, a method of binding a reactive material (e.g., a silane coupling agent, an epoxy compound, polyisocyanate) to the surface of pigment, and a method of employing a pigment derivative (synergist) are proposed, as described in the following literatures:

*Kinzoku Sekken no Seishitsu to oyo* (*Properties and Applications of Metal Soap*)(Saiwai Shobo),

*Insatsu Inki Gijyutsu* (*Printing Ink Technology*) (CMC Shuppan, 1984),

*Saishin Ganryo Oyo Gijyutsu* (*The newest Pigment Applied Technology*) (CMC Shuppan, 1986).

Of these pigments, easily dispersive pigments which are commercially available in the form of the pigment whose surface is previously coated with a resin or wax, are called instant pigments (for example, Microlith pigment, manufactured by Ciba Specialty Chemicals). Such an instant pigment is particularly preferred on account that when the pigment is introduced into a light-sensitive material, no dispersion is necessary, but the pigment is able to excellently disperse in a high boiling point organic solvent. In this case, the high boiling point organic solvent having the pigment dispersed therein may be further dispersed in a hydrophilic colloid such as gelatin.

In the present invention, preferably in the second embodiment, as mentioned above, the pigment may be dispersed in a high boiling point organic solvent, followed by further dispersing of the resulting dispersion into a hydrophilic colloid such as gelatin. Alternatively, the pigment may be directly dispersed in a hydrophilic colloid. At this time, various kinds of dispersants, such as surfactant type-low molecular dispersants and high molecular dispersants, may be used, in accordance with a binder and a pigment to be used together. However, employment of the high molecular-type dispersant is more preferred from the viewpoint of dispersion stability. Examples of the dispersant include those described in JP-A-3-69949 and European Patent No. 549 486.

A particle size after dispersion of the pigment for use in the present invention, preferably in the second embodiment, is preferably.in the range of 0.01 $\mu$m to 10 $\mu$m, more preferably in the range of 0.02 $\mu$m to 1 $\mu$m.

In order to disperse a pigment in a binder, known dispersion methods which are applied for the production of ink, toner, and the like, may be used. Examples of the dispersing machine include sand mill, atliter, pearl mill, super mill, ball mill, impeller, disperser, KD mill, colloid mill, dynatron, three-leg roll mill, and pressure kneader. The details are described in *Saishin Ganryo Oyo Gijyutsu* (*The Newest Pigment Applied Technology*) (CMC Shuppan, 1986).

The total amount to be used of the pigments that can be used in the present invention, preferably in the second embodiment, is preferably in the range of 0.1 mg/m$^2$ to 10 mg/m$^2$, more preferably in the range of 0.3 mg/m$^2$ to 5 mg/m$^2$. Further, a blue pigment is preferably used in combination with other pigments having different hue from that of the blue pigment. A method in which a pigment is added to the hydrophilic colloidal layer forming the photographic structural layer is more preferable to a method in which a pigment is added to the polyolefin coating resin of the support because the amount of the pigment required to adjust the same tint can be largely decreased, bringing about a large costly merit.

When the blue pigment is used in combination with the aforementioned red pigment and/or violet pigment in the present invention, preferably in the second embodiment, they may be used, by dispersing in the same hydrophilic colloid layer or in different hydrophilic colloid layers. That is, the layer to which the blue pigment is added is not particularly limited.

In the present invention, preferably in the second embodiment, it is also preferable to control the white base by using an oil-soluble dye for the photographic structural layer of the light-sensitive material. Typically specific examples of the oil-soluble dye include the compounds 1 to 27 described in JP-A-2-842, page (8) to page (9).

Also, in the present invention, preferably in the second embodiment, it is possible to control the white base by compounding a fluorescent whitening agent in the hydrophilic colloidal layer of the light-sensitive material and by allowing the fluorescent whitening agent to remain in the light-sensitive material after the light-sensitive material is treated. Also, a polymer catching a fluorescent whitening agent such as polyvinyl pyrrolidone may be compounded in the light-sensitive material.

As the silver halide color photographic light-sensitive material (hereinafter sometimes referred to simply as "light-sensitive material") in the present invention, a silver halide color photographic light-sensitive material that comprises a support having provided thereon at least one silver halide emulsion layer containing a yellow dye-forming coupler, at least one silver halide emulsion layer containing a magenta dye-forming coupler and at least one silver halide emulsion layer containing a cyan dye-forming coupler is preferably used.

In the following, the silver halide light-sensitive material that is preferably used in the present invention, preferably in the second embodiment, is explained.

Silver halide grains in the silver halide emulsion which can be used in the present invention, preferably in the second embodiment, are preferably cubic or tetradecahedral crystal grains substantially having {100} planes (these grains may be rounded at the apexes thereof and further may have planes of high order), or octahedral crystal grains. Further, a silver halide emulsion in which the proportion of tabular grains having an aspect ratio of 2 or more and composed of {100} or {111} planes accounts for 50% or more in terms of the total projected area, can also be preferably used. The term "aspect ratio" refers to the value obtained by dividing the diameter of the circle having an area equivalent to the projected area of an individual grain by the thickness of the grain. In the present invention, preferably in the second embodiment, cubic grains, or tabular grains having {100} planes as major faces, or tabular grains having {111} planes as major faces are preferably used.

As a silver halide emulsion which can be used in the present invention, preferably in the second embodiment, for example, silver chloride, silver bromide, silver iodobromide, or silver chloro(iodo)bromide emulsions may be used. It is preferable for a rapid processing to use a silver chloride, silver chlorobromide, silver chloroiodide, or silver chlorobromoiodide emulsions having a silver chloride content of 90 mol % or greater, more preferably said silver chloride, silver chlorobromide, silver chloroiodide, or silver chlorobromoiodide emulsions having a silver chloride content of 98 mol % or greater. Preferred of these silver halide emulsions are those having in the shell parts of silver halide grains, a silver iodochloride phase of 0.01 to 0.50 mol %, more preferably 0.05 to 0.40 mol %, per mol of the total silver, in view of high sensitivity and excellent high illumination intensity exposure suitability. Further, especially preferred of these silver halide emulsions are those containing silver halide grains having on the surface thereof a silver bromide localized phase of 0.2 to 5 mol %, more preferably 0.5 to 3 mol %, per mol of the total silver, since both high sensitivity and stabilization of photographic properties are attained.

The silver halide emulsion for use in the present invention, preferably in the second embodiment, preferably contains silver iodide. In order to introduce iodide ions, an iodide salt solution may be added alone, or it may be added in combination with both a silver salt solution and a high chloride salt solution. In the latter case, the iodide salt solution and the high chloride salt solution may be added separately or as a mixture solution of these salts of iodide and high chloride. The iodide salt is generally added in the form of a soluble salt, such as alkali or alkali earth iodide salt. Alternatively, the iodide salt may be introduced by cleaving the iodide ions from an organic molecule, as described in U.S. Pat. No. 5,389,508. As another source of the iodide ion, fine silver iodide grains may be used.

The iodide salt solution may be added, concentrating in a time during grain formation, or otherwise over a certain period of time. The position of iodide ions introduced into the high chloride emulsion grains is limited for the purpose of imparting high speed and low fog to the emulsion. The more inside iodide ions are introduced into the emulsion grains, the smaller increase in sensitivity it is. Accordingly, the iodide salt solution is preferably added to the portion outer than 50%, more preferably outer than 70%, and most preferably outer than 80% of the grain volume. On the other hand, the addition of iodide salt solution is preferably finished up to the portion inner than 98%, most preferably inner than 96% of the grain volume. As mentioned above, the addition of iodide salt solution is finished at somewhat inside from the surface of grains, resulting in a high speed and low fog emulsion.

The distribution of iodide ion concentration to the depth direction inside an individual grain can be measured by means of, for example, TRIFT II type TOF-SIMS (trade name) manufactured by Phi Evans Company, in accordance with Etching/TOF-SIMS (Time of Flight-Secondary Ion Mass Spectrometry) process. The details of TOF-SIMS process are described in *Hyomen Bunseki Gijutsu Sensho Niji Ion Shitsuryobunsekiho,* editted by Nippon Hyomenkagaku Kai, Maruzen Co. Ltd. (1999). By analytical research of the emulsion grains according to the Etching/TOF-SIMS process, it is found that even though the addition of iodide salt solution has been completed up to the step of forming the inner part of final grains, there are iodide ions oozed toward the grain surface. In case where the emulsion for use in the present invention contains silver iodide, preferably, iodide ions have the maximum concentration at the grain surface, and in addition, iodide ion concentration decreases toward the inside of the grain, by analyzing with Etching/TOF-SIMS.

The silver halide emulsion grains to be used in the light-sensitive material of the present invention, preferably of the second embodiment, preferably have a silver bromide localized phase.

When the silver halide emulsion for use in the present invention contains a silver bromide localized phase, the silver bromide localized phase is preferably formed by epitaxial growth of the localized phase having a silver bromide content of at least 10 mol % on the grain surface. In addition, the emulsion grains preferably have the outermost shell portion having a silver bromide content of at least 1 mol % or more in the vicinity of the surface of the grains.

The silver bromide content of the silver bromide localized phase is preferably in the range of 1 to 80 mol %, and most preferably in the range of 5 to 70 mol %. The silver bromide localized phase is preferably composed of silver having population of 0.1 to 30 mol %, more preferably 0.3 to 20 mol %, to the molar amount of entire silver which constitutes silver halide grains for use in the present invention. The silver bromide localized phase is preferably doped with complex ions of a metal of the Group VIII, such as iridium ion. The amount of these compounds to be added can be varied in a wide range depending on the purposes, and it is preferably in the range of $10^{-9}$ to $10^{-2}$ mol per mol of silver halide.

In the present invention, preferably in the second embodiment, ions of a transition metal are preferably added in the course of grain formation and/or growth of the silver halide grains, to include the metal ions in the inside and/or on the surface of the silver halide grains. The metal ions to be used are preferably ions of a transition metal. Preferable examples of the transition metal are iron, ruthenium, iridium, osmium, lead, cadmium or zinc. Further, 6-coordinated octahedral complex salts of these metal ions which have ligands are more preferably used. The ligand to be used may be an inorganic compound. Among the inorganic compounds, cyanide ion, halide ion, thiocyanato, hydroxide ion, peroxide ion, azide ion, nitrite ion, water, ammonia, nitrosyl ion, or thionitrosyl ion are preferably used. Such ligand is preferably coordinated to any one of metal ions selected from a group consisting of the above-mentioned iron, ruthenium, iridium, osmium, lead, cadmium and zinc. Two or more kinds of these ligands are also preferably used in one complex molecule.

Among them, the silver halide emulsion for use in the present invention, preferably in the second embodiment, particularly preferably contains an iridium ion having at least one organic ligand for the purpose of improving reciprocity failure at a high illuminance.

It is common in the case of other transition metal, when an organic compounds are used as a ligand, preferable examples of the organic compound include chain compounds having a main chain of 5 or less carbon atoms and/or heterocyclic compounds of 5- or 6-membered ring. More preferable examples of the organic compound are those having at least a nitrogen, phosphorus, oxygen, or sulfur atom in a molecule as an atom which is capable of coordinating to a metal. Most preferred organic compounds are furan, thiophene, oxazole, isooxazole, thiazole, isothiazole, imidazole, pyrazole, triazole, furazane, pyran, pyridine, pyridazine, pyrimidine and pyrazine. Further, organic compounds which have a substituent introduced into a basic skeleton of the above-mentioned compounds are also preferred.

Among these compounds, 5-methylthiazole among thiazole ligands is particularly preferably used as the ligand preferable for the iridium ion.

Preferable combinations of a metal ion and a ligand are those of the iron and/or ruthenium ion and the cyanide ion. Preferred of these compounds are those in which the number of cyanide ions accounts for the majority of the coordination number intrinsic to the iron or ruthenium that is the central metal. The remaining sites are preferably occupied by thiocyanato, ammonia, water, nitrosyl ion, dimethylsulfoxide, pyridine, pyrazine, or 4,4'-bipyridine. Most preferably each of 6 coordination sites of the central metal is occupied by a cyanide ion, to form a hexacyano iron complex or a hexacyano ruthenium complex. Such metal complexes composed of these cyanide ion ligands are preferably added during grain formation in an amount of $1\times10^{-8}$ mol to $1\times10^{-2}$ mol, most preferably $1\times10^{-6}$ mol to $5\times10^{-4}$ mol, per mol of silver.

In case of the iridium complex, preferable ligands are fluoride, chloride, bromide and iodide ions, not only said organic ligands. Among these ligands, chloride and bromide ions are more preferably used. Specifically, preferable iridium complexes are the following compound in addition to those that have said organic ligands: $[IrCl_6]^{3-}$, $[IrCl_6]^{2-}$, $[IrCl_5(H_2O)]^{2-}$, $[IrCl_5(H_2O)]^{-}$, $[IrCl_4(H_2O)_2]^{-}$, $[IrCl_4(H_2O)_2]^{0}$, $[IrCl_3(H_2O)_3]^{0}$, $[IrCl_3(H_2O)_3]^{+}$, $[IrBr_6]^{3-}$, $[IrBr_6]^{2-}$, $[IrBr_5(H_2O)]^{2-}$, $[IrBr_5(H_2O)]^{-}$, $[IrBr_4(H_2O)_2]^{-}$, $[IrBr_4(H_2O)_2]^{0}$, $[IrBr_3(H_2O)_3]^{0}$, and $[IrBr_3(H_2O)_3]^{+}$. These iridium complexes are preferably added during grain formation in an amount of $1\times10^{-10}$ mol to $1\times10^{-3}$ mol, most preferably $1\times10^{-8}$ mol to $1\times10^{-5}$ mol, per mol of silver. In case of the ruthenium complex and the osmium complex, nitrosyl ion, thionitrosyl ion, water molecule, and chloride ion ligands are preferably used singly or in combination. More preferably these ligands form a pentachloronitrosyl complex, a pentachlorothionitrosyl complex, or a pentachloroaquo complex. The formation of a hexachloro complex is also preferred. These complexes are preferably added during grain formation in an amount of $1\times10^{-10}$ mol to $1\times10^{-6}$ mol, more preferably $1\times10^{-9}$ mol to $1\times10^{-6}$ mol, per mol of silver.

In the present invention, preferably in the second embodiment, the above-mentioned complexes are preferably added directly to the reaction solution at the time of silver halide grain formation, or indirectly to the grain-forming reaction solution via addition to an aqueous halide solution for forming silver halide grains or other solutions, so that they are doped to the inside of the silver halide grains. Further, these methods are preferably combined to incorporate the complex into the inside of the silver halide grains.

In case where these complexes are doped to the inside of the silver halide grains, they are preferably uniformly distributed in the inside of the grains. On the other hand, as disclosed in JP-A-4-208936, JP-A-2-125245 and JP-A-3-188437, they are also preferably distributed only in the grain surface layer. Alternatively they are also preferably distributed only in the inside of the grain while the grain surface is covered with a layer free from the complex. Further, as disclosed in U.S. Pat. Nos. 5,252,451 and 5,256,530, it is also preferred that the silver halide grains are subjected to physical ripening in the presence of fine grains having complexes incorporated therein to modify the grain surface phase. Further, these methods may be used in combination. Two or more kinds of complexes may be incorporated in the inside of an individual silver halide grain. The halogen composition at the position (portion) where the complexes are incorporated, is not particularly limited, but they are preferably incorporated in any of a silver chloride layer (phase), a silver chlorobromide layer (phase), a silver bromide layer (phase), a silver iodochloride layer (phase) and a silver iodobromide layer (phase).

The silver halide grains contained in the silver halide emulsion for use in the present invention preferably in the second embodiment, have an average grain size (the grain size herein refers to the diameter of the circle equivalent to the projected area of the grain, and the number average is taken as the average grain size) of preferably from 0.1 $\mu$m to 2 $\mu$m.

With respect to the distribution of sizes of these grains, so called monodisperse emulsion having a variation coefficient (the value obtained by dividing the standard deviation of the grain size distribution by the average grain size) of 20% or less, more preferably 15% or less, and further preferably 10% or less, is preferred. For obtaining a wide latitude, it is also preferred to blend the above-described monodisperse emulsions in the same layer or to form a multilayer structure by multilayer-coating of the monodisperse emulsions.

The color photographic printing paper in the present invention, preferably in the second embodiment, preferably has at least one yellow color-forming silver halide emulsion layer, at least one magenta color-forming silver halide emulsion layer, and at least one cyan color-forming silver halide emulsion layer, on a support. Generally, these silver halide emulsion layers are in the order, from the support, of the yellow color-forming silver halide emulsion layer, the magenta color-forming silver halide emulsion layer and the cyan color-forming silver halide emulsion layer. However, another layer arrangement which is different from the above, may be adopted.

Further, in order to process the light-sensitive material of the present invention, processing materials and processing methods described in JP-A-2-207250, page 26, right lower column, line 1, to page 34, right upper column, line 9, and in JP-A-4-97355, page 5, left upper column, line 17, to page 18, right lower column, line 20, can be preferably applied in addition to above-mentioned super-rapid processing. Further, as the preservative used for this developing solution, compounds described in the patent publications listed in the above Table are preferably used.

Typically, there is a method in which a process is carried out using a processing solution obtained after a sample of the light-sensitive material is exposed to an image from a negative film having an average density by using a mini-lab "PP350" manufactured by Fuji Photo Film Co., Ltd. and a CP48S Chemicals as a treating agent, and continuous treatment is carried out until the volume of a replenishing solution for color developing becomes two times the volume of a tank of a color developing solution.

The chemicals as the treating agent may be CP45X and CP47L manufactured by Fuji Photo Film Co., Ltd., RA-100 and RA-4 manufactured by Eastman Kodak and the like without any problem.

In the present invention, preferably in the third embodiment, in order to obtain color images, the print paper needs to have at least one yellow image-forming layer, at least one magenta image-forming layer, and at least one cyan image-forming layer, and each image forming layer needs to contain a silver halide emulsion having a different color sensitivity. It is preferable that the yellow image-forming layer contains a blue-sensitive silver halide emulsion, the magenta image-forming layer contains a green-sensitive silver halide emulsion, and the cyan image-forming layer contains a red-sensitive silver halide emulsion. However, the present invention is not limited to this combination.

In the present invention, preferably in the third embodiment, at least 3 kinds of visible laser lights having different wavelengths are used, wherein at least 2 kinds of the laser lights are obtained from semiconductors themselves without using nonlinear optical crystals. This is necessary for making the exposing apparatus compact and less costly. Besides, for making the exposing apparatus compact and less costly, it is preferable that a second harmonic generation (SHG) laser light source comprising a combination of a semiconductor laser as an exciting light source and an interposed nonlinear optical crystal, is at most one if used or is not used.

The wavelengths of the laser light sources are mainly blue wavelengths (420 to 450 nm), green wavelengths (500 to 560 nm), and red wavelengths (620 to 710 nm), wherein the shortest wavelength of the laser lights is 450 nm or less. It is possible to use a laser light source having a wavelength outside these ranges. Further, in order to inhibit the tint change in the peripheral region of the print, the wavelength difference between the longest wavelength and the shortest wavelength of the laser lights to be used in the present invention is preferably 180 to 210 nm and more preferably 185 to 205 nm.

Specific examples of the laser light sources that are preferably used include a blue semiconductor laser having a wavelength of 430 to 450 nm (presented by NICHIA CORPORATION in the 48th Meeting of the Japan Society of Applied Physics and Related Societies in March in 2001), a blue laser having a wavelength of about 470 nm taken out after subjecting a semiconductor laser (oscillation wavelength: about 940 nm) to wavelength conversion by means of an SHG crystal of $LiNbO_3$ having an inverted domain structure in the shape of a waveguide, a green laser having a wavelength of about 530 nm taken out after subjecting a semiconductor laser (oscillation wavelength: about 1060 nm) to wavelength conversion by means of an SHG crystal of $LiNbO_3$ having an inverted domain structure in the shape of a waveguide, a red semiconductor laser having a wavelength of about 685 nm (Hitachi Type No. HL6738MG), and a red semiconductor laser having a wavelength of about 650 nm (Hitachi Type No. HL6501MG).

When such a scanning exposing light source is used, the wavelength at peak spectral sensitivity of the light-sensitive material of the present invention can be selected arbitrarily depending on the wavelength of the scanning exposing light source to be used. In the case of a semiconductor laser using a semiconductor laser as an exciting light source or an SHG light source obtained by a combination of a semiconductor laser and a nonlinear optical crystal, the oscillation wavelength of laser can be halved. As a result, blue light and green light can be obtained. Accordingly, the light-sensitive material can have peak spectral sensitivities in 3 wavelength regions of ordinary blue, green, and red.

The exposure time in such scanning exposure is preferably $10^{-4}$ second or less, more preferably $10^{-6}$ second or less, assuming that the pixel density is 400 dpi.

The details of the preferable scanning exposing methods that can be used in the present invention are described in the gazettes that will be listed later.

In the present invention, preferably in the third embodiment, $\gamma c$, $\gamma m$, $\gamma y$, and $\Delta S$ are defined as follows.

An exposure amount (E1) which gave a developed color density equivalent to unexposed density +0.02 and an exposure amount (E2) which gave a developed color density equivalent to 90% of the maximum developed color density were sought, and the value $\gamma = \mathrm{Log}(E2/E1)$ thus obtained was defined as the gradation. The unexposed density includes the fogging density.

For convenience, in the present invention, preferably in the third embodiment, the value defined above is designated as "gradation" and is expressed by "$\gamma$".

$\gamma c$: gradation of cyan-colored image obtained by color development processing after exposure to a laser light source having the longest wavelength;

$\gamma m$: gradation of magenta-colored image obtained by color development processing after exposure to a laser light source having the exposure wavelength in 520 to 560 nm;

$\gamma y$: gradation of yellow-colored image obtained by color development processing after exposure to a laser light source having the shortest wavelength.

From the sensitocurves of yellow and magenta colored images obtained by a process comprising exposure to a laser light source having the shortest wavelength and color development processing after the exposure, an exposure amount (Ey) which gave a yellow density of 1.8 was obtained and the value Log(1/Ey) was defined as the yellow sensitivity (Sy).

Meanwhile, an exposure amount (Em) which gave a magenta density of 0.6 was obtained and the value Log(1/Em) was defined as the magenta sensitivity (Sm).

ΔS: difference between the yellow sensitivity and the magenta sensitivity (Sy−Sm)

In the present invention, preferably in the third embodiment, for the inhibition of the tint change in the peripheral region of prints, the values of γc, γm, and γy defined above are each 1.0 to 1.6, and preferably 1.05 to 1.55. Further, it is important the difference between any two of γc, γm, and γy is within the range of −0.2 to 0.2, and the difference is preferably within the range of −0.18 to 0.18. In the case where γc, γm, or γy is less than 1.0, the tint change in the peripheral region of prints is. remarkable. The case where γc, γm, or γy is more than 1.6 cannot be adopted because of the decrease of the maximum developed color density and/or decrease of the color purity of yellow. The case where the difference between any two of γc, γm, and γy is less than −0.2 and the case where this difference is more than 0.2, cannot be adopted because the tint change in the peripheral region of prints is remarkable.

In the present invention, preferably in the third embodiment, for the improvement of the color purity of yellow, it is necessary that the value of ΔS is within the range of 1.0 to 1.8 and this value is preferably within the range of 1.05 to 1.75. In the case where ΔS is less than 1.0, the color purity of yellow is lowered because magenta is formed in the yellow images. The case where ΔS is more than 1.8 cannot be adopted because such problem as decrease of the magenta developed color density occurs.

The value of ΔS is influenced by such factors as the spectral sensitivity distributions of the silver halide emulsions contained in the yellow image forming layer and the magenta image forming layer. These spectral sensitivity distributions cannot be determined generally by the method for the preparation of the silver halide emulsion because these spectral sensitivity distributions can vary depending on various factors such as sensitizing dye species to be used in the silver halide emulsion, halogen compositions, and ripening time and ripening temperature at the preparation of the silver halide emulsion, but for example, the means, in which silver iodide is distributed such that the concentration of the silver iodide is highest at the surface of the grains of the silver halide emulsion to be contained in the yellow image forming layer, is preferable as a means of maintaining ΔS within the range of the present invention. However, the present invention is not limited to this means.

When forming a phase containing silver iodide at a maximum concentration in the surface of silver halide grains, the local silver iodide content of the phase containing silver iodide is preferably 0.3 mol % or more, and more preferably in the range of 0.5 to 8 mol % or more. In order to raise the local concentration by use of a smaller silver iodide content, the phase containing silver iodide comprises preferably 3 to 30%, more preferably of 3 to 15%, of the silver amount of the grain volume. For the introduction of iodide ions for forming the phase containing silver iodide, a solution of an iodide salt may be added singly or a solution of a silver salt and a solution of an iodide salt may be added simultaneously. Generally, since an iodide that is added during the formation of grains having a high silver chloride content tends to ooze to the surface of the grains, the phase containing silver iodide tends to be formed in the surface of the grains.

Further, it is also possible to form a phase containing silver bromide in addition to the phase containing silver iodide.

The silver halide grains contained in the silver halide emulsion for use in the present invention, preferably in the third embodiment, have an average grain size (the grain size herein refers to the diameter of the circle equivalent to the projected area of the grain, and the number average is taken as the average grain size) of preferably from 0.1 μm to 2 μm. With respect to the distribution of sizes of these grains, so called monodisperse emulsion having a variation coefficient (the value obtained by dividing the standard deviation of the grain size distribution by the average grain size) of 20% or less, more preferably 15% or less, and further preferably 10% or less, is preferred. For obtaining a wide latitude, it is also preferred to blend the above-described monodisperse emulsions in the same layer or to form a multilayer structure by multilayer-coating of the monodisperse emulsions.

The silver halide emulsion for use in the present invention may contain silver halide grains other than the silver halide grains according to the present invention, i.e., the specific silver halide grains. In the silver halide emulsion for use in the present invention, preferably in the third embodiment, however, a ratio of the specific silver halide grains in the total projected area of the all silver halide grains is preferably 50% or more, and more preferably 80% or more.

The silver halide photographic light-sensitive material of the present invention, preferably of the third embodiment, can be used for a color positive film, a color reversal film, a color reversal photographic printing paper, a color photographic printing paper and the like. Among these materials, the light-sensitive material of the present invention is preferably used for a color photographic printing paper. The color photographic printing paper preferably has at least one yellow color-forming silver halide emulsion layer, at least one magenta color-forming silver halide emulsion layer, and at least one cyan color-forming silver halide emulsion layer, on a support. Generally, these silver halide emulsion layers are in the order, from the support, of the yellow color-forming silver halide emulsion layer, the magenta color-forming silver halide emulsion layer and the cyan color-forming silver halide emulsion layer. However, another layer arrangement which is different from the above, may be adopted.

With regard to the time required for treating the light-sensitive material having an aptitude to super-rapid processing in the present invention, preferably in the third and forth embodiments, color developing time is preferably 60 seconds or less, more preferably 50 seconds or less but 6 seconds or more, and still more preferably 30 seconds or less but 6 seconds or more. Similarly, bleaching/fixing time is preferably 60 seconds or less, more preferably 50 seconds or less but 6 seconds or more, and still more preferably 30 seconds or less but 6 seconds or more. Also, water-washing or stabilizing time is preferably 150 seconds or less, and more preferably 130 seconds or less but 6 seconds or more.

The blue- and red-exposure light sources that can be used in the image-forming-method of the present invention, preferably of the forth embodiment, are semiconductor lasers having a wavelength of 430 to 450 nm and a wavelength of 620 to 670 nm respectively. Further, it is preferably in the present invention, in the forth embodiment, to use a semiconductor laser having a shorter wavelength than the wavelength spectral sensitivity maximum. However, the present invention is not limited thereto.

Specifically, the blue exposure light source for use in the first embodiment is a semiconductor laser of a wavelength shorter by 30 nm to 60 nm, preferably 35 nm to 55 nm, and more preferably 40 nm to 50 nm, than the wavelength of the blue sensitivity maximum. For example, if a wavelength of the blue sensitivity maximum is 480 nm, exposure is conducted using a semiconductor laser with a wavelength of 420 nm to 450 nm. The blue semiconductor laser is described in detail in a report presented by NICHIA CORPORATION in the 48th Meeting of the Japan Society of Applied Physics and Related Societies in March in 2001).

As the red and green light sources for exposure in first embodiment, preferred are monochromatic high density light sources such as a gas laser, a light-emitting diode, a semiconductor laser and a second harmonic generation light source (SHG) comprising a combination of nonlinear optical crystal with a solid state laser using a semiconductor laser as an excitation light source. For obtaining a compact and inexpensive system, semiconductor laser and SHG light sources are more preferable, semiconductor laser light source is especially preferable.

The red exposure light source for use in the second embodiment of the present invention, preferably in the forth embodiment, is preferably a red semiconductor laser of a wavelength shorter by 40 nm to 80 nm than the maximum red sensitivity wavelength. These light sources are already available on the market. Specifically, it is preferred to use semiconductor lasers such as AlGaInP (the oscillation wavelength: about 680 nm; Type No. LN9R20 (trade name) manufactured by Matsushita Electric Industrial Co., Ltd.), (the oscillation wavelength: about 650 nm; Type No. HL6501MG (trade name) manufactured by Hitachi, Ltd.), or (the oscillation wavelength: about 685 nm; ML101J10 (trade name) manufactured by Mitsubishi Electric Corporation), and GaAlAs (the oscillation wavelength: 785 nm; HL7859MG (trade name) manufactured by Hitachi, Ltd.).

As the green exposure light source for use in the second embodiment of the present invention, it is preferable to use laser light sources such as a green laser at 532 nm obtained by wavelength modulation of $YVO_4$ solid state laser (the oscillation wavelength: 1064 nm) using as an excitation light source a semiconductor laser GaAlAs (the oscillation wavelength: 808.7 nm) with an SHG crystal of $LiNbO_3$ having an inverting domain structure.

In present invention, preferably in the forth embodiment, it is preferable for sharp image to conduct exposure with resolution of 200 dpi or more, more preferably 400 dpi or more, and especially preferably 600 dpi or more. The upper limit of the sharp image is preferably 5,000 dpi, more preferably 3,000 dpi. The term "dpi" means the number of pixels per inch.

The exposure time in such scanning exposure is preferably $2\times10^{-4}$ second or less, more preferably $5\times10^{-6}$ second or less, and further more preferably $1\times10^{-6}$ second or less, assuming that the pixel density is 200 dpi. The lower limit of the exposure time is preferably $1\times10^{-12}$ second or less, more preferably $1\times10^{-10}$ second or less.

The total wetting time in the present invention, preferably in the forth embodiment, is 180 sec. at the highest (preferably 10 sec. to 180 sec.), preferably 100 sec. or less (preferably 10 sec. to 100 sec.), more preferably 70 sec. or less (preferably 10 sec. to 70 sec.). The developing time of the total wetting time is 45 sec. at the highest (preferably 3 sec. to 45 sec.), preferably 30 sec. or less (preferably 3 sec. to 30 sec.), more preferably 20 sec. or less (preferably 5 sec. to 20 sec.), and especially preferably 5 sec. or more but 15 sec. or less.

The temperature of the developing solution is in the range of 30° C. to 60° C., especially preferably 40° C. to 50° C. The term "temperature of the developing solution" means a temperature of color-developing tank in the step of color-forming developing treatment.

From the view point of productivity, a period of time ranging from "just after exposure" to "just.before immersion into a developing solution" is preferably within 10 sec. (preferably 2 sec. to 10 sec.), more preferably 2 sec. or more and 8 sec. or less.

A silver halide emulsion for used in the present invention, preferably in the forth embodiment, is explained in detail below.

In the present invention, preferably in the fourth embodiment, the blue-sensitive silver halide emulsion in the light-sensitive material includes a specific silver halide grain. The silver halide emulsion for use in the present invention is not particularly limited, but preferably a cubic or tetradecahedral crystal grains (peak of these grains may be round and may have a higher level plane) having substantially {100} planes or an octahedral crystal grains, or a tabular grains having {100} planes or {111} planes as major faces and having an aspect ratio of 2 or more. The aspect ratio is defined as the value obtained by dividing the diameter of a circle corresponding to the circle having the same area as projected area by the thickness of the grains. With respect to a tabular grains having {100} planes or {111} planes as major faces, those described in 33 column (P7) to column P840 (P8) in JP-A-2000-352794 may be referred.

As the silver halide emulsion for use in the present invention, preferably in the forth embodiment, it is preferred that the silver chloride content is 90 mole % or more. From the point of rapid processing properties, the silver chloride content is more preferably 93 mole % or more, and further preferably 95 mole % or more. The silver iodide content is preferably from 0.02 to 1 mole %, more preferably from 0.05 to 0.80 mole %, and most preferably from 0.07 to 0.60 mole %, because high sensitivity and hard gradation in the high illumination intensity exposure can be achieved. The silver bromide content is preferably from 0.1 to 7 mole %, and more preferably from 0.5 to 5 mole %, because hard gradation and excellent latent image stability can be achieved.

The silver halide grains for use in the present invention, preferably in the forth embodiment, are preferably silver iodobromochloride grains, and more preferably silver iodobromochloride grains having the above-described halogen composition.

The silver halide grains for use in the present invention, preferably in the forth embodiment, may have a silver bromide-containing phase and/or a silver iodide-containing phase. The term "silver bromide-containing phase or a silver iodide-containing phase" as used herein means a site at which a concentration of silver bromide or silver iodide is higher than that of its periphery. The halogen composition of the silver bromide-containing phase or the silver iodide-containing phase and its periphery may vary either continuously or drastically. Such a silver bromide-containing phase or a silver iodide-containing phase may form a layer in which the concentration has an approximately constant width at a certain portion in the grain, or maximum point having no spread. The local silver bromide content of the silver bromide-containing phase is preferably 5 mole % or more, more preferably from 10 to 80 mole %, and most preferably from 15 to 50 mole %. The local silver iodide content of the silver iodide-containing phase is preferably 0.3 mole % or more, more preferably from 0.5 to 8 mole %, and most preferably from 1 to 5 mole %. Further, a plurality of such silver bromide- or a silver iodide-containing phase may each exist in the grain in the layer form. Although the silver bromide or silver iodide content of each phase may be different, it is preferable that at least one silver bromide-containing phase and at least one silver iodide-containing phase are incorporated in a grain.

It is important that the silver bromide-containing phase and the silver iodide-containing phase of the silver halide emulsion for use in the present invention, preferably in the forth embodiment, are each in the layer form so as to surround the grain. One preferred embodiment is that the silver bromide-containing phase or the silver iodide-containing phase formed in the layer form so as to surround the grain has a uniform concentration distribution in the circumferential direction of the grain in each phase. However, in the silver bromide-containing phase or the silver iodide-containing phase formed in the layer form so as to surround the grain, there may be the maximum point or the minimum point of the silver bromide or silver iodide concentration in the circumferential direction of the grain to have a concentration distribution. For example, when the emulsion has the silver bromide-containing phase or the silver iodide-containing phase formed in the layer form so as to surround the grain in the vicinity of a surface of the grain, the silver bromide or silver iodide concentration of a corner portion or an edge of the grain can be different from that of a major face of the grain. Further, aside from the silver bromide-containing phase or the silver iodide-containing phase formed in the layer form so as to surround the grain in the vicinity of a surface of the grain, the silver bromide-containing phase or the silver iodide-containing phase not surround the grain may exist in isolation at a specific portion of the surface of the grain.

When the silver halide emulsion used for the present invention, preferably in the forth embodiment, has a silver bromide-containing phase, the silver bromide-containing phase is formed in the layer (band-like) form so as to form a maximum concentration inside of the grain. Likewise, when the silver halide emulsion used for the present invention, preferably in the forth embodiment, has a silver iodide-containing phase, the silver iodide-containing phase is formed with a profile (it is not band structure) in which the iodide ion concentration decreases in the depth direction from the grain surface. Such silver bromide-containing phase or silver iodide-containing phase is constituted preferably in a silver amount of 3% or more but 30% or less of the grain volume and more preferably in a silver amount of 3% or more but 15% or less, from the meaning that the local concentration is increased with the less content of silver bromide or silver iodide.

According to the present invention, notwithstanding the fluctuation in exposure environment (temperature) in the laser scanning digital exposure, a constant-quality image can be obtained, and a system of forming a digital image with a high-quality can be provided at a low cost.

According to the present invention, it is possible to provide an image-forming method using a digital color print system that attains low cost and high quality, and that can use inexpensive laser sources, and that has interchangeability with an ordinary analog exposure system, and that can maintain constant quality even though environmental temperature at the time of exposure changes; and a silver halide color photographic light-sensitive material that is used for the image-forming method.

Further, the method of the present invention ensures that residual color is decreased and an image improved in quality.can be formed and is therefore preferable as a method used to obtain a color print. The color photographic light-sensitive material of the present invention is suitably used in the image forming method.

According to the present invention, it is possible to provide an image forming method which decreases the residual color of a silver halide print material by treatment, specifically, the aforementioned super-rapid processing, to thereby obtain a color print satisfactory in view of image quality and also to provide a silver halide color photographic light-sensitive material used in this method.

Further, the color image forming process and the silver halide color photographic light-sensitive material for laser exposure of the present invention provide excellent effects that a color image, in which color purity decrease of yellow and tint change in the peripheral region of print are inhibited, can be formed by using a compact laser light source.

According to the present invention, with respect to the color image formation by exposing a silver halide photographic light-sensitive material by use of a laser light, it is possible to provide a color image forming process which comprises exposing a silver halide light-sensitive material to light by using an inexpensive and compact laser light source and provides a high-quality color print and to provide a silver halide color photographic light-sensitive material to be used in the process.

Further, according to the present invention, notwithstanding the fluctuation in exposure environment (temperature) in the laser scanning digital exposure, a constant-quality image can be obtained, and a system of forming a digital image with a high quality can be provided at a low cost. Further, according to the image-forming method of the present invention, a high-image quality can be kept, even though the applied exposure wavelength shifts, to some extent, from the wavelength range which a light-sensitive layer has a spectral sensitivity maximum.

The present invention is suitably used in the so-called amateur prints, because it can provide a compact system at low cost. Further, the present invention provides excellent effects that it is less subject to variation of exposure wavelength. More specifically, it is possible to provide an image-forming method using a digital color print system that attains low cost and. high quality, and that can use inexpensive laser sources, and that has interchangeability with an ordinary analog exposure system, and that can maintain constant quality even though the environmental temperature in exposure changes.

Hereinafter, the present invention will be described in more detail by way of examples, but the present invention should not be limited thereto.

EXAMPLES

Herein, the identical mark for applying to the compounds used in the following examples means to show the same compounds, unless otherwise specified.

Example 101

(Preparation of Emulsion B-1a)

1000 ml of a 3% aqueous solution of a lime-processed gelatin was prepared, and then pH and pCl were adjusted to 5.5 and 1.7 respectively. An aqueous solution containing 2.12 mole of silver nitrate and an aqueous solution containing 2.2 mole of sodium chloride were mixed to the above-mentioned aqueous gelatin solution at the same time with vigorous stirring at 66° C. Potassium bromide (KBr) was added to the reaction solution with vigorous stirring at the step of the addition of from 80% to 90% of the entire silver nitrate amount used in emulsion grain formation, so that the KBr amount became 2 mole % per mole of the finished silver halide. An aqueous solution of $K_4[Ru(CN)_6]$ was added at the step of the addition of from 80% to 90% of the entire silver nitrate amount, so that the Ru amount became $3\times10^{-5}$mole per mole of the finished silver halide. An aqueous solution of $K_2[IrCl_6]$ was added at the step of the addition of from 83% to 88% of the entire silver nitrate amount, so that the Ir amount became $3\times10^{-8}$ mole per mole of the finished silver halide. When the addition of 90% of the entire silver nitrate amount was completed, an aqueous solution of potassium iodide (KI) was added with vigorous stirring, so that the I amount became 0.2 mole % per mole of the finished silver halide. An aqueous solution of $K_2$[Ir (5-methylthiazole)$Cl_5$] was added at the step of the addition of from 92% to 98% of the entire silver nitrate amount, so that the Ir amount became $1\times10^{-6}$ mole per mole of the finished silver halide. After desalting at 40° C., 168 g of a lime-processed gelatin was added, and then pH and pCl were adjusted to 5.5 and 1.8 respectively. The obtained emulsion was revealed to contain cubic silver iodobromide grains having an equivalent-sphere diameter of 0.75 μm and a coefficient of variation of 11%.

To the emulsion melted at 40° C. was added sodium thiosulfonate in an amount of $2\times10^{-5}$ mole per mole of silver halide, and the resulting emulsion was optimally ripened at 60° C. with sodium thiosulfate penta hydrate as a sulfur sensitizer and (S-2) as a gold sensitizer. After cooling to 40° C., a sensitizing dye B-A, a sensitizing dye B-B, 1-phenyl-5-mercaptotetrazole, 1-(5-methylureidophenyl)-5-mercaptotetrazole, and potassium bromide were added in an amount of $2.4\times10^{-4}$ mole, $1.6\times10^{-4}$ mole, $2\times10^{-4}$ mole, $2\times10^{-4}$ mole, and $2\times10^{-3}$ mole, per mole of silver halide respectively, thereby Emulsion B-1a being prepared. It was revealed that the Emulsion B-1a exhibited a spectral sensitivity maximum at 480 nm.

Sentizing dye B-A

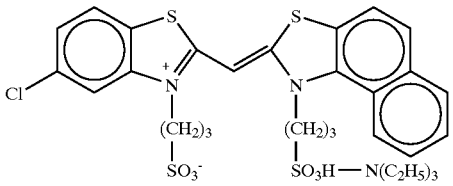

Sentizing dye B-C

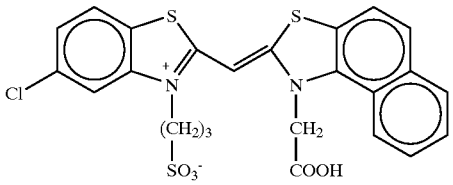

Sensitizing dye B-B

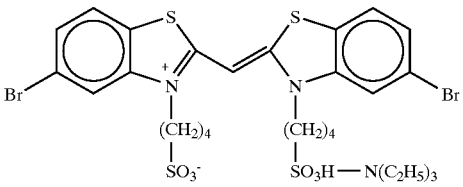

-continued

Sentizing dye B-D

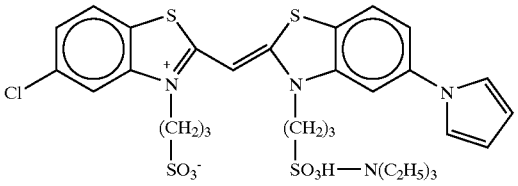

Sensitizing dye B-E

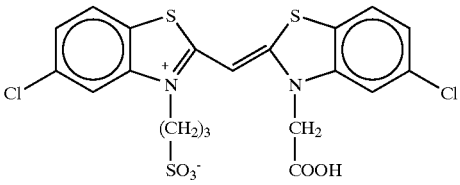

Sensitizing dye B-F

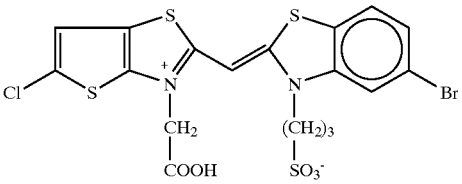

(Preparation of Emulsion B-2a)

Emulsion B-2a was prepared in the same manner as in the preparation of Emulsion B-1a, except that a sensitizing dye B-A was added to the emulsion in an amount of $4\times10^{-4}$ mole per mole of silver halide in place of the sensitizing dyes B-A and B-B.

(Preparation of Emulsions B-3a to B-5a)

Emulsions B-3a to B-5a were prepared in the same manner as in the preparation of Emulsion B-2a, except that the kinds and the addition amounts of the sensitizing dyes were changed as shown in Table 2.

(Preparation of Emulsion B-6a)

Preparation of Emulsion F described in Example 2 of JP-A-2000-100345 was repeated except for employing the dye with the wavelength of spectral sensitivity maximum as shown in Table 2, thereby obtaining a high silver chloride tabular emulsion having {111} planes as major faces, a thickness of 0.13 μm, an aspect ratio of 6, an equivalent-cubic particle side length of 0.4 μm, and an iodide content of 0.4 mole %. The thus-obtained emulsion is designated Emulsion B-6a.

(Preparation of Emulsion Ga)

1000 ml of a 3% aqueous solution of a lime-processed gelatin was prepared, and then pH and pCl were adjusted to 5.5 and 1.7 respectively. An aqueous solution containing 2.12 mole of silver nitrate and an aqueous solution containing 2.2 mole of sodium chloride were mixed to the above-mentioned aqueous gelatin solution at the same time with vigorous stirring at 45° C. An aqueous solution of $K_4$[Ru $(CN)_6$] was added at the step of the addition of from 80% to 90% of the entire silver nitrate amount, so that the Ru amount became $3\times10^{-5}$ mole per mole of the finished silver halide. An aqueous solution of $K_2[IrCl_6]$ was added at the step of the addition of from 83% to 88% of the entire silver nitrate amount, so that the Ir amount became $5\times10^{-8}$ mole per mole of the finished silver halide. An aqueous solution of $K_2$[Ir(5-methylthiazole)Cl5] was added at the step of the addition of from 92% to 95% of the entire silver nitrate amount, so that the Ir amount became $5\times10^{-7}$mole per mole of the finished silver halide. An aqueous solution of $K_2[Ir(H_2O)Cl_5]$ was added at the step of the addition of from 95% to 98% of the entire silver nitrate amount, so that the Ir amount became $5\times10^{-7}$ mole per mole of the finished silver halide. After desalting at 40° C., 168 g of a lime-processed gelatin was added, and then pH and pCl were adjusted to 5.5 and 1.8 respectively. The obtained emulsion was revealed to contain cubic silver chloride grains having an equivalent-sphere diameter of 0.35 μm and a coefficient of variation of 10%.

To the emulsion melted at 40° C. was added sodium thiosulfonate in an amount of $2\times10^{-5}$ mole per mole of silver halide, and the resulting emulsion was optimally ripened at 60° C. with sodium thiosulfate penta hydrate as a sulfur sensitizer and (S-2) as a gold sensitizer. After cooling to 40° C., a sensitizing dye G-A, 1-phenyl-5-mercaptotetrazole, 1-(5-methylureidophenyl)-5-mercaptotetrazole, and potassium bromide were added in an amount of $6\times10^{-4}$ mole, $2\times10^{-4}$ mole, $8\times10^{-4}$ mole, and $7\times10^{-3}$mole, per mole of silver halide respectively, thereby Emulsion Ga being prepared.

Sensitizing dye G-A

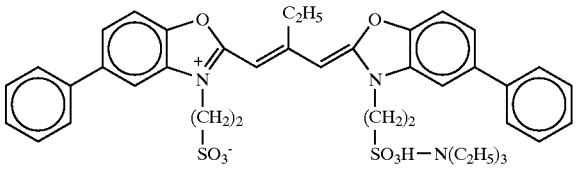

(Preparation of Emulsion R-1a)

1000 ml of a 3% aqueous solution of a lime-processed gelatin was prepared, and then pH and pCl were adjusted to 5.5 and 1.7 respectively. An aqueous solution containing 2.12 mole of silver nitrate and an aqueous solution containing 2.2 mole of sodium chloride were mixed to the above-mentioned aqueous gelatin solution at the same time with vigorous stirring at 45° C. Potassium bromide (KBr) was added to the reaction solution with vigorous stirring at the step of the addition of from 80% to 100% of the entire silver nitrate amount used in emulsion grain formation, so that the KBr amount became 4 mole % per mole of the finished silver halide. An aqueous solution of $K_4[Ru(CN)_6]$ was added at the step of the addition of from 80% to 90% of the entire silver nitrate amount, so that the Ru amount became $3\times10^{-5}$ mole per mole of the finished silver halide. An aqueous solution of $K_2[IrCl_6]$ was added at the step of the addition of from 83% to 88% of the entire silver nitrate amount, so that the Ir amount became $5\times10^{-8}$ mole per mole of the finished silver halide. When the addition of 90% of the entire silver nitrate amount was completed, an aqueous solution of potassium iodide (KI) was added with vigorous stirring, so that the I amount became 0.1 mole % per mole of the finished silver halide. An aqueous solution of $K_2[Ir(5\text{-methylthiazole})Cl_5]$ was added at the step of the addition of from 92% to 95% of the entire silver nitrate amount, so that the Ir amount became $5\times10^{-7}$ mole per mole of the finished silver halide. An aqueous solution of $K_2[Ir(H_2O)Cl_5]$ was added at the step of the addition of from 95% to 98% of the entire silver nitrate amount, so that the Ir amount became $5\times10^{-7}$ mole per mole of the finished silver halide. After desalting at 40° C., 168 g of a lime-processed gelatin was added, and then pH and pCl were adjusted to 5.5 and 1.8 respectively. The obtained emulsion was revealed to contain cubic silver iodobromide grains having an equivalent-sphere diameter of 0.3 μm and a coefficient of variation of 10%.

To the emulsion melted at 40° C. was added sodium thiosulfonate in an amount of $2\times10^{-5}$ mole per mole of silver halide, and the resulting emulsion was optimally ripened at 60° C. with sodium thiosulfate penta hydrate as a sulfur sensitizer and (S-2) as a gold sensitizer. After cooling to 40° C., a sensitizing dye R-A, 1-phenyl-5-mercaptotetrazole, 1-(5-methylureidophenyl)-5-mercaptotetrazole, compound I, and potassium bromide were added in an amount of $7\times10^{-5}$ mole, $2\times10^{-4}$mole, $8\times10^{-4}$ mole, $1\times10^{-3}$ mole, and $7\times10^{-3}$ mole, per mole of silver halide respectively, thereby Emulsion R-1a being prepared. It was revealed that the Emulsion R-1a exhibited a spectral sensitivity maximum at 700 nm.

Sensitizing dye R-A

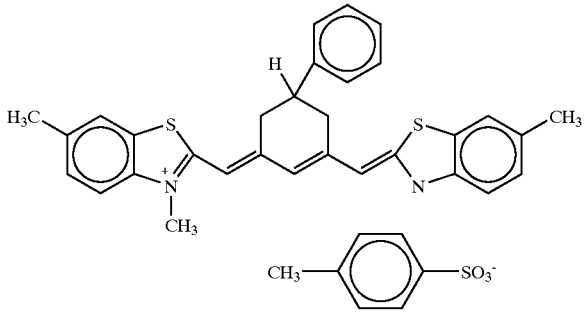

Sensitizing dye R-B

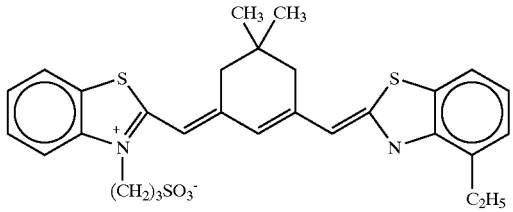

(Compound I)

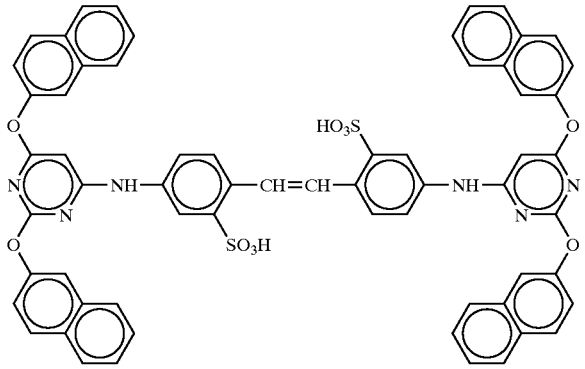

(Preparation of Emulsion R-2a)

Emulsion R-2a was prepared in the same manner as in the preparation of Emulsion B-1a, except that a sensitizing dye R-B was added to the emulsion in an amount of $7\times10^{-5}$ mole per mole of silver halide in place of the sensitizing dye R-A.

TABLE 2

| Emulsion | Sensitizing dye | Addition amount (mole number per mole of silver halide) | Wavelength of spectral sensitivity maximum |
|---|---|---|---|
| B-1a | B-A | $2.4 \times 10^{-4}$ | 480 nm |
| | B-B | $1.6 \times 10^{-4}$ | |
| B-2a | B-A | $4 \times 10^{-4}$ | 482 nm |
| B-3a | B-C | $4 \times 10^{-4}$ | 486 nm |
| B-4a | B-D | $4 \times 10^{-4}$ | 473 nm |
| B-5a | B-C | $2 \times 10^{-4}$ | 480 nm |
| | B-D | $2 \times 10^{-4}$ | |
| B-6a | B-C | $3.3 \times 10^{-4}$ | 480 nm |
| | B-E | $2.3 \times 10^{-4}$ | |
| | B-F | $2.0 \times 10^{-4}$ | |
| R-1a | R-A | $7 \times 10^{-5}$ | 700 nm |
| R-2a | R-B | $7 \times 10^{-5}$ | 700 nm |

After corona discharge treatment was performed on the surface of a paper support whose both surfaces were laminated with polyethylene resin, a gelatin subbing layer containing sodium dodecylbenzenesulfonate was formed on that surface. In addition, photographic constituting layers from the first layer to the seventh layer were coated on the support to make a silver halide color photographic light-sensitive material having the following layer arrangement. The coating solution for each of the photographic constituting layers were prepared as follows.

(Preparation of Coating solution for First layer)

57 g of a yellow coupler (ExY), 7 g of a color-image stabilizer (Cpd-1), 4 g of a color-image stabilizer (Cpd-2), 7 g of a color-image stabilizer (Cpd-3) and 2 g of a color-image stabilizer (Cpd-8) were dissolved in 21 g of a solvent (Solv-1) and 80 ml of ethyl acetate, and the resultant solution was added to 220 g of an aqueous 23.5 masse gelatin solution containing 4 g of sodium dodecylbenzenesulfonate. The resultant mixture was emulsified and dispersed by a high speed stirring emulsifier (dissolver), followed by addition of water to prepare 900 g of emulsified dispersion Aa.

The emulsified dispersion Aa described above and the Emulsion B-1a were mixed and dissolved to prepare a coating solution of the first layer having the following composition. The coating amount of each emulsion is represented by the coating amount of silver.

The coating solutions for the second to seventh layers were prepared following the same procedures as for the coating solution of the first layer. 1-oxy-3,5-dichloro-s-triazine sodium salt (H-1), (H-2), and (H-3) were used as gelatin hardeners in each layer. In addition, Ab-1, Ab-2, Ab-3 and Ab-4 were added to each layer such that their total amounts were 15.0 mg/m$^2$, 60.0 mg/m$^2$, 5.0 mg/m$^2$ and 10.0 mg/m$^2$, respectively.

(H-1) Hardner

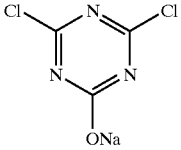

(used in an amount of 1.4 mass% per gelatin)

-continued (H-2) Hardner

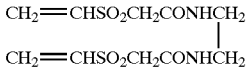

(H-3) Hardner

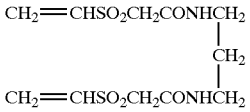

(Ab-1) Antiseptic

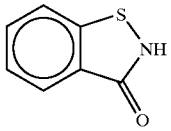

(Ab-2) Antiseptic

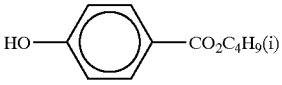

(Ab-3) Antiseptic

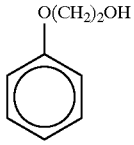

(AB-4) Antiseptic

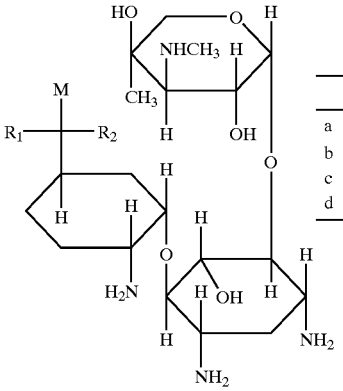

| | $R_1$ | $R_2$ |
|---|---|---|
| a | $CH_3$ | $NHCH_3$ |
| b | $CH_3$ | $NH_2$ |
| c | H | $NH_2$ |
| d | H | $NHCH_3$ |

A mixture in 1:1:1:1 of a, b, c, and d (molar ratio)

Further, 1-phenyl-5-mercaptotetrazole was added to the green-, and Red-sensitive emulsion layers in amounts of $1.0 \times 10^{-3}$ mole and $5.9 \times 10^{-4}$ mole, respectively, per mole of silver halide. Also, 1-phenyl-5-mercaptotetrazole was added to the second layer, the forth layer, and the sixth layer in amounts of 0.2 mg/m$^2$, 0.2 mg/m$^2$, and 0.6 mg/m$^2$, respectively.

Further, a copolymer latex of methacrylic acid and butyl acrylate (ratio by mass, 1:1; average molecular weight, 200,000 to 400,000) was added to the red-sensitive emulsion layer in an amount of 0.05 g/m$^2$. Further, disodium catechol-3,5-disulfonate was added to the second layer, the fourth layer and the sixth layer in an amount of 6 mg/m$^2$, 6 mg/m$^2$ and 18 mg/m$^2$, respectively. Furthermore, to prevent irradiation, the following dyes (the number given in parenthesis represents the coating amount) were added.

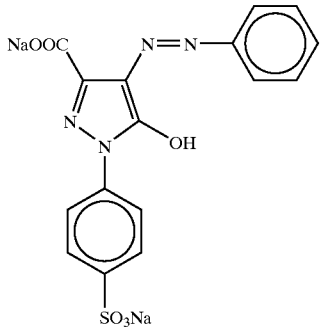

(2 mg/m$^2$)

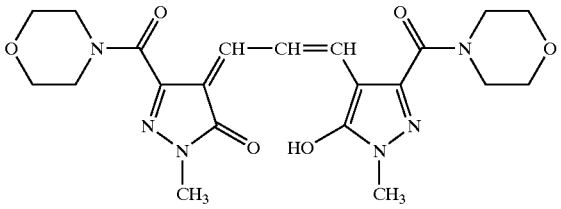

(2 mg/m$^2$)

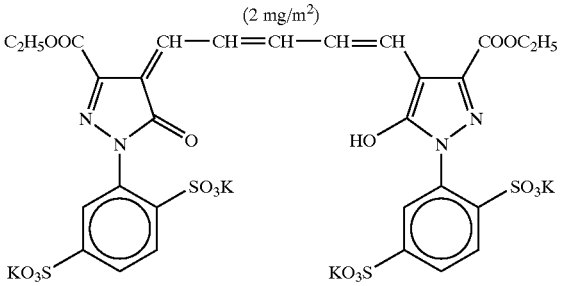

(3 mg/m$^2$)

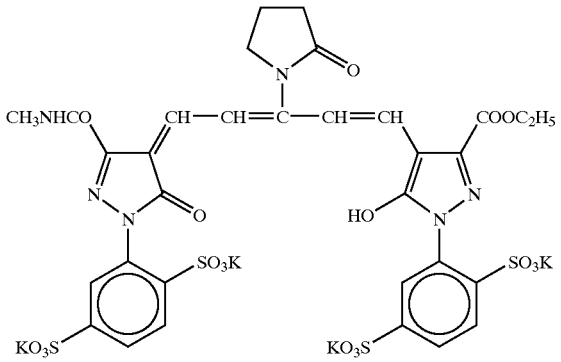

(7 mg/m$^2$)

(Layer Constitution)

The composition of each layer is shown below. The 2 numbers show coating amounts (g/m$^2$). In the case of the silver halide emulsion, the coating amount is in terms of silver.

Support

Polyethylene resin laminated paper

{The polyethylene resin on the first layer side contained a white pigment ($TiO_2$; content of 16 mass %, ZnO; content of 4 mass %), a fluorescent whitening agent (4,4'-bis(5-methylbenzoxazolyl)stilbene; content of 0.03 mass %) and a bluish dye (ultramarine)}

| | |
|---|---|
| First Layer (Blue-Sensitive Emulsion Layer) | |
| Emulsion B-1a | 0.24 |
| Gelatin | 1.25 |
| Yellow coupler (ExY) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.21 |
| Second Layer (Color Mixing Inhibiting Layer) | |
| Gelatin | 0.99 |
| Color mixing inhibitor (Cpd-4) | 0.09 |
| Color-image stabilizer (Cpd-5) | 0.018 |
| Color-image stabilizer (Cpd-6) | 0.13 |
| Color-image stabilizer (Cpd-7) | 0.01 |
| Solvent (Solv-1) | 0.06 |
| Solvent (Solv-2) | 0.22 |
| Third Layer (Green-Sensitive Emulsion Layer) | |
| Emulsion Ga | 0.14 |
| Gelatin | 1.36 |
| Magenta coupler (ExM) | 0.15 |
| Ultraviolet absorbing agent (UV-A) | 0.14 |
| Color-image stabilizer (Cpd-2) | 0.02 |
| Color mixing inhibitor (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.03 |
| Color-image stabilizer (Cpd-10) | 0.01 |
| Color-image stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (Color Mixing Inhibiting Layer) | |
| Gelatin | 0.71 |
| Color mixing inhibitor (Cpd-4) | 0.06 |
| Color-image stabilizer (Cpd-5) | 0.013 |
| Color-image stabilizer (Cpd-6) | 0.10 |
| Color-image stabilizer (Cpd-7) | 0.007 |
| Solvent (Solv-1) | 0.04 |
| Solvent (Solv-2) | 0.16 |
| Fifth Layer (Red-Sensitive Emulsion Layer) | |
| Emulsion R-1a | 0.12 |
| Gelatin | 1.11 |
| Cyan coupler (ExC-2) | 0.13 |
| Cyan coupler (ExC-3) | 0.03 |
| Color-image stabilizer (Cpd-1) | 0.05 |
| Color-image stabilizer (Cpd-6) | 0.06 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.12 |
| Color-image stabilizer (Cpd-16) | 0.03 |
| Color-image stabilizer (Cpd-17) | 0.09 |
| Color-image stabilizer (Cpd-18) | 0.07 |
| Solvent (Solv-5) | 0.15 |
| Solvent (Solv-8) | 0.05 |
| Sixth Layer (Ultraviolet Absorbing Layer) | |
| Gelatin | 0.46 |
| Ultraviolet absorbing agent (UV-B) | 0.45 |
| Compound (S1–4) | 0.0015 |
| Solvent (Solv-7) | 0.25 |
| Seventh Layer (Protective Layer) | |
| Gelatin | 1.00 |
| Acryl-modified copolymer of polyvinyl alcohol (modification degree: 17%) | 0.04 |
| Liquid paraffin | 0.02 |
| Surface active agent (Cpd-13) | 0.01 |

Hereinbelow, the compounds used in this Example and after Example 102 are shown.

(ExY) Yellow coupler
A mixture in 70:30 (molar ratio) of
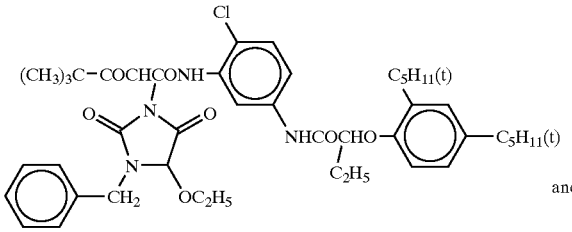
and
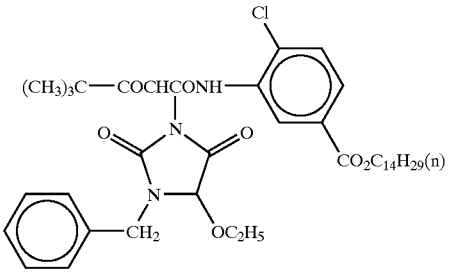
(ExM) Magenta coupler
A mixture in 40:40:20 (molar ratio) of
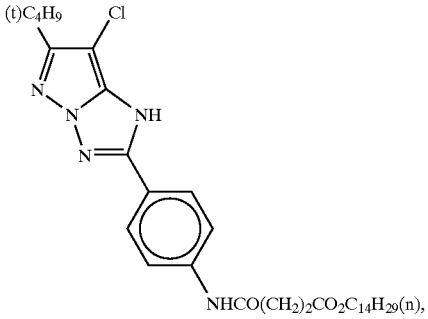
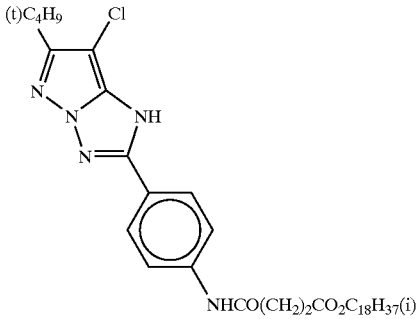
and
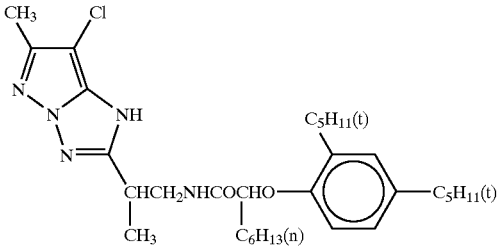
-continued
(E x C-2) Cyan coupler
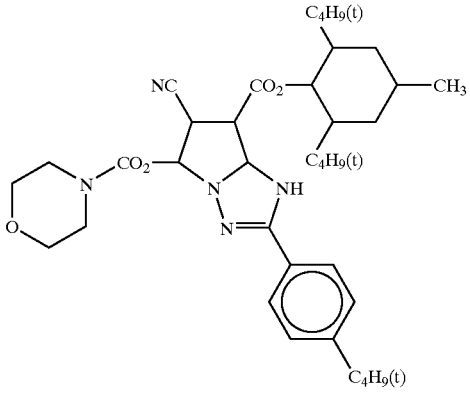
E x C-3) Cyan coupler
A mixture in 50:25:25 (molar ratio) of
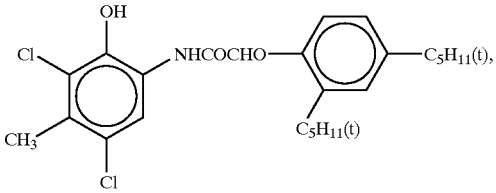
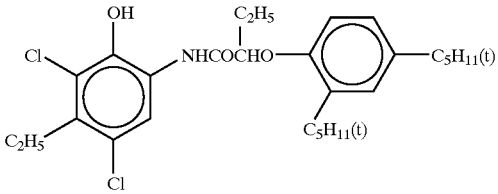
and
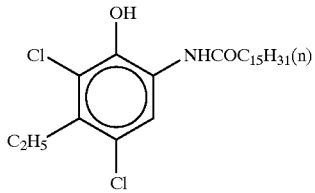
(Cpd-1) Color-image stabilizer
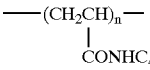
Number-average molecular weight 60,000
(Cpd-2) Color-image stabilizer
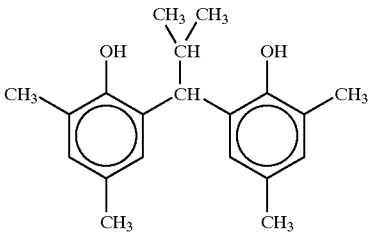

-continued (Cpd-3) Color-image stabilizer

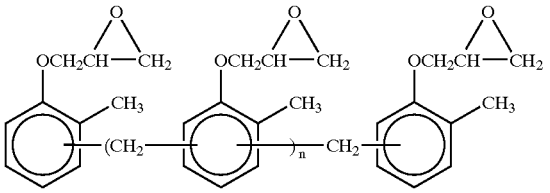

n = 7 ~ 8 (average value)

(Cpd-4) Color mixing inhibitor

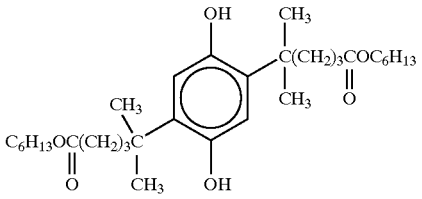

(Cpd-5) Color-image stabilizer

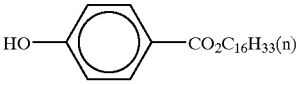

(Cpd-6) Color-image stabilizer

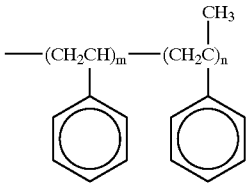

number-average molecular weight 600
m/n = 10/90

(Cpd-7)
Color-image stabilizer

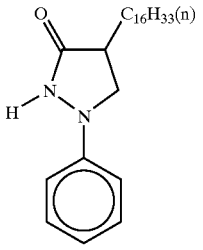

(Cpd-8)
Color-image stabilizer

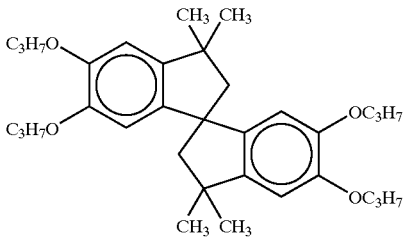

-continued (Cpd-9)
Color-image stabilizer

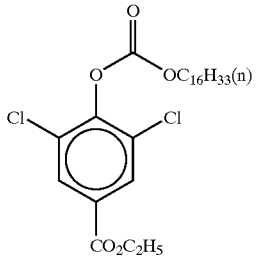

(Cpd-10)
Color-image stabilizer

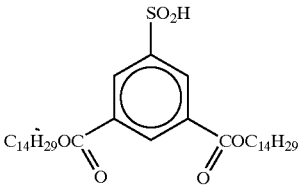

(Cpd-11)

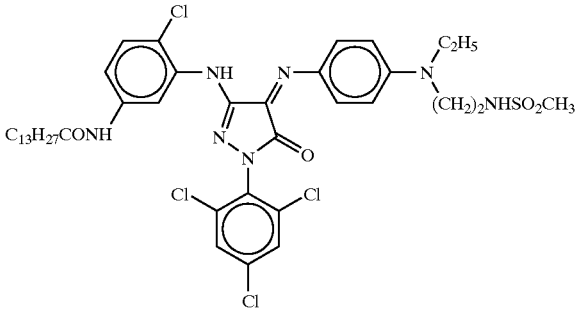

(Cpd-13) Surface active agent
A mixture in 7:3 (molar ratio) of

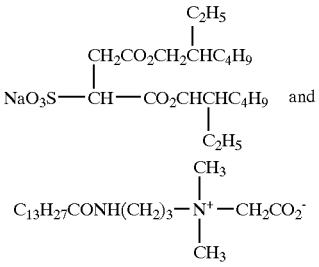

(Cpd-14)

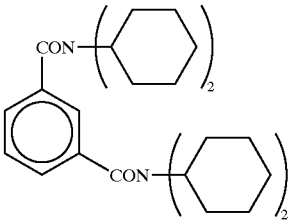

(Cpd-15)

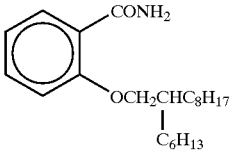

-continued (Cpd-16)

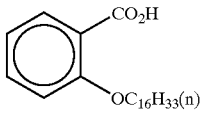

(Cpd-17)

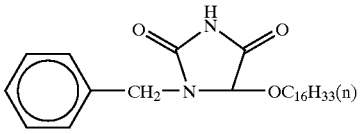

(Cpd-18)

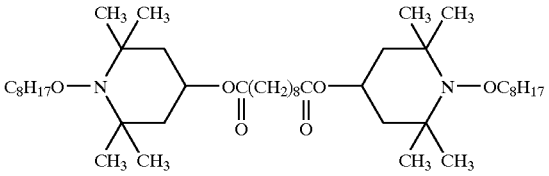

(Cpd-19) Color mixing inhibitor

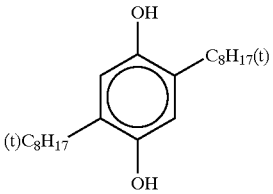

(UV-1)
Ultraviolet absorbing agent

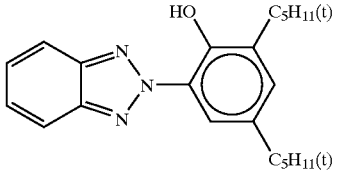

(UV-2)
Ultraviolet absorbing agent

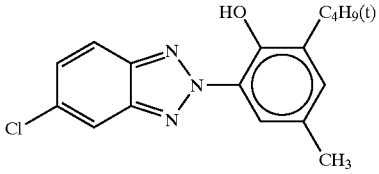

(UV-3)
Ultraviolet absorbing agent

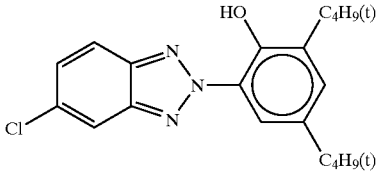

(UV-4)
Ultraviolet absorbing agent

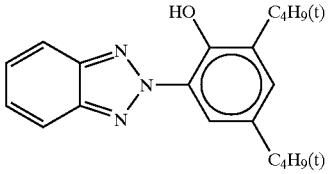

-continued (UV-5)
Ultraviolet absorbing agent

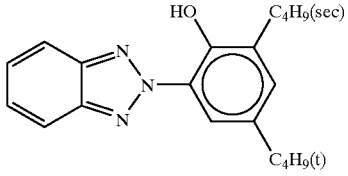

(UV-6)
Ultraviolet absorbing agent

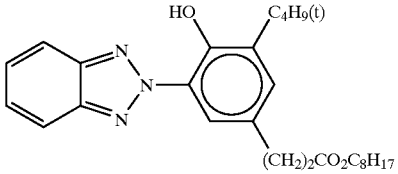

(UV-7) Ultraviolet absorbing agent

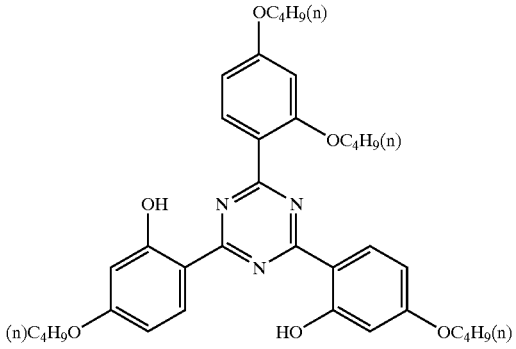

UV-A: Amixture of UV-1/UV-2/UV-3/UV-4 = 4/2/2/3 (mass ratio)
UV-B: A mixture of UV-1/UV-2/UV-3/UV-4/UV-5/UV-6 = 9/3/3/4/5/3 (mass ratio)
UV-C: A mixture of UV-2/UV-3/UV-6/UV-7 = 1/1/1/2 (mass ratio)

(Solv-1)

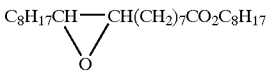

(Solv-2)

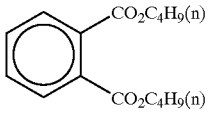

(Solv-3)

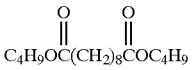

(Solv-4)

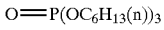

(Solv-5)

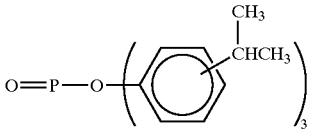

-continued (Solv-7)

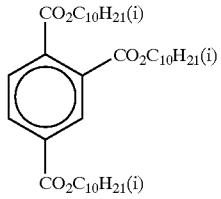

(Solv-8)

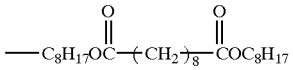

(S1-4)

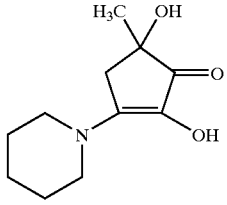

The thus-obtained sample was designated sample 101a. Further, samples 301a to 320a were prepared in the same manner as sample 101a except that Emulsion in the first and fifth layers was replaced with Emulsions as shown in the following Table 5.

Laser Scanning Exposure Apparatus

The following laser oscillators as shown in Table 3 were provided.

Blue laser: 488 nm, 473 nm, 458 nm, 440 nm.

Green laser: 532 nm (a green laser taken out by changing the wavelength of a semiconductor laser (the oscillation wavelength: 1064 nm) by an SHG crystal of a wave guide-like $LiNbO_3$ having an inverting domain structure).

Red laser: 780 nm, 685 nm, 650 nm, 635 nm.

The exposure was effected in such a manner that the three color laser beams could scan successively a sample moving vertically to the direction of the scanning, through respective rotating polygon mirrors. The temperature of the semiconductor laser was kept by using a Peltier device to prevent the quantity of light from being changed by temperature. The substantial light beam diameter was shown in the table, and scanning pitch was 42.3 $\mu$m (600 dpi), and average exposure time was $1.7\times10^{-7}$ seconds per one pixel.

For examining photographic characteristics of the coating samples thus prepared, the following experiment was performed.

Each sample was left thoroughly at 40° C. (55% R.H.) and subjected to gradation exposure for sensitometry by irradiation of laser beams of each of B, G and R in the same environment. Besides, each sample was left thoroughly at 10° C. (55% R.H.) and subjected to gradation exposure for sensitometry in the same manner as mentioned above. The wavelength of the laser beam used to irradiate is shown in Table 4.

After exposure, each sample was processed according to the following color development processing A.

TABLE 3

| Laser oscillator | | | |
|---|---|---|---|
| Color | Laser system | Wavelength (nm) | Serial Number etc. |
| Blue | Gas (Ar) | 488 | NATIONAL LASER CORPORATION |
| Blue | SHG | 473 | FUJI FILM Frontier Built-in |
| Blue | Gas (Ar) | 458 | NATIONAL LASER CORPORATION |
| Blue | Laser diode | 440 | NICHIA CORPORATION |
| Green | SHG | 532 | FUJI FILM Frontier Built-in |
| Red | Laser diode | 780 | HITACHI HL7859MG (Trade mark) |
| Red | Laser diode | 685 | Mitsubishi ML101J10 (Trade mark) |
| Red | Laser diode | 650 | HITACHI HL6501MG (Trade mark) |
| Red | Laser diode | 635 | HITACHI HL6314MG (Trade mark) |

TABLE 4

| | Blue exposure | | | Red exposure | | |
|---|---|---|---|---|---|---|
| Experiment No. | ① Laser wavelength (nm) | ② (Wavelength of spectral sensitivity maximum - ①) (nm) | $\Delta S^{40° C.-10° C.}$ | ③ Laser wavelength (nm) | ④ (Wavelength of spectral sensitivity maximum - ③) (nm) | $\Delta S^{40° C.-10° C.}$ |
| 1 | 488 nm | −8 mm (Comparative) | 100 | 685 nm | 15 nm (Comparative) | 10 |
| 2 | 473 nm | 7 nm (Comparative) | 30 | 685 nm | 15 nm (Comparative) | 10 |
| 3 | 458 nm | 22 nm (Comparative) | 30 | 685 nm | 15 nm (Comparative) | 10 |
| 4 | 440 nm | 40 nm (This invention) | 10 | 685 nm | 15 nm (Comparative) | 10 |
| 5 | 440 nm | 40 nm (This invention) | 10 | 780 nm | −80 nm (Comparative) | 150 |
| 6 | 440 nm | 40 nm (This invention) | 10 | 650 nm | 50 nm (This invention) | 5 |
| 7 | 440 nm | 40 nm (This invention) | 10 | 635 nm | 65 nm (This invention) | 5 |

Processing method used in this example is presented below.

[Processing A]

The above-described light-sensitive material sample was processed to a 127 mm width roll-like form. Mini-lab printer processor PP1258AR (trade name) manufactured by Fuji Photo Film Co., Ltd. was used to subject the light-sensitive material sample to image-wise exposure. A continuous processing (running test) was performed until an accumulated replenisher amount of color developer in the processing steps presented below reached two times the tank volume of a color developer. The processing with the running solution was named processing A.

| Processing step | Temperature | Time | Replenisher amount* |
|---|---|---|---|
| Color development | 38.5° C. | 45 sec | 45 ml |
| Bleach-fixing | 38.0° C. | 45 sec | 35 ml |
| Rinse (1) | 38.0° C. | 20 sec | — |
| Rinse (2) | 38.0° C. | 20 sec | — |
| Rinse (3)** | 38.0° C. | 20 sec | — |
| Rinse (4)** | 38.0° C. | 30 sec | 121 ml |

(Note)
*Replenisher amount per $m^2$ of the light-sensitive material to be processed.
**A rinse cleaning system RC50D (trade name), manufactured by Fuji Photo Film Co., Ltd., was installed in the rinse (3), and the rinse solution was taken out from the rinse (3) and sent to a reverse osmosis membrane module (RC50D) by using a pump.
The permeated water obtained in that tank was supplied to the rinse (4), and the concentrated water was returned to the rinse (3).
Pump pressure was controlled such that the water to be permeated in the reverse osmosis module would be maintained in an amount of 50 to 300 ml/min, and the rinse solution was circulated under controlled temperature for 10 hours a day.

(The rinse was made in a tank counter-current system from (1) to (4).)

The composition of each processing solution was as follows, respectively:

| | Tank Solution | Replenisher |
|---|---|---|
| [Color-developer] | | |
| Water | 800 ml | 800 ml |
| Dimethylpolysiloxane-series surface active agent (Silicone KF351A, trade name: manufactured by Shinetsu Kagaku Kogyo Co.) | 0.1 g | 0.1 g |
| Tri(isopropanol)amine | 8.8 g | 8.8 g |
| Ethylenediaminetetraacetic acid | 4.0 g | 4.0 g |
| Polyethylene glycol (molecular weight 300) | 10.0 g | 10.0 g |
| Sodium 4,5-dihydroxybenzene-1,3-disulfonate | 0.5 g | 0.5 g |
| Potassium chloride | 10.0 g | — |
| Potassium bromide | 0.040 g | 0.010 g |
| Triazinylaminostilbene-series fluorescent whitening agent (Hacchol FWA-SF; trade name, manufactured by Showa Chemical Industry Co., Ltd.) | 2.5 g | 5.0 g |
| Sodium sulfite | 0.1 g | 0.1 g |
| Disodium-N,N-bis(sulfonatoethyl)-hydroxylamine | 8.5 g | 11.1 g |
| N-Ethyl-N-(β-methanesulfonamidoethyl)-3-methyl-4-amino-4-aminoaniline.3/2 sulfuric acid.monohydrate | 5.0 g | 15.7 g |
| Potassium carbonate | 26.3 g | 26.3 g |
| water to make | 1000 ml | 1000 ml |
| pH (at 25° C./pH was adjusted by KOH and sulfuric acid) | 10.15 | 12.50 |
| [Bleach-fixing solution] | | |
| Water | 700 ml | 600 ml |
| Ethylenediaminetetraacetic acid iron (III) ammonium | 47.0 g | 94.0 g |
| Ethylenediaminetetraacetic acid | 1.4 g | 2.8 g |
| m-Carboxybenzenesulfinic acid | 8.3 g | 16.5 g |
| Nitric acid (67%) | 16.5 g | 33.0 g |
| Imidazole | 14.6 g | 29.2 g |
| Ammonium thiosulfate (750 g/liter) | 107.0 ml | 214.0 ml |
| Ammonium sulfite | 16.0 g | 32.0 g |
| Ammonium bisulfite | 23.1 g | 46.2 g |
| water to make | 1000 ml | 1000 ml |
| pH (at 25° C./pH was adjusted by acetic acid and ammonia) | 6.0 | 6.0 |
| [Rinse solution] | | |
| Sodium chlorinated isocyanurate | 0.02 g | 0.02 g |
| Deionized water (conductivity: 5 μS/cm or below) | 1000 ml | 1000 ml |
| pH | 6.5 | 6.5 |

Yellow density and cyan density of each of the above samples after processing was measured, and characteristic curves in a laser scanning exposure were obtained. The sensitivity is defined as the reciprocal of the exposure amount giving a color density of the minimum color density +1.0. ΔS refers to a difference of each of B and R sensitivities between 40° C. (55% R.H.) and 10° C. (55% R.H.), assuming that each of Band R sensitivities at 10° C. (55% R.H.) is taken as 100 respectively. The results obtained are shown in Table 5.

TABLE 5

| | Blue exposure | | | | Red exposure | | | |
|---|---|---|---|---|---|---|---|---|
| Sample | Emulsion | ①Laser wavelength | ②(Wavelength of spectral sensitivity maximum - ①) | $\Delta S^{40° C.-10° C.}$ | Emulsion | ③Laser wavelength | ④(Wavelength of spectral sensitivity maximum - ③) | $\Delta S^{40° C.-10° C.}$ |
| 301a | B-2a | 488 nm | −6 nm (Comparative) | 150 | R-1a | 685 nm | 15 nm (Comparative) | 10 |
| 302a | B-3a | 488 nm | −2 nm (Comparative) | 50 | R-1a | 685 nm | 15 nm (Comparative) | 10 |
| 303a | B-4a | 488 nm | −15 nm (Comparative) | 50 | R-1a | 685 nm | 15 nm (Comparative) | 10 |
| 304a | B-5a | 488 nm | −8 nm (Comparative) | 50 | R-1a | 685 nm | 15 nm (Comparative) | 10 |
| 305a | B-6a | 488 nm | −8 nm (Comparative) | 80 | R-1a | 685 nm | 15 nm (Comparative) | 10 |

TABLE 5-continued

| | Blue exposure | | | | Red exposure | | | |
|---|---|---|---|---|---|---|---|---|
| Sample | Emulsion | ①Laser wavelength | ②(Wavelength of spectral sensitivity maximum - ①) | $\Delta S^{40° C.-10° C.}$ | Emulsion | ③Laser wavelength | ④(Wavelength of spectral sensitivity maximum - ③) | $\Delta S^{40° C.-10° C.}$ |
| 306a | B-2a | 440 nm | 42 nm (This invention) | 15 | R-1a | 685 nm | 15 nm (Comparative) | 10 |
| 307a | B-3a | 440 nm | 46 nm (This invention) | 5 | R-1a | 685 nm | 15 nm (Comparative) | 10 |
| 308a | B-4a | 440 nm | 33 nm (This invention) | 5 | R-1a | 685 nm | 15 nm (Comparative) | 10 |
| 309a | B-5a | 440 nm | 40 nm (This invention) | 3 | R-1a | 685 nm | 15 nm (Comparative) | 10 |
| 310a | B-6a | 440 nm | 40 nm (This invention) | 10 | R-1a | 685 nm | 15 nm (Comparative) | 10 |
| 311a | B-2a | 488 nm | −6 nm (Comparative) | 150 | R-2a | 650 nm | 50 nm (This invention) | 5 |
| 312a | B-3a | 488 nm | −2 nm (Comparative) | 50 | R-2a | 650 nm | 50 nm (This invention) | 5 |
| 313a | B-4a | 488 nm | −15 nm (Comparative) | 50 | R-2a | 650 nm | 50 nm (This invention) | 5 |
| 314a | B-5a | 488 nm | −8 nm (Comparative) | 50 | R-2a | 650 nm | 50 nm (This invention) | 5 |
| 315a | B-6a | 488 nm | −8 nm (Comparative) | 80 | R-2a | 650 nm | 50 nm (This invention) | 5 |
| 316a | B-2a | 440 nm | 42 nm (This invention) | 15 | R-2a | 650 nm | 50 nm (This invention) | 5 |
| 317a | B-3a | 440 nm | 46 nm (This invention) | 5 | R-2a | 650 nm | 50 nm (This invention) | 5 |
| 318a | B-4a | 440 nm | 33 nm (This invention) | 5 | R-2a | 650 nm | 50 nm (This invention) | 5 |
| 319a | B-5a | 440 nm | 40 nm (This invention) | 3 | R-2a | 650 nm | 50 nm (This invention) | 5 |
| 320a | B-6a | 440 nm | 40 nm (This invention) | 10 | R-2a | 650 nm | 50 nm (This invention) | 5 |

As apparent from the results in Table 5, it is understood that the sensitivity fluctuation due to fluctuation in exposure temperature is considerably minimized by the image-forming method of the present invention. It is believed that the semiconductor laser of 440 nm or 650 nm will become from now on a main semiconductor laser and easy to obtain in a large scale at a low cost. Accordingly, a high-quality image-forming system can be provided at a low cost by the present invention.

Example 102

Thin-layered samples were prepared in the same manner as in Example 101 except for altering the layer constitution as described below.

Preparation of samples

| | |
|---|---|
| First Layer (Blue-Sensitive Emulsion Layer) | |
| Emulsion B-1a | 0.14 |
| Gelatin | 0.75 |
| Yellow coupler (ExY-2) | 0.34 |
| Color-image stabilizer (Cpd-1) | 0.04 |
| Color-image stabilizer (Cpd-2) | 0.02 |
| Color-image stabilizer (Cpd-3) | 0.04 |
| Color-image stabilizer (Cpd-8) | 0.01 |
| Solvent (Solv-1) | 0.13 |
| Second Layer (Color Mixing Inhibiting Layer) | |
| Gelatin | 0.60 |
| Color mixing inhibitor (Cpd-19) | 0.09 |
| Color-image stabilizer (Cpd-5) | 0.007 |
| Color-image stabilizer (Cpd-7) | 0.007 |

-continued

| | |
|---|---|
| Ultraviolet absorbing agent (UV-C) | 0.05 |
| Solvent (Solv-5) | 0.11 |
| Third Layer (Green-Sensitive Emulsion Layer) | |
| Emulsion Ga | 0.14 |
| Gelatin | 0.73 |
| Magenta coupler (ExM) | 0.15 |
| Ultraviolet absorbing agent (UV-A) | 0.05 |
| Color-image stabilizer (Cpd-2) | 0.02 |
| Color mixing inhibitor (Cpd-7) | 0.008 |
| Color-image stabilizer (Cpd-8) | 0.07 |
| Color-image stabilizer (Cpd-9) | 0.03 |
| Color-image stabilizer (Cpd-10) | 0.009 |
| Color-image stabilizer (Cpd-11) | 0.0001 |
| Solvent (Solv-3) | 0.06 |
| Solvent (Solv-4) | 0.11 |
| Solvent (Solv-5) | 0.06 |
| Fourth Layer (Color Mixing Inhibiting Layer) | |
| Gelatin | 0.48 |
| Color mixing inhibitor (Cpd-4) | 0.07 |
| Color-image stabilizer (Cpd-5) | 0.006 |
| Color-image stabilizer (Cpd-7) | 0.006 |
| Ultraviolet absorbing agent (UV-C) | 0.04 |
| Solvent (Solv-5) | 0.09 |
| Fifth Layer (Red-Sensitive Emulsion Layer) | |
| Emulsion R-1a | 0.12 |
| Gelatin | 0.59 |
| Cyan coupler (ExC-2) | 0.13 |
| Cyan coupler (ExC-3) | 0.03 |
| Color-image stabilizer (Cpd-7) | 0.01 |
| Color-image stabilizer (Cpd-9) | 0.04 |
| Color-image stabilizer (Cpd-15) | 0.19 |
| Color-image stabilizer (Cpd-18) | 0.04 |
| Ultraviolet absorbing agent (UV-7) | 0.02 |

-continued

| | |
|---|---|
| Solvent (Solv-5) | 0.09 |
| Sixth Layer (Ultraviolet Absorbing Layer) | |
| Gelatin | 0.32 |
| Ultraviolet absorbing agent (UV-C) | 0.42 |
| Solvent (Solv-7) | 0.08 |
| Seventh Layer (Protective Layer) | |
| Gelatin | 0.70 |
| Acryl-modified copolymer of polyvinyl alcohol (modification degree: 17%) | 0.04 |
| Liquid paraffin | 0.01 |
| Surface active agent (Cpd-13) | 0.01 |
| Polydimethylsiloxane | 0.01 |
| Silicon dioxide | 0.003 |

(ExY-2)

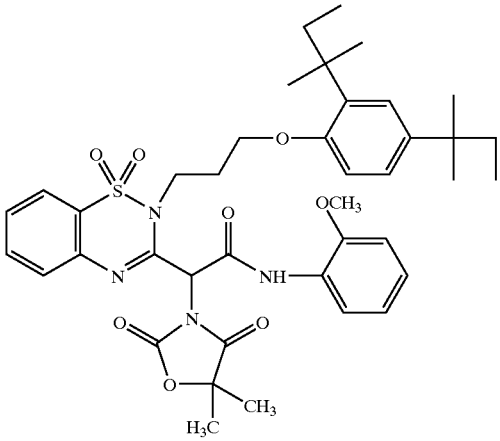

The sample obtained in the above-described way was designated as the sample 201a.

Each sample was subjected to laser scanning exposure using the laser oscillators described in.Example 101. The exposure was performed at the same exposure-environmental temperature (40° C. and 10° C.) as in Example 101.

After exposure, the samples underwent ultra-rapid development processing according to the following development processing B. The time from just after the exposure to soak to the developer was 7 seconds.

Processing B

The above-described light-sensitive material samples were processed to a 127 mm width roll-like form. They were image-wise exposed to light through a negative film having an average density using a test processor made by remodeling a mini-lab printer processor PP350 (trade name), manufactured by Fuji Photo Film Co., Ltd., so that a processing time and temperature could be changed. A continuous processing (running test) was performed until an accumulated replenisher amount of color developer used in the following processing steps became 0.5 times the tank volume of a color developer tank.

| Processing step | Temperature | Time | Replenishment rate* |
|---|---|---|---|
| Color development | 45.0° C. | 15 sec | 45 ml |
| Bleach-fixing | 40.0° C. | 15 sec | 35 ml |
| Rinse (1) | 40.0° C. | 8 sec | — |
| Rinse (2) | 40.0° C. | 8 sec | — |

-continued

| Processing step | Temperature | Time | Replenishment rate* |
|---|---|---|---|
| Rinse (3)** | 40.0° C. | 8 sec | — |
| Rinse (4) | 38.0° C. | 8 sec | 121 ml |
| Drying | 80.0° C. | 15 sec | |

(Note)

*Replenishment rate per $m^2$ of the light-sensitive material to be processed.

**A rinse cleaning system RC50D (trade name), manufactured by Fuji Photo Film Co., Ltd., was installed in the rinse (3), and the rinse solution was taken out from the rinse (3) and sent to a reverse osmosis membrane module (RC50D) by using a pump.

The permeated water obtained in that tank was supplied to the rinse (4), and the concentrated water was returned to the rinse (3).

Pump pressure was controlled such that the water to be permeated in the reverse osmosis module would be maintained in an amount of 50 to 300 ml/min, and the rinse solution was circulated under controlled temperature for 10 hours a day.

The rinse was made in a four-tank counter-current system from (1) to (4).

The composition of each processing solution was as follows.

| | (Tank solution) | (Replenisher) |
|---|---|---|
| (Color developer) | | |
| Water | 800 ml | 600 ml |
| Fluorescent whitening agent (FL-1) | 5.0 g | 8.5 g |
| Triisopropanolamine | 8.8 g | 8.8 g |
| Sodium p-toluenesulfonate | 20.0 g | 20.0 g |
| Ethylenediamine tetraacetic acid | 4.0 g | 4.0 g |
| Sodium sulfite | 0.10 g | 0.50 g |
| Potassium chloride | 10.0 g | — |
| Sodium 4,5-dihydroxybenzene-1,3-disulfonate | 0.50 g | 0.50 g |
| Disodium-N,N-bis(sulfonatoethyl)-hydroxylamine | 8.5 g | 14.5 g |
| 4-amino-3-methyl-N-ethyl-N-(β-methanesulfonamidoethyl)aniline.3/2 sulfate.monohydrate | 10.0 g | 22.0 g |
| Potassium carbonate | 26.3 g | 26.3 g |
| Water to make | 1000 ml | 1000 ml |
| pH (25° C./adjusted using sulfuric acid and potassium hydroxide) | 10.35 | 12.6 |
| (Bleach-fixing solution) | | |
| Water | 800 ml | 800 ml |
| Ammonium thiosulfate (750 g/l) | 107 ml | 214 ml |
| Succinic acid | 29.5 g | 59.0 g |
| Ammonium iron (III) ethylenediamine-tetraacetate | 47.0 g | 94.0 g |
| Ethylenediamine tetraacetic acid | 1.4 g | 2.8 g |
| Nitric acid (67%) | 17.5 g | 35.0 g |
| Imidazole | 14.6 g | 29.2 g |
| Ammonium sulfite | 16.0 g | 32.0 g |
| Potassium metabisulfite | 23.1 g | 46.2 g |
| Water to make | 1000 ml | 1000 ml |
| pH (25° C./adjusted using nitric acid and aqua ammonia) | 6.00 | 6.00 |
| (Rinse solution) | | |
| Sodium chlorinated-isocyanurate | 0.02 g | 0.02 g |
| Deionized water (conductivity: 5 μS/cm or less) | 1000 ml | 1000 ml |
| pH (25° C.) | 6.5 | 6.5 |

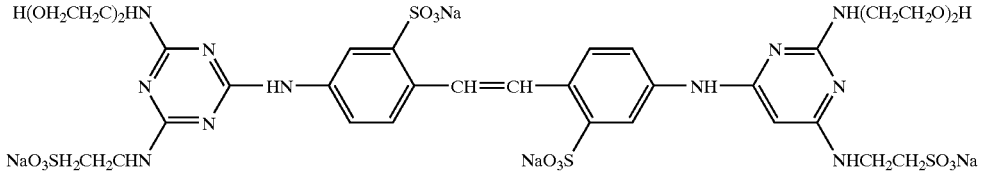

Yellow density and cyan density of sample 201a after processing was measured, and characteristic curves in a laser scanning exposure were obtained. The sensitivity is defined as in Example 101 and the difference of sensitivity ΔS was evaluated in the same manner as Example 101.

Similar to the results in Example 101, it was confirmed that the sensitivity fluctuation due to fluctuation in exposure temperature is considerably minimized by the image-forming method of the present invention.

Example 103

Emulsion B-1a and/or Emulsion B-1a of sample 201a employed in Example 102 were replaced by other emulsions. Exposure and development processing were carried out in the same manner as Example 102.

Similar to the results in Example 102, it was confirmed that the sensitivity fluctuation due to fluctuation in exposure temperature is considerably minimized by the image-forming method of the present invention.

Example 201

(Preparation of Blue-sensitive Layer Emulsion Ab for Comparison)

To 1.06 liter of deionized distilled water containing 5.7 mass % of deionized gelatin, 46.3 of 10% aqueous solution of NaCl was added. Further, 46.4% of $H_2SO_4$ (1N) and 0.012 g of Compound (X) were added successively, and then the temperature was adjusted to 60° C. Immediately after that, to the mixture in a reaction vessel, silver nitrate (0.1 mole) and NaCl (0.1 mole) were added while stirring with high speed, over 10 minutes. Successively an aqueous solution of silver nitrate (1.5 mole) and an aqueous solution of NaCl (1.5 mole) were added over 60 minutes according to the flow rate-accelerating method such that the final addition rate became 4 times the initial addition rate. Therefore, a 0.2 mole % aqueous solution of silver nitrate and a 0.2 mole % aqueous solution of NaCl were added over 6 minutes at the constant addition rate. At this time, $K_3IrCl_5(H_2O)$ was added to the aqueous solution of NaCl in the amount so as to give a concentration of $7\times10^{-7}$ mole based on the total. silver amount, so that the aquo-iridium compound was doped to the silver chloride grains.

Further, an aqueous solution of silver nitrate (0.2 mole) and an aqueous solution of NaCl (0.18 mole) and an aqueous solution of KBr (0.02 mole) were added over 6 minutes. At this time, $K_4Ru(CN)_6$ and $K_4Fe(CN)_6$ were dissolved in these halogen solution so as to give a concentration of $0.6\times10^{-5}$ mole based on the total silver amount, respectively. In this way, these metal compounds were incorporated in the silver halide grains.

Besides, during growth of the grain at the final stage, an aqueous solution of KI corresponding to 0.001 mole based on the total silver amount was added to a reaction vessel over 1 minute. The addition started from the time when 93% of the grain formation was completed.

Thereafter, Compound (Y) as a settling agent was added at 40° C., and pH was adjusted to about 3.5, followed by desalting and washing.

Compound X

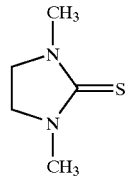

Compound Y

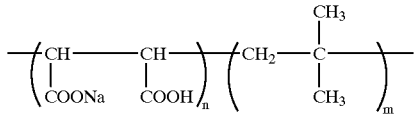

n and m is each an integer

To the desalted and washed emulsion, deionized gelatin and an aqueous solution of NaCl, and an aqueous solution of NaOH were added. Then, the temperature of the emulsion was elevated to 50° C., and the pAg and pH of the emulsion were adjusted to 7.6 and 5.6, respectively.

The resulting emulsion was a gelatin composition comprising cubic silver halide grains having a halogen composition of silver chloride (98.9 mole %), silver bromide (1 mole %) and silver iodide (0.1 mole %), average side length of 0.70 μm and coefficient of variation of the side length of 8%.

The temperature of the above-mentioned emulsion grains was kept to 60° C. Then, $4.6\times10^{-4}$ mole/Ag mole of spectral sensitizing dye-1 was added. Further, $1\times10^{-5}$ mole/Ag mole of thiosulfonic acid compound-1 was added. Then, a fine grain emulsion containing a doped iridium hexachloride, and having silver bromide (90 mole %) and silver chloride (10 mole %), and an average grain size of 0.05 μm, was added and ripened for 10 minutes. Further, a fine grain having silver bromide (40 mole %) and silver chloride (60 mole %), and an average grain size of 0.05 μm, was added and ripened for 10 minutes. Thus, the fine grains were dissolved, so that the silver bromide content of the cubic host grains increased up to 1.3 mole, and iridium hexachloride was doped in an amount of $1\times10^{-7}$ mole/Ag mole.

Successively, $1\times10^{-5}$ mole/Ag mole of sodium thiosulfate and $2\times10^{-5}$ mole/Ag mole of gold sensitizer-1 were added. Immediately after that, the temperature of the emulsion was elevated to 60° C. and the emulsion was ripened at the same temperature for 40 minutes, and then cooled to 50° C. Immediately after cooling, mercapto compounds −1 and −2 were added so as to give a concentration of $6.2\times10^{-4}$ mole per mole of Ag, respectively. Then, after ripening for 10 minutes, an aqueous solution of KBr was added so as to give a concentration of 0.009 mole based on silver, and ripened for 10 minutes. Thereafter, the temperature of the emulsion was lowered, and the emulsion was stored.

Thus, high-speed emulsion A-1b was prepared.

Cubic grains having an average side length of 0.55 μm and coefficient of variation of the side length of 9% were prepared by the same preparation method as with emulsion A-1b, except that the temperature during grain formation was changed to 55° C.

Spectral sensitization and chemical sensitization were performed with corrected sensitization amounts so as to meet the specific surface area (according to the ratio of the side lengths 0.7/0.55=1.27 times). Thus, the low-speed emulsion A-2b was prepared.

Spectral sensitizing dye-1

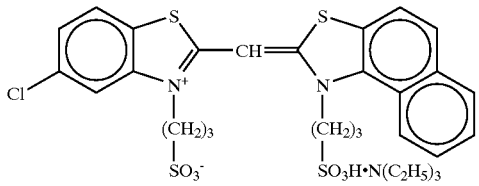

Thiosulfonic acid compound-1

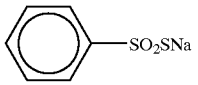

Mercapt compound-1

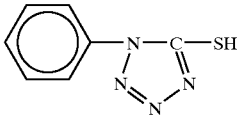

Mercapt compound-2

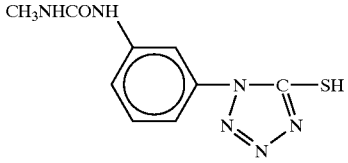

Gold sensitizer-1

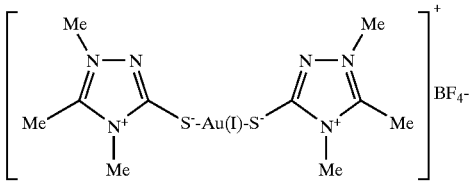

(Present Invention, Preparation of a Blue-sensitive Layer Emulsion Bb)

A blue-sensitive and high-speed emulsion B-1b was prepared in the same manner as in the preparation of the comparative blue-sensitive layer emulsion A-1b except that the foregoing spectral sensitizing dye I-(2) was added in an amount of $4.6\times10^{-4}$ mol/Ag mol in place of the spectral sensitizing dye-1. A blue-sensitive and low-speed emulsion B-2b was prepared in the same manner as above by adding the spectral sensitizing dye I-(2) in such an amount as to make the specific surface area equal to that of the emulsion B-1 in place of the spectral sensitizing dye-1. The particle size was 0.40 μm as an average side length on the high-speed side and 0.30 μm as an average side length on the low-speed side. A coefficient of variation in the particle size was 8% on both sides.

(Present Invention, Preparation of Green-sensitive Layer Emulsion Cb)

Green-sensitive high-speed emulsion C-1b and Green-sensitive low-speed emulsion C-2b were prepared by the same preparation conditions as with the above-mentioned emulsions A-1b and A-2b, except that the temperature during grain formation was lowered and sensitizing dyes were changed as described below, amounts of sodium thiosulfate and the gold sensitizer-1 per surface area of grain were constant.

(Sensitizing dye D)

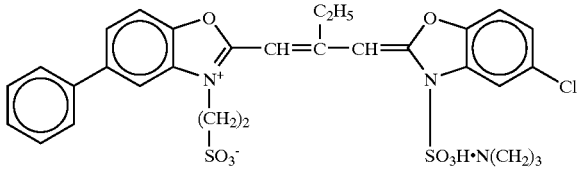

(Sensitizing dye E)

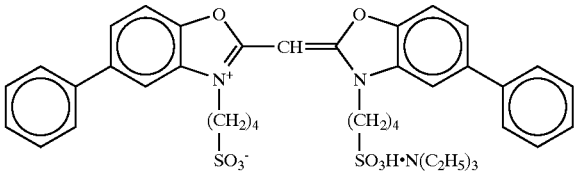

As to the grain size, average side length of the high-speed emulsion and average side length of the low-speed emulsion were 0.40 μm and 0.30 μm, respectively. The coefficient of variation of the side length of these emulsions was 8%, respectively.

Sensitizing dye D was added to the large grain size emulsion and the small grain size emulsion in an amount of $3.2\times10^{-4}$ mole and of $3.8\times10^{-4}$ mole, per mole of silver halide, respectively. Beside, Sensitizing dye E was added to the large grain size emulsion and the small grain size emulsion in an amount of $4.2\times10^{-5}$mole and of $7.4\times10^{-5}$ mole, per mole of silver halide, respectively.

(Present Invention, Preparation of Red-sensitive Layer Emulsion Db)

Red-sensitive high-speed emulsion D-1b and Red-sensitive low-speed emulsion D-2b were prepared by the same preparation conditions as with the above-mentioned emulsions A-1b and A-2b, except that the temperature during grain formation was lowered and sensitizing dyes were changed as described below.

(Sensitizing dye G)

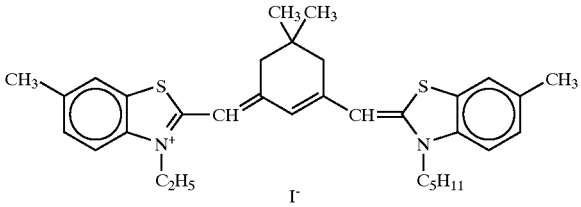

-continued (Sensitizing dye H)

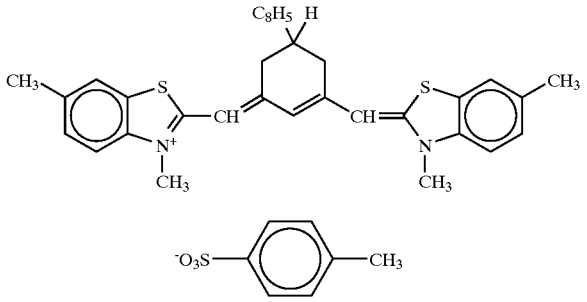

As to the grain size, average side length of the high-speed emulsion and average side length of the low-speed emulsion were 0.38 μm and 0.32 μm, respectively. The coefficient of variation of the side length of these emulsions was 9% and 10%, respectively.

Each of sensitizing dye G and H was added to the large grain size emulsion in an amount of $8.0\times10^{-5}$ mole, and to the small grain size emulsion in an amount of $10.7\times10^{-5}$ mole, per mole of silver halide, respectively.

Further, $3.0\times10^{-3}$ mole of the compound I was added to the red sensitive layer per mole of silver halide.

(Preparation of Coating solution for First layer)

57 g of a yellow coupler (ExY-200), 7 g of a color-image stabilizer (Cpd-1), 5 g of a color-image stabilizer (Cpd-2), 6 g of a color-image stabilizer (Cpd-3) and 2 g of a color-image stabilizer (Cpd-8) were dissolved in 22 g of a solvent (Solv-1) and 80 ml of ethyl acetate, and the resultant solution was added to 220 g of an aqueous 23.6% by mass gelatin solution containing 4 g of sodium dodecylbenzenesulfonate. The resultant mixture was emulsified and dispersed by a high speed stirring emulsifier (dissolver), followed by addition of water to prepare 900 g of emulsified dispersion Ab.

The emulsified dispersion Ab described above and the emulsions A-1b and A-2b were mixed and dissolved to prepare a coating solution of the first layer having the following composition. The coating amount of each emulsion is represented by the coating amount of silver.

The coating solutions for the second to seventh layers were prepared following the same procedures as for the coating solution of the first layer. 1-oxy-3,5-dichloro-s-triazine sodium salt (H-1), (H-2), and (H-3) were used as gelatin hardeners in each layer. A quantity of addition was adjusted so that the swelled film thickness with water would be the value of Table 6. In addition, Ab-1, Ab-2, Ab-3 and Ab-4 were added to each layer such that their total amounts were 14.0 mg/m$^2$, 62.0 mg/m$^2$, 5.0 mg/m$^2$ and 10.0 mg/m$^2$, respectively.

Further, 1-(3-methylureidophenyl)-5-mercaptotetrazole was added to the second layer, the forth layer, the sixth layer and the seventh layer in amounts of 0.2 mg/m$^2$, 0.3 mg/m$^2$, 0.6 mg/m$^2$ and 0.1 mg/m$^2$, respectively.

Also, 4-hydroxy-6-methyl-1,3,3a,7-tetrazaindene was added to the blue-, and green-sensitive emulsion layers in amounts of $1\times10^{-4}$ mole and $2\times10^{-4}$mole, respectively, per mole of silver halide.

Further, a copolymer latex of methacrylic acid and butyl acrylate (ratio by mass, 1:1; average molecular weight, 200,000 to 400,000) was added to the red-sensitive emulsion layer in an amount of 0.05 g/m$^2$.

Further, disodium catechol-3,5-disulfonate was added to the second layer, the fourth layer and the sixth layer in an amount of 6 mg/m$^2$, 6 mg/m$^2$ and 17 mg/m$^2$, respectively.

Furthermore, to prevent irradiation, the same dyes that were added in Example 101 (the number given in parenthesis represents the coating amount) were added.

(Layer Constitution)

The composition of each layer is shown below. The numbers show coating amounts (g/m$^2$). In the case of the silver halide emulsion, the coating amount is in terms of silver.

Support

Polyethylene resin laminated paper

{The polyethylene resin on the first layer side contained a white pigment ($TiO_2$; content of 16 mass %, ZnO; content of 4 mass %), a fluorescent whitening agent (4,4'-bis(5-methylbenzoxazolyl)stilbene; content of 0.03 mass %) and a bluish dye (ultramarine; content of 0.03 mass %), the amount of the polyethylene resin is 29.2 g/m$^2$}

| | |
|---|---|
| First Layer (Blue-Sensitive Emulsion Layer) | |
| Silver chloride emulsion Ab (gold-sulfur sensitized cubes, a 3:7 mixture of the large-size emulsion A-1b and the small-size emulsion A-2b (in terms of mol of silver)) | 0.24 |
| Gelatin | 1.31 |
| Yellow coupler (ExY-200) | 0.57 |
| Color-image stabilizer (Cpd-1) | 0.06 |
| Color-image stabilizer (Cpd-2) | 0.05 |
| Color-image stabilizer (Cpd-3) | 0.06 |
| Color-image stabilizer (Cpd-8) | 0.03 |
| Solvent (Solv-1) | 0.22 |
| Second Layer (Color Mixing Inhibiting Layer) | |
| Gelatin | 1.20 |
| Color mixing inhibitor (Cpd-204) | 0.11 |
| Color-image stabilizer (Cpd-5) | 0.018 |
| Color-image stabilizer (Cpd-6) | 0.13 |
| Color-image stabilizer (Cpd-7) | 0.06 |
| Solvent (Solv-1) | 0.04 |
| Solvent (Solv-202) | 0.13 |
| Solvent (Solv-5) | 0.11 |

-continued

| | |
|---|---|
| Third Layer (Green-Sensitive Emulsion Layer) | |
| Silver chlorobromide emulsion Bb (gold-sulfur sensitized cubes, a 1:3 mixture of the large-size emulsion B-1b and the small-size emulsion B-2b (in terms of mol of silver)) | 0.14 |
| Gelatin | 1.30 |
| Magenta coupler (ExM-200) | 0.17 |
| Ultraviolet absorbing agent (UV-A200) | 0.14 |
| Color-image stabilizer (Cpd-2) | 0.003 |
| Color mixing inhibitor (Cpd-204) | 0.003 |
| Color-image stabilizer (Cpd-6) | 0.09 |
| Color-image stabilizer (Cpd-8) | 0.02 |
| Color-image stabilizer (Cpd-9) | 0.02 |
| Color-image stabilizer (Cpd-10) | 0.03 |
| Color-image stabilizer (Cpd-211) | 0.0004 |
| Solvent (Solv-3) | 0.09 |
| Solvent (Solv-4) | 0.17 |
| Solvent (Solv-5) | 0.18 |
| Fourth Layer (Color Mixing Inhibiting Layer) | |
| Gelatin | 0.68 |
| Color mixing inhibitor (Cpd-204) | 0.06 |
| Color-image stabilizer (Cpd-5) | 0.011 |
| Color-image stabilizer (Cpd-6) | 0.09 |
| Color-image stabilizer (Cpd-7) | 0.06 |
| Solvent (Solv-1) | 0.02 |
| Solvent (Solv-202) | 0.07 |
| Solvent (Solv-5) | 0.069 |
| Fifth Layer (Red-Sensitive Emulsion Layer) | |
| Silver chlorobromide emulsion Cb (gold-sulfur sensitized cubes, a 5:5 mixture of the large-size emulsion C-lb and the small-size emulsion C-2b (in terms of mol of silver)) | 0.16 |
| Gelatin | 1.25 |
| Cyan coupler (ExC-201) | 0.023 |
| Cyan coupler (ExC-202) | 0.05 |
| Cyan coupler (ExC-203) | 0.15 |
| Ultraviolet absorbing agent (UV-A200) | 0.055 |
| Color-image stabilizer (Cpd-1) | 0.24 |
| Color-image stabilizer (Cpd-7) | 0.002 |
| Color-image stabilizer (Cpd-9) | 0.03 |
| Color-image stabilizer (Cpd-12) | 0.01 |
| Solvent (Solv-208) | 0.06 |
| Sixth Layer (Ultraviolet Absorbing Layer) | |
| Gelatin | 0.46 |
| Ultraviolet absorbing agent (UV-B200) | 0.33 |
| Compound (S1-4) | 0.0014 |
| Solvent (Solv-7) | 0.21 |
| Seventh Layer (Protective Layer) | |
| Gelatin | 1.00 |
| Acryl-modified copolymer of polyvinyl alcohol (modification degree: 17%) | 0.04 |
| Liquid paraffin | 0.02 |
| Surface active agent (Cpd-13) | 0.016 |

(ExY-200) Yellow coupler

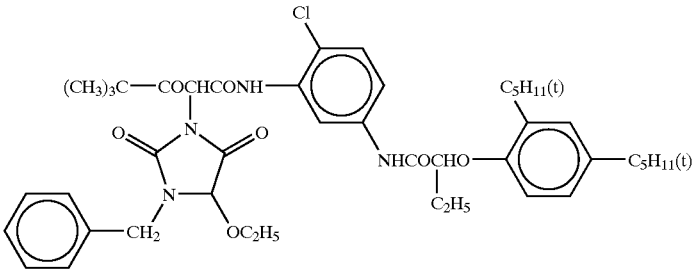

(ExM-200) Magenta coupler

A mixture in 40:40:20 (molar ratio) of

-continued
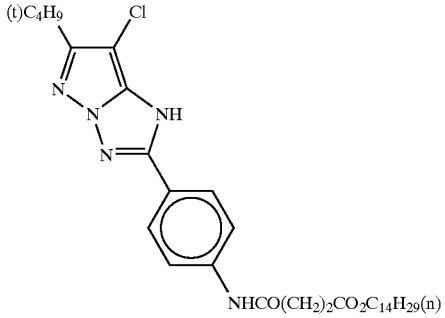
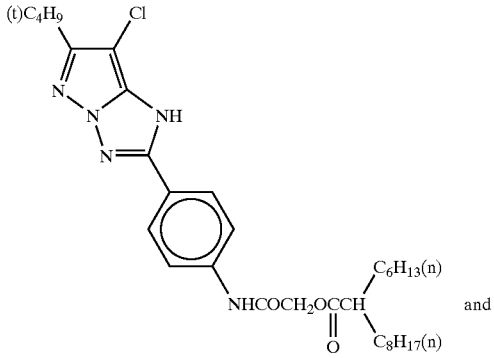
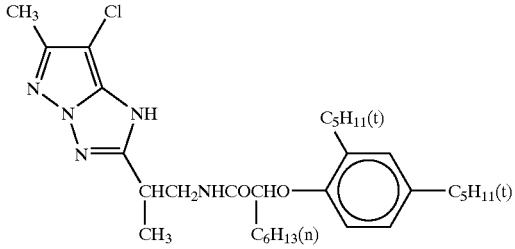
(ExC-201) Cyan coupler
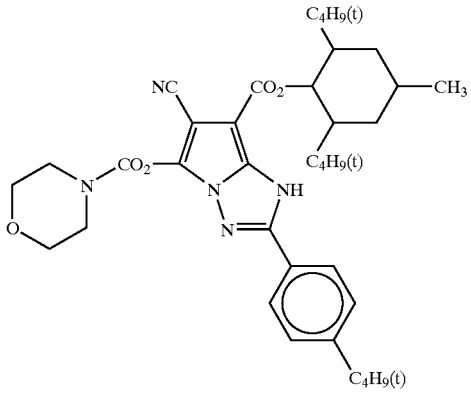
(ExC-202) Cyan coupler
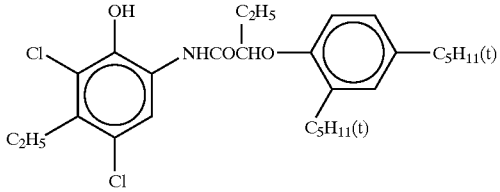

-continued
(ExC-203) Cyan coupler
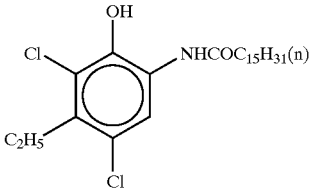
(Cpd-204) Color mixing inhibitor
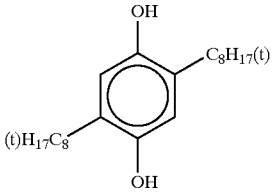
(Cpd-211)
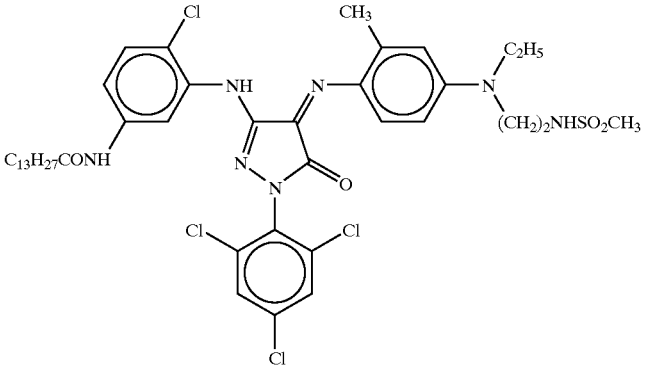
(Cpd-12)
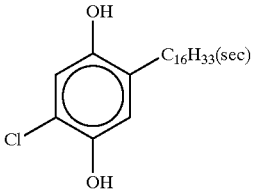
UV-A200: A mixture of UV-1/UV-2/UV-3=7/2/2 (mass ratio)
UV-B200: A mixture of UV-1/UV-2/UV-3/UV-5/UV-6=13/3/3/5/3 (mass ratio)
UV-C200: A mixture of UV-1/UV-3=9/1 (mass ratio)
(Solv-202)
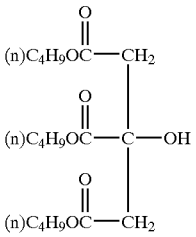
(Solv-208)
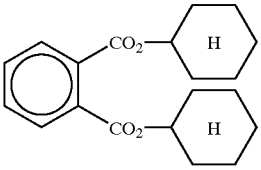

Each amount of gelatin hardeners, 1-oxy-3,5-dichloro-s-triazine sodium salts (H-1), (H-2) and (H-3) to be added to the sample 101b produced in the above manner was changed such that the thickness of a swelled film was equal to the values shown in Table 6. Also, the amounts of a gelatin to be applied to a first layer to a seventh layer were decreased equally such that the film thickness was equal to the value shown in the table. Further, each amount of the blue-sensitive emulsion, the green-sensitive emulsion and the red-sensitive emulsion to be applied was decreased equally such that amount of silver to be applied (amount of Ag) was equal to the value shown in Table 6. Also, as shown in Table 6, the blue-sensitive emulsions Ab and Bb were applied to produce coating samples 101b to 113b.

(Preparation of Processing Solution)

The above coating samples were processed into a form of a roll with a width of 127 mm, and the photosensitive material was imagewise exposed from a negative film of average density, by using a laboratory processor obtained by modifying Digital Mini-Lab Frontier 350 manufactured by Fuji Photo Film Co., Ltd. so that the processing time and processing temperature could be changed, and continuous processing (running test) was performed until the volume of the color developer replenisher used in the following processing step became double the volume of the color developer tank. The processing using this running processing solution was named processing B200.

| Processing step | Temperature | Time | Replenisher amount* |
|---|---|---|---|
| Color development | 46.0° C. | 18 sec | 46 ml |
| Bleach-fixing | 43.0° C. | 18 sec | 35 ml |
| Rinse (1) | 43.0° C. | 5.5 sec | — |
| Rinse (2) | 43.0° C. | 5.5 sec | — |
| Rinse (3)** | 43.0° C. | 5.5 sec | — |
| Rinse (4)** | 40.0° C. | 5.5 sec | 130 m1 |
| Drying | 80° C. | 12 sec | |

(Note)

*Replenisher amount per $m^2$ of the light-sensitive material to be processed.

**A rinse cleaning system RC50D (trade name), manufactured by Fuji Photo Film Co., Ltd., was installed in the rinse (3), and the rinse solution was taken out from the rinse (3) and sent to a reverse osmosis module (RC50D) by using a pump. The permeated water obtained in that tank was supplied to the rinse (4), and the concentrated water was returned to the rinse (3). Pump pressure was controlled such that the water to be permeated in the reverse osmosis module would be maintained in an amount of 50 to 300 ml/min, and the rinse solution was circulated under controlled temperature for 10 hours a day. The rinse was made in a tank counter-current system from (1) to (4).

The composition of each processing solution was as follows, respectively:

| | (Tank solution) | (Replenisher) |
|---|---|---|
| (Color developer) | | |
| Water | 800 ml | 800 ml |
| Fluorescent whitening agent (FL-3) | 4.3 g | 8.3 g |
| Residual color reducing agent (SR-1) | 3.0 g | 5.5 g |
| Triisopropanolamine | 8.8 g | 8.8 g |
| Sodium p-toluenesulfonate | 10.0 g | 10.0 g |
| Ethylenediamine tetraacetic acid | 4.2 g | 4.2 g |
| Sodium sulfite | 0.10 g | 0.10 g |
| Potassium chloride | 9.0 g | — |
| Sodium 4,5-dihydroxybenzene-1,3-disulfonate | 0.52 g | 0.52 g |
| Disodium-N,N-bis(sulfonatoethyl)hydroxylamine | 8.5 g | 14.0 g |
| 4-amino-3-methyl-N-ethyl-N-(β-methanesulfonamidoethyl)aniline · 3/2 sulfate · monohydrate | 7.0 g | 19.0 g |
| Potassium carbonate | 26.3 g | 26.3 g |
| Water to make | 1000 ml | 1000 ml |
| pH (25° C., adjusted using sulfuric acid and KOH) | 10.25 | 12.6 |

FL-3

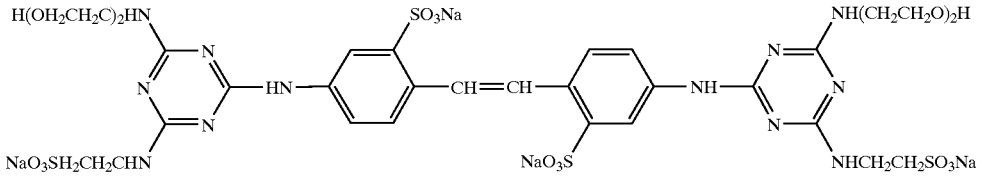

SR-1

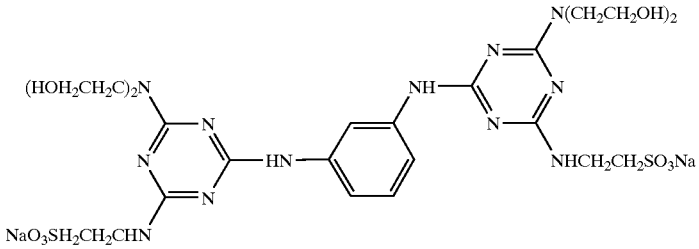

-continued

| | (Tank solution) | (Replenisher) |
|---|---|---|
| (Bleach-fixing solution) | | |
| Water | 800 ml | 800 ml |
| Ammonium thiosulfate (750 g/ml) | 107 ml | 214 ml |
| Succinic acid | 29.5 g | 59.0 g |
| Ammonium iron (III) ethylenediaminetetraacetate | 47.0 g | 94.0 g |
| Ethylenediaminetetraacetic acid | 1.5 g | 3.0 g |
| Nitric acid (67%) | 17.5 g | 35.0 g |
| Imidazole | 14.7 g | 29.6 g |
| Ammonium sulfite | 16.8 g | 32.6 g |
| Potassium metabisulfite | 24.1 g | 47.2 g |
| Water to make | 1000 ml | 1000 ml |
| pH (25° C., adjusted using nitric acid and aqueous ammonia) | 6.00 | 6.00 |
| (Rinse solution) | | |
| Deionized water (conductivity: 5 μS/cm or below) | 1000 ml | 1000 ml |
| pH (25° C.) | 6.5 | 6.5 |

(Exposure Condition)

Also, the exposure section of Digital Mini-lab Frontier 350 manufactured by Fuji Photo Film Co., Ltd. was remodeled so as to change exposure wavelength so that a blue color-emitting laser with a wavelength of about 470 nm taken out from a blue color-emitting semiconductor laser (oscillation wavelength: about 940 nm) by wavelength conversion using a SHG crystal of $LiNbO_3$ having a waveguide-like inversion domain structure and a blue color-emitting semiconductor laser (presented by NICHIA CORPORATION in the 48th Meeting of the Japan Society of Applied Physics and Related Societies in March in 2001) with a wavelength of about 440 nm were changed to suit the occasion. Also a green color-emitting laser with a wavelength of about 530 nm taken out from a semiconductor laser (oscillation wavelength: about 1060 nm) by wavelength conversion using a SHG crystal of $LiNbO_3$ having a waveguide-like inversion domain structure and a red color-emitting semiconductor laser (Hitachi type No. HL6501MG) having a wavelength of about 650 nm were used. Each of these three laser lights was moved in a direction perpendicular to the scanning direction by a polygon mirror so that it is possible to scan-expose the sample to light sequentially. A variation in the quantity of light caused by the temperature of the semiconductor laser was suppressed by keeping the temperature constant by using a Peltier element. The effective beam diameter was 80 μm, the scanning pitch was 42.3 μm (600 dpi) and the average exposure time per pixel was $1.7\times10^{-7}$ seconds. The apparatus was remodeled such that the latent image time since exposure until the start of developing could be varied and the latent image time was set to 9 seconds.

(Sensitivity)

Each developed color density of yellow, magenta and cyan colors of each sample after exposure treatment using the exposure apparatus remodeled in the above manner was measured to find each sensitivity after the exposure. The sensitivity was defined as the reciprocal of an exposure amount giving a developed color density higher by 1.0 than the minimum developed color density and expressed by a relative value when the sensitivity of the sample 101b applied as the blue color-sensitive layer was defined as 100.

(Evaluation of Developing Progress Characteristics)

The photographic sensitivity of the blue-sensitive layer of the sample was estimated using the same experimental instrument that was used in the evaluation of sensitivity for a color developing time of 10 seconds. A difference between an exposure amount giving the photographic sensitivity when the sample was treated for a color developing time of 15 seconds and an exposure amount giving the photographic sensitivity when the sample was treated for a color developing time of 10 seconds was evaluated by a relative value when the difference in the case of the coating sample 101b was defined as 100.

(Functional Evaluation of Residual Color)

A sample obtained by producing in the same manner as above, exposing imagewise and treating was evaluated functionally according to the following standard.

◎: Almost no residual color is observed and the white base of the unexposed area is seen clean.

○: A little residual color is observed but is not perceptible.

Δ: A lot of residual color is observed but practically allowable.

×: Inferior clearing of dye, a level out of the question.

(Evaluation for Drying Characteristics)

The drying characteristics of the coating sample after treated was evaluated by the touch according to the following standards.

○: Dried sufficiently.

×: Moistened and inferior drying characteristics.

(Measurement of Dry Film Thickness and Swelled Film Thickness)

Dry film thickness was found by observing the section of the dried coating sample by a scanning electron microscope (SEM). Also, a dry coating sample was swelled in 35° C. pure water for a plenty time and then subjected to measurement using a chopper bar system.

The results are shown in Table 6.

TABLE 6

| Coating sample | Swelled film thickness (μm) | Dry film thickness (μm) | Amount of silver to be applied ($g/m^2$) | Exposure wavelength (nm) | Blue-sensitive silver halide | Sensitivity | Development progress characteristics | Residual color | Drying characteristics |
|---|---|---|---|---|---|---|---|---|---|
| 101b | 23 | 10 | 0.47 | 470 | Ab | 100 | 100 | x | x |
| 102b | 23 | 10 | 0.47 | 470 | Bb | 81 | 100 | x | x |
| 103b | 23 | 10 | 0.47 | 440 | Bb | 110 | 98 | x | x |
| 104b | 16 | 10 | 0.47 | 470 | Ab | 94 | 191 | x | x |
| 105b | 23 | 10 | 0.47 | 440 | Bb | 105 | 95 | x | x |
| 106b | 16 | 10 | 0.47 | 440 | Bb | 101 | 185 | Δ | ○ |
| 107b | 16 | 6 | 0.47 | 440 | Bb | 100 | 79 | ○ | ○ |
| 108b | 16 | 6 | 0.42 | 440 | Bb | 105 | 61 | ◎ | ○ |
| 109b | 16 | 6 | 0.47 | 470 | Ab | 101 | 86 | x | ○ |
| 110b | 23 | 10 | 0.47 | 440 | Ab | 88 | 117 | x | x |
| 111b | 16 | 10 | 0.47 | 440 | Ab | 85 | 138 | x | ○ |
| 112b | 21 | 6 | 0.47 | 440 | Bb | 105 | 103 | ○ | x |
| 113b | 16 | 6 | 0.55 | 440 | Bb | 101 | 62 | Δ | ○ |

As is clear from Table 6, it was confirmed that the swelled film thickness and the dry film thickness each fell in the range defined in the present invention, satisfactory sensitivity was obtained when the laser diode having an exposure wavelength of 440 nm, the residual color was decreased and the whiteness of the white base became conspicuous. Further, if the amount of silver to be applied was small, it was confirmed that the residual color was remarkably bettered and the sample was found to have super-rapid processing suitability.

Example 202

In Example 201, the contents of $TiO_2$ and ZnO which were white pigments were altered to 20 mass % and 6 mass % respectively and the content of 4,4'-bis(5-methylbenzoxazolyl)stilbene which was a fluorescent whitening agent was altered to 0.05 mass % to prepare a Support 2. Also, the layer constitution of the fifth constitution was altered to the following constitution.

Fifth Layer (Red-Sensitive Emulsion Layer)

| | |
|---|---|
| Silver chlorobromide emulsion Cb (gold-sulfur sensitized cubes, a 5:5 mixture of the large-size emulsion C-1b and the small-size emulsion C-2b (in terms of mole of silver)) | 0.10 |
| Gelatin | 1.25 |
| Cyan coupler (ExC-201) | 0.03 |
| Cyan coupler (ExC-203) | 0.01 |
| Cyan coupler (ExC-4) | 0.12 |
| Cyan coupler (ExC-5) | 0.01 |
| Color-image stabilizer (Cpd-1) | 0.02 |
| Color-image stabilizer (Cpd-6) | 0.06 |
| Color-image stabilizer (Cpd-7) | 0.02 |
| Color-image stabilizer (Cpd-9) | 0.04 |
| Color-image stabilizer (Cpd-10) | 0.02 |
| Color-image stabilizer (Cpd-14) | 0.01 |
| Color-image stabilizer (Cpd-15) | 0.11 |
| Color-image stabilizer (Cpd-16) | 0.01 |
| Color-image stabilizer (Cpd-17) | 0.005 |
| Color-image stabilizer (Cpd-18) | 0.07 |
| Color-image stabilizer (Cpd-20) | 0.01 |
| Ultraviolet absorbing agent (UV-7) | 0.01 |
| Solvent (Solv-5) | 0.15 |

(ExC-4) Cyan coupler

-continued

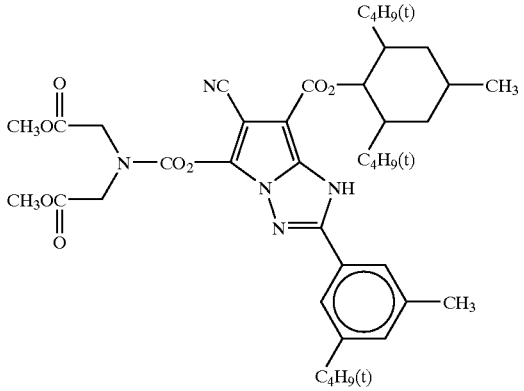

(ExC-5) Cyan coupler

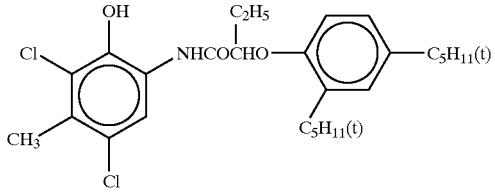

(Cpd-20)

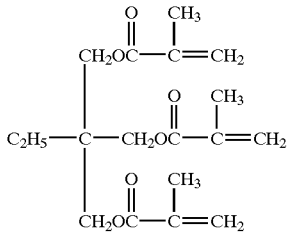

In the same manner as in Example 201, the amount of the film hardener and the amount of the gelatin were adjusted to produce a coating sample having a swelled film thickness and dry film thickness which each fell in the preferable range defined in the present invention and the effect of the present invention was confirmed in the case of exposing the blue-sensitive silver halide to light in the exposure range according to the present invention.

Example 203

(Preparation of a Blue-sensitive Layer Silver Halide Emulsion)

A blue-sensitive emulsion C-1b was prepared in the same manner as in Example 201 except that in the preparation of the blue-sensitive layer emulsion Ab produced in Example 201, $K_3IrCl_5(H_2O)$ to be added in the formation of the particle was not added, the amount of Ir in the emulsion of the fine particle obtained by doping Ir hexachloride with 90 mol % of silver bromide and 10 mol % of silver chloride was altered to $1\times10^{-6}$ mol/Ag mol and the amount of the chemical sensitizer consisting of sodium thiosulfate and the gold sensitizer-1 was altered such that the optimum photographic characteristics could be obtained. Moreover, a blue-sensitive emulsion D-1b was prepared in the same manner as in Example 201 except that in the preparation of the blue-sensitive layer emulsion Bb produced in Example 201, $K_3IrCl_5(H_2O)$ was not added, the amount of Ir hexachloride was altered to $1\times10^{-6}$ mol/Ag mol and the amount of the chemical sensitizer was altered to the optimum amount. As to small size particles, emulsions C-2b and D-2b were prepared in the same manner as in the example.

Coating samples 301b to 311b were prepared in the same manner as in Example 201. The sensitivity, the development progress characteristics, the residual color and the drying characteristics of the blue-sensitive emulsion were evaluated in the same manner as in Example 201. As to the latent image time, the evaluation was made in the condition that the latent image time was altered to 5 seconds and 10 seconds. The results are shown in Table 7.

TABLE 7

| Coating sample | Swelled film thickness (μm) | Dry film thickness (μm) | Amount of silver to be applied ($g/m^2$) | Exposure wavelength (nm) | AgX | Latent image time (sec) | Sensitivity | Development progress characteristics | Residual color | Drying characteristics |
|---|---|---|---|---|---|---|---|---|---|---|
| 301b | 21 | 10 | 0.44 | 470 | Ab | 5 | 100 | 100 | x | x |
| 302b | 21 | 10 | 0.44 | 470 | Ab | 10 | 105 | 95 | x | x |
| 303b | 21 | 10 | 0.44 | 470 | Cb | 5 | 83 | 98 | x | x |
| 304b | 21 | 10 | 0.44 | 470 | Cb | 10 | 107 | 100 | x | x |
| 305b | 15 | 5.5 | 0.44 | 470 | Cb | 5 | 61 | 77 | Δ | ○ |
| 306b | 15 | 5.5 | 0.44 | 470 | Cb | 10 | 110 | 80 | Δ | ○ |
| 307b | 15 | 5.5 | 0.44 | 470 | Bb | 5 | 53 | 75 | ○ | ○ |
| 308b | 15 | 5.5 | 0.44 | 440 | Bb | 5 | 106 | 71 | ○ | ○ |
| 309b | 15 | 5.5 | 0.44 | 440 | Bb | 10 | 107 | 70 | ○ | ○ |
| 310b | 15 | 5.5 | 0.44 | 440 | Db | 5 | 86 | 80 | ○ | ○ |
| 311b | 15 | 5.5 | 0.44 | 440 | Db | 10 | 103 | 80 | ○ | ○ |

As is found from Table 7, the effect of the present invention was confirmed and it was also confirmed that the emulsion using $K_2IrCl_5(H_2O)$ as the Ir complex brought about satisfactory photographic characteristics even when the latent image time was shorter than 10 seconds.

Example 301

(Preparation of the Emulsion B-1)

To a 3% aqueous solution of lime-treated gelatin were added an aqueous solution of silver nitrate and an aqueous solution of sodium chloride simultaneously with vigorous stirring at 60° C. Over a period ranging from the time point of 80% addition of silver nitrate to the time point of 90% addition of silver nitrate, potassium bromide in an amount of 2 mol % per mole of silver halide to be finally formed was added under vigorous mixing. Over a period ranging from the time point of 80% addition of silver nitrate to the time point of 90% addition of silver nitrate, an aqueous solution of $K_4[Ru(CN)_6]$ in an amount of $9\times10^{-6}$ mol of Ru per mole of silver halide to be finally formed was added. Over a period ranging from the time point of 83% addition of silver nitrate to the time point of 88% addition of silver nitrate, an aqueous solution of $K_2[IrCl_6]$ in an amount of $1\times10^{-9}$ mol of Ir per mole of silver halide to be finally formed was added. Over a period ranging from the time point of 92% addition of silver nitrate to the time point of 98% addition of silver nitrate, an aqueous solution of $K_2[Ir(5\text{-methylthiazole})Cl_5]$ in an amount of $1\times10^{-7}$ mol of Ir per mole of silver halide to be finally formed was added. After the desalting treatment at 40° C. of the mixture, lime-treated gelatin was added and pH was adjusted to 5.6 and the pCl was adjusted to 1.7. The emulsion obtained in this way was an emulsion composed of cubic silver chlorobromide grains having an equivalent-sphere diameter of 0.67 μm and a coefficient of variation of 10.5%.

The emulsion was dissolved, to which were added sodium thiosulfonate in an amount of $1\times10^{-5}$ mol per mole of silver halide, sodium thiosulfate pentahydrate as a sulfur sensitizer, and (S-2) as a gold sensitizer. The emulsion was then ripened at 60° C. so that the emulsion reached an optimum state. Next, after the emulsion was cooled to 40° C., the sensitizing dye A in an amount of $2.5\times10^{-4}$mol per mole of silver halide, the sensitizing dye B in an amount of $1.2\times10^{-4}$ mol per mole of silver halide, 1-phenyl-5-mercaptotetrazole in an amount of $2\times10^{-4}$ mol per mole of silver halide, 1-(5-methylureidophenyl)-5-mercaptotetrazole in an amount of $2.8\times10^{-4}$ mol per mole of silver halide, 1-[3-(5-mercaptotetrazole-1-yl)-phenyl]-1-hydroxy-1-methylurea in an amount of $8.8\times10^{-6}$ mol per mole of silver halide, and potassium bromide in an amount of $3\times10^{-3}$ mol per mole of silver halide were added. The emulsion obtained in this way was designated as the Emulsion B-1.

(Sensitizing dye A)

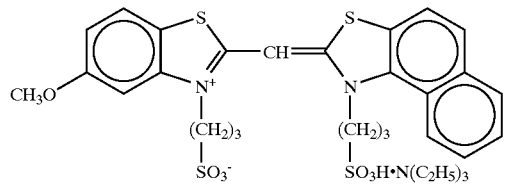

-continued (Sensitizing dye B)

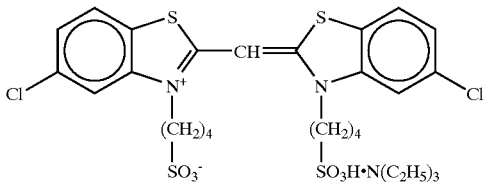

(Preparation of the Emulsion B-2)

The Emulsion B-2 was prepared in the same way as in the preparation of the Emulsion B-1, except that the emulsion was ripened for 30 minutes following the addition of the sensitizing dye A and the sensitizing dye B without changing the temperature subsequent to the ripening at 60° C. of the emulsion so that an optimum state was reached after the addition of sodium thiosulfate pentahydrate and (S-2). After the completion of the ripening, the temperature of the emulsion was lowered to 40° C.

(Preparation of the Emulsion B-3)

The Emulsion B-3 was prepared in the same way as in the preparation of the Emulsion B-1, except that, at the time point of completion of 90% addition of silver nitrate, an aqueous solution of potassium iodide in an amount of 0.08 mol % of I per mole of silver halide to be finally formed was added under vigorous mixing. When the concentration distribution of silver iodide of the silver halide grains contained in the Emulsion B-3 was measured, it was found that the surface of the silver halide grains had a silver iodide-containing phase whose silver iodide content was maximal.

(Preparation of the Emulsions B-4 to B-6)

The Emulsions B-4 to B-6 were prepared in the same way as in the preparation of the Emulsions B-1 to B-3, respectively, except that the temperature at which the aqueous solution of silver nitrate and the aqueous solution of sodium chloride were mixed by addition was changed to 52° C. and the amounts of chemicals to be added other than silver nitrate, sodium chloride, potassium bromide, and potassium iodide were adjusted. The emulsions obtained in this way were emulsions composed of cubic silver halide grains having equivalent-sphere diameters of 0.54 μm and coefficients of variation of 9.5 to 11%. When the concentration distribution of silver iodide of the silver halide grains contained in the Emulsion B-6 was measured, it was found that the surface of the silver halide grains had a silver iodide-containing phase whose silver iodide content was maximal.

(Preparation of the Emulsion B-7)

The Emulsion B-7 was prepared in the same way as in the preparation of the Emulsion B-1, except that the temperature at which the aqueous solution of silver nitrate and the aqueous solution of sodium chloride were mixed by addition was changed to 49° C. and the amounts of chemicals to be added other than silver nitrate, sodium chloride, and potassium bromide were adjusted. The emulsion obtained in this way was an emulsion composed of cubic silver halide grains having an equivalent-sphere diameter of 0.49 μm and a coefficient of variation of 11.5%.

(Preparation of the Emulsion G-1)

To a 3% aqueous solution of lime-treated gelatin were added an aqueous solution of silver nitrate and an aqueous solution of sodium chloride simultaneously with vigorous stirring at 50° C. Over a period ranging from the time point of 80% addition of silver nitrate to the time point of 90% addition of silver nitrate, potassium bromide in an amount of 2.2 mol % per mole of silver halide to be finally formed was added under vigorous mixing. Over a period ranging from the time point of 80% addition of silver nitrate to the time point of 90% addition of silver nitrate, an aqueous solution of $K_4[Ru(CN)_6]$ in an amount of $1.8\times10^{-5}$ mol of Ru per mole of silver halide to be finally formed was added. Over a period ranging from the time point of 83% addition of silver nitrate to the time point of 88% addition of silver nitrate, an aqueous solution of $K_2[IrCl_6]$ in an amount of $1\times10^{-9}$ mol of Ir per mole of silver halide to be finally formed was added. At the time point of completion of 90% addition of silver nitrate, an aqueous solution of potassium iodide in an amount equivalent to 0.15 mol % of I per mole of silver halide to be finally formed was added under vigorous mixing. Over a period ranging from the time point of 92% addition of silver nitrate to the time point of 98% addition of silver nitrate, an aqueous solution of $K_2[Ir(5\text{-methyl-thiazole})Cl_5]$ in an amount of $2\times10^{-7}$ mol of Ir per mole of silver halide to be finally formed was added. After the desalting treatment at 40° C. of the mixture, lime-treated gelatin was added and pH was adjusted to 5.6 and the pCl was adjusted to 1.7. The emulsion obtained in this way was an emulsion composed of cubic silver iodochlorobromide grains having an equivalent-sphere diameter of 0.38 μm and a coefficient of variation of 11.5%.

The emulsion was dissolved at 40° C., to which were added sodium thiosulfonate in an amount of $2\times10^{-5}$ mol per mole of silver halide, sodium thiosulfate pentahydrate as a sulfur sensitizer, and (S-2) as a gold sensitizer. The emulsion was then ripened at 60° C. so that the emulsion reached an optimum state. Next, after the emulsion was cooled to 40° C., the sensitizing dye D in an amount of $7\times10^{-4}$ mol per mole of silver halide, 1-phenyl-5-mercaptotetrazole in an amount of $4\times10^{-4}$ mol per mole of silver halide, 1-(5-methylureidophenyl)-5-mercaptotetrazole in an amount of $9\times10^{-4}$ mol per mole of silver halide, and potassium bromide in an amount of $9\times10^{-3}$ mol per mole of silver halide were added. The emulsion obtained in this way was designated as the Emulsion G-1.

(Sensitizing dye D)

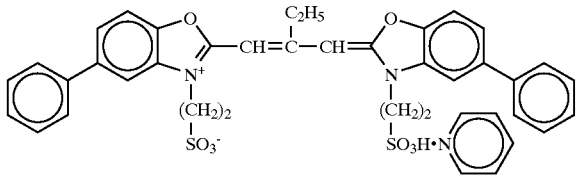

(Preparation of the Emulsion G-2)

The Emulsion G-2 was prepared in the same way as in the preparation of the Emulsion G-1, except that the temperature at which the aqueous solution of silver nitrate and the aqueous solution of sodium chloride were mixed by addition was changed to 45° C. and the amounts of chemicals to be added other than silver nitrate, sodium chloride, potassium bromide, and potassium iodide were adjusted. The emulsion obtained in this way was an emulsion composed of cubic silver iodochlorobromide grains having an equivalent-sphere diameter of 0.31 μm and a coefficient of variation of 10.5%.

(Preparation of the Emulsion R-1)

To a 3% aqueous solution of lime-treated gelatin were added an aqueous solution of silver nitrate and an aqueous solution of sodium chloride simultaneously with vigorous stirring at 48° C. Over a period ranging from the time point of 80% addition of silver nitrate to the time point of 90% addition of silver nitrate, potassium bromide in an amount of 2 mol % per mole of silver halide to be finally formed was added under vigorous mixing. Over a period ranging from the time point of 80% addition of silver nitrate to the time point of 90% addition of silver nitrate, an aqueous solution of $K_4[Ru(CN)_6]$ in an amount of $4.8\times10^{-5}$ mol of Ru per mole of silver halide to be finally formed was added. Over a period ranging from the time point of 83% addition of silver nitrate to the time point of 88% addition of silver nitrate, an aqueous solution of $K_2[IrCl_6]$ in an amount of $1.1\times10^{-9}$ mol of Ir per mole of silver halide to be finally formed was added. At the time point of completion of 90% addition of silver nitrate, an aqueous solution of potassium iodide in an amount of 0.18 mol % of I per mole of silver halide to be finally formed was added under vigorous mixing. Over a period ranging from the time point of 92% addition of silver nitrate to the time point of 98% addition of silver nitrate, an aqueous solution of $K_2[Ir(5\text{-methylthiazole})Cl_5]$ in an amount of $2\times10^{-7}$ mol of Ir per mole of silver halide to be finally formed was added. After the desalting treatment at 40° C. of the mixture, lime-treated gelatin was added and pH was adjusted to 5.6 and the pCl was adjusted to 1.7. The emulsion obtained in this way was an emulsion composed of cubic silver iodochlorobromide grains having an equivalent-sphere diameter of 0.37 μm and a coefficient of variation of 9.8%.

The emulsion was dissolved at 40° C., to which were added sodium thiosulfonate in an amount of $2\times10^{-5}$ mol per mole of silver halide, sodium thiosulfate pentahydrate as a sulfur sensitizer, and (S-2) as a gold sensitizer. The emulsion was then ripened at 60° C. so that the emulsion reached an optimum state. Next, after the emulsion was cooled to 40° C., the sensitizing dye H in an amount of $2.2\times10^{-4}$ mol per mole of silver halide, 1-phenyl-5-mercaptotetrazole in an amount of $2.2\times10^{-4}$ mol per mole of silver halide, 1-(5-methylureidophenyl)-5-mercaptotetrazole in an amount of $6.8\times10^{-4}$ mol per mole of silver halide, the compound I in an amount of $8\times10^{-4}$ mol per mole of silver halide, and potassium bromide in an amount of $8\times10^{-3}$ mol per mole of silver halide were added. The emulsion obtained in this way was designated as the Emulsion R-1.

(Preparation of the Emulsions R-2 and R-3)

The Emulsions R-2 and R-3 were prepared in the same way as in the preparation of the Emulsion R-1, except that the temperatures at which the aqueous solution of silver nitrate and the aqueous solution of sodium chloride were mixed by addition were changed to 44° C. and 42° C., respectively, and the amounts of chemicals to be added other than silver nitrate, sodium chloride, potassium bromide, and potassium iodide were adjusted. The emulsion R-2 obtained in this way was an emulsion composed of cubic silver iodochlorobromide grains having an equivalent-sphere diameter of 0.30 μm and a coefficient of variation of 10 to 11%. The emulsion R-3 obtained in this way was an emulsion composed of cubic silver iodochlorobromide grains having an equivalent-sphere diameter of 0.28 μm and a coefficient of variation of 10 to 11%.

After corona discharge treatment was performed on the surface of a paper support whose both surfaces were laminated with polyethylene resin, a gelatin subbing layer containing sodium dodecylbenzenesulfonate was formed on that surface. In addition, photographic constituting layers from the first layer to the seventh layer were coated on the support to make a silver halide color photographic light-sensitive material having the following layer arrangement. The coating solution for each of the photographic constituting layers were prepared as follows.

(Preparation of Coating Solution for First Layer)

57 g of a yellow coupler (EXY), 7 g of a color-image stabilizer (Cpd-1), 4 g of a color-image stabilizer (Cpd-2), 7 g of a color-image stabilizer (Cpd-3) and 2 g of a color-image stabilizer (Cpd-8) were dissolved in 21 g of a solvent (Solv-1) and 80 ml of ethyl acetate, and the resultant solution was added to 220 g of an aqueous 23.5% by mass gelatin solution containing 4 g of sodium dodecylbenzenesulfonate. The resultant mixture was emulsified and dispersed by a high speed stirring emulsifier (dissolver), followed by addition of water to prepare 900 g of emulsified dispersion A.

The emulsified dispersion A described above and the Emulsions B-1 and B-4 were mixed and dissolved to prepare a coating solution of the first layer having the following composition. The coating amount of each emulsion is represented by the coating amount of silver.

The coating solutions for the second to seventh layers were prepared following the same procedures as for the coating solution of the first layer. 1-oxy-3,5-dichloro-s-triazine sodium salt (H-1), (H-2), and (H-3) were used as gelatin hardeners in each layer. In addition, Ab-1, Ab-2, Ab-3 and Ab-4 were added to each layer such that their total amounts were 15.0 mg/m$^2$, 60.0 mg/m$^2$, 5.0 mg/m$^2$ and 10.0 mg/m$^2$, respectively.

Further, 1-phenyl-5-mercaptotetrazole was added to the green-, and Red-sensitive emulsion layers in amounts of $1.0\times10^{-3}$mole and $5.9\times10^{-4}$ mole, respectively, per mole of silver halide. Also, 1-phenyl-5-mercaptotetrazole was added to the second layer, the forth layer, and the sixth layer in amounts of 0.2 mg/m$^2$, 0.2 mg/m$^2$, and 0.6 mg/m$^2$, respectively.

Further, a copolymer latex of methacrylic acid and butyl acrylate (ratio by mass, 1:1; average molecular weight, 200,000 to 400,000) was added to the red-sensitive emulsion layer in an amount of 0.05 g/m$^2$. Further, disodium catechol-3,5-disulfonate was added to the second layer, the fourth layer and the sixth layer in an amount of 6 mg/m$^2$, 6 mg/m$^2$ and 18 mg/m$^2$, respectively. Furthermore, to prevent irradiation, the following dyes (the number given in parenthesis represents the coating amount) were added.

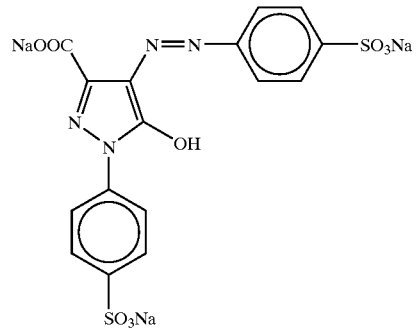

(2 mg/m$^2$)

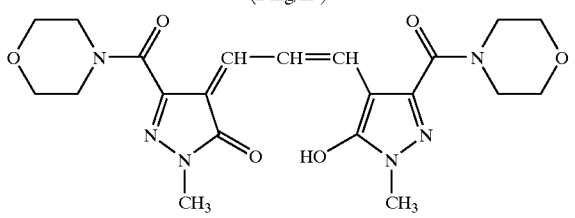

(2 mg/m$^2$)

-continued

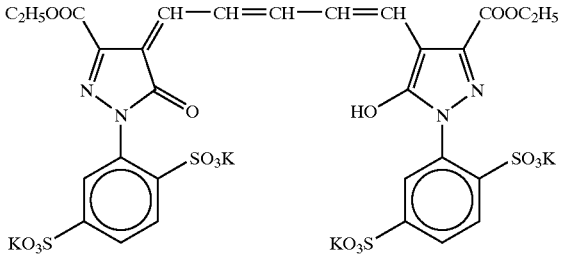

(6 mg/m$^2$)

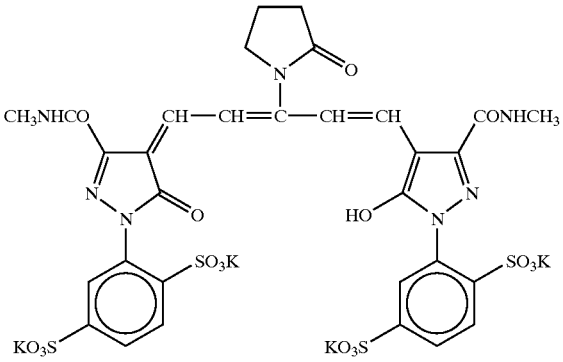

(14 mg/m$^2$)

(Layer Constitution)

The composition of each layer is shown below. The numbers show coating amounts (g/m$^2$). In the case of the silver halide emulsion, the coating amount is in terms of silver.

Support

Polyethylene resin laminated paper

{The polyethylene resin on the first layer side contained a white pigment ($TiO_2$; content of 16 mass %, ZnO; content of 4 mass %), a fluorescent whitening agent (4,4'-bis(5-methylbenzoxazolyl)stilbene; content of 0.03 mass %) and a bluish dye (ultramarine)}

| | |
|---|---|
| First Layer (Blue-Sensitive Emulsion Layer) | |
| Emulsion B-1 | 0.10 |
| Emulsion B-4 | 0.14 |
| Gelatin | 1.25 |
| Yellow coupler (ExY) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.21 |
| Second Layer (Color Mixing Inhibiting Layer) | |
| Gelatin | 0.99 |
| Color mixing inhibitor (Cpd-4) | 0.09 |
| Color-image stabilizer (Cpd-5) | 0.018 |
| Color-image stabilizer (Cpd-6) | 0.13 |
| Color-image stabilizer (Cpd-7) | 0.01 |
| Solvent (Solv-1) | 0.06 |
| Solvent (Solv-2) | 0.22 |
| Third Layer (Green-Sensitive Emulsion Layer) | |
| Emulsion G-1 | 0.08 |
| Emulsion G-2 | 0.06 |
| Gelatin | 1.36 |

-continued

| | |
|---|---|
| Magenta coupler (ExM) | 0.15 |
| Ultraviolet absorbing agent (UV-A) | 0.14 |
| Color-image stabilizer (Cpd-2) | 0.02 |
| Color mixing inhibitor (Cpd-4) | 0.002 |
| Color-image stabilizer (Cpd-6) | 0.09 |
| Color-image stabilizer (Cpd-8) | 0.02 |
| Color-image stabilizer (Cpd-9) | 0.03 |
| Color-image stabilizer (Cpd-10) | 0.01 |
| Color-image stabilizer (Cpd-11) | 0.0001 |
| Solvent (Solv-3) | 0.11 |
| Solvent (Solv-4) | 0.22 |
| Solvent (Solv-5) | 0.20 |
| Fourth Layer (Color Mixing Inhibiting Layer) | |
| Gelatin | 0.71 |
| Color mixing inhibitor (Cpd-4) | 0.06 |
| Color-image stabilizer (Cpd-5) | 0.013 |
| Color-image stabilizer (Cpd-6) | 0.10 |
| Color-image stabilizer (Cpd-7) | 0.007 |
| Solvent (Solv-1) | 0.04 |
| Solvent (Solv-2) | 0.16 |
| Fifth Layer (Red-Sensitive Emulsion Layer) | |
| Emulsion R-1 | 0.05 |
| Emulsion R-2 | 0.07 |
| Gelatin | 1.11 |
| Cyan coupler (ExC-2) | 0.13 |
| Cyan coupler (ExC-3) | 0.03 |
| Color-image stabilizer (Cpd-1) | 0.05 |
| Color-image stabilizer (Cpd-6) | 0.06 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.12 |
| Color-image stabilizer (Cpd-16) | 0.03 |
| Color-image stabilizer (Cpd-17) | 0.09 |
| Color-image stabilizer (Cpd-18) | 0.07 |
| Solvent (Solv-5) | 0.15 |
| Solvent (Solv-8) | 0.05 |
| Sixth Layer (Ultraviolet Absorbing Layer) | |
| Gelatin | 0.46 |
| Ultraviolet absorbing agent (UV-B) | 0.45 |
| Compound (S1–4) | 0.0015 |
| Solvent (Solv-7) | 0.25 |
| Seventh Layer (Protective Layer) | |
| Gelatin | 1.00 |
| Acryl-modified copolymer of polyvinyl alcohol (modification degree: 17%) | 0.04 |
| Liquid paraffin | 0.02 |
| Surface active agent (Cpd-13) | 0.01 |

The sample obtained in the above-described way was designated as the sample 101. The sample 102 was manufactured in the same way as in the manufacture of the sample 101, except that the Emulsion B-4 in the blue-sensitive emulsion layer was replaced with the Emulsion B-1; the sample 103 was manufactured in the same way as in the manufacture of the sample 101, except that the Emulsion B-4 in the blue-sensitive emulsion layer was replaced with the Emulsion B-7; the sample 104 was manufactured in the same way as in the manufacture of the sample 101, except that the Emulsion B-1 and the Emulsion B-4 in the blue-sensitive emulsion layer were replaced with the Emulsion B-2 and the Emulsion B-5, respectively; and the sample 105 was manufactured in the same way as in the manufacture of the sample 101, except that the Emulsion B-1 and the Emulsion B-4 in the blue-sensitive emulsion layer were replaced with the Emulsion B-3 and the Emulsion B-6, respectively. The sample 106 was manufactured in the same way as in the manufacture of the sample 105, except that the Emulsion R-2 in the red-sensitive emulsion layer was replaced with the Emulsion R-1; and the sample 107 was manufactured in the same way as in the manufacture of the sample 105, except that the Emulsion R-2 in the red-sensitive emulsion layer was replaced with the Emulsion R-3.

By using these samples, the following experiment was conducted.

Each of the coated samples was exposed by scanning with a blue wavelength laser, a green wavelength laser, and a red wavelength laser such that a graduated exposure for sensitometry was performed. The laser light sources employed were a blue semiconductor laser light source having a wavelength of 440 nm or a laser light source having a wavelength of 473 nm as second harmonic taken out after subjecting a YAG solid laser (oscillation wavelength: 946 nm), using a GaAlAs semiconductor laser (oscillation wavelength: 808.5 nm) as an exciting light source, to wavelength conversion by means of a $LiNbO_3$ nonlinear optical crystal having an inverted domain structure for a blue wavelength light source; a laser light source having a wavelength of 532 nm as second harmonic taken out after subjecting a $YVO_4$ solid laser (oscillation wavelength: 1064 nm), using a GaAlAs semiconductor laser (oscillation wavelength: 808.7 nm) as an exciting light source, to wavelength conversion by means of a $LiNbO_3$ nonlinear optical crystal having an inverted domain structure for a green wavelength light source; and a semiconductor laser (680 nm: Type No. LN9R20 manufactured by Matsushita Electric Industrial Co., Ltd.) or a semiconductor laser (640 nm: Type No. HL6501MG manufactured by Hitachi, Ltd.) for a red wavelength light source.

The laser light was moved in the direction vertical to the scanning direction by means of a polygon mirror so that the sample surface underwent successive scanning exposure. The light amount variation due to the temperature of the semiconductor laser was prevented by keeping the temperature constant by utilizing a Peltier element. The effective beam diameter was 80 $\mu$m, the scanning pitch was 42.3 $\mu$m (600 dpi), and the average exposure time per pixel was $1.7\times10^{-7}$seconds.

After the exposure, the color development processing A was carried out in the same manner as in Example 101.

Gradation exposure was carried out by the laser-scanning exposure described above and characteristic curves were obtained by measuring the densities of the samples after color development processing.

An exposure amount (E1) which gave a developed color density equivalent to unexposed density +0.02 and an exposure amount (E2) which gave a developed color density equivalent to 90% of the maximum developed color density were sought, and the value indicated below was defined as the gradation (γ).

$$\gamma=\mathrm{Log}(E2/E1)$$

The above-mentioned gradation of the yellow image, which was obtained by color development processing after gradation exposure to a blue laser light alone, was measured and the value thus obtained was defined as γy. The gradation of the magenta image, which was obtained by color development processing after gradation exposure to a green laser light alone, was measured and the value thus obtained was defined as γm. Further, the gradation of the cyan image, which was obtained by color development processing after gradation exposure to a red laser light alone, was measured and the value thus obtained was defined as γc.

Gradation exposure was carried out using a blue laser light alone and subsequently color development processing was carried out. The densities of yellow and magenta colors thus obtained were measured and a characteristic curve was obtained. The magenta density at a yellow density of 2.1 was measured and the value thus obtained was defined as the magenta density in yellow. The smaller this value is, the higher the color purity of yellow is.

An exposure amount (Ey) which gave a yellow density of 1.8 was estimated and the value Log (1/Ey) was defined as the yellow sensitivity (Sy). An exposure amount (Em) which gave a magenta density of 0.6 was estimated and the value Log (1/Em) was defined as the magenta sensitivity (Sm). The difference between the yellow sensitivity and the magenta sensitivity (Sy−Sm) was estimated and the value thus obtained was defined as Δs.

The light amounts of blue, green, and red laser lights were adjusted so that a gray image having a density of 0.7 was formed and development processing was carried out after the exposure. The sample (in 8×10 inch size) after the processing was assessed according to the following 4 criteria with respect to the tint changes in the central region and in the central region and the peripheral region.

◎: good because no color tint change is observed in the peripheral region

○: acceptable although some color tint change is observed in the peripheral region Δ: not acceptable because some color tint change is observed in the peripheral region ×: not acceptable because significant color tint change is observed in the peripheral region In Table 8, the kind of the color tint that changed relative to the gray image formed in the central region is indicated in ( ).

The results shown in Table 8 are those obtained by using a semiconductor laser of 680 nm as a red wavelength light source.

TABLE 8

| Experiment No. | Sample | Blue wavelength light source | γy | γm | γc | γy − γm | γy − γc | γm − γc | ΔS | Magenta density in yellow | Color tint in the peripheral region |
|---|---|---|---|---|---|---|---|---|---|---|---|
| 1-1 | 101 | 473 nm | 1.32 | 1.50 | 1.24 | −0.18 | 0.08 | 0.26 | 1.45 | 0.28 | ◎ |
| 1-2 | 102 | 473 nm | 0.91 | 1.48 | 1.30 | −0.57 | −0.39 | 0.18 | 1.95 | 0.27 | Δ (Blue) |
| 1-3 | 103 | 473 nm | 1.72 | 1.41 | 1.29 | 0.31 | 0.43 | 0.12 | 0.94 | 0.37 | Δ (yellow) |
| 1-4 | 104 | 473 nm | 1.32 | 1.47 | 1.31 | −0.15 | 0.01 | 0.16 | 1.72 | 0.27 | ◎ |
| 1-5 | 105 | 473 nm | 1.37 | 1.44 | 1.30 | −0.07 | 0.07 | 0.14 | 1.25 | 0.30 | ◎ |
| 1-6 | 106 | 473 nm | 1.33 | 1.44 | 1.05 | −0.11 | 0.28 | 0.39 | 1.33 | 0.26 | ○ (Red) |

TABLE 8-continued

| Experiment No. | Sample | Blue wavelength light source | γy | γm | γc | γy − γm | γy − γc | γm − γc | ΔS | Magenta density in yellow | Color tint in the peripheral region |
|---|---|---|---|---|---|---|---|---|---|---|---|
| 1-7 | 107 | 473 nm | 1.32 | 1.42 | 1.58 | −0.10 | −0.26 | −0.16 | 1.30 | 0.27 | ○ (Cyan) |
| 1-8 | 101 | 440 nm | 1.33 | 1.51 | 1.26 | −0.18 | 0.07 | 0.25 | 0.85 | 0.48 | Δ (Red) |
| 1-9 | 102 | 440 nm | 0.90 | 1.49 | 1.28 | −0.59 | −0.38 | 0.21 | 1.88 | 0.27 | x (Blue) |
| 1-10 | 103 | 440 nm | 1.78 | 1.42 | 1.30 | 0.36 | 0.48 | 0.12 | 0.90 | 0.59 | x (yellow) |
| 1-11 | 104 | 440 nm | 1.38 | 1.44 | 1.31 | −0.06 | 0.07 | 0.13 | 1.15 | 0.25 | ○ (Red) |
| 1-12 | 105 | 440 nm | 1.30 | 1.45 | 1.29 | −0.15 | −0.01 | 0.16 | 1.58 | 0.25 | ○ (Red) |
| 1-13 | 106 | 440 nm | 1.40 | 1.44 | 1.02 | −0.04 | 0.38 | 0.42 | 1.28 | 0.27 | x (Red) |
| 1-14 | 107 | 440 nm | 1.28 | 1.43 | 1.58 | −0.15 | −0.30 | −0.15 | 1.25 | 0.28 | Δ (Cyan) |

(Note): ( ) shows a color tint in the peripheral region

As is seen from the results of Table 8, in the case where a semiconductor light source of 440 nm is used as a blue wavelength light source, the color tint change in the peripheral region becomes worse (comparison between Experiments 1-1 to 1-7 and Experiments 1-8 to 1-14). It can be seen that if specially satisfactory performances are to be provided in the case where a semiconductor light source of 440 nm is used as a blue wavelength light source, the values of γy, γm, γc, and ΔS are within the respective preferable ranges of the present invention (comparison between Experiments 1-8 to 1-10, 1-13, and 1-14 and Experiments 1-11 and 1-12).

Example 302

By using the samples 104 and 105, the following experiment was conducted.

Each of the coated samples was exposed by scanning with a blue laser, a green laser, and a red laser such that a gradation exposure for sensitometry was performed. The laser light sources employed were a blue semiconductor laser having a wavelength of 440 nm for a blue wavelength light source; a laser having a wavelength of 532 nm as second harmonic taken out after subjecting a $YVO_4$ solid laser (oscillation wavelength: 1064 nm), using a GaAlAs semiconductor laser (oscillation wavelength: 808.7 nm) as an exciting light source, to wavelength conversion by means of a $LiNbO_3$ nonlinear optical crystal having an inverted domain structure for a green wavelength light source; and a semiconductor laser (680 nm: Type No. LN9R20 manufactured by Matsushita Electric Industrial Co., Ltd.) or a semiconductor laser (640 nm: Type No. HL6501MG manufactured by Hitachi, Ltd.) for a red wavelength light source.

Exposure, processing, and assessment were carried out in the same ways as in Example 301.

As is seen from the results of Table 9 the tint change in the peripheral region can be further improved by employing a red light source having a shorter wavelength and by decreasing the wavelength difference between the blue light source wavelength and the red light source wavelength.

Example 303

Thin-layered sample 301 was prepared in the same manner as Sample 101 in Example 301 except for altering the layer constitution as described below.

Preparation of sample 301

| | |
|---|---|
| First Layer (Blue-Sensitive Emulsion Layer) | |
| Emulsion B-1 | 0.07 |
| Emulsion B-4 | 0.07 |
| Gelatin | 0.75 |
| Yellow coupler (ExY-2) | 0.34 |
| Color-image stabilizer (Cpd-1) | 0.04 |
| Color-image stabilizer (Cpd-2) | 0.02 |
| Color-image stabilizer (Cpd-3) | 0.04 |
| Color-image stabilizer (Cpd-8) | 0.01 |
| Solvent (Solv-1) | 0.13 |
| Second Layer (Color Mixing Inhibiting Layer) | |
| Gelatin | 0.60 |
| Color mixing inhibitor (Cpd-19) | 0.09 |
| Color-image stabilizer (Cpd-5) | 0.007 |
| Color-image stabilizer (Cpd-7) | 0.007 |
| Ultraviolet absorbing agent (UV-C) | 0.05 |
| Solvent (Solv-5) | 0.11 |
| Third Layer (Green-Sensitive Emulsion Layer) | |
| Emulsion G-1 | 0.08 |

TABLE 9

| Experiment No. | Sample | Red wavelength light source | γy | γm | γc | γy − γm | γy − γc | γm − γc | ΔS | Magenta density in yellow | Color tint in the peripheral region | Remarks |
|---|---|---|---|---|---|---|---|---|---|---|---|---|
| 2-1 | 104 | 680 nm | 1.37 | 1.44 | 1.30 | −0.07 | 0.07 | 0.14 | 1.13 | 0.31 | ○ (red) | This invention |
| 2-2 | 105 | 680 nm | 1.30 | 1.44 | 1.31 | −0.14 | −0.01 | 0.13 | 1.60 | 0.27 | ○ (red) | This invention |
| 2-3 | 104 | 640 nm | 1.36 | 1.43 | 1.31 | −0.07 | 0.05 | 0.12 | 1.15 | 0.30 | ◎ | This invention |
| 2-4 | 105 | 640 nm | 1.31 | 1.44 | 1.31 | −0.13 | 0 | 0.13 | 1.60 | 0.27 | ◎ | This invention |

-continued

| | |
|---|---|
| Emulsion G-2 | 0.06 |
| Gelatin | 0.73 |
| Magenta coupler (ExM) | 0.15 |
| Ultraviolet absorbing agent (UV-A) | 0.05 |
| Color-image stabilizer (Cpd-2) | 0.02 |
| Color-image stabilizer (Cpd-7) | 0.008 |
| Color-image stabilizer (Cpd-8) | 0.07 |
| Color-image stabilizer (Cpd-9) | 0.03 |
| Color-image stabilizer (Cpd-10) | 0.009 |
| Color-image stabilizer (Cpd-11) | 0.0001 |
| Solvent (Solv-3) | 0.06 |
| Solvent (Solv-4) | 0.11 |
| Solvent (Solv-5) | 0.06 |
| Fourth Layer (Color Mixing Inhibiting Layer) | |
| Gelatin | 0.48 |
| Color mixing inhibitor (Cpd-4) | 0.07 |
| Color-image stabilizer (Cpd-5) | 0.006 |
| Color-image stabilizer (Cpd-7) | 0.006 |
| Ultraviolet absorbing agent (UV-C) | 0.04 |
| Solvent (Solv-5) | 0.09 |
| Fifth Layer (Red-Sensitive Emulsion Layer) | |
| Emulsion R-1 | 0.06 |
| Emulsion R-2 | 0.06 |
| Gelatin | 0.59 |
| Cyan coupler (ExC-2) | 0.13 |
| Cyan coupler (ExC-3) | 0.03 |
| Color-image stabilizer (Cpd-7) | 0.01 |
| Color-image stabilizer (Cpd-9) | 0.04 |
| Color-image stabilizer (Cpd-15) | 0.19 |
| Color-image stabilizer (Cpd-18) | 0.04 |
| Ultraviolet absorbing agent (UV-7) | 0.02 |
| Solvent (Solv-5) | 0.09 |
| Sixth Layer (Ultraviolet Absorbing Layer) | |
| Gelatin | 0.32 |
| Ultraviolet absorbing agent (UV-C) | 0.42 |
| Solvent (Solv-7) | 0.08 |
| Seventh Layer (Protective Layer) | |
| Gelatin | 0.70 |
| Acryl-modified copolymer of polyvinyl alcohol (modification degree: 17%) | 0.04 |
| Liquid paraffin | 0.01 |
| Surface active agent (Cpd-13) | 0.01 |
| Polydimethylsiloxane | 0.01 |
| Silicon dioxide | 0.003 |

Samples 302 to 307 were prepared based on Sample 301 by changing emulsion construction as in the manufacture of Samples 102 to 107 based on Sample 101 of Example 301.

After exposure, the samples underwent ultra-rapid development processing according to the [processing B] in the same manner as in Example 102.

The assessments of these samples were carried out in the same way as in Examples 301 and 302, except that the processing was changed to the [processing B]. The same results as those of Examples 301 and 302 were obtained.

Example 401

(Preparation of Emulsion B-11) Comparative Example: Cubic Silver Chloride 1000 ml of a 3% aqueous solution of a lime-processed gelatin was prepared, and then pH and pCl were adjusted to 3.5 and 1.7 respectively. An aqueous solution containing 2.12 mole of silver nitrate and an aqueous solution containing 2.2 mole of sodium chloride were mixed to the above-mentioned aqueous gelatin solution at the same time with vigorous stirring at 65° C. Silver nitrate was added to the reaction solution with vigorous stirring at the step of the addition of from 80% to 100% of the entire silver nitrate amount, so that the silver potential was controlled to be kept constant at 110 mV. An aqueous solution of $K_4[Ru(CN)_6]$ was added at the step of the addition of from 80% to 90% of the entire silver nitrate amount, so that the Ru amount became $3\times10^{-5}$ mole per mole of the finished silver halide. After desalting at 40° C., 168 g of a lime-processed gelatin was added, and then pH and pCl were adjusted to 5.5 and 1.8 respectively. The obtained emulsion was revealed to contain cubic silver iodobromide grains having an equivalent-sphere diameter of 0.75 μm and a coefficient of variation of 11.5%.

To the emulsion melted at 40° C. was added sodium thiosulfonate in an amount of $2\times10^{-5}$ mole per mole of silver halide, and the resulting emulsion was optimally ripened at 60° C. with sodium thiosulfate penta hydrate as a sulfur sensitizer and (S-2) as a gold sensitizer. After cooling to 40° C., a sensitizing dye A, a sensitizing dye B, 1-phenyl-5-mercaptotetrazole, 1-(5-methylureidophenyl)-5-mercaptotetrazole, and potassium bromide were added in an amount of $2.4\times10^{-4}$ mole, $1.6\times10^{-4}$ mole, $2\times10^{-4}$ mole, $2\times10^{-4}$ mole, and $2\times10^{-3}$ mole, per mole of silver halide respectively, thereby Emulsion B-11 being prepared.

(Sensitizing dye A)

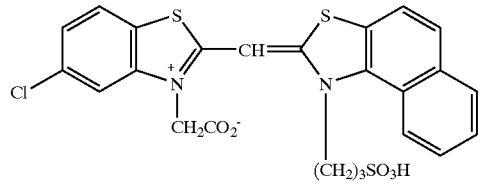

(Sensitizing dye B)

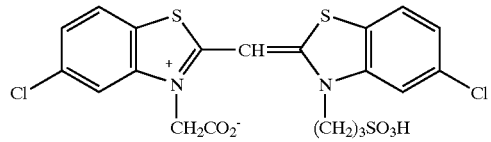

(Preparation of Emulsion B-12) The Present Invention: 90% Iodine

An emulsion was prepared in the same manner as in preparation of Emulsion B-11 except that at the moment when the addition of 90% of the entire silver nitrate amount was terminated, an aqueous solution of potassium iodide (KI) was added with vigorous stirring, so that the I amount became 0.1 mole % per mole of the finished silver halide. The obtained emulsion grains were revealed to be cubic silver iodochloride grains having an equivalent-sphere diameter of 0.7 μm and a coefficient of variation of 11%. The thus-obtained emulsion was designated Emulsion B-12. The distribution of an iodide ion concentration in the depth direction of each grain of Emulsion B-12 was measured by the etching/TOF-SIMS method. From the analysis by the etching/TOF-SIMS method, it was revealed that even when the addition of the iodide salt solution was terminated in the inside of the grain, the iodide ions oozed toward the surface of the grain, and consequently had the concentration maximum at the surface of the grain and the iodide ion concentration decreased inwardly.

(Preparation of Emulsion B-13) 50% Iodine

An emulsion was prepared in the same manner as in preparation of Emulsion B-11 except that at the moment when the addition of 50% of the entire silver nitrate amount was terminated, an aqueous solution of potassium iodide (KI) was added with vigorous stirring, so that the I amount became 0.1 mole % per mole of the finished silver halide. The obtained emulsion grains were revealed to be cubic silver iodochloride grains having an equivalent-sphere diameter of 0.75 μm and a coefficient of variation of 11%.

The thus-obtained emulsion was designated Emulsion B-13. From the analysis of the distribution of an iodide ion concentration in the depth direction of each grain of Emulsion B-13 according to the etching/TOF-SIMS method, it was revealed that the iodide ion concentration had a loose maximum in the inside of the grain, because the iodide salt solution was added more internally to the inside of the grain.

(Preparation of Emulsion B-14) 80% to 90% Br

An emulsion was prepared in the same manner as in preparation of Emulsion B-11 except that potassium bromide (KBr) was added with vigorous stirring at the step of the addition of from 80% to 90% of the entire silver nitrate amount used in emulsion grain formation, so that the Br amount became 2 mole % per mole of the finished silver halide. The obtained emulsion grains were revealed to be cubic silver bromochloride grains having an equivalent-sphere diameter of 0.75 μm and a coefficient of variation of 11%. The thus-obtained emulsion was designated Emulsion B-14. From the analysis of the distribution of an bromide ion concentration in the depth direction of each grain of Emulsion B-14 according to the etching/TOF-SIMS method, it was revealed that the iodide ion had a concentration maximum in the inside of the grain.

(Preparation of Emulsion B-15) 90% to 100% Br

An emulsion was prepared in the same manner as in preparation of Emulsion B-11 except that potassium bromide (KBr) was added with vigorous stirring at the step of the addition of from 90% to 100% of the entire silver nitrate amount used in emulsion grain formation, so that the Br amount became 2 mole % per mole of the finished silver halide. The obtained emulsion grains were revealed to be cubic silver bromochloride grains having an equivalent-sphere diameter of 0.75 μm and a coefficient of variation of 11%. The thus-obtained emulsion was designated Emulsion B-15. From the analysis of the distribution of a bromide ion concentration in the depth direction of each grain of Emulsion B-15 according to the etching/TOF-SIMS method, it was revealed that the bromide ion concentration loosely decreased from the surface to the inside of the grain.

(Preparation of Emulsion B-16) 80% to 90% Br×90% Iodine

An emulsion was prepared in the same manner as in preparation of Emulsion B-11 except that potassium bromide (KBr) was added with vigorous stirring at the step of the addition of from 80% to 90% of the entire silver nitrate amount used in emulsion grain formation, so that the Br amount became 2 mole % per mole of the finished silver halide, and further at the moment when the addition of 90% of the entire silver nitrate amount was terminated, an aqueous solution of potassium iodide (KI) was added with vigorous stirring, so that the I amount became 0.1 mole % per mole of the finished silver halide. The obtained emulsion grains were revealed to be cubic silver iodobromochloride grains having an equivalent-sphere diameter of 0.75 μm and a coefficient of variation of 11%. The thus-obtained emulsion was designated Emulsion B-16.

From the analysis of the distribution of an bromide ion and iodide ion concentration in the depth direction of each grain of Emulsion B-16 according to the etching/TOF-SIMS method, it was revealed that even when the addition of the iodide salt solution was terminated in the inside of the grain, the iodide ions oozed toward the surface of the grain, and consequently had the concentration maximum at the outermost surface of the grain and the iodide ion concentration decreased inwardly. On the other hand, the bromide ions had the concentration maximum in the inside of the grain. Based on the above, it is assumed that the silver bromide-containing phase is located in the layer form more internally in the grain than the silver iodide-containing phase formed in the layer form.

(Preparation of Emulsion B-17) The Present Invention: 90% Iodine

An emulsion was prepared in the same manner as in preparation of Emulsion B-11 except that at the moment when the addition of 90% of the entire silver nitrate amount was terminated, silver iodide fine grains were added with vigorous stirring, so that the I amount became 0.1 mole % per mole of the finished silver halide. The silver iodide fine grain emulsion employed in this step was prepared by means of a stirrer mixer described in JP-A-10-43570. The obtained emulsion grains were revealed to be cubic silver iodochloride grains having an equivalent-sphere diameter of 0.75 μm and a coefficient of variation of 11%. The thus-obtained emulsion was designated Emulsion B-17. From the analysis of the distribution of an iodide ion concentration in the depth direction of each grain of Emulsion B-17 according to the etching/TOF-SIMS method, it was revealed that even when the addition of silver iodide fine grains was terminated in the inside of the grain, the iodide ions oozed toward the surface of the grain, and consequently had the concentration maximum at the outermost surface of the grain and the iodide ion concentration decreased inwardly.

(Preparation of Emulsion B-18) 80% to 90% Br

An emulsion was prepared in the same manner as in preparation of Emulsion B-11 except that silver bromide fine grains were continuously added with vigorous stirring by means of a stirrer mixer described in JP-A-10-43570, at the step of the addition of from 80% to 90% of the entire silver nitrate amount used in emulsion grain formation, so that the Br amount became 2 mole % per mole of the finished silver halide. The obtained emulsion grains were revealed to be cubic silver bromochloride grains having an equivalent-sphere diameter of 0.75 μm and a coefficient of variation of 11%. The thus-obtained emulsion was designated Emulsion B-18. From the analysis of the distribution of an bromide ion concentration in the depth direction of each grain of Emulsion B-18 according to the etching/TOF-SIMS method, it was revealed that the bromide ion had a concentration maximum in the inside of the grain.

(Preparation of Emulsion B-19) 80% to 90% AgBr fine grains×90% Iodine fine grains An emulsion was prepared in the same manner as in preparation of Emulsion B-11 except that at the step of the addition of from 80% to 90% of the entire silver nitrate amount used in emulsion grain formation, silver bromide fine grains were added with vigorous stirring so that the Br amount became 2 mole % per mole of the finished silver halide, and further at the moment when the addition of 90% of the entire silver nitrate amount was terminated, silver iodide fine grains were added with vigorous stirring, so that the I amount became 0.1 mole % per mole of the finished silver halide. The silver bromide fine grain emulsion and the silver iodide fine grain emulsion were prepared by means of a stirrer mixer described in JP-A-10-43570. The obtained emulsion grains were revealed to be cubic silver iodobromochloride grains having an equivalent-sphere diameter of 0.75 μm and a coefficient of variation of 11%. The thus-obtained emulsion was designated Emulsion B-19.

From the analysis of the distribution of an bromide ion and iodide ion concentration in the depth direction of each grain of Emulsion B-19 according to the etching/TOF-SIMS method, it was revealed that even when the addition of the silver iodide fine grains was terminated in the inside of the grain, the iodide ions oozed toward the surface of the grain, and consequently had a loose concentration maximum at the outermost surface of the grain and the iodide ion concentration decreased inwardly. On the other hand, the bromide ion concentration more mildly decreased than the iodide ion concentration from the surface to the inside of the grain. Based on the above, it is assumed that the silver bromide-containing phase is located in the layer form more internally in the grain than the silver iodide-containing phase formed in the layer form.

(Preparation of Emulsion B-20) The Present Invention: Silver Halide Cube×Ru, Ir

An emulsion was prepared in the same manner as in preparation of Emulsion B-11 except that an aqueous solution of $K_2[IrCl_6]$ was added at the step of the addition of from 83% to 88% of the entire silver nitrate amount, so that the Ir amount became $3\times10^{-8}$ mole per mole of the finished silver halide, and further an aqueous solution of $K_2[Ir(5\text{-methylthiazole})Cl_5]$ was added at the step of the addition of from 92% to 98% of the entire silver nitrate amount, so that the Ir amount became $1\times10^{-6}$ mole per mole of the finished silver halide. The obtained emulsion was revealed to contain cubic silver chloride grains having an equivalent-sphere diameter of 0.75 μm and a coefficient of variation of 11%. The thus-obtained emulsion was designated Emulsion B-20.

(Preparation of Emulsion B-21)

An emulsion was prepared in the same manner as in preparation of Emulsion B-19 except that an aqueous solution of $K_2[IrCl_6]$ was added at the step of the addition of from 83% to 88% of the entire silver nitrate amount, so that the Ir amount became $3\times10^{-8}$mole per mole of the finished silver halide, and further an aqueous solution of $K_2[Ir(5\text{-methylthiazole})Cl_5]$ was added at the step of the addition of from 92% to 98% of the entire silver nitrate amount, so that the Ir amount became $1\times10^{-6}$ mole per mole of the finished silver halide. The obtained emulsion was revealed to contain cubic silver iodobromochloride grains having an equivalent-sphere diameter of 0.75 μm and a coefficient of variation of 11%. The thus-obtained emulsion was designated Emulsion B-21. From the analysis From the analysis by of the etching/TOF-SIMS method, according to the etching/TOF-SIMS method, it was revealed that a profile of the distribution of an bromide ion and iodide ion concentration in the depth direction of each grain of Emulsion B-21 was the same as Emulsion B-19.

(Preparation of Emulsion B-31) {100} Silver Chloride Tabular Grains

To a reactor were added 1.7 liter of $H_2O$, 35.5 g of inert gelatin (a deionized alkali-processed bone gelatin having a methionine content of about 40 μmol/g), 1.4 g of sodium chloride, and 6.4 ml of 1 N nitric acid. The pH of the mixture was 4.5. Then the mixture was kept at 29° C. Thereafter, an aqueous solution of silver nitrate (A-1 solution: 0.2 g/ml of silver nitrate) and an aqueous solution of sodium chloride (M-1 solution: 0.069 g/ml of sodium chloride) were added to this mixture with vigorous stirring for 45 sec at the flow rate of 68.2 ml/min. After 2 min, P-2 solution (potassium bromide: 0.021 g/ml of KBr) was added for 14 sec at the flow rate of 186 ml/min. Further, after 3 min, A-2 solution (0.4 g/ml of silver nitrate) and M-3 solution (0.15 g/ml of sodium chloride) were mixed and added simultaneously 135 sec at the flow rate of 34 ml/min. An aqueous gelatin solution G-1 (120 ml of $H_2O$, 20 g of gelatin, 7 ml of 1 N aqueous solution of NaOH, 1.7 of NaCl) was added, and the temperature of the mixture was elevated up to 75° C. over 15 min and ripened for 10 min. Further, 466 ml of A-3 solution (0.4 g/ml of silver nitrate) was added while the flow rate was linearly increased from 5.0 ml/min to 9.5 ml/min. Herein, M-4 solution (0.15 g/ml of sodium chloride) was simultaneously added while maintaining the silver potential at 120 mv. Further, 142 ml of A-4 solution (0.4 g/ml of silver nitrate) was added while the flow rate was linearly increased from 5.0 ml/min to 7.4 ml/min. Herein, M-5 solution (0.14 g/ml of sodium chloride) was simultaneously added while the silver potential was linearly decreased from 120 mv to 100 mV. In this time, an aqueous solution of $K_4[Ru(CN)_6]$ was added at the step of the addition of from 80% to 90% of the entire silver nitrate amount, so that the Ru amount became $3\times10^{-5}$mole per mole of the finished silver halide. Thereafter, the mixture was precipitated, washed, and desalted at 40° C. Further, 130 g of inert gelatin was added so as to re-disperse the emulsion, and pH and pAg were adjusted to 6.0 and 7.0 respectively.

A part of the emulsion was taken to observe an electron microphotographic image (TEM image) of the replica of the grain. From the electron microphotograph image, it was revealed that 95.1% of the total projected area of the entire silver halide grains was occupied by {100} tabular grains having an average grain size of 0.94 μm, an average grain thickness of 0.180 μm, an average aspect ratio of 5.1, an average adjacent side length ratio of 1.15 and an equivalent-cubic side length of 0.500 μm.

To the emulsion melted at 40° C., sodium thiosulfonate was added in an amount of $3.5\times10^{-5}$ mole per mole of silver halide, and the emulsion was optimally ripened at 60° C. with a sulfur sensitizer (sodium thiosulfate penta hydrate) and a gold sensitizer (S-2). After the temperature was reduced to 40° C., a sensitizing dye A, a sensitizing dye B, 1-phenyl-5-mercaptotetrazole and 1-(5-methylureidophenyl)-5-mercaptotetrazole were added thereto in an amount of $3.8\times10^{-4}$ mole, $1.9\times10^{-4}$ mole, $3.5\times10^{-4}$ mole and $3.5\times10^{-4}$ mole, per mole of silver halide respectively. The thus-obtained emulsion was designated Emulsion B-31.

(Preparation of Emulsion B-32) {100} Silver Chloride Tabular Grains×90% Iodine

An emulsion was prepared in the same manner as in preparation of Emulsion B-31 except that at the moment when the addition of 90% of the entire silver nitrate amount was terminated, an aqueous solution of potassium iodide (KI) were added with vigorous stirring, so that the I amount became 0.4 mole % per mole of the finished silver halide. The obtained emulsion grains were revealed to be tabular grains having {100} planes as major faces that occupy 94.1% of the total projected area of the entire silver halide grains, and have an average grain size of 0.94 μm, an average grain thickness of 0.184 μm, an average aspect ratio of 5.0, an average adjacent side length ratio of 1.16 and an equivalent-cubic side length of 0.503 μm. The thus-obtained emulsion was designated Emulsion B-32. From the analysis of the distribution of an iodide ion concentration in the depth direction of each grain of Emulsion B-32 according to the etching/TOF-SIMS method, it was revealed that even when the addition of iodide salt solution was terminated in the inside of the grain, the iodide ions oozed toward the surface of the grain, and consequently had the concentration maximum at the outermost surface of the grain and the iodide ion concentration decreased inwardly.

(Emulsion B-33) {100} Tabular Grains 80% to 90% Br

An emulsion was prepared in the same manner as in preparation of Emulsion B-31 except that at the step of the addition of 80% to 90% of the entire silver nitrate amount, potassium bromide (KBr) were added with vigorous stirring, so that the Br amount became 2 mole % per mole of the finished silver halide. The obtained emulsion grains were revealed to be tabular grains having {100} planes as major faces that occupy 95.2% of the total projected area of the entire silver halide grains, and have an average grain size of 0.95 μm, an average grain thickness of 0.185 μm, an average aspect ratio of 5.0, an average adjacent side length ratio of 1.16 and an equivalent-cubic side length of 0.506 μm. The thus-obtained emulsion was designated Emulsion B-33. From the analysis of the distribution of a bromide ion concentration in the depth direction of each grain of Emulsion B-33 according to the etching/TOF-SIMS method, it was revealed that the bromide ion concentration had a loose maximum in the inside of the grain.

(Emulsion B-34) {100} Tabular Grains×80% to 90% Br×90% Iodine

An emulsion was prepared in the same manner as in preparation of Emulsion B-31 except that at the step of the addition of 80% to 90% of the entire silver nitrate amount, potassium bromide (KBr) were added with vigorous stirring, so that the Br amount became 2 mole % per mole of the finished silver halide, and further at the moment when the addition of 90% of the entire silver nitrate amount was terminated, an aqueous solution of potassium iodide (KI) were added with vigorous stirring, so that the I amount became 0.4 mole % per mole of the finished silver halide. The obtained emulsion grains were revealed to be tabular grains having {100} planes as major faces that occupy 95.2% of the total projected area of the entire silver halide grains, and have an average grain size of 0.94 μm, an average grain thickness of 0.185 μm, an average aspect ratio of 5.1, an average adjacent side length ratio of 1.14 and an equivalent-cubic side length of 0.505 μm. The thus-obtained emulsion was designated Emulsion B-34. From the analysis of the distribution of a bromide ion and an iodide ion concentration in the depth direction of each grain of Emulsion B-34 according to the etching/TOF-SIMS method, it was revealed that the iodide ions oozed toward the surface of the grain, and consequently had a loose concentration maximum at the outermost surface of the grain and the iodide ion concentration decreased inwardly. On the other hand, the bromide ion concentration had a loose concentration maximum at the inside of the grain. Based on the above, it is assumed that the silver bromide-containing phase is located in the layer form more internally in the grain than the silver iodide-containing phase formed in the layer form. Further, from the measurement by the ESCA method, it was revealed that an iodide ion concentration on the surface of a grain was 3.2 mole % of the silver ion concentration.

(Emulsion B-35) {100} Tabular Grains×80% to 90% AgBr×90% AgI

An emulsion was prepared in the same manner as in preparation of Emulsion B-31 except that at the step of the addition of 80% to 90% of the entire silver nitrate amount, silver bromide fine grains were added with vigorous stirring, so that the Br amount became 2 mole % per mole of the finished silver halide, and further at the moment when the addition of 90% of the entire silver nitrate amount was terminated, silver iodide fine grains were added with vigorous stirring, so that the I amount became 0.4 mole % per mole of the finished silver halide. The silver bromide fine grain emulsion and the silver iodide fine grain emulsion, both of which were used in the above step, were prepared by means of a stirrer mixer described in JP-A-10-43570. The obtained emulsion grains were revealed to be tabular grains having {100} planes as major faces that occupy 95.1% of the total projected area of the entire silver halide grains, and have an average grain size of 0.95 μm, an average grain thickness of 0.182 μm, an average aspect ratio of 5.2, an average adjacent side length ratio of 1.13 and an equivalent-cubic side length of 0.505 μm. The thus-obtained emulsion was designated Emulsion B-35.

From the analysis of the distribution of a bromide ion and an iodide ion concentration in the depth direction of each grain of Emulsion B-35 according to the etching/TOF-SIMS method, it was revealed that even when the addition of the iodide salt solution was terminated in the inside of the grain, the iodide ions oozed toward the surface of the grain, and consequently had a loose concentration maximum at the outermost surface of the grain and the iodide ion concentration decreased inwardly. On the other hand, the bromide ion concentration more mildly decreased than the iodide ion concentration from the surface to the inside of the grain. Based on the above, it is assumed that the silver bromide-containing phase is located in the layer form more internally in the grain than the silver iodide-containing phase formed in the layer form. Further, from the measurement by the ESCA method, it was revealed that an iodide ion concentration on the surface of a grain was 3.0 mole % of the silver ion concentration.

(Preparation of Emulsion B-36)

An emulsion was prepared in the same manner as in preparation of Emulsion B-31 except that an aqueous solution of $K_2[IrCl_6]$ was added at the step of the addition of from 83% to 88% of the entire silver nitrate amount, so that the Ir amount became $1\times10^{-7}$ mole per mole of the finished silver halide, and further an aqueous solution of $K_2[Ir(5\text{-methylthiazole})Cl_5]$ was added at the step of the addition of from 92% to 98% of the entire silver nitrate amount, so that the Ir amount became $3\times10^{-6}$ mole per mole of the finished silver halide. The obtained emulsion was revealed to be tabular grains having {100} planes as major faces that occupy 95.1% of the total projected area of the entire silver halide grains, and have an average grain size of 0.94 μm, an average grain thickness of 0.180 μm, an average aspect ratio of 5.1 an average adjacent side length ratio of 1.15 and an equivalent-cubic side length of 0.500 μm. The thus-obtained emulsion was designated Emulsion B-36.

(Emulsion B-37)

An emulsion was prepared in the same manner as in preparation of Emulsion B-35 except that an aqueous solution of $K_2[IrCl_6]$ was added at the step of the addition of from 83% to 88% of the entire silver nitrate amount, so that the Ir amount became $1\times10^{-7}$ mole per mole of the finished silver halide, and further an aqueous solution of $K_2[Ir(5\text{-methylthiazole})Cl_5]$ was added at the step of the addition of from 92% to 98% of the entire silver nitrate amount, so that the Ir amount became $3\times10^{-6}$ mole per mole of the finished silver halide. The obtained emulsion was revealed to be tabular grains having {100} planes as major faces that occupy 95.1% of the total projected area of the entire silver halide grains, and have an average grain size of 0.95 μm, an average grain thickness of 0.182 μm, an average aspect ratio of 5.2 an average adjacent side length ratio of 1.13 and an equivalent-cubic side length of 0.505 μm. The thus-obtained emulsion was designated Emulsion B-37. From the analysis by the etching/TOF-SIMS method, it was revealed a profile of the distribution of a bromide ion and an iodide ion concentration in the depth direction of each grain of Emulsion B-37 was the same as Emulsion B-35. Further, from the measurement by the ESCA method, it was revealed that an iodide ion concentration on the surface of a grain was 3.0 mole % of the silver ion concentration.

(Preparation of Emulsion B-41) {111} Tabular Grains Pure Silver Chloride

To a reactor were added 1.2 liter of $H_2O$, 1.0 g of sodium chloride and 2.5 g of inert gelatin and kept at 30° C.

Thereafter, an aqueous solution of silver nitrate (C-1 solution: 0.24 g/ml of silver nitrate) and an aqueous solution of sodium chloride (N-1 solution: a mixture of 0.083 g/ml of sodium chloride and 0.01 g/ml of inert gelatin) were added to this mixture with vigorous stirring for 1 min at the flow rate of 75 ml/min. In 1 min after the addition was terminated, 20 ml of aqueous solution of containing 0.9 m mole of a crystal habit controlling agent 1 (K-1) was added. Further, after 1 min, 340 ml of a 10% aqueous solution of phthalated gelatin (HG-1) and 2.0 g of sodium chloride were added. The temperature of the mixture was elevated up to 55° C. over 25 min and the mixture was ripened at 55° C. for 30 min. Further, at the step of grain growth, 524 ml of C-2 solution (0.4 g /ml of silver nitrate) and 451 ml of N-2 solution (0.17 g/ml of sodium chloride) were added for 27 min at an accelerated flow rate. Herein, 285 ml of aqueous solution of containing 2.1 m mole of a crystal habit controlling agent 1 (K-2) was simultaneously added at an accelerated flow rate (in proportion to the addition of silver nitrate). Further, 142 ml of C-3 solution (0.4 g/ml of silver nitrate) was added while the flow rate was linearly increased from 10 ml/min to 15 ml/min. At the same time, N-3 solution (0.14 g/ml of sodium chloride) was added so that the silver potential would be linearly decreased from 100 mV to 80 mV. Further, an aqueous solution of $K_4[Ru(CN)_6]$ was added at the step of the addition of from 80% to 90% of the entire silver nitrate amount, so that the Ru amount became $3\times10^{-5}$ mole per mole of the finished silver halide. After the temperature was elevated up to 75° C., a sensitizing dye A and a sensitizing dye B were added in an amount of $5\times10^{-4}$ mole and $2.5\times10^{-4}$ mole, per mole of silver halide respectively, and the mixture was ripened for 20 min.

Crystal habit controlling agent 1

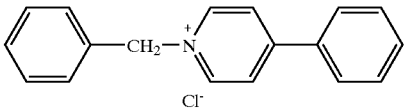

Thereafter, the mixture was precipitated, washed and desalted at 30° C. Further, 130 g of inert gelatin was added and pH and pAg were adjusted to 6.3 and 7.2 respectively. The obtained emulsion grains were revealed that 98.2% or more of the total projected area of the entire silver halide grains was occupied by {111} tabular grains having an average aspect ratio of 2 or more, and said tabular grains have an average grain size of 0.97 μm, an average grain thickness of 0.123 μm, an average aspect ratio of 7.2, and an equivalent-cubic side length of 0.450 μm.

To the emulsion melted at 40° C., sodium thiosulfonate was added in an amount of $3\times10^{-5}$ mole per mole of silver halide, and the emulsion was optimally ripened at 60° C. with a sulfur sensitizer (sodium thiosulfate penta hydrate) and a gold sensitizer (S-2). After the temperature was reduced to 40° C., 1-phenyl-5-mercaptotetrazole and 1-(5-methylureidophenyl)-5-mercapto tetrazole were added thereto in an amount of $4.7\times10^{-4}$ mole and $4.7\times10^{-4}$ mole, per mole of silver halide respectively. The thus-obtained emulsion was designated Emulsion B-41.

(Preparation of Emulsion B-42) {111} Tabular Grains 90% Iodine

An emulsion was prepared in the same manner as in preparation of Emulsion B-41 except that at the moment when the addition of 90% of the entire silver nitrate amount was terminated, an aqueous solution of potassium iodide (KI) were added with vigorous stirring, so that the I amount became 0.4 mole % per mole of the finished silver halide. The obtained emulsion grains were revealed that 98.5% or more of the total projected area of the entire silver halide grains is occupied by tabular grains having {111} planes as major faces and having an average aspect ratio of 2 or more, and said tabular grains have an average grain size of 0.95 μm, an average grain thickness of 0.131 μm, an average aspect ratio of 7.1 and an equivalent-cubic side length of 0.453 μm. The thus-obtained emulsion was designated Emulsion B-42. From the analysis of the distribution of an iodide ion concentration in the depth direction of each grain of Emulsion B-42 according to the etching/TOF-SIMS method, it was revealed that even when the addition of iodide salt solution was terminated in the inside of the grain, the iodide ions oozed toward the surface of the grain, and consequently had the concentration maximum at the outermost surface of the grain and the iodide ion concentration decreased inwardly.

(Preparation of Emulsion B-43) {111} Tabular Grains 80% to 90% Br

An emulsion was prepared in the same manner as in preparation of Emulsion B-41 except that at the step of the addition of 80% to 90% of the entire silver nitrate amount, potassium bromide (KBr) were added with vigorous stirring, so that the Br amount became 2 mole % per mole of the finished silver halide. The obtained emulsion grains were revealed that 97.9% of the total projected area of the entire silver halide grains is occupied by tabular grains having {111} planes as major faces and said tabular grains have an average grain size of 0.96 μm, an average grain thickness of 0.129 μm, an average aspect ratio of 7.3 and an equivalent-cubic side length of 0.454 μm. The thus-obtained emulsion was designated Emulsion B-43. From the analysis of the distribution of a bromide ion concentration in the depth direction of each grain of Emulsion B-43 according to the etching/TOF-SIMS method, it was revealed that the bromide ion concentration had a loose concentration maximum at the inside of the grain.

(Preparation of Emulsion B-44) {111} Tabular Grains 80% to 90% Br×90% Iodine

An emulsion was prepared in the same manner as in preparation of Emulsion B-41 except that potassium bromide (KBr) was added with vigorous stirring at the step of the addition of from 80% to 90% of the entire silver nitrate amount used in emulsion grain formation, so that the Br amount became 2 mole % per mole of the finished silver halide, and further at the moment when the addition of 90% of the entire silver nitrate amount was terminated, an aqueous solution of potassium iodide (KI) was added with vigorous stirring, so that the I amount became 0.4 mole % per mole of the finished silver halide. The obtained emulsion grains were revealed that 96.9% of the total projected area of the entire silver halide grains is occupied by tabular grains having {111} planes as major faces and said tabular grains have an average grain size of 0.99 μm an average grain thickness of 0.125 μm, an average aspect ratio of 7.8 and an equivalent-cubic side length of 0.458 μm. The thus-obtained emulsion was designated Emulsion B-44. From the analysis of the distribution of a bromide ion and an iodide ion concentration in the depth direction of each grain of Emulsion B-44 according to the etching/TOF-SIMS method, it was revealed that the iodide ions oozed toward the surface of the grain, and consequently had a loose concentration maximum at the outermost surface of the grain and the iodide ion concentration decreased inwardly. On the other hand, the bromide ions had a loose concentration maximum at the inside of the grain. Based on the above, it is assumed that the silver bromide-containing phase is located in the layer form more internally in the grain than the silver iodide-containing phase formed in the layer form. Further, from the measurement by the ESCA method, it was revealed that an iodide ion concentration on the surface of a grain was 2.7 mole % of the silver ion concentration.

(Preparation of Emulsion B-45) {111} Tabular Grains×80% to 90% AgBr×90% AgI

An emulsion was prepared in the same manner as in preparation of Emulsion B-41 except that at the step of the addition of 80% to 90% of the entire silver nitrate amount, silver bromide fine grains were added with vigorous stirring, so that the Br amount became 2 mole % per mole of the finished silver halide, and further at the moment when the addition of 90% of the entire silver nitrate amount was terminated, silver iodide fine grains were added with vigorous stirring, so that the I amount became 0.4 mole % per mole of the finished silver halide. The silver bromide fine grain emulsion and the silver iodide fine grain emulsion, both of which were used in the above step, were prepared by means of a stirrer mixer described in JP-A-10-43570. The obtained emulsion grains were revealed that 97.6% of the total projected area of the entire silver halide grains is occupied by tabular grains having {111} planes as major faces, and said tabular grains have an average grain size of 0.92 μm, an average grain thickness of 0.139 μm, an average aspect ratio of 6.7, and an equivalent-cubic side length of 0.452 μm. The thus-obtained emulsion was designated Emulsion B-45.

From the analysis of the distribution of a bromide ion and an iodide ion concentration in the depth direction of each grain of Emulsion B-45 according to the etching/TOF-SIMS method, it was revealed that even when the addition of the iodide salt solution was terminated in the inside of the grain, the iodide ions oozed toward the surface of the grain, and consequently had a loose concentration maximum at the outermost surface of the grain and the iodide ion concentration decreased inwardly. On the other hand, the bromide ion concentration more mildly decreased than the iodide ion concentration from the surface to the inside of the grain. Based on the above, it is assumed that the silver bromide-containing phase is located in the layer form more internally in the grain than the silver iodide-containing phase formed in the layer form. Further, from the measurement by the ESCA method, it was revealed that an iodide ion concentration on the surface of a grain was 3.0 mole % of the silver ion concentration.

(Preparation of Emulsion B-46) {111} Tabular Grains Silver Chloride

An emulsion was prepared in the same manner as in preparation of Emulsion B-41 except that an aqueous solution of $K_2[IrCl_6]$ was added at the step of the addition of from 83% to 88% of the entire silver nitrate amount, so that the Ir amount became $1.4\times10^{-7}$ mole per mole of the finished silver halide, and further an aqueous solution of $K_2[Ir(5\text{-methylthiazole})Cl_5]$ was added at the step of the addition of from 92% to 98% of the entire silver nitrate amount, so that the Ir amount became $4.5\times10^{-6}$mole per mole of the finished silver halide. The obtained emulsion was revealed that 98.2% or more of the total projected area of the entire silver halide grains is occupied by tabular grains having {111} planes as major faces and an average aspect ratio of 2 or more, and said tabular grains have an average grain size of 0.97 μm, an average grain thickness of 0.123 μm, an average aspect ratio of 7.2 and an equivalent-cubic side length of 0.450 μm. The thus-obtained emulsion was designated Emulsion B-46.

(Preparation of Emulsion B-47)

An emulsion was prepared in the same manner as in preparation of Emulsion B-45 except that an aqueous solution of $K_2[IrCl_6]$ was added at the step of the addition of from 83% to 88% of the entire silver nitrate amount, so that the Ir amount became $1.4\times10^{-7}$ mole per mole of the finished silver halide, and further an aqueous solution of $K_2[Ir(5\text{-methylthiazole})Cl_5]$ was added at the step of the addition of from 92% to 98% of the entire silver nitrate amount, so that the Ir amount became $4.5\times10^{-6}$ mole per mole of the finished silver halide. The obtained emulsion was revealed that 97.6% of the total projected area of the entire silver halide grains is occupied by tabular grains having {111} planes as major faces, and said tabular grains have an average grain size of 0.92 μm, an average grain thickness of 0.139 μm, an average aspect ratio of 6.7 and an equivalent-cubic side length of 0.452 μm. The thus-obtained emulsion was designated Emulsion B-47. From the analysis by the etching/TOF-SIMS method, it was revealed that a profile of the distribution of a bromide ion and an iodide ion concentration in the depth direction of each grain of Emulsion B-47 was the same as Emulsion B-45. Further, from the measurement by the ESCA method, it was revealed that an iodide ion concentration on the surface of a grain was 3.0 mole % of the silver ion concentration.

(Preparation of Emulsion Gd)

1000 ml of a 3% aqueous solution of lime-processed gelatin was prepared, and pH and pCl were adjusted to 5.5 and 1.7 respectively. An aqueous solution containing 2.12 mole of silver nitrate and an aqueous solution containing 2.2 mole of sodium chloride were added thereto, and mixed with vigorous stirring at 45° C. at the same time. At the step of the addition of from 80% to 90% of the entire silver nitrate amount, an aqueous solution of $K_4[Ru(CN)_6]$ was added so that the Ru amount became $3\times10^{-5}$ mole per mole of the finished silver halide. Further, at the step of the addition of from 83% to 88% of the entire silver nitrate amount, an aqueous solution of $K_2[IrCl_6]$ was added so that the Ir amount became $5\times10^{-8}$ mole per mole of the finished silver halide. Further, an aqueous solution of $K_2[Ir(5\text{-methylthiazole})Cl_5]$ was added at the step of the addition of from 92% to 95% of the entire silver nitrate amount, so that the Ir amount became $5\times10^{-7}$ mole per mole of the finished silver halide. Further, at the step of the addition of from 95% to 98% of the entire silver nitrate amount, an aqueous solution of $K_2[Ir(H_2O)Cl_5]$ was added so that the Ir amount became $5\times10^{-7}$mole per mole of the finished silver halide. After the mixture was subjected to desalting at 40° C., 168 g of a lime-processed gelatin was added, and then pH and pCl were adjusted to 5.5 and 1.8 respectively. The obtained emulsion grains were revealed to be cubic silver chloride having an equivalent-sphere diameter of 0.35 μm and a coefficient of variation of 10%.

To the emulsion melted at 40° C., sodium thiosulfonate was added in an amount of $2\times10^{-5}$ mole per mole of silver halide, and the emulsion was optimally ripened at 60° C. with a sulfur sensitizer (sodium thiosulfate penta hydrate) and a gold sensitizer (S-2). After the temperature was reduced to 40° C., a sensitizing dye D, 1-phenyl-5-mercaptotetrazole, 1-(5-methylureidophenyl)-5-mercaptotetrazole and potassium bromide were added thereto in an amount of $6\times10^{-4}$ mole, $2\times10^{-4}$ mole, $8\times10^{-4}$ mole, and $7\times10^{-3}$ mole, per mole of silver halide respectively. The thus-obtained emulsion was designated Emulsion Gd.

(Preparation of Emulsion R-11)

1000 ml of a 3% aqueous solution of lime-processed gelatin was prepared, and pH and pCl were adjusted to 5.5 and 1.7 respectively. An aqueous solution containing 2.12 mole of silver nitrate and an aqueous solution containing 2.2 mole of sodium chloride were added thereto and mixed with vigorous stirring at 45° C. at the same time. At the step of the addition of from 80% to 90% of the entire silver nitrate amount, an aqueous solution of $K_4[Ru(CN)_6]$ was added so that the Ru amount became $3\times10^{-5}$ mole per mole of the finished silver halide. Further, at the step of the addition of from 80% to 100% of the entire silver nitrate amount, addition was performed while the silver potential was controlled to be kept constant at 110 mv. After the mixture was subjected to desalting at 40° C., 168 g of a lime-processed gelatin was added, and then pH and pCl were adjusted to 5.5 and 1.8 respectively. The obtained emulsion grains were revealed to be cubic silver chloride having an equivalent-sphere diameter of 0.3 μm and a coefficient of variation of 10%.

To the emulsion melted at 40° C., sodium thiosulfonate was added in an amount of $2\times10^{-5}$ mole per mole of silver halide, and the emulsion was optimally ripened at 60° C. with a sulfur sensitizer (sodium thiosulfate penta hydrate) and a gold sensitizer (S-2). After the temperature was reduced to 40° C., a sensitizing dye G, 1-phenyl-5-mercaptotetrazole, 1-(5-methyureidophenyl)-5-mercaptotetrazole, Compound I and potassium bromide were added thereto in an amount of $7\times10^{-5}$ mole, $2\times10^{-4}$ mole, $8\times10^{-4}$ mole, $1\times10^{-3}$mole and $7\times10^{-3}$ mole, per mole of silver halide respectively. The thus-obtained emulsion had a spectral sensitivity maximum at a wavelength of 700 nm and was designated Emulsion R-11.

(Preparation of Emulsion R-12)

An emulsion was prepared in the same manner as in preparation of Emulsion R-11 except that potassium bromide (KBr) was added with vigorous stirring at the step of the addition of from 80% to 100% of the entire silver nitrate amount used in emulsion grain formation, so that the Br amount became 4 mole % per mole of the finished silver halide, and further at the moment when the addition of 90% of the entire silver nitrate amount was terminated, an aqueous solution of potassium iodide (KI) was added with vigorous stirring, so that the I amount became 0.1 mole % per mole of the finished silver halide. The obtained emulsion grains were revealed to be cubic silver iodobromochloride grains having an equivalent-sphere diameter of 0.3 μm and a coefficient of variation of 10%. The thus-obtained emulsion was designated Emulsion R-12. From the analysis of the distribution of an bromide ion and iodide ion concentration in the depth direction of each grain of Emulsion R-12 according to the etching/TOF-SIMS method, it was revealed that the iodide ions oozed toward the surface of the grain and the iodide ions concentration decreased inwardly, while the bromide ions had a concentration maximum in the inside of the grain.

(Preparation of Emulsion R-13)

An emulsion was prepared in the same manner as in preparation of Emulsion R-12 except that an aqueous solution of $K_2[IrCl_6]$ was added at the step of the addition of from 83% to 88% of the entire silver nitrate amount, so that the Ir amount became $5\times10^{-8}$mole per mole of the finished silver halide, an aqueous solution of $K_2$[Ir(5-methylthiazole)$Cl_5$] was added at the step of the addition of from 92% to 95% of the entire silver nitrate amount, so that the Ir amount became $5\times10^{-7}$mole per mole of the finished silver halide, and further an aqueous solution of $K_2[Ir(H_2O)Cl_5]$ was added at the step of the addition of from 95% to 98% of the entire silver nitrate amount, so that Ir amount became $5\times10^{-7}$ mole per mole of the finished silver halide. The obtained emulsion was revealed to contain cubic silver chloride grains having an equivalent-sphere diameter of 0.3 μm and a coefficient of variation of 10%. The thus-obtained emulsion was designated Emulsion R-13. From the analysis by the etching/TOF-SIMS method, it was revealed that a profile of the distribution of a bromide ion and an iodide ion concentration in the depth direction of each grain of Emulsion R-13 was the same as Emulsion R-12.

[Preparation of Silver Halide Photography Light-sensitive Material]

After corona discharge treatment was performed on the surface of a paper support whose both surfaces were laminated with polyethylene, a gelatin subbing layer containing sodium dodecylbenzenesulfonate was formed on that surface. In addition, photographic constituting layers from the first layer to the seventh layer were coated on the support to make a silver halide color photographic light-sensitive material having the following layer arrangement. The coating solution for each of the photographic constituting layers were prepared as follows.

(Preparation of Coating Solution for First Layer)

57 g of a yellow coupler (ExY), 7 g of a color-image stabilizer (Cpd-1), 4 g of a color-image stabilizer (Cpd-2), 7 g of a color-image stabilizer (Cpd-3) and 2 g of a color-image stabilizer (Cpd-8) were dissolved in 21 g of a solvent (Solv-1) and 80 ml of ethyl acetate, and the resultant solution was added to 220 g of an aqueous 23.5% by mass gelatin solution containing 4 g of sodium dodecylbenzenesulfonate. The resultant mixture was emulsified and dispersed by a high speed stirring emulsifier (dissolver), followed by addition of water to prepare 900 g of emulsified dispersion Ad.

The emulsified dispersion Ad described above and the Emulsion B-11 were mixed and dissolved to prepare a coating solution of the first layer having the following composition. The coating amount of each emulsion is represented by the coating amount of silver.

The coating solutions for the second to seventh layers were prepared following the same procedures as for the coating solution of the first layer. 1-oxy-3,5-dichloro-s-triazine sodium salt (H-1), (H-2), and (H-3) were used as gelatin hardeners in each layer. In addition, (Ab-1), (Ab-2), (Ab-3) and (Ab-4) were added to each layer such that their total amounts were 15.0 mg/$m^2$, 60.0 mg/$m^2$, 5.0 mg/$m^2$ and 10.0 mg/$m^2$, respectively.

Further, 1-phenyl-5-mercaptotetrazole was added to the green-, and Red-sensitive emulsion layers in amounts of $1.0\times10^{-3}$ mole and $5.9\times10^{-4}$ mole, respectively, per mole of silver halide. Also, 1-phenyl-5-mercaptotetrazole was added to the second layer, the forth layer, and the sixth layer in amounts of 0.2 mg/$m^2$, 0.2 mg/$m^2$, and 0.6 mg/$m^2$, respectively.

Further, a copolymer latex of methacrylic acid and butyl acrylate (ratio by mass, 1:1; average molecular weight, 200,000 to 400,000) was added to the red-sensitive emulsion layer in an amount of 0.05 g/$m^2$. Further, disodium catechol-3,5-disulfonate was added to the second layer, the fourth layer and the sixth layer in an amount of 6 mg/$m^2$, 6 mg/$m^2$ and 18 mg/$m^2$, respectively. Furthermore, to prevent irradiation, the same dyes that were used in Example 101 (the number given in parenthesis represents the coating amount) were added.

(Layer Constitution)

The composition of each layer is shown below. The numbers show coating amounts (g/$m^2$). In the case of the silver halide emulsion, the coating amount is in terms of silver.

Support

Polyethylene resin laminated paper

{The polyethylene resin on the first layer side contained a white pigment ($Tio_2$; content of 16 mass %, ZnO; content of 4 mass %), a fluorescent whitening agent (4,4'-bis(5-methylbenzoxazolyl)stilbene; content of 0.03 mass %) and a bluish dye (ultramarine)}

| First Layer (Blue-Sensitive Emulsion Layer) | |
|---|---|
| Emulsion B-11 | 0.24 |
| Gelatin | 1.25 |
| Yellow coupler (ExY) | 0.57 |
| Color-image stabilizer (Cpd-1) | 0.07 |
| Color-image stabilizer (Cpd-2) | 0.04 |
| Color-image stabilizer (Cpd-3) | 0.07 |
| Color-image stabilizer (Cpd-8) | 0.02 |
| Solvent (Solv-1) | 0.21 |
| **Second Layer (Color Mixing Inhibiting Layer)** | |
| Gelatin | 0.99 |
| Color mixing inhibitor (Cpd-4) | 0.09 |
| Color-image stabilizer (Cpd-5) | 0.018 |
| Color-image stabilizer (Cpd-6) | 0.13 |
| Color-image stabilizer (Cpd-7) | 0.01 |
| Solvent (Solv-1) | 0.06 |
| Solvent (Solv-2) | 0.22 |
| **Third Layer (Green-Sensitive Emulsion Layer)** | |
| Emulsion Gd | 0.14 |
| Gelatin | 1.36 |
| Magenta coupler (ExM) | 0.15 |
| Ultraviolet absorbing agent (UV-A) | 0.14 |
| Color-image stabilizer (Cpd-2) | 0.02 |
| Color mixing inhibitor (Cpd-4) | 0.002 |
| Color-image stabilizer (Cpd-6) | 0.09 |
| Co1or-image stabilizer (Cpd-8) | 0.02 |
| Color-image stabilizer (Cpd-9) | 0.03 |
| Color-image stabilizer (Cpd-10) | 0.01 |
| Color-image stabilizer (Cpd-11) | 0.0001 |
| Solvent (Solv-3) | 0.11 |
| Solvent (Solv-4) | 0.22 |
| Solvent (Solv-5) | 0.20 |
| **Fourth Layer (Color Mixing Inhibiting Layer)** | |
| Gelatin | 0.71 |
| Color mixing inhibitor (Cpd-4) | 0.06 |
| Color-image stabilizer (Cpd-5) | 0.013 |
| Color-image stabilizer (Cpd-6) | 0.10 |
| Color-image stabilizer (Cpd-7) | 0.007 |
| Solvent (Solv-1) | 0.04 |
| Solvent (Solv-2) | 0.16 |
| **Fifth Layer (Red-Sensitive Emulsion Layer)** | |
| Emulsion R-11 | 0.12 |
| Gelatin | 1.11 |
| Cyan coupler (ExC-2) | 0.13 |
| Cyan coupler (ExC-3) | 0.03 |
| Color-image stabilizer (Cpd-1) | 0.05 |
| Color-image stabilizer (Cpd-6) | 0.06 |
| Color-image stabilizer (Cpd-7) | 0.02 |
| Color-image stabilizer (Cpd-9) | 0.04 |
| Color-image stabilizer (Cpd-10) | 0.01 |
| Color-image stabilizer (Cpd-14) | 0.01 |
| Color-image stabilizer (Cpd-15) | 0.12 |
| Color-image stabilizer (Cpd-16) | 0.03 |
| Color-image stabilizer (Cpd-17) | 0.09 |
| Color-image stabilizer (Cpd-18) | 0.07 |
| Solvent (Solv-5) | 0.15 |
| Solvent (Solv-8) | 0.05 |
| **Sixth Layer (Ultraviolet Absorbing Layer)** | |
| Gelatin | 0.46 |
| Ultraviolet absorbing agent (UV-B) | 0.45 |
| Compound (S1-4) | 0.0015 |
| Solvent (Solv-7) | 0.25 |

-continued

| Seventh Layer (Protective Layer) | |
|---|---|
| Gelatin | 1.00 |
| Acryl-modified copolymer of polyvinyl alcohol (modification degree: 17%) | 0.04 |
| Liquid paraffin | 0.02 |
| Surface active agent (Cpd-13) | 0.01 |

The thus-obtained sample was designated sample B(111). Further, samples B(112) to B(119) were prepared in the same manner as sample B(111) except that Emulsion B-11 was replaced with Emulsion B-12 to Emulsion B-19. Similarly, samples B(131) to B(135) and samples B(141) to B(145) were prepared employing Emulsion B-31 to Emulsion B-35, and Emulsion B-41 to Emulsion B-45 in place of Emulsion B-11, respectively.

Laser Scanning Exposure Apparatus

The following laser oscillators I, II were provided.

<Laser Oscillator I>

Blue laser: 473 nm

Green laser: 532 nm (a green laser taken out by changing the wavelength of a semiconductor (the oscillation wavelength: 1064 nm) by an SHG crystal of a wave guide-like $LiNbO_3$ having an inverting domain structure)

Red laser: 685 nm

<Laser Oscillator II>

Blue laser: 440 nm

Green laser: 532 nm (a green laser taken out by changing the wavelength of a semiconductor (the oscillation wavelength: 1064 nm) by an SHG crystal of a wave guide-like $LiNbO_3$ having an inverting domain structure)

Red laser: 658 nm

The laser beams were made to be able to transfer vertically to scanning direction by a polygonal mirror and successively scanning exposure the sample. For restraining the fluctuation of light amount due to the change of temperature, the temperature of semiconductor laser was maintained constant using Peltier element. The effective beam diameter is described in Table 10. The scanning pitch was 42.3 $\mu$m (600 dpi) and the average exposure time per one pixel was $1.7\times10^{-7}$ seconds.

The construction of laser oscillators I, II was shown in Table 10.

TABLE 10

| | Color | Laser system | Wave-length | Make |
|---|---|---|---|---|
| Laser oscillator I | Blue | SHG | 473 nm | FUJI FILM Frontier Built-in |
| | Green | SHG | 532 nm | FUJI FILM Frontier Built-in |
| | Red | Laser diode | 685 nm | Mitsubishi ML101J10 (Trade mark) |
| Laser oscillator II | Blue | Laser diode | 440 nm | NICHIA CORPORATION |
| | Green | SHG | 532 nm | FUJI FILM Frontier Built-in |
| | Red | Laser diode | 658 nm | HITACHI HL6501HG (Trade mark) |

For examining photographic characteristics of the thus-prepared coating samples, the following experiment was performed.

Each sample was thoroughly left at 38±0.3° C. (50% R.H.) and then, in the same environment, subjected to gradation exposure for sensitometry by irradiation of laser beams of each of B, G and R using the laser oscillator I. Further, each sample was thoroughly left at 12±0.3° C. (50% R.H.) and then, in the same environment, subjected to gradation exposure for sensitometry in the same manner as in 38° C.

Further, each sample was subjected to gradation exposure for sensitometry in the same manner as the above except that the laser oscillator I was replaced with the laser oscillator II.

After exposure, each sample was processed according to the color development process A in the same manner as in Example 101.

Yellow density of each of samples B(111) to B(145) after processing was measured, and characteristic curves in a laser scanning exposure under each condition were obtained. The sensitivity is defined as the reciprocal of the exposure amount giving a color density of the minimum color density +0.1. ΔSB(I) refers to a difference of B sensitivity between 38° C. (50% R.H.) and 12° C. (50% R.H.) in the case of the laser oscillator I, assuming that B sensitivity at 12° C. (50% R.H.) is taken as 100. Likewise, ΔSB(II) refers to a difference of B sensitivity between 38° C. (50% R.H.) and 12° C. (50% R.H.) in the case of the laser oscillator II, assuming that B sensitivity at 12° C. (50% R.H.) is taken as. 100. The ΔSB(I) and ΔSB(II) that were obtained are shown in Table 11.

Further, a wavelength at which the blue-sensitive emulsion of each sample has a spectral sensitivity maximum, is shown together with the ΔSB(I) and ΔSB(II) in Table 11.

TABLE 11

| Sample | Emulsion | Blue-sensitive Emulsion Wavelength of Spectral Sensitivity Maximum | Shape | Halogen Composition | ΔSB(I) (38° C. to 12° C.) | ΔSB(II) (38° C. to 12° C.) |
|---|---|---|---|---|---|---|
| B(111) | B-11 | 480 nm | Cubic | AgCl | 20 | 37 |
| B(112) | B-12 | " | " | $AgCl_{99.9}I_{0.1}$ | 20 | 22 |
| B(113) | B-13 | " | " | " | 23 | 25 |
| B(114) | B-14 | " | " | $AgCl_{98}Br_2$ | 20 | 22 |
| B(115) | B-15 | " | " | " | 23 | 24 |
| B(116) | B-16 | " | " | $AgCl_{97.9}Br_2I_{0.1}$ | 20 | 20 |
| B(117) | B-17 | " | " | $AgCl_{99.9}I_{0.1}$ | 20 | 17 |
| B(118) | B-18 | " | " | $AgCl_{98}Br_2$ | 20 | 17 |
| B(119) | B-19 | " | " | $AgCl_{97.9}Br_2I_{0.1}$ | 18 | 15 |
| B(131) | B-31 | " | {100} tabular | AgCl | 17 | 37 |
| B(132) | B-32 | " | " | $AgCl_{99.6}I_{0.4}$ | 15 | 10 |
| B(133) | B-33 | " | " | $AgCl_{98}Br_2$ | 17 | 15 |
| B(134) | B-34 | " | " | $AgCl_{97.6}Br_2I_{0.4}$ | 15 | 12 |
| B(135) | B-35 | " | " | " | 12 | 5 |
| B(141) | B-41 | " | {111} tabular | AgCl | 15 | 40 |
| B(142) | B-42 | " | " | $AgCl_{99.6}I_{0.4}$ | 15 | 11 |
| B(143) | B-43 | " | " | $AgCl_{98}Br_2$ | 15 | 10 |
| B(144) | B-44 | " | " | $AgCl_{97.6}Br_2I_{0.4}$ | 15 | 8 |
| B(145) | B-45 | " | " | " | 12 | 5 |

It is seen from the results in Table 11 that in the samples each having a blue-sensitive emulsion layer in which a silver iodide-containing phase and/or a silver bromide-containing phase are incorporated in the emulsion for use in the present invention, a sensitivity fluctuation due to fluctuation in exposure temperature is not considerably deteriorated, notwithstanding the use of laser oscillator II whose laser oscillation wavelength is far from the wavelength at which the blue-sensitive emulsion has a spectral sensitivity maximum. Further, it is seen that such effect is prominent when the silver iodide-containing phase and/or the silver bromide-containing phase are formed with silver iodide fine grains and/or silver bromide fine grain, and more prominent with {100} tabular grains or with {111} tabular grains.

Example 402

Thin-layered samples were prepared in the same manner as in Example 401 except for altering the layer constitution as described below.

Preparation of samples

| | |
|---|---|
| First Layer (Blue-Sensitive Emulsion Layer) | |
| Emulsion B-11 | 0.14 |
| Gelatin | 0.75 |
| Yellow coupler (ExY-2) | 0.34 |
| Color-image stabilizer (Cpd-1) | 0.04 |
| Color-image stabilizer (Cpd-2) | 0.02 |
| Color-image stabilizer (Cpd-3) | 0.04 |
| Color-image stabilizer (Cpd-8) | 0.01 |
| Solvent (Solv-1) | 0.13 |
| Second Layer (Color Mixing Inhibiting Layer) | |
| Gelatin | 0.60 |
| Color mixing inhibitor (Cpd-19) | 0.09 |
| Color-image stabilizer (Cpd-5) | 0.007 |
| Color-image stabilizer (Cpd-7) | 0.007 |
| Ultraviolet absorbing agent (UV-C) | 0.05 |
| Solvent (Solv-5) | 0.11 |
| Third Layer (Green-Sensitive Emulsion Layer) | |
| Emulsion Gd | 0.14 |
| Gelatin | 0.73 |

-continued

| | |
|---|---|
| Magenta coupler (ExM) | 0.15 |
| Ultraviolet absorbing agent (UV-A) | 0.05 |
| Color-image stabilizer (Cpd-2) | 0.02 |
| Color mixing inhibitor (Cpd-7) | 0.008 |
| Color-image stabilizer (Cpd-8) | 0.07 |
| Color-image stabilizer (Cpd-9) | 0.03 |
| Color-image stabilizer (Cpd-10) | 0.009 |
| Color-image stabilizer (Cpd-11) | 0.0001 |
| Solvent (Solv-3) | 0.06 |
| Solvent (Solv-4) | 0.11 |
| Solvent (Solv-5) | 0.06 |

-continued

| | |
|---|---|
| Fourth Layer (Color Mixing Inhibiting Layer) | |
| Gelatin | 0.48 |
| Color mixing inhibitor (Cpd-4) | 0.07 |
| Color-image stabilizer (Cpd-5) | 0.006 |
| Color-image stabilizer (Cpd-7) | 0.006 |
| Ultraviolet absorbing agent (UV-C) | 0.04 |
| Solvent (Solv-5) | 0.09 |
| Fifth Layer (Red-Sensitive Emulsion Layer) | |
| Emulsion R-11 | 0.12 |
| Gelatin | 0.59 |
| Cyan coupler (ExC-2) | 0.13 |
| Cyan coupler (ExC-3) | 0.03 |
| Color-image stabilizer (Cpd-7) | 0.01 |

-continued

| | |
|---|---|
| Color-image stabilizer (Cpd-9) | 0.04 |
| Color-image stabilizer (Cpd-15) | 0.19 |
| Color-image stabilizer (Cpd-18) | 0.04 |
| Ultraviolet absorbing agent (UV-7) | 0.02 |
| Solvent (Solv-5) | 0.09 |
| Sixth Layer (Ultraviolet Absorbing Layer) | |
| Gelatin | 0.32 |
| Ultraviolet absorbing agent (UV-C) | 0.42 |
| Solvent (Solv-7) | 0.08 |
| Seventh Layer (Protective Layer) | |
| Gelatin | 0.70 |
| Acryl-modified copolymer of polyvinyl alcohol (modification degree: 17%) | 0.04 |
| Liquid paraffin | 0.01 |
| Surface active agent (Cpd-13) | 0.01 |
| Polydimethylsiloxane | 0.01 |
| Silicon dioxide | 0.003 |

The thus-obtained sample was designated sample C(111). Further, samples C(112) to C(119) were prepared in the same manner as sample C(111) except that Emulsion B-11 was replaced with Emulsion B-12 to B-19. Similarly, samples C(131) to C(135) and samples C(141) to C(145) were prepared employing Emulsion B-31 to B-35, and Emulsion B-41 to B-45 in place of Emulsion B-11, respectively.

Each sample was subjected to laser scanning exposure using the laser oscillators I, II (Table 10) described in Example 401. The exposure was performed at the same exposure-environmental temperature (38° C. and 12° C.) as in Example 401.

After exposure, the samples underwent ultra-rapid development processing according to the following development processing B. The time from just after the exposure to soak to the developer was 7 seconds.

Yellow density of each sample after processing was measured to obtain a characteristic curve. The sensitivity is defined as in Example 401. The difference of sensitivity that is referred to as ΔSB(I) and ΔSB(II) respectively was evaluated as in Example 401. They are shown in Table 12.

TABLE 12

| Sample | Emulsion | Blue-sensitive Emulsion Wavelength of Spectral Sensitivity Maximum | Shape | Halogen Composition | ΔSB(I) (38° C. to 12° C.) | ΔSB(II) (38° C. to 12° C.) |
|---|---|---|---|---|---|---|
| C(111) | B-11 | 480 nm | Cubic | AgCl | 17 | 48 |
| C(112) | B-12 | " | " | $AgCl_{99.9}I_{0.1}$ | 18 | 20 |
| C(113) | B-13 | " | " | " | 20 | 22 |
| C(114) | B-14 | " | " | $AgCl_{98}Br_2$ | 17 | 22 |
| C(115) | B-15 | " | " | " | 20 | 20 |
| C(116) | B-16 | " | " | $AgCl_{97.9}Br_2I_{0.1}$ | 15 | 15 |
| C(117) | B-17 | " | " | $AgCl_{99.9}I_{0.1}$ | 17 | 15 |
| C(118) | B-18 | " | " | $AgCl_{98}Br_2$ | 17 | 15 |
| C(119) | B-19 | " | " | $AgCl_{97.9}Br_2I_{0.1}$ | 15 | 10 |
| C(131) | B-31 | " | {100} tabular | AgCl | 12 | 55 |
| C(132) | B-32 | " | " | $AgCl_{99.6}I_{0.4}$ | 12 | 10 |
| C(133) | B-33 | " | " | $AgCl_{98}Br_2$ | 15 | 10 |
| C(134) | B-34 | " | " | $AgCl_{97.6}Br_2I_{0.4}$ | 12 | 8 |
| C(135) | B-35 | " | " | " | 10 | 5 |
| C(141) | B-41 | " | {111} tabular | AgCl | 10 | 50 |
| C(142) | B-42 | " | " | $AgCl_{99.6}I_{0.4}$ | 10 | 11 |
| C(143) | B-43 | " | " | $AgCl_{98}Br_2$ | 12 | 10 |
| C(144) | B-44 | " | " | $AgCl_{97.6}Br_2I_{0.4}$ | 10 | 8 |
| C(145) | B-45 | " | " | " | 8 | 5 |

Similar to the results in Example 401, it was confirmed that in the image-forming method of the present invention, a sensitivity fluctuation due to fluctuation in exposure temperature was not considerably deteriorated, notwithstanding the use of laser oscillator II whose laser-oscillation wavelength is far from the wavelength at which the blue-sensitive emulsion has a spectral sensitivity maximum. Further, such effect was considerably enhanced when the {100} tabular grains or the {111} tabular grains were used.

Example 403

Experimentation was performed in the same manner as Example 402 except that Emulsion B-11 of sample C(111) in Example 402 was replaced with other emulsions. The particulars and results obtained are shown in Table 13. The wavelength at which the red-sensitive emulsion has a spectral sensitivity maximum is also shown together in Table 13. Further, each sample was subjected to laser scanning exposure using the laser oscillators I, II (Table 10) described in Example 401. The exposure was performed at the same exposure-environmental temperature (38° C. and 12° C.) as in Example 402.

After exposure, each sample was subjected to a super-rapid processing according to the color development processing B in the same manner as in Example 402.

TABLE 13

| Sample | Emulsion | Blue-sensitive Emulsion Wavelength of Spectral Sensitivity Maximum | Shape | Halogen Composition | Metal Dopant Added | ΔSB(I) (38° C. to 12° C.) | ΔSB(II) (38° C. to 12° C.) |
|---|---|---|---|---|---|---|---|
| D(111) | B-11 | 480 nm | Cubic | AgCl | Ru | 17 | 48 |
| D(120) | B-20 | " | " | " | Ru + Ir | 17 | 27 |
| D(121) | B-21 | " | " | $AgCl_{97.6}Br_2I_{0.4}$ | Ru + Ir | 15 | 14 |
| D(131) | B-31 | " | {100} tabular | AgCl | Ru | 12 | 55 |
| D(136) | B-36 | " | " | " | Ru + Ir | 12 | 22 |
| D(137) | B-37 | " | " | $AgCl_{97.6}Br_2I_{0.4}$ | Ru + Ir | 10 | 5 |
| D(141) | B-41 | " | {111} tabular | AgCl | Ru | 10 | 50 |
| D(146) | B-46 | " | " | " | Ru + Ir | 10 | 20 |
| D(147) | B-47 | " | " | $AgCl_{97.6}Br_2I_{0.4}$ | Ru + Ir | 8 | 5 |

Similar to the results in Example 402, it was confirmed that in the image-forming method of the present invention, a sensitivity fluctuation due to fluctuation in exposure temperature was not considerably deteriorated, notwithstanding the use of laser oscillator II whose laser-oscillation wavelength is far from the wavelength at which the blue-sensitive emulsion has a spectral sensitivity maximum. Further, such effect was considerably enhanced when the {100} tabular grains or the {111} tabular grains were used.

Example 404

Experimentation was performed in the same manner as Example 402 except that Emulsion R-11 of sample C(111) in Example 402 was replaced with other emulsions. The particulars and results obtained are shown in Table 14. The wavelength at which the red-sensitive emulsion has a spectral sensitivity maximum is also shown together in Table 14. Further, each sample was subjected to laser scanning exposure using the laser oscillators I, II (Table 10) described in Example 401. The exposure was performed at the same exposure-environmental temperature (38° C. and 12° C.) as in Example 402.

After exposure, the samples underwent ultra-rapid development processing according to the development processing B, in the same manner as Example 402. Cyan density of each of samples after processing was measured, and characteristic curves in a laser scanning exposure under each condition were obtained. The sensitivity is defined as the reciprocal of the exposure amount giving a color density of the minimum color density +0.1 in the same manner as Example 401. ΔSR(I) refers to a difference of R sensitivity between 38° C. (50% R.H.) and 12° C. (50% R.H.) in the case of the laser oscillator I, assuming that R sensitivity at 12° C. (50% R.H.) is taken as 100. Likewise, ΔSR(II) refers to a difference of R sensitivity between 38° C. (50% R.H.) and 12° C. (50% R.H.) in the case of the laser oscillator II, assuming that R sensitivity at 12° C. (50% R.H.) is taken as 100. The ΔSR(I) and ΔSR(II) that were obtained are shown in Table 14.

Similar to the results in Example 402, it was confirmed that in the image-forming method of the present invention, a sensitivity fluctuation due to fluctuation in exposure temperature was not considerably deteriorated, notwithstanding the use of laser oscillator II whose laser-oscillation wavelength is far from the wavelength at which the red-sensitive emulsion has a spectral sensitivity maximum.

Having described our invention as related to the present embodiments, it is our intention that the invention not be limited by any of the details of the description, unless otherwise specified, but rather be construed broadly within its spirit and scope as set out in the accompanying claims.

What we claim is:

1. An image-forming method comprising:

employing a silver halide color photographic light-sensitive material, comprising, on a support, at least one silver halide emulsion layer containing a yellow dye-forming coupler, at least one silver halide emulsion layer containing a magenta dye-forming coupler, at least one silver halide emulsion layer containing a cyan dye-forming coupler, at least one color-mix preventing layer and at least one protective layer, wherein the said silver halide emulsion layer containing a yellow dye-forming coupler includes a blue-sensitive silver halide emulsion having a silver chloride content of 90 mole % or more, and containing at least one blue-sensitive sensitizing dye represented by formula (B-I); and exposing the said silver halide color photographic light-sensitive material to a blue semiconductor laser of a wavelength shorter by 30 nm to 60 nm than the wavelength at which the said blue-sensitive silver halide emulsion has the spectral sensitivity maximum:

TABLE 14

| Sample | Emulsion | Red-sensitive Emulsion Wavelength of Spectral Sensitivity Maximum | Shape | Halogen Composition | Metal Dopant Added | ΔSR(I) (38° C. to 12° C.) | ΔSR(II) (38° C. to 12° C.) |
|---|---|---|---|---|---|---|---|
| R(151) | R-11 | 700 nm | Cubic | AgCl | Ru | 10 | 22 |
| R(152) | R-12 | " | " | $AgCl_{97.9}Br_2I_{0.1}$ | " | 10 | 14 |
| R(153) | R-13 | " | " | " | Ru+Ir | 10 | 8 |

Formula (B-I)

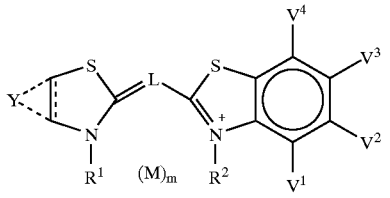

in formula (B-I), Y represents atoms necessary to form a benzene ring or a heterocyclic ring, each of which may be condensed with another carbon ring or heterocyclic ring and may have a substituent; $R^1$ and $R^2$ each represent an alkyl group, an aryl group, or a heterocyclic group; $V^1$, $V^2$, $V^3$, and $V^4$ each represent a hydrogen atom or a substituent, with the proviso that two adjacent substituents do not bond with each other to form a saturated or unsaturated condensed ring; L represents a methine group; M represents a counter ion; and m represents a number of 0 or greater necessary to neutralize a charge of the molecule.

2. The image-forming method according to claim 1, wherein the light-sensitive material is exposed to blue, green, or red light for 5 microseconds or less per pixel, with resolution of 200 dpi or more, and it is developed with a 40° C. or more developer solution, for a total wetting time of 100 seconds or less.

3. The image-forming method according to claim 1, wherein development processing is conducted within 10 seconds after exposure.

4. An image-forming method comprising:

employing a silver halide color photographic light-sensitive material, comprising, on a support, at least one silver halide emulsion layer containing a yellow dye-forming coupler, at least one silver halide emulsion layer containing a magenta dye-forming coupler, at least one silver halide emulsion layer containing a cyan dye-forming coupler, at least one color-mix preventing layer and at least one protective layer, wherein the said silver halide emulsion layer containing a yellow dye-forming coupler includes a blue-sensitive silver halide emulsion having a silver chloride content of 90 mole % or more, and containing at least one blue-sensitive sensitizing dye represented by formula (B-I), and wherein the said silver halide emulsion layer containing a cyan dye-forming coupler that includes a red-sensitive silver halide emulsion having a silver chloride content of 90 mole % or more, and containing at least one red-sensitive sensitizing dye represented by formula (R-I); and exposing the said blue-sensitive silver halide emulsion at a wavelength shorter by 30 nm to 60 nm than the spectral sensitivity maximum of the blue-sensitive silver halide emulsion by using a blue semiconductor laser, and exposing the said red-sensitive silver halide emulsion at a wavelength shorter by 40 nm to 80 nm than the spectral sensitivity maximum of the red-sensitive silver halide emulsion by using a red semiconductor laser:

Formula (B-I)

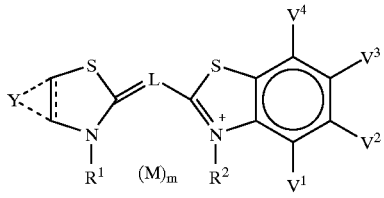

in formula (B-I), Y represents atoms necessary to form a benzene ring or a heterocyclic ring, each of which may be condensed with another carbon ring or heterocyclic ring and may have a substituent; $R^1$ and $R^2$ each represent an alkyl group, an aryl group, or a heterocyclic group; $V^1$, $V^2$, $V^3$, and $V^4$ each represent a hydrogen atom or a substituent, with the proviso that two adjacent substituents do not bond with each other to form a saturated or unsaturated condensed ring; L represents a methine group; M represents a counter ion; and m represents a number of 0 or greater necessary to neutralize a charge of the molecule;

Formula (R-I)

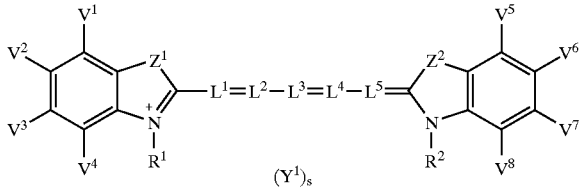

in formula (R-I), $Z^1$ represents a nitrogen atom, an oxygen atom, a sulfur atom or a selenium atom; $L^1$, $L^2$, $L^3$, $L^4$, and $L^5$ each represent a methine group which may be substituted, or may be combined together with other methine group to form a 5- or 6-membered ring; $R^1$ and $R^2$ which may be the same or different, each represent an alkyl group, and may have a substituent; further, $R^1$ and $L^1$, and/or $R^2$ and $L^5$, may bond with another to form a 5- or 6-membered ring; $V^1$, $V^2$, $V^3$, $V^4$, $V^5$, $V^6$, $V^7$, and $V^8$ each represent a hydrogen atom, a halogen atom, an alkyl group, an acyl group, an acyloxy group, an alkoxycarbonyl group, a carbamoyl group, a sulfamoyl group, a carboxyl group, a cyano group, a hydroxyl group, an amino group, an acylamino group, an alkoxy group, an alkylthio group, an alkylsulfonyl group, a sulfo group, an aryloxy group, or an aryl group; two of $V^1$ to $V^8$, bonding to carbon atoms adjacent to each other, may be combined together to form a condensed ring;, $Y^1$ represents a counter ion for balancing a charge; and s represents a number of 0 or greater necessary to neutralize a charge.

5. The image-forming method according to claim 4, wherein the light-sensitive material is exposed to blue, green, or red light for 5 microseconds or less per pixel, with resolution of 200 dpi or more, and it is developed with a 40° C. or more developer solution, for a total wetting time of 100 seconds or less.

6. The image-forming method according to claim 4, wherein development processing is conducted within 10 seconds after exposure.

7. A silver halide color photographic light-sensitive material for use in a laser exposure, which comprises, on a support:

at least one silver halide emulsion layer containing a yellow dye-forming coupler, at least one silver halide emulsion layer containing a magenta dye-forming coupler, at least one silver halide emulsion layer containing a cyan dye-forming coupler, at least one color-mix preventing layer and at least one protective layer; wherein the said silver halide emulsion layer containing a yellow dye-forming coupler includes a blue-sensitive silver halide emulsion having a silver chloride content of 90 mole % or more and containing at least one blue-sensitive sensitizing dye represented by formula (B-I), and the wavelength of the spectral sensitivity maximum of the said blue-sensitive silver halide emulsion is longer by 30 nm to 60 nm than the exposure wavelength of a blue exposure light source to be used:

Formula (B-I)

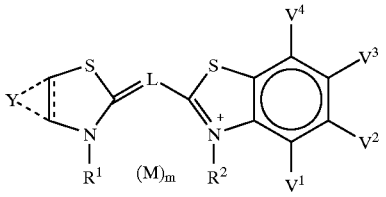

in formula (B-I), Y represents atoms necessary to form a benzene ring or a heterocyclic ring, each of which may be condensed with another carbon ring or heterocyclic ring and may have a substituent; $R^1$ and $R^2$ each represent an alkyl group, an aryl group, or a heterocyclic group; $V^1$, $V^2$, $V^3$, and $V^4$ each represent a hydrogen atom or a substituent, with the proviso that two adjacent substituents do not bond with each other to form a saturated or unsaturated condensed ring; L represents a methine group; M represents a counter ion; and m represents a number of 0 or greater necessary to neutralize a charge of the molecule.

8. A silver halide color photographic light-sensitive material for use in a laser exposure, which comprises, on a support:

at least one silver halide emulsion layer containing a yellow dye-forming coupler, at least one silver halide emulsion layer containing a magenta dye-forming coupler, at least one silver halide emulsion layer containing a cyan dye-forming coupler, at least one color-mix preventing layer and at least one protective layer; wherein the said silver halide emulsion layer containing a yellow dye-forming coupler includes a blue-sensitive silver halide emulsion having a silver chloride content of 90 mole % or more and containing at least one blue-sensitive sensitizing dye represented by formula (B-I), and the wavelength of the spectral sensitivity maximum of the said blue-sensitive silver halide emulsion is longer by 30 nm to 60 nm than the exposure wavelength of a blue exposure light source to be used; and wherein the said silver halide emulsion layer containing a cyan dye-forming coupler includes a red-sensitive silver halide emulsion having a silver chloride content of 90 mole % or more and containing at least one red-sensitive sensitizing dye represented by formula (R-I), and the wavelength of the spectral sensitivity maximum of the said red-sensitive silver halide emulsion is longer by 40 nm to 80 nm than the exposure wavelength of a red exposure light source to be used:

Formula (B-I)

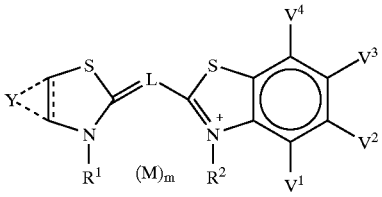

in formula (B-I), Y represents atoms necessary to form a benzene ring or a heterocyclic ring, each of which may be condensed with another carbon ring or heterocyclic ring and may have a substituent; $R^1$ and $R^2$ each represent an alkyl group, an aryl group, or a heterocyclic group; $V^1$, $V^2$, $V^3$, and $V^4$ each represent a hydrogen atom or a substituent, with the proviso that two adjacent substituents do not bond with each other to form a saturated or unsaturated condensed ring; L represents a methine group; M represents a counter ion; and m represents a number of 0 or greater necessary to neutralize a charge of the molecule;

Formula (R-I)

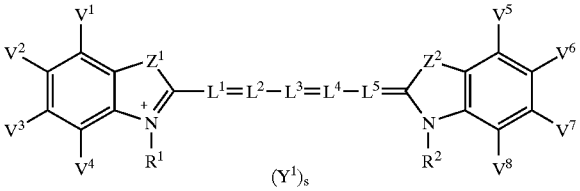

in formula (R-I), $Z^1$ represents a nitrogen atom, an oxygen atom, a sulfur atom, or a selenium atom; $L^1$, $L^2$, $L^3$, $L^4$, and $L^5$ each represent a methine group which may be substituted, or may be combined together with other methine group to form a 5- or 6-membered ring; $R^1$ and $R^2$ which may be the same or different, each represent an alkyl group and may have a substituent; further, $R^1$ and $L^1$, and/or $R^2$ and $L^5$, may bond with another to form a 5- or 6-membered ring; $V^1$, $V^2$, $V^3$, $V^4$, $V^5$, $V^6$, $V^7$, and $V^8$ each represent a hydrogen atom, a halogen atom, an alkyl group, an acyl group, an acyloxy group, an alkoxycarbonyl group, a carbamoyl group, a sulfamoyl group, a carboxyl group, a cyano group, a hydroxyl group, an amino group, an acylamino group, an alkoxy group, a alkylthio group, an alkylsulfonyl group, a sulfo group, an aryloxy group, or an aryl group; two of $V^1$ to $V^8$, bonding to carbon atoms adjacent to each other, may be combined together to form a condensed ring; $Y^1$ represents a counter ion for balancing a charge; and s represents a number of 0 or greater necessary to neutralize a charge.

* * * * *

UNITED STATES PATENT AND TRADEMARK OFFICE

CERTIFICATE OF CORRECTION

PATENT NO. : 6,916,601 B2
APPLICATION NO. : 10/330013
DATED : July 12, 2005
INVENTOR(S) : Akito Yokozawa et al.

It is certified that error appears in the above-identified patent and that said Letters Patent is hereby corrected as shown below:

At line 16 of Claim 1, please delete "of a" and insert therefor --having a wavelength of 440 nm to 450 nm, said--; at line 17 of Claim 1, please insert --being-- in between "wavelength" and "shorter".

At line 24 of Claim 4, please insert --having a wavelength of 440 nm to 450 nm-- in between "laser" and ",".

At line 65 of column 178, cancel the text beginning with "7. A silver halide" to and ending "the molecule." at line 37 of column 179, and insert the following claim:

7. The image-forming method according to Claim 1, wherein the blue semiconductor laser has a wavelength of 440 nm.

At line 38 of column 179, cancel the text beginning with "8. A silver halide" to and ending "a charge." at line 59 of column 180, and insert the following claim:

8. The image-forming method according to Claim 4, wherein the blue semiconductor laser has a wavelength of 440 nm.

Signed and Sealed this

Twelfth Day of September, 2006

JON W. DUDAS
*Director of the United States Patent and Trademark Office*